US011173337B2

(12) United States Patent
Jones et al.

(10) Patent No.: US 11,173,337 B2
(45) Date of Patent: Nov. 16, 2021

(54) WEIGHTLIFTING ASSEMBLY AND WEIGHT RACK INCLUDING WEIGHTLIFTING ASSEMBLY

(71) Applicant: Coulter Ventures, LLC, Columbus, OH (US)

(72) Inventors: Ahmik Jones, Upper Arlington, OH (US); James Carmichael, Hilliard, OH (US); Bill Henniger, Columbus, OH (US); Anthony Roberto, Columbus, OH (US); Emmanuel Sergakis, Plain City, OH (US); Bryan Adams, Columbus, OH (US); Austin Scott, Westerville, OH (US)

(73) Assignee: Coulter Ventures, LLC., Columbus, OH (US)

( * ) Notice: Subject to any disclaimer, the term of this patent is extended or adjusted under 35 U.S.C. 154(b) by 0 days.

(21) Appl. No.: 16/294,664

(22) Filed: Mar. 6, 2019

(65) Prior Publication Data

US 2019/0275363 A1 Sep. 12, 2019

Related U.S. Application Data

(60) Provisional application No. 62/750,651, filed on Oct. 25, 2018, provisional application No. 62/748,187,
(Continued)

(51) Int. Cl.
*A63B 21/06* (2006.01)
*A63B 21/00* (2006.01)
(Continued)

(52) U.S. Cl.
CPC ..... *A63B 21/0616* (2015.10); *A63B 17/00* (2013.01); *A63B 21/06* (2013.01);
(Continued)

(58) Field of Classification Search
CPC ..... A63B 21/0616; A63B 21/0626; A63B 21/628; A63B 21/4035; A63B 21/06;
(Continued)

(56) References Cited

U.S. PATENT DOCUMENTS 2,067,403 A 1/1937 Lea
2,476,863 A * 7/1949 Hawes ..... E04G 7/24 403/395
(Continued)

FOREIGN PATENT DOCUMENTS

EP 2345459 A1 7/2011
EP 3295998 A1 3/2018
(Continued)

OTHER PUBLICATIONS

Jul. 23, 2019—(WO) International Search Report & Written Opinion—App PCT/US2019/021017.
(Continued)

*Primary Examiner* — Megan Anderson
*Assistant Examiner* — Thao N Do
(74) *Attorney, Agent, or Firm* — Banner & Witcoff, Ltd.

(57) ABSTRACT

An adjustable carriage assembly is configured to be mounted on a frame member of a weight rack and includes a locking structure for locking the carriage assembly in place on the frame member. The carriage assembly may include a moveable carriage with a plurality of rollers that engage the frame member, as well as one or more handles for gripping to adjust the position of the carriage assembly and a connection structure for connection of an implement or accessory. Various implements and accessories can be connected to or used in connection with the carriage assembly, including various weightlifting implements and accessories that are pivotably connected to the carriage assembly.

23 Claims, 86 Drawing Sheets

Related U.S. Application Data filed on Oct. 19, 2018, provisional application No. 62/725,048, filed on Aug. 30, 2018, provisional application No. 62/723,107, filed on Aug. 27, 2018, provisional application No. 62/639,392, filed on Mar. 6, 2018.

(51) Int. Cl.

| | |
|---|---|
| ***A63B 21/08*** | (2006.01) |
| ***A63B 23/035*** | (2006.01) |
| ***A63B 21/062*** | (2006.01) |
| ***A63B 17/00*** | (2006.01) |
| ***A63B 21/078*** | (2006.01) |
| ***A63B 21/16*** | (2006.01) |
| ***A63B 23/04*** | (2006.01) |
| ***A63B 21/072*** | (2006.01) |
| ***A63B 21/055*** | (2006.01) |
| ***A63B 21/065*** | (2006.01) |

(52) U.S. Cl.

CPC ..... *A63B 21/0615* (2013.01); *A63B 21/0626* (2015.10); *A63B 21/0628* (2015.10); *A63B 21/078* (2013.01); *A63B 21/08* (2013.01); *A63B 21/16* (2013.01); *A63B 21/4035* (2015.10); *A63B 23/035* (2013.01); *A63B 23/03508* (2013.01); *A63B 21/055* (2013.01); *A63B 21/0552* (2013.01); *A63B 21/065* (2013.01); *A63B 21/0724* (2013.01); *A63B 21/0783* (2015.10); *A63B 23/03541* (2013.01); *A63B 23/03558* (2013.01); *A63B 23/04* (2013.01); *A63B 2023/0411* (2013.01); *A63B 2225/093* (2013.01)

(58) Field of Classification Search

CPC ... A63B 21/0615; A63B 21/078; A63B 21/08; A63B 21/0783; A63B 21/055; A63B 21/0552; A63B 21/065; A63B 21/0724; A63B 21/018; A63B 17/00; A63B 2023/0411; A63B 2225/093; A63B 23/035; A63B 23/03508; A63B 23/03541; A63B 23/03558; A63B 23/04; A63B 23/0411

USPC ..... 482/38, 120

See application file for complete search history.

(56) References Cited

U.S. PATENT DOCUMENTS

| | | | | | |
|---|---|---|---|---|---|
| 3,716,231 | A * | 2/1973 | Martin | A63B 17/00 | 482/144 |
| 4,286,782 | A | 9/1981 | Fuhrhop | | |
| 4,339,125 | A | 7/1982 | Uyeda et al. | | |
| 4,492,375 | A * | 1/1985 | Connelly | A63B 21/055 | 482/130 |
| 4,582,320 | A | 4/1986 | Shaw | | |
| 4,634,127 | A * | 1/1987 | Rockwell | A63B 21/169 | 482/138 |
| 4,635,934 | A | 1/1987 | Roethke | | |
| 4,697,809 | A * | 10/1987 | Rockwell | A63B 21/0628 | 482/102 |
| 4,856,775 | A | 8/1989 | Colledge et al. | | |
| 4,955,604 | A | 9/1990 | Pogue | | |
| 5,050,868 | A | 9/1991 | Pearson | | |
| 5,116,297 | A | 5/1992 | Stonecipher | | |
| 5,135,453 | A | 8/1992 | Sollenberger | | |
| 5,184,992 | A | 2/1993 | Banks | | |
| D358,623 | S | 5/1995 | Macasieb | | |
| 5,529,558 | A | 6/1996 | Koenig | | |
| 5,569,133 | A | 10/1996 | Vittone | | |
| 5,688,216 | A * | 11/1997 | Mauriello | A63B 21/154 | 482/101 |
| 5,722,922 | A | 3/1998 | Watterson et al. | | |
| 5,971,897 | A * | 10/1999 | Olson | A63B 21/0626 | 482/101 |
| D439,292 | S | 3/2001 | Webber et al. | | |
| 6,217,483 | B1 * | 4/2001 | Kallassy | A63B 21/068 | 482/38 |
| 6,238,323 | B1 | 5/2001 | Simonson | | |
| 6,261,205 | B1 | 7/2001 | Elefson | | |
| 6,394,935 | B1 | 5/2002 | Lake | | |
| 6,447,430 | B1 | 9/2002 | Webb et al. | | |
| 6,482,139 | B1 | 11/2002 | Haag | | |
| 6,508,743 | B1 * | 1/2003 | Fortin | A63B 1/00 | 482/38 |
| D489,601 | S | 5/2004 | Meeker | | |
| 7,070,546 | B1 * | 7/2006 | Grasso | A63B 21/072 | 482/103 |
| D550,790 | S | 9/2007 | Staten | | |
| D550,791 | S | 9/2007 | Rogers et al. | | |
| D550,792 | S | 9/2007 | Rogers et al. | | |
| D551,306 | S | 9/2007 | Rogers et al. | | |
| 7,488,277 | B1 * | 2/2009 | Knapp | A63B 21/078 | 482/104 |
| 7,549,950 | B1 | 6/2009 | Lundquist et al. | | |
| 7,727,129 | B1 * | 6/2010 | Goddard | A63B 21/0626 | 482/104 |
| 7,998,040 | B2 | 8/2011 | Kram et al. | | |
| 8,057,368 | B1 | 11/2011 | Lyszczarz | | |
| 8,096,926 | B1 * | 1/2012 | Batea | A63B 21/0628 | 482/99 |
| 8,157,713 | B1 * | 4/2012 | Siskowic | A63B 21/0004 | 482/141 |
| 8,172,733 | B1 | 5/2012 | Batca | | |
| 8,337,370 | B2 * | 12/2012 | Rogers | A63B 21/078 | 482/104 |
| 8,827,875 | B2 | 9/2014 | Schiano | | |
| 9,011,301 | B2 | 4/2015 | Balandis et al. | | |
| 9,028,381 | B2 | 5/2015 | Mestemaker | | |
| 9,289,638 | B2 * | 3/2016 | Towley, III | A63B 23/1218 | |
| 9,302,139 | B2 * | 4/2016 | Habing | A63B 21/4035 | |
| D761,085 | S * | 7/2016 | Cox | D8/354 | |
| 9,409,220 | B2 * | 8/2016 | Henniger | B21D 53/36 | |
| 9,421,413 | B2 | 8/2016 | Staten et al. | | |
| D769,991 | S | 10/2016 | Thomas | | |
| D772,356 | S | 11/2016 | Gregory | | |
| D781,452 | S | 3/2017 | Bokros | | |
| 9,802,075 | B2 * | 10/2017 | Gvoich | A63B 21/154 | |
| D806,808 | S | 1/2018 | Gregory | | |
| D808,475 | S | 1/2018 | Meredith et al. | | |
| D815,305 | S | 4/2018 | Alvarado et al. | | |
| 10,004,970 | B1 * | 6/2018 | Mailander | A63B 21/4035 | |
| 10,016,646 | B2 * | 7/2018 | Butler | A63B 21/00065 | |
| 10,226,661 | B2 | 3/2019 | Henniger et al. | | |
| D849,160 | S | 5/2019 | Lau | | |
| D855,720 | S | 8/2019 | Kuka | | |
| D873,935 | S * | 1/2020 | Van Den Berg | D21/691 | |
| 10,525,301 | B2 * | 1/2020 | Hsu | A63B 21/4035 | |
| 2003/0115955 | A1 | 6/2003 | Keiser | | |
| 2003/0134723 | A1 * | 7/2003 | Greenland | A63B 21/078 | 482/104 |
| 2005/0054493 | A1 | 3/2005 | Skilken et al. | | |
| 2005/0202941 | A1 | 9/2005 | Vaes | | |
| 2006/0035765 | A1 | 2/2006 | Smith | | |
| 2006/0040799 | A1 | 2/2006 | Pompile | | |
| 2006/0183607 | A1 | 8/2006 | Collias | | |
| 2006/0199712 | A1 * | 9/2006 | Barnard | A63B 22/0007 | 482/142 |
| 2006/0252615 | A1 | 11/2006 | Melcer | | |
| 2007/0054785 | A1 * | 3/2007 | Drechsler | A63B 21/078 | 482/94 |
| 2007/0093365 | A1 | 4/2007 | Batca | | |
| 2007/0155595 | A1 * | 7/2007 | Rogers | A63B 21/4035 | 482/94 |
| 2007/0155596 | A1 * | 7/2007 | Rogers | A63B 21/4047 | 482/97 |
| 2007/0161468 | A1 * | 7/2007 | Yanagisawa | A63B 23/03541 | 482/94 |

(56) References Cited

U.S. PATENT DOCUMENTS

| | | | | |
|---|---|---|---|---|
| 2008/0113852 | A1 | 5/2008 | Caldwell | |
| 2009/0143203 | A1 | 6/2009 | Knapp | |
| 2010/0137112 | A1* | 6/2010 | Harker | B60P 7/0823 482/92 |
| 2010/0216610 | A1 | 8/2010 | Gedeon-Janvier | |
| 2010/0292057 | A1 | 11/2010 | Dunn | |
| 2012/0083392 | A1* | 4/2012 | Taranto | A63B 23/03508 482/98 |
| 2012/0289384 | A1* | 11/2012 | Staten | A63B 21/0783 482/104 |
| 2012/0329613 | A1 | 12/2012 | Schiano | |
| 2013/0035220 | A1 | 2/2013 | Adams | |
| 2013/0296143 | A1 | 11/2013 | Staten et al. | |
| 2013/0296146 | A1* | 11/2013 | Staten | A63B 21/00069 482/120 |
| 2014/0087928 | A1 | 3/2014 | Luedeka | |
| 2014/0256517 | A1 | 9/2014 | Poppinga | |
| 2015/0016919 | A1 | 1/2015 | Tambomino et al. | |
| 2015/0051054 | A1* | 2/2015 | Barnhill | A63B 23/03583 482/112 |
| 2015/0083681 | A1* | 3/2015 | Childs | A63B 21/078 211/85.7 |
| 2015/0126335 | A1 | 5/2015 | Gilson et al. | |
| 2015/0141221 | A1 | 5/2015 | Delgado | |
| 2015/0182773 | A1 | 7/2015 | Olson et al. | |
| 2015/0246258 | A1* | 9/2015 | Hockridge | A63B 21/156 482/99 |
| 2015/0290488 | A1 | 10/2015 | Hopperstad et al. | |
| 2015/0352395 | A1* | 12/2015 | Gregory | A63B 23/03558 482/123 |
| 2016/0023035 | A1 | 1/2016 | Meyer | |
| 2016/0199691 | A1* | 7/2016 | Hockridge | A63B 21/068 482/96 |
| 2016/0213967 | A1 | 7/2016 | Habing et al. | |
| 2017/0007877 | A1* | 1/2017 | Leipheimer | A63B 21/078 |
| 2017/0056705 | A1 | 3/2017 | Zha et al. | |
| 2017/0189736 | A1 | 7/2017 | Martin | |
| 2017/0246496 | A1* | 8/2017 | Nelson | A63B 21/0783 |
| 2017/0246504 | A1 | 8/2017 | Simmons | |
| 2017/0312564 | A1* | 11/2017 | Perez Gomez | A63B 21/068 |
| 2018/0036573 | A1 | 2/2018 | Lennox et al. | |
| 2018/0185694 | A1* | 7/2018 | Schween | A63B 21/0626 |
| 2018/0243597 | A1 | 8/2018 | Schlegel | |
| 2019/0240521 | A1 | 8/2019 | Staten | |
| 2019/0275363 | A1 | 9/2019 | Jones et al. | |
| 2020/0038704 | A1* | 2/2020 | Adams | A63B 23/0405 |
| 2020/0078633 | A1* | 3/2020 | Chou | A63B 21/00069 |

FOREIGN PATENT DOCUMENTS

| | | | |
|---|---|---|---|
| FR | 2630652 | A1 | 11/1989 |
| GB | 2346808 | A | 8/2000 |
| KR | 200466889 | Y1 | 5/2013 |
| KR | 20140060130 | A | 5/2014 |
| WO | 9842411 | A1 | 10/1998 |
| WO | 201893699 | A1 | 5/2018 |
| WO | 2018208772 | A1 | 11/2018 |

OTHER PUBLICATIONS

Sorinex Exercise Equipment: "Base camp jammer arms adjustable attachment point", Feb. 27, 2018 (Feb. 27, 2018), pp. 1-3, Retrieved from the Internet: URL:https:www.facebook.com/sorinex.strength/videos/base-camp-jammer-arms-adjustabl e-attachment-point/10158262519208647/.

Mar. 31, 2020—(WO) ISR and WO—App PCT/US2019/056130.

Photo from https://web.archive.org/web/20170112075250/https:/mydynamicfitness.com, dated Jan. 12, 2017.

Screenshots from https://www.youtube.com/watch?v=A4xv8OhVbzl, dated May 17, 2018.

Product promotional materials for Dynamic Fitness Ultra Pro Rack Series from https://web.archive.org/web/20170112075250/https://mydynamicfitness.com, dated Jan. 12, 2017.

Product listing for Rogue Monster Lever Arms from https://web.archive.org/web/20160529110340/http://www.roguefitness.com/monster-lever-arms, dated May 29, 2016.

Product listing for Rogue Monster Lever Arms from https://web.archive.org/web/20161111082206/http://www.roguefitness.com/monster-lever-arms, dated Nov. 11, 2016.

* cited by examiner

WEIGHTLIFTING ASSEMBLY AND WEIGHT RACK INCLUDING WEIGHTLIFTING ASSEMBLY

CROSS-REFERENCE TO RELATED APPLICATIONS

This application is a non-provisional of, and claims priority to, the following applications: U.S. Provisional Application No. 62/639,392, filed Mar. 6, 2018; U.S. Provisional Application No. 62/723,107, filed Aug. 27, 2018; U.S. Provisional Application No. 62/725,048, filed Aug. 30, 2018; U.S. Provisional Application No. 62/748,187, filed Oct. 19, 2018; and U.S. Provisional Application No. 62/750,651, filed Oct. 25, 2018, all of which prior applications are incorporated by reference herein in their entireties and made part hereof.

FIELD OF THE INVENTION

This disclosure relates to machines for weightlifting and other exercise, and more specifically to a weightlifting assembly configured to be moveable along a frame member and fixed in a plurality of different positions along the frame member, and weight racks including one or more of such assemblies.

BACKGROUND

Weight racks and other weightlifting equipment often make use of structures that may be mounted at different locations for different exercises, and in particular, at different heights from the ground surface. One example is an articulating arm, which may be placed at different positions and orientations for performing a wide variety of exercises. Moveable and adjustable assemblies for adjusting the mounting height of such equipment exist, but these assemblies suffer from disadvantages such as difficulty of adjustment and inability to support large amounts of weight that are used by dedicated weightlifters. Accessories for such articulating arms are also often found lacking in these and other areas.

The present disclosure is provided to address this need and other needs in existing adjustable assemblies and weight racks including such assemblies. A full discussion of the features and advantages of the present disclosure is deferred to the following detailed description, which proceeds with reference to the accompanying drawings.

BRIEF SUMMARY

General aspects of the present disclosure relate to an adjustable carriage assembly configured to be mounted on a frame member of a weight rack and having a locking structure for locking the carriage assembly in place on the frame member, as well as various implements and accessories that can be connected to or used in connection with the carriage assembly, for example, various weightlifting implements and accessories that pivotably connect to the carriage assembly.

Aspects of the disclosure relate to an adjustable carriage assembly that includes a carriage defining a passage configured to receive a frame member therethrough such that the carriage is moveable along the frame member. The carriage includes a first side plate, a second side plate laterally spaced from the first side plate, and a rear plate connected to the first and second side plates and extending between the first and second side plates, where the passage is defined between the first and second side plates. A first handle and a second handle are connected to the carriage proximate a rear of the carriage, such that the first and second handles are laterally spaced from each other. A plurality of rollers are rotatably connected to the first and second side plates and extend between the first and second side plates, and the plurality of rollers include one or more front rollers and rear rollers spaced rearwardly from the front roller(s), such that the front roller(s) are configured to engage a front surface of the frame member and the rear roller(s) are configured to engage a rear surface of the frame member. In one configuration, the assembly includes a pair of front rollers and a pair of rear rollers. A pivotable connection structure is connected to the first and second side plates of the carriage at a front of the carriage, and the pivotable connection structure is configured for connection to an articulating implement. The assembly also includes a locking structure configured for engaging the frame member to lock the carriage in position relative to the frame member. The locking structure may include a pin connected to the rear plate that is moveable by axial translation between a locked position, where the pin extends into the passage and is configured to engage the frame member to lock the carriage in position, and an unlocked position, where the pin is retracted from the passage and is configured to disengage from the frame member to allow movement of the carriage with respect to the frame member. The pin is positioned between the first and second handles, and the pin includes an end piece having a first grip extending outward from the end piece toward the first handle and a second grip extending outward from the end piece toward the second handle. The pin may be received in a hole or holes in the frame member.

According to one aspect, the locking structure further includes a biasing member operably engaging the pin and biasing the pin toward the locked position. In one configuration, the locking structure further includes a collar connected to the rear plate, where the pin extends through the collar, and the biasing member is positioned within the collar. Additionally, in one configuration, the pin has a first portion that connects to the end piece and extends through the collar and a second portion that is wider than the first portion and forms a distal end of the pin, where the second portion extends through the rear plate and into the passage when the pin is in the locked position. The biasing member in this configuration may be or include a coil spring wrapped around the first portion, such that the pin compresses the coil spring in the unlocked position.

According to another aspect, the assembly also includes a first handle mount and a second handle mount connected to the carriage at the rear of the carriage and spaced vertically from each other, where the first handle is connected to the first and second handle mounts and extends vertically between the first and second handle mounts, and the second handle is connected to the first and second handle mounts and extends vertically between the first and second handle mounts. In one configuration, the first handle mount is connected to the first side plate and the second side plate proximate a top of the carriage and extends across the rear of the carriage between the first and second side plates, and the second handle mount is connected to the first side plate and the second side plate proximate a bottom of the carriage and extends across the rear of the carriage between the first and second side plates.

According to a further aspect, the first grip curves forwardly at a first distal end thereof to form a first recess on a front side of the end piece and the second grip curves forwardly at a second distal end thereof to form a second recess on the front side of the end piece.

According to yet another aspect, the assembly further includes a second pin configured to removably engage at least one of the first and second side plates, where the second pin is configured to extend into the passage to engage the frame member to lock the carriage in position when the second pin is engaged with the at least one of the first and second side plates. In this configuration, the pin is configured to extend into the passage in a first direction, and the second pin is configured to extend into the passage in a second direction that is perpendicular to the first direction.

According to a still further aspect, the first side plate and the second side plate have holes that are aligned with each other and positioned on opposite sides of the passage, and the holes are configured to removably receive a second pin such that the second pin extends through the passage and through the holes in the first and second side plates to engage the frame member to lock the carriage in position.

Additional aspects of the disclosure relate to an adjustable carriage assembly that includes a carriage defining a passage configured to receive a frame member therethrough such that the carriage is moveable along the frame member, where the carriage includes a first side plate located on a first side of the carriage, a second side plate laterally spaced from the first side plate and located on a second side of the carriage opposite the first side, and a rear plate connected to the first and second side plates and extending between the first and second side plates, such that the passage is defined between the first and second side plates. A first handle and a second handle are connected to the carriage proximate a rear of the carriage, and the first and second handles are laterally spaced from each other, and are elongated and extend along a vertical direction, such that the first and second handles are parallel to each other. The assembly also includes a handle mounting structure including a first upper mounting portion and a first lower mounting portion extending outward on the first side of the carriage and a second upper mounting portion and a second lower mounting portion extending outward on the second side of the carriage, where the first handle is connected to the first upper mounting portion and the first lower mounting portion and extends vertically between the first upper mounting portion and the first lower mounting portion, and the second handle is connected to the second upper mounting portion and the second lower mounting portion and extends vertically between the second upper mounting portion and the second lower mounting portion. A plurality of rollers are rotatably connected to the first and second side plates and extending between the first and second side plates, and the plurality of rollers include one or more front rollers and rear rollers spaced rearwardly from the front roller(s), such that the front roller(s) are configured to engage a front surface of the frame member and the rear roller(s) are configured to engage a rear surface of the frame member. In one configuration, the assembly includes a pair of front rollers and a pair of rear rollers. A pivotable connection structure is connected to the first and second side plates of the carriage at a front of the carriage, and the pivotable connection structure is configured for connection to an articulating implement. The assembly further includes a locking structure configured for engaging the frame member to lock the carriage in position relative to the frame member, and the locking structure includes a pin connected to the rear plate at a location equidistant between the first and second handles such that the pin can be actuated by a user's hands while the user's hands are gripping the first and second handles. The pin is moveable by axial translation between a locked position, where the pin extends into the passage and is configured to engage the frame member to lock the carriage in position, and an unlocked position, where the pin is retracted from the passage and is configured to disengage from the frame member to allow movement of the carriage with respect to the frame member. The pin may be received in a hole or holes in the frame member.

According to one aspect, the locking structure further includes a biasing member operably engaging the pin and biasing the pin toward the locked position and a collar connected to the rear plate, where the pin extends through the collar, and the biasing member is positioned within the collar. In one configuration, the pin has a first portion that connects to an end piece and extends through the collar and a second portion that is wider than the first portion and forms a distal end of the pin, and the second portion extends into the passage when the pin is in the locked position. The biasing member includes a coil spring wrapped around the first portion, such that the pin compresses the coil spring in the unlocked position.

According to another aspect, the handle mounting structure further includes a first handle mount and a second handle mount connected to the carriage at the rear of the carriage and spaced vertically from each other, wherein the first handle mount forms the first and second upper mounting portions, and the second handle mount forms the first and second lower mounting portions. In one configuration, the first handle mount is connected to the first side plate and the second side plate proximate a top of the carriage and extends across the rear of the carriage between the first and second side plates, and the second handle mount is connected to the first side plate and the second side plate proximate a bottom of the carriage and extends across the rear of the carriage between the first and second side plates. Additionally, in this configuration, the first handle mount may have first arms extending forward along the first side plate and the second side plate for connection to the first and second side plates, and the second handle mount may have second arms extending forward along the first side plate and the second side plate for connection to the first and second side plates. In another configuration, the first handle mount has a first cutout extending forward with respect to the carriage and located between the first and second upper mounting portions, and the second handle mount has a second cutout extending forward with respect to the carriage and located between the first and second lower mounting portions.

According to a further aspect, the pin includes an end piece having a first grip extending outward from the end piece toward the first handle and a second grip extending outward from the end piece toward the second handle.

According to yet another aspect, the assembly further includes a second pin configured to removably engage at least one of the first and second side plates, where the second pin is configured to extend into the passage to engage the frame member to lock the carriage in position when the second pin is engaged with the at least one of the first and second side plates. In this configuration, the pin extends into the passage in a first direction, and the second pin extends into the passage in a second direction that is perpendicular to the first direction.

Further aspects of the disclosure relate to an adjustable carriage assembly that includes a carriage defining a passage configured to receive a frame member therethrough such that the carriage is moveable along the frame member, where the carriage includes a first side plate, a second side plate spaced from the first side plate, and a rear plate connected to the first and second side plates and extending between the first and second side plates, and the passage is defined between the first and second side plates. A plurality of rollers are rotatably connected to the first and second side plates and extend between the first and second side plates, and the plurality of rollers include one or more front rollers and rear rollers spaced rearwardly from the front roller(s), such that the front roller(s) are configured to engage a front surface of the frame member and the rear roller(s) are configured to engage a rear surface of the frame member. In one configuration, the assembly includes a pair of front rollers and a pair of rear rollers. Each of the plurality of rollers includes a first enlarged end and a second enlarged end opposite the first enlarged end, a pair of first cylindrical sections located inward from the first and second enlarged ends, where the first cylindrical sections have diameters that are smaller than diameters of the first and second enlarged ends, a first chamfered section and a second chamfered section extending inwardly from the first and second enlarged ends to the first cylindrical sections, respectively, and a second cylindrical section located between the first cylindrical sections and forming a center portion of the roller. The second cylindrical section has a diameter that is smaller than the diameters of the first cylindrical sections. A pivotable connection structure is connected to the first and second side plates of the carriage, and the pivotable connection structure is configured for connection to an articulating implement. The assembly also includes a locking structure configured for engaging the frame member to lock the carriage in position relative to the frame member, and the locking structure includes a pin that is moveable by axial translation between a locked position, where the pin extends into the passage and is configured to engage the frame member to lock the carriage in position, and an unlocked position, where the pin is retracted from the passage and is configured to disengage from the frame member to allow movement of the carriage with respect to the frame member. The rollers may be freely rotatable. Aspects of the disclosure also relate to a roller having a structure as described herein.

According to one aspect, a first handle a second handle are connected to the carriage such that the first and second handles are spaced from each other, and the first handle and the second handle are elongated and extend along a vertical direction, such that the first and second handles are parallel to each other. In this configuration, the pin may be connected to the carriage at a location between the first and second handles such that the pin can be actuated by a user's hands while the user's hands are gripping the first and second handles.

According to another aspect, the assembly further includes a first handle and a second handle connected to the carriage such that a space is defined between the first and second handles, and the pin is positioned between the first and second handles. The pin has an end piece having a first grip extending outward from the end piece toward the first handle and a second grip extending outward from the end piece toward the second handle.

According to a further aspect, the rear rollers include a top rear roller and a bottom rear roller, and the pin is located vertically between the top and bottom rear rollers.

According to yet another aspect, the rear rollers include a top rear roller and a bottom rear roller that are horizontally aligned with each other, and the front rollers include a top front roller and a bottom front roller that are horizontally aligned with each other. In this configuration, the top rear roller and the top front roller are vertically aligned with each other, and the bottom rear roller and the bottom front roller are vertically aligned with each other.

According to a still further aspect, the assembly further includes a first handle and a second handle connected to the carriage proximate a rear of the carriage, where the first and second handles are laterally spaced from each other, and the first handle and the second handle are elongated and extend along a vertical direction. The assembly also includes a handle mounting structure including a first upper mounting portion and a first lower mounting portion extending outward on a first side of the carriage and a second upper mounting portion and a second lower mounting portion extending outward on a second side of the carriage opposite the first side. In this configuration, the first handle is connected to the first upper mounting portion and the first lower mounting portion and extends vertically between the first upper mounting portion and the first lower mounting portion, and the second handle is connected to the second upper mounting portion and the second lower mounting portion and extends vertically between the second upper mounting portion and the second lower mounting portion. The first and second upper mounting portions are located vertically above axes of rotation of all of the plurality of rollers, and the first and second lower mounting portions are located vertically below axes of rotation of all of the plurality of rollers.

According to an additional aspect, each of the plurality of rollers has tapered diameter changes between the second cylindrical section and the first cylindrical sections.

According to another aspect, the first cylindrical sections of the plurality of rollers are configured to engage the front and rear surfaces of the frame member, the first cylindrical sections and the first and second chamfered sections of the plurality of rollers are configured to combine to engage corners of the frame member, and the second cylindrical section of each roller is configured to be spaced from the frame member.

According to another aspect, the assembly further includes spacers connected to inner surfaces of the first and second side plates to confront the passage and positioned between the front rollers and the rear rollers, which are configured to fill spaces between the first and second side plates and lateral side surfaces of the frame member between the front and rear rollers.

Still further aspects of the disclosure relate to an adjustable carriage assembly that includes an adjustable bracket having a first side plate and a second side plate laterally spaced from the first side plate such that a passage configured to receive a frame member therethrough is defined between the first and second side plates, and a mounting bracket removably connected to the first and second side plates at a front side of the adjustable bracket, the mounting bracket having a connection for an exercise implement. This connection may be a pivotable connection in one embodiment. A plurality of rollers are rotatably connected to the adjustable bracket and extend through the passage, the plurality of rollers including at least a front roller and a rear roller spaced rearwardly from the front roller, such that the front roller is configured to engage a front surface of the frame member and the rear roller is configured to engage a rear surface of the frame member, and the carriage assembly is moveable along the frame member. The assembly also includes a locking structure configured for engaging the frame member to lock the carriage assembly in position relative to the frame member, and the locking structure includes a pin configured to extend into the passage to engage the frame member to lock the carriage assembly in position. The assembly may also include the exercise implement, which may be a monolift attachment in one configuration.

According to one aspect, the adjustable bracket has a plurality of slots located in the first and second side plates at the front side of the adjustable bracket, and the mounting bracket has a plurality of projections removably received in the slots to removably connect the mounting bracket to the adjustable bracket. In one configuration, the plurality of slots includes four slots, with two of the slots located in each of the first and second side plates of the adjustable bracket, and the plurality of projections includes four projections. In another configuration, the plurality of slots are L-shaped slots. In a further configuration, the assembly includes a retractable pin connected to the adjustable bracket, and the retractable pin is moveable between an extended position, where the retractable pin engages the mounting bracket to retain the mounting bracket in connection with the adjustable bracket, and a retracted position, where the retractable pin permits the mounting bracket to be removed from the adjustable bracket.

According to another aspect, the front roller and the rear roller may be rotatably mounted on the adjustable bracket, or the front roller may be rotatably mounted on the mounting bracket, while the rear roller is rotatably mounted on the adjustable bracket.

According to a further aspect, the adjustable bracket further includes a rear plate extending between the first and second side plates at a rear of the adjustable bracket, and the pin extends through the rear plate.

Aspects of the disclosure also relate to various implements and accessories configured for connection to the carriage assembly and/or an articulating arm mounted on the carriage assembly.

For example, aspects of the disclosure relate to an implement in the form of a monolift attachment that includes a pivoting piece configured to be pivotably connected to a mount (e.g., a carriage assembly as described herein), the pivoting piece including a hook portion configured for engaging and supporting a weight at an elevated position and a counterweight configured to cause rotation of the pivoting piece to a rearward position in an unloaded state, where the pivoting piece is configured to rotate to a forward position when the weight is loaded on the hook portion. One or more additional counterweight pieces are connected to the counterweight to increase a mass of the counterweight, and the pivoting piece and the additional counterweight piece are pieces of metal plate formed a same material and having a same thickness. Aspects also relate to a method of manufacturing such a monolift attachment, which includes cutting or otherwise forming the pivoting piece and the additional counterweight piece(s) from a single piece of metal plate, which may be no larger than a rectangle of minimum size necessary to cut the pivoting piece.

As another example, aspects of the disclosure relate to an accessory in the form of an adjustable handle assembly that includes a mounting body defining a passage configured to receive an articulating arm therethrough such that the mounting body is moveable along the articulating arm, a gripping handle connected to the mounting body and extending from the mounting body for gripping by a user, and a weight holder connected to the mounting body for holding one or more weights. A plurality of rollers are rotatably connected to the mounting body within the passage and including at least a first roller and a second roller spaced from the first roller, such that the first roller is configured to engage a first surface of the articulating arm and the second roller is configured to engage a second surface of the articulating arm that is opposite the first surface, and such that the passage extends between the first and second rollers. The assembly also includes a locking structure configured for engaging the articulating arm to releasably lock the mounting body in position relative to the articulating arm, where the locking structure includes a pin configured to extend into the passage to engage the articulating arm to lock the mounting body in position.

According to one aspect, the plurality of rollers further includes a third roller and a fourth roller spaced from the third roller, such that the third roller is positioned on the same side of the passage as the first roller and is configured to engage the first surface of the articulating arm, and the fourth roller is positioned on the same side of the passage as the second roller and is configured to engage the second surface of the articulating arm, and such that the passage further extends between the third and fourth rollers.

According to another aspect, the weight holder and the gripping handle extend outward from opposite sides of the mounting body.

According to a further aspect, the pin is a removable pin that extends through a hole in the mounting body and into the passage to engage the articulating arm and lock the mounting body in position, and the pin is removable from the mounting body to permit movement of the mounting body along the articulating arm.

According to yet another aspect, the assembly further includes a spacer connected to the mounting body to confront the passage and positioned between the first roller and the second roller, where the spacer is configured to fill a space between the mounting body and a lateral side surface of the articulating arm between the first and second rollers.

As a further example, aspects of the disclosure relate to an accessory in the form of a weight supporting assembly that includes a weight support configured to be connected to an articulating arm at a first location along a length of the articulating arm, the weight support being configured to removably support a free weight at an elevated position, and a counterweight assembly configured to be connected to the articulating arm at a second location along the length of the articulating arm that is closer than the first location to a pivot connection between the articulating arm and a vertical support member. The counterweight assembly includes a slot configured to receive the vertical support member therein, and the slot is configured to have a length that is longer than a corresponding dimension of the vertical support member, such that the counterweight assembly is configured to provide a range of movement for the articulating arm that is defined by a range of travel of the vertical support member within the slot. The counterweight assembly further includes a counterweight configured to be located on an opposite side of the vertical support member from the articulating arm and configured to bias the articulating arm to pivot toward the vertical support member.

According to one aspect, the counterweight assembly includes a retaining bracket that is configured to be fixedly connected to the articulating arm and having the slot therein, and the counterweight is connected to the retaining bracket.

According to another aspect, a front end of the counterweight assembly is configured to be fixedly connected to the articulating arm, the counterweight is mounted proximate a rear end of the counterweight assembly, and the slot is positioned between the front and rear ends.

According to a further aspect, the weight support includes a mounting bracket configured for connection to the articulating arm and an engagement part connected to the mounting bracket and configured to engage and support the free weight. In one configuration, the mounting bracket has a J-cup configuration configured to extend around three sides of the articulating arm and having a fixed peg that is configured to be received in a first hole in the articulating arm and a removable pin that is configured to be inserted through the mounting bracket and through a second hole in the articulating arm to connect the mounting bracket to the articulating arm. In another configuration, the engagement part has a hook shape, with a notch configured to receive a portion of the free weight and a protrusion extending upward at a distal end of the engagement part and defining an end of the notch.

As yet another example, aspects of the disclosure relate to an accessory in the form of an adjustable handle assembly that includes a mounting body having two side walls that are parallel and spaced from each other and a transverse wall connected to the two side walls and extending between the two side walls, where the side walls and the transverse wall define a passage configured to receive an articulating arm therethrough such that the mounting body extends around three sides of the articulating arm. The mounting body further has a fixed peg that is configured to be received in a first hole in the articulating arm to connect the mounting body to the articulating arm. A gripping handle is connected to the mounting body and extends from the mounting body for gripping by a user, and a weight holder is connected to the mounting body for holding one or more weights. The assembly further includes a locking structure configured for engaging the articulating arm to releasably lock the mounting body in position relative to the articulating arm, and the locking structure includes a pin configured to extend into the passage to engage the articulating arm to lock the mounting body in position.

According to one aspect, the pin is a removable pin that is configured to be inserted through the mounting body and through a second hole in the articulating arm to further connect the mounting body to the articulating arm.

According to another aspect, one of the side walls has an extension that extends along an axial length of the passage beyond the other of the side walls, and the fixed peg is connected to the extension.

According to a further aspect, the assembly further includes spacers connected to inner surfaces of the side walls and the transverse wall and configured to confront the articulating arm within the passage.

As a still further example, aspects of the disclosure relate to an accessory in the form of a handle assembly including a first articulating bracket configured to be pivotably connected to a first articulating arm, a first gripping handle connected to the first articulating bracket and extending from the first articulating bracket in a first direction that is parallel to an axis of articulation of the first articulating arm, and a first weight holder configured to be fixedly connected to the first articulating arm such that the first weight holder extends from the first articulating arm in a second direction opposite the first direction. The first gripping handle is configured for gripping by a user during a weightlifting exercise, and the first weight holder is configured to be loaded with a first weight for use in the weightlifting exercise.

According to one aspect, the assembly includes a second articulating bracket configured to be pivotably connected to a second articulating arm arranged alongside the first articulating arm, a second gripping handle connected to the second articulating bracket and extending from the second articulating bracket in the second direction and toward the first articulating bracket, and a second weight holder configured to be fixedly connected to the second articulating arm such that the second weight holder extends from the second articulating arm in the first direction. The second gripping handle is configured for gripping by a user during a weightlifting exercise, and the second weight holder is configured to be loaded with a second weight for use in the weightlifting exercise.

According to another aspect, the assembly further includes a second articulating bracket configured to be pivotably connected to a second articulating arm arranged alongside the first articulating arm, wherein the first gripping handle is connected to the second articulating bracket and extends from the second articulating bracket in the second direction and toward the first articulating bracket, such that the first gripping handle extends between the first and second articulating brackets, and a second weight holder configured to be fixedly connected to the second articulating arm such that the second weight holder extends from the second articulating arm in the first direction. The second weight holder is configured to be loaded with a second weight for use in the weightlifting exercise. In one configuration, the first gripping handle may be a straight bar or a curling bar.

According to a further aspect, the first articulating bracket has two side members configured to be pivotably connected to opposite surfaces of the first articulating arm and a tube member connected to the two side members and extending between the two side members. The first gripping handle is received in the tube member to connect the first gripping handle to the first articulating bracket.

Other aspects of the disclosure relate to a weightlifting assembly that includes an adjustable carriage assembly as described herein, with an accessory or implement connected to the adjustable carriage assembly, or a weight rack having a frame member with such an adjustable carriage assembly or weightlifting assembly mounted on the frame member. The implement may include an articulating arm connected to a pivotable connection structure of the carriage assembly and an accessory connected to the articulating arm and configured for use in a weightlifting exercise. The accessory in this configuration may be any of the accessories described herein, or other accessories compatible for use with the articulating arm.

Other features and advantages of the disclosure will be apparent from the following description taken in conjunction with the attached drawings.

BRIEF DESCRIPTION OF THE DRAWINGS

To allow for a more full understanding of the present disclosure, it will now be described by way of example, with reference to the accompanying drawings in which.

DETAILED DESCRIPTION

Figure 1:
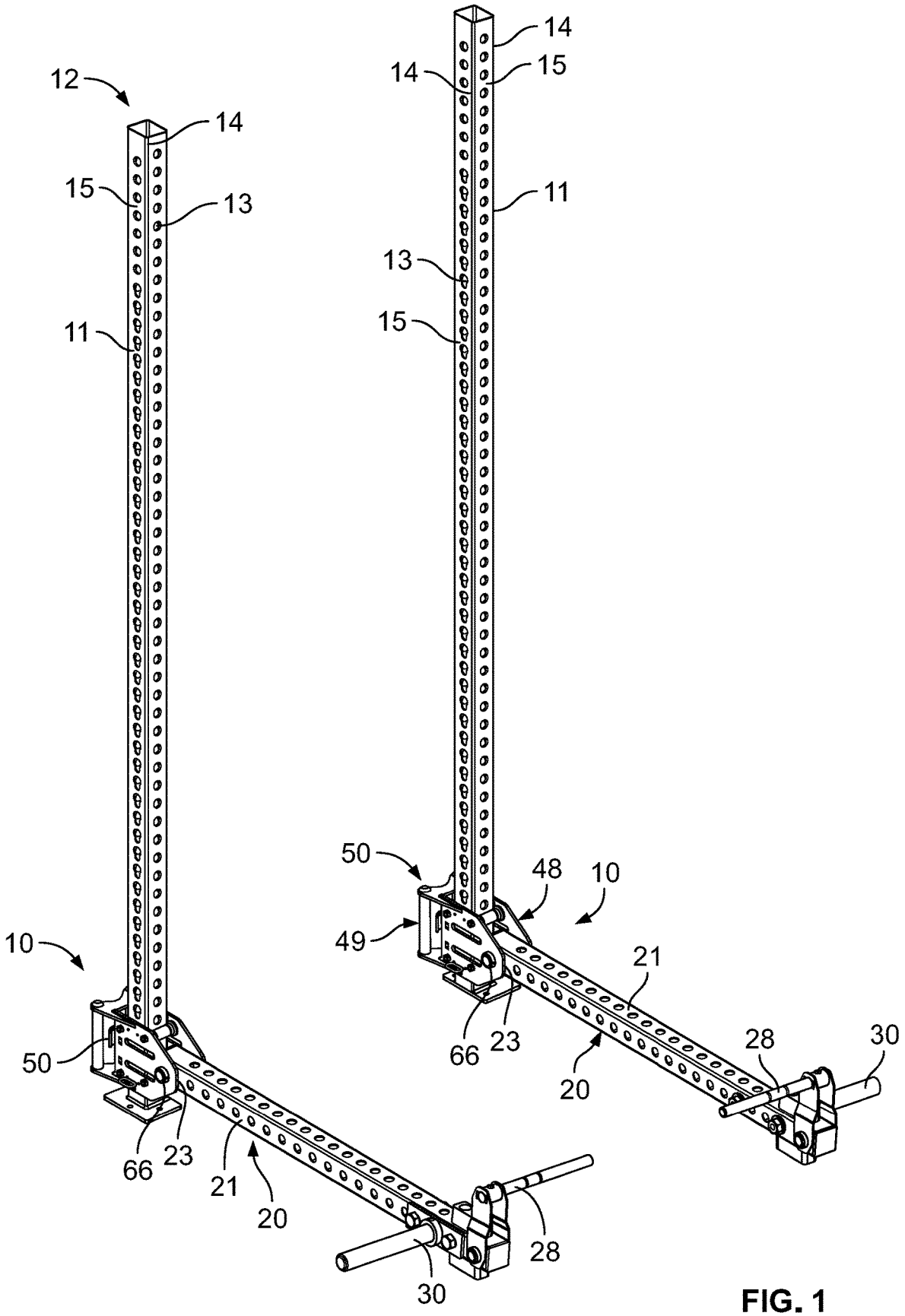
FIG. 1 is a front perspective view of a weight rack including two weightlifting assemblies each having a carriage assembly with an articulating arm connected to the carriage assembly and accessories connected to the articulating arm in the form of a handle assembly and a weight holder, according to aspects of the disclosure.

While this invention is susceptible of embodiments in many different forms, there are shown in the drawings and will herein be described in detail example embodiments of the invention with the understanding that the present disclosure is to be considered as an exemplification of the principles of the invention and is not intended to limit the broad aspect of the invention to the embodiments illustrated. In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

FIGS. 1-14 illustrate a first embodiment of a weightlifting assembly 10 for connection to a frame member 11 of a weight rack 12, such as the vertical member 11 shown in FIGS. 1-5. It is understood that FIG. 1 may be considered to depict only a portion of the weight rack 12, and in some embodiments, the weight rack 12 may include a different number of vertical frame members 11 and/or horizontal frame members 11 connecting the vertical frame members 11, as well as additional implements and accessories connected to the weight rack 12. Each frame member 11 may have a plurality of holes 13 extending through the sides of the frame member 11 for connection to a variety of different components, as known in the art. The frame members 11 in FIGS. 1-5 each have a square or rectangular cross-section, with four flat sides 15 and four corners 14, with a plurality of the holes 13 extending through all sides 15 along the length of the frame member 11. Some of the holes 13 in the embodiment of FIGS. 1-5 have a notched or teardrop shape, as seen clearly for example in FIG. 2. The weightlifting assembly 10 includes a carriage assembly 50 and an implement 20 connected to the carriage assembly 50. The carriage assembly 50 is configured to be adjustably mounted on the frame member 11 to permit sliding of carriage assembly 50 axially along the frame member 11 and fixing of the carriage assembly 50 at a plurality of different axial positions (vertical positions in FIG. 1-5). The implement 20 may be an articulating implement 20 configured for articulating movement in a weightlifting exercise in one embodiment, and may include structures to enable, assist, or complement such movement.

The carriage assembly 50 in the embodiment of FIGS. 1-10 includes a carriage body or carriage 51 that is moveably mounted on the frame member 11 of the weight rack 12 by one or more engaging structures 52, with a connection structure 66 connected to the carriage 51 to connect to and/or support the implement 20. The connection structure 66 in the embodiment of FIGS. 1-10 is configured for a pivoting or articulating connection, as discussed in greater detail herein. In one embodiment, the engaging structure(s) 52 engage opposite sides or outer surfaces 15 of the frame member 11. The engaging structure(s) 52 in FIGS. 1-10 include rollers 53 that are positioned to engage front and rear outer surfaces 15 of the frame member 11 and define a passage 54 through the carriage 51, such that the frame member 11 extends through the passage 54 in the carriage 51. In this configuration, the frame member 11 is surrounded on all sides by the carriage assembly 50 and is engaged on at least two sides (e.g., front and rear sides 15) by the carriage assembly 50. In another embodiment, the rollers 53 may be positioned on the left and right sides 15 of the frame member 11 and may engage the left and right sides 15 of the frame member 11. The carriage assembly 50 in FIGS. 1-10 has four total rollers 53, with two rollers 53 (upper and lower) on each side of the passage 54, i.e., two rollers 53 more proximate to a front 48 of the carriage assembly 50 and two rollers 53 more proximate to a rear 49 of the carriage assembly 50. Each of the rollers 53 has an axle 55 that defines an axis of rotation of the roller 53, and all of the rollers 53 in this embodiment rotate freely on parallel axes. The carriage 51 includes two plates 57 that are parallel and spaced from each other, and the rollers 53 are connected to the two plates 57 and extend between the two plates 57. The carriage 51 may further include a rear plate or transverse plate 74 that is connected to both plates 57 and extends laterally between the plates 57 transverse or perpendicular to both plates 57. The rear plate 74 in FIGS. 1-10 does not extend the full height of the plates 57, and does not extend above or below the rear rollers 53 in one embodiment. The plates 57 and the rear plate 74 may be connected together by welding the ends of the rear plate 74 to the inner surfaces of the plates 57 in a T-joint configuration in one embodiment, but other connection techniques may be used, including other integral joining techniques.

The plates 57 define the lateral sides of the passage 54, with the rollers 53 defining the front and rear sides of the passage 54. The rollers 53 provide the points of moveable engagement between the carriage assembly 50 and the frame member 11 in the embodiment of FIGS. 1-10, and may provide the sole points of constant engagement between the carriage assembly 50 and the frame member 11 in one embodiment. It is understood that the axles 55 of the rollers 53 extend completely through each roller 53 and between the plates 57 in the embodiment of FIGS. 1-10, and the axles 55 of the rollers 53 are received in holes 56 in both plates 57. In another embodiment, the axle 55 of each roller 53 may be defined by a pair of spindles or other rotary structure on each end of the roller 53. The rollers 53 may be made from a hard plastic (e.g., UHMW) or other polymer material in one embodiment, but may be made from other materials (e.g., aluminum or other metals) in another embodiment.

Figure 5:
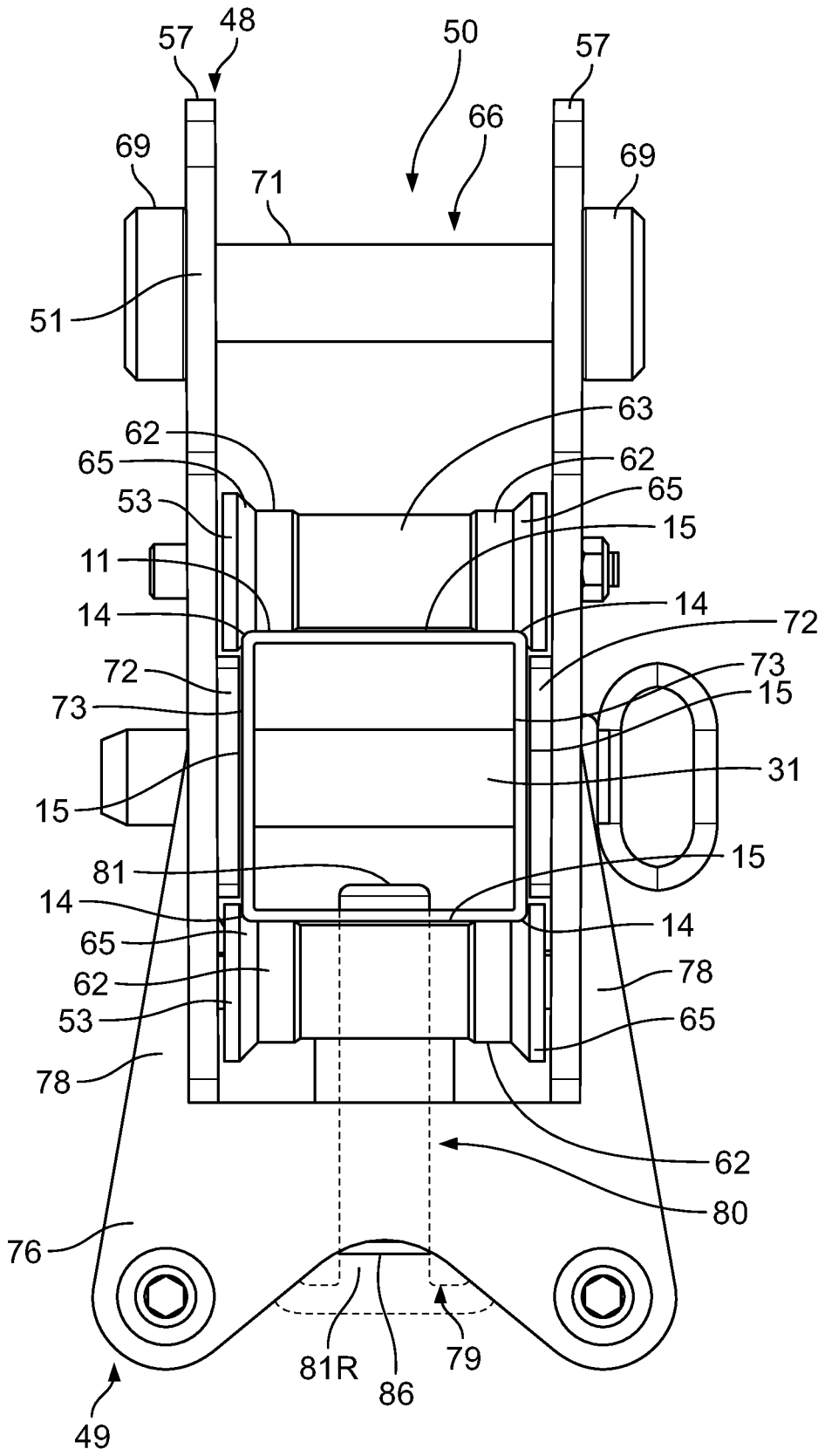
FIG. 5 is a top view of the frame member and carriage assembly of FIG. 4.
Figure 6:
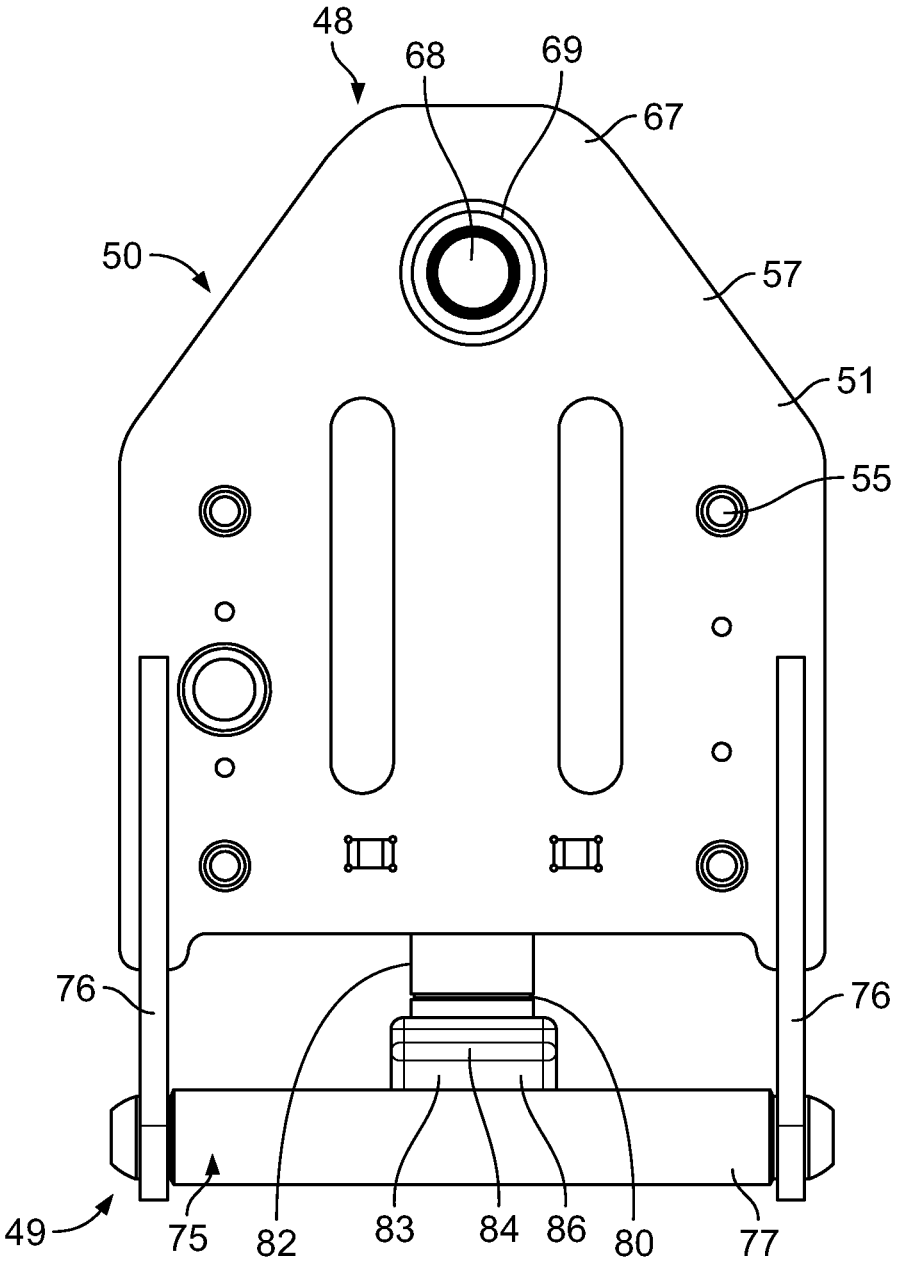
FIG. 6 is a side view of the carriage assembly of FIG. 4.
Figure 7:
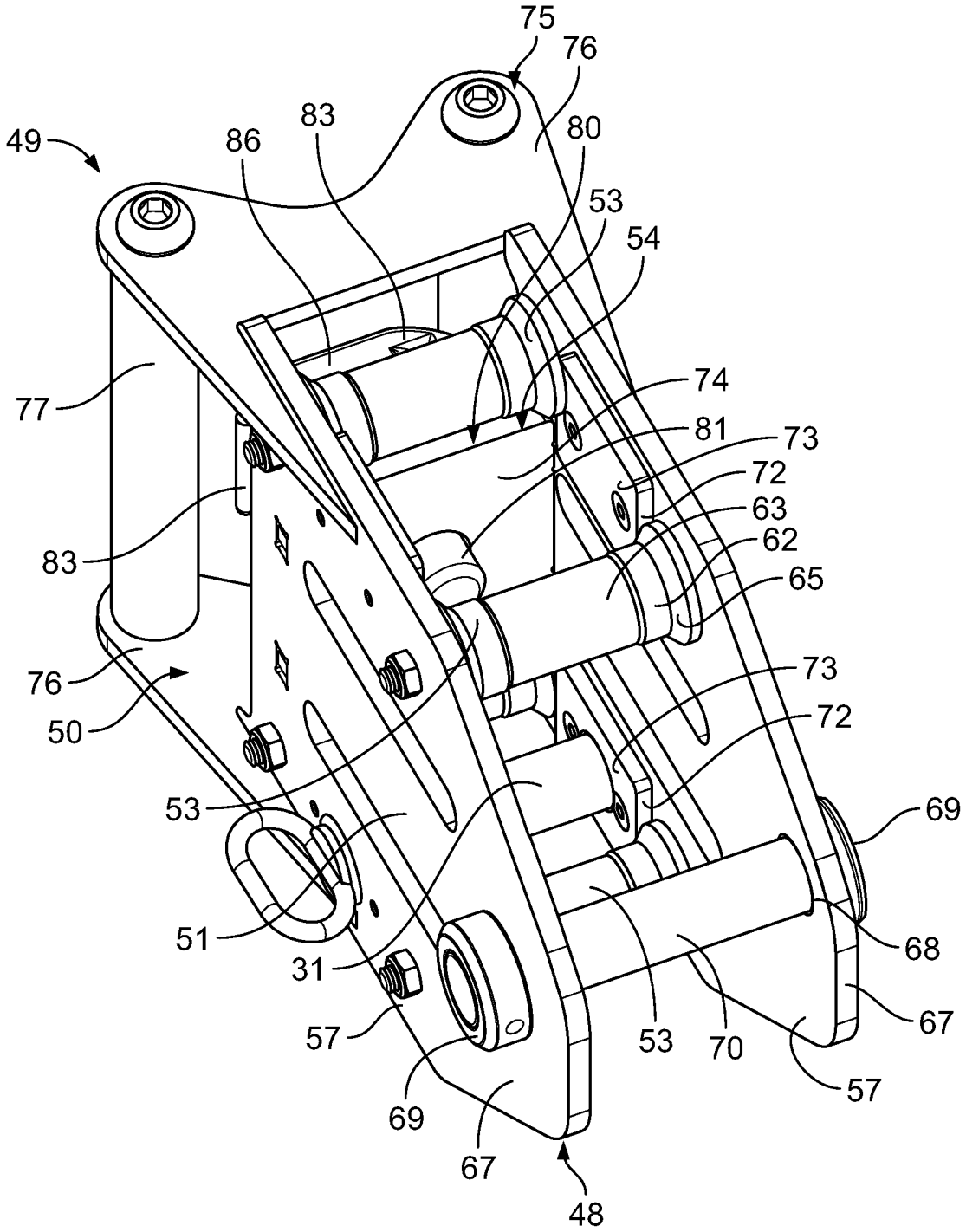
FIG. 7 is a front perspective view of the carriage assembly of FIG. 4.
Figure 8:
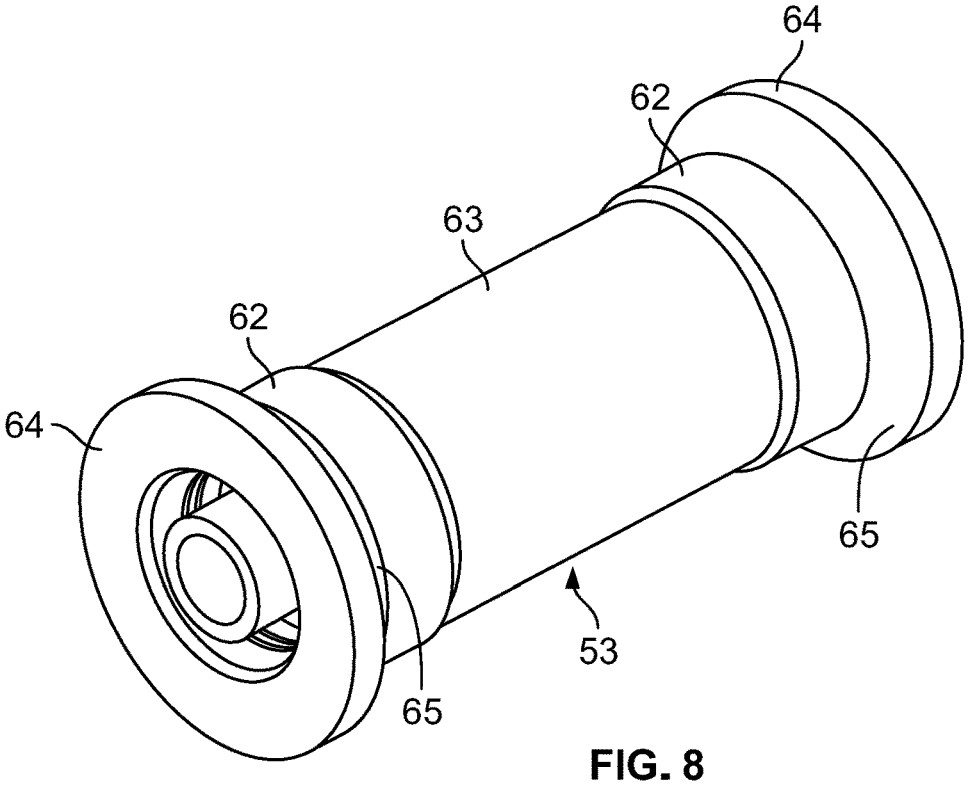
FIG. 8 is a perspective view of a roller of the carriage assembly of FIG. 4.
Figure 9:
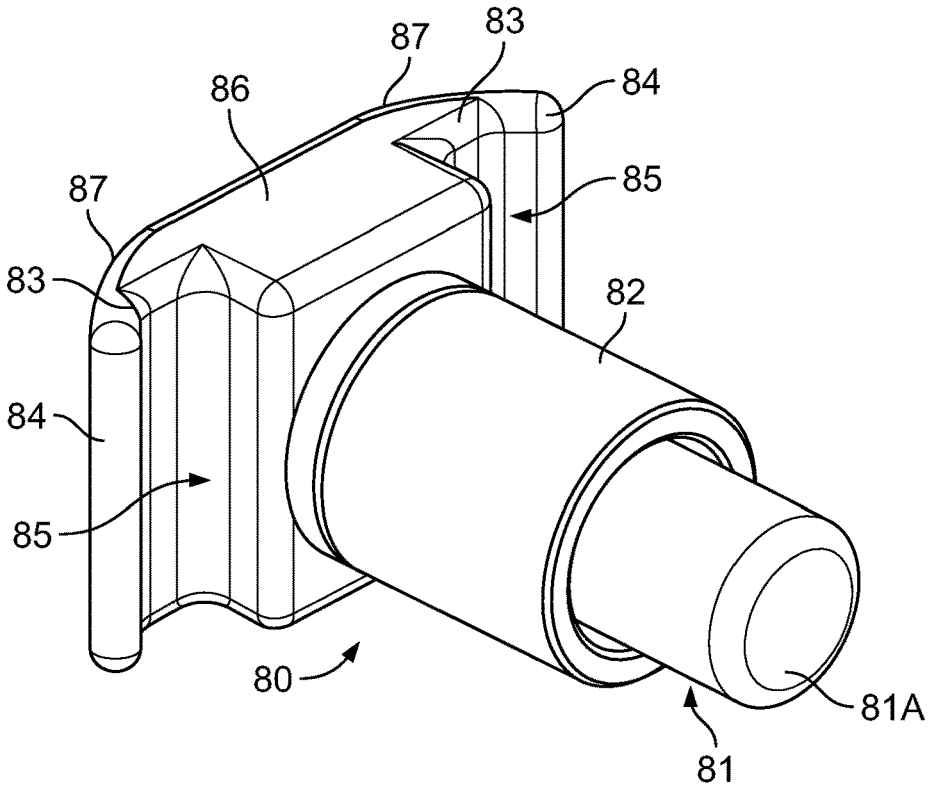
FIG. 9 is a perspective view of a releasable locking structure of the carriage assembly of FIG. 4.

The rollers 53 in the embodiment of FIGS. 1-10 and the engagement of the rollers 53 with the frame member 11 are illustrated in greater detail in FIGS. 2-5 and 8. In this embodiment, each roller 53 has a cylindrical body with a first section 62 having a larger cylindrical diameter and a second section 63 having a relatively smaller cylindrical diameter than the first section 62. In this configuration, the first section 62 engages the frame member 11 and the second section 63 is spaced from the frame member 11 due to the smaller diameter of the second section 63. The rollers 53 in FIGS. 1-10 each have two first sections 62 located near the ends of the roller 53 and a second section 63 located at the center of the roller 53 between the two first sections 62. The change in diameter between the first sections 62 and the second section 63 in this embodiment is a tapered or chamfered diameter change, but may be a step-change in another embodiment. Additionally, the rollers 53 in FIGS. 1-10 have enlarged ends 64 with chamfered or conical sections 65 having gradually decreasing diameters and extending between the ends 64 and the first sections 62. The rollers 53 having this configuration engage the frame member 11 by the first sections 62 engaging the front and rear outer surfaces 15 of the frame member 11 and the first sections 62 and the chamfered sections 65 combining to engage the corners 14 of frame member 11, as shown in FIG. 5. The carriage assembly 50 further has spacers 72 positioned between the front rollers 53 and the rear rollers 53 to fill the spaces between the carriage 51 and the lateral side surfaces 15 of the frame member 11 between the rollers 53. In this configuration, the spacers 72 have confronting surfaces 73 that are configured to confront the side surfaces 15 of the frame member 11 without constantly and/or tightly engaging the side surfaces 15, in order to reduce clearance between the carriage assembly 50 and the frame member 11. In one embodiment, small spaces exist between the confronting surfaces 73 of the spacers 72 and the side surfaces 15 of the frame member 11. This close confronting configuration reduces the freedom for lateral movement and/or twisting of the carriage assembly 50 during movement. The spacers 72 are low friction plastic or FRP plates in one embodiment. The spacers 72 are fastened to the inner surfaces of the plates 57 (e.g., by bolts or screws) in the embodiment of FIGS. 1-10, with two spacers 72 on the inner surface of each plate 57 between the top rollers 53 and the bottom rollers 53. Two of the spacers 72 positioned on the lower portion of the carriage assembly 50 in the embodiment of FIGS. 1-10 are configured to permit a removable pin 31 (discussed herein) to extend through.

In another embodiment, the rollers 53 may engage the frame member 11 in another manner.

In a further embodiment, the carriage assembly 50 may include engaging structures 52 that engage the frame member 11 in a different manner, and the frame member 11 may include complementary structures for such engagement. For example, the frame member 11 may include rails, flanges, grooves, lips, or other structures that are engaged by engaging structures 52 of the carriage assembly 50, such as rollers, wheels, clamps, etc.

The carriage assembly 50 in the embodiment of FIGS. 1-10 is configured to move by translation up and down along the frame member 11, and the rollers 53 roll against the outer surfaces 15 of the frame member 11 during this movement. The frame member 11 may have stops (not shown) near the bottom and/or the top of the frame member 11 that prevent further movement of the carriage assembly 50. Additionally, the carriage assembly 50 has a connection structure 66 that is configured to connect to the implement 20. The connection structure 66 in the embodiment of FIGS. 1-10 includes openings 68 in both of the plates 57 at the front of the carriage assembly 50. The connection structure 66 in this embodiment also includes a pin 70 that is fixedly connected to the connection structure 66 and is pivotably connected to the implement 20 to provide a pivotable or articulating connection with the implement. The plates 57 have collars 69 with the openings 68 defined therethrough to provide reinforcement to the connection structure 66, and the collars 69 have holes 71 to receive set screws (not shown) to engage the pin 70 and create a fixed connection between the pin 70 and the carriage assembly 50. The collars 69 may be connected to the plates 57 by welding or other integral joining technique in one embodiment. The connection structures of the implement 20 are described elsewhere herein. In another embodiment, the pin 70 may be fixedly connected to the implement 20 and pivotably connected to the carriage assembly 50. The carriage assembly 50 in this embodiment further includes projections 67 on the plates 57 extending outward from the front of the carriage assembly 50, and the connection structure 66 is positioned on the projections 67 to position the connection structure 66 forward of and spaced from the frame member 11.

The carriage assembly 50 in FIGS. 1-10 includes a handle assembly 75 connected to the carriage 51 to provide a component for gripping by the user to assist in movement of the carriage assembly 50 along the frame member 11 and/or carrying the carriage assembly 50 when not mounted on the frame member 11. The handle assembly 75 in one embodiment includes one or more handle mounts 76 that are connected to the carriage 51 and handles 77 connected to the handle mount(s) 76. In the embodiment of FIGS. 1-10, the handle assembly 75 includes upper and lower handle mounts 76 that are connected to both plates 57 of the carriage assembly 50 at the rear 49 of the carriage assembly 50, and two spaced handles 77 connected to both handle mounts 76. Each handle mount 76 has arms 78 that are spaced from each other and are connected (e.g., by welding or other integral joining technique) to the outer surfaces of the plates 57 of the carriage assembly 50. Additionally, each handle mount 76 has mounting portions 76A, 76B that are configured for connection to the handles 77. The upper mount 76 has two upper mounting portions 76A, and the lower handle mount 76 has two lower mounting portions 76B in the embodiment of FIGS. 1-10. The upper mounting portions 76A are configured as a single upper handle mount structure 76, and the lower mounting portions 76B are configured as a single lower handle mount structure 76 in this embodiment, but it is understood that the upper handle mounts 76A and/or the lower handle mounts 76B may be provided as separate structures in another embodiment. The handle mounts 76 are vertically spaced from each other in this embodiment, and the handles 77 are laterally spaced from each other and extend vertically between the handle mounts 76, such that each handle 77 is connected to the handle mounts 76 at upper and lower ends. The handles 77 are elongated and extend generally parallel to each other and are spaced equal distances from the axis of the pin 81 in the embodiment of FIGS. 1-10. The handle mounts 76 in FIGS. 1-10 each include a cutout 79 between the connection points with the handles 77, providing improved aesthetics, as well as reduced weight and material usage. In other embodiments, the handle assembly 75 may be differently configured.

The carriage assembly 50 in one embodiment also includes a moveable and/or releasable locking structure 80 configured for selectively locking the carriage assembly 50 in position with respect to the frame member 11. In the embodiment of FIGS. 1-10, the carriage assembly 50 includes an axially moveable pin 81 that is configured to extend through a hole or holes 13 in the frame member 11 to fix the carriage assembly 50 in position on the frame member 11. The pin 81 in FIGS. 1-10 is in the form of a spring loaded pin that extends through the rear plate 74 of the carriage assembly 50. The pin 81 in this embodiment is axially moveable (i.e., by axial translation) between a locked position, where the pin 81 extends into the passage 54 to engage the frame member 11, such as by being received in a hole 13 of the frame member 11, and a free position, where the pin 81 is retracted and does not engage the frame member 11. FIG. 5 illustrates the pin 81 in the locked position with a retracted pin 81R shown in broken lines to indicate the free position. The locked position and the free position may therefore be considered an extended position and a retracted position, respectively, in the embodiment of FIGS. 1-10. In the locked position, the engagement between the pin 81 and the frame member 11 resists movement of the carriage assembly 50 along the length of the frame member 11 (i.e., vertically in FIGS. 1-5), and in the free position, the carriage assembly 50 is free to move along the length of the frame member 11.

Figure 10:
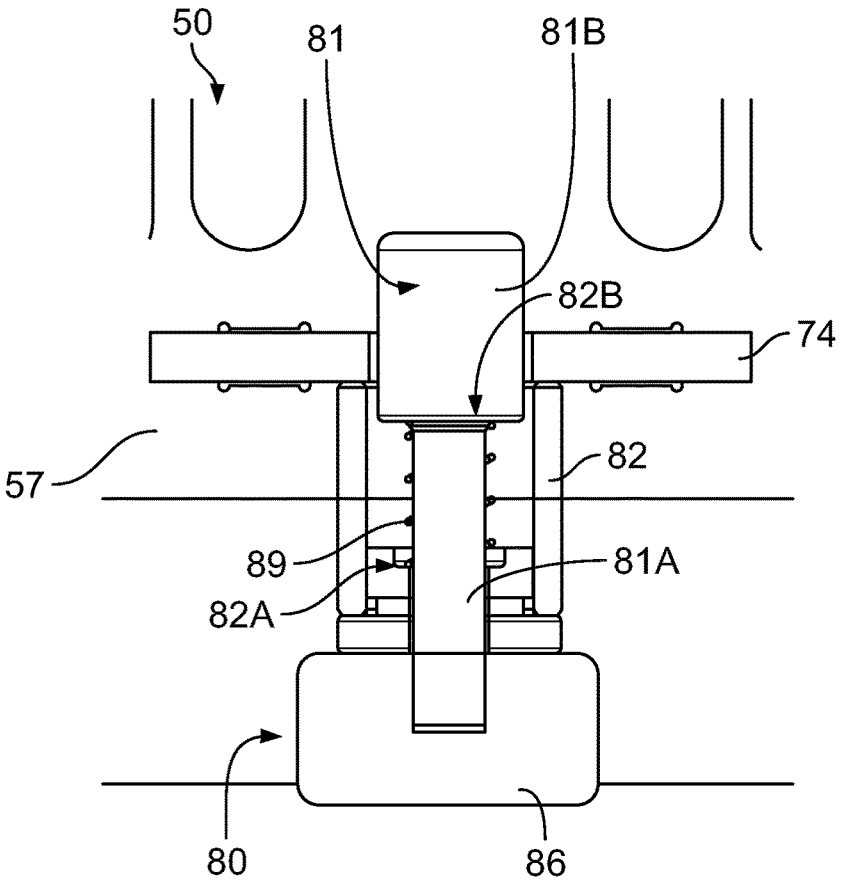
FIG. 10 is a cross-section view of a portion of the carriage assembly of FIG. 4.
Figure 11:
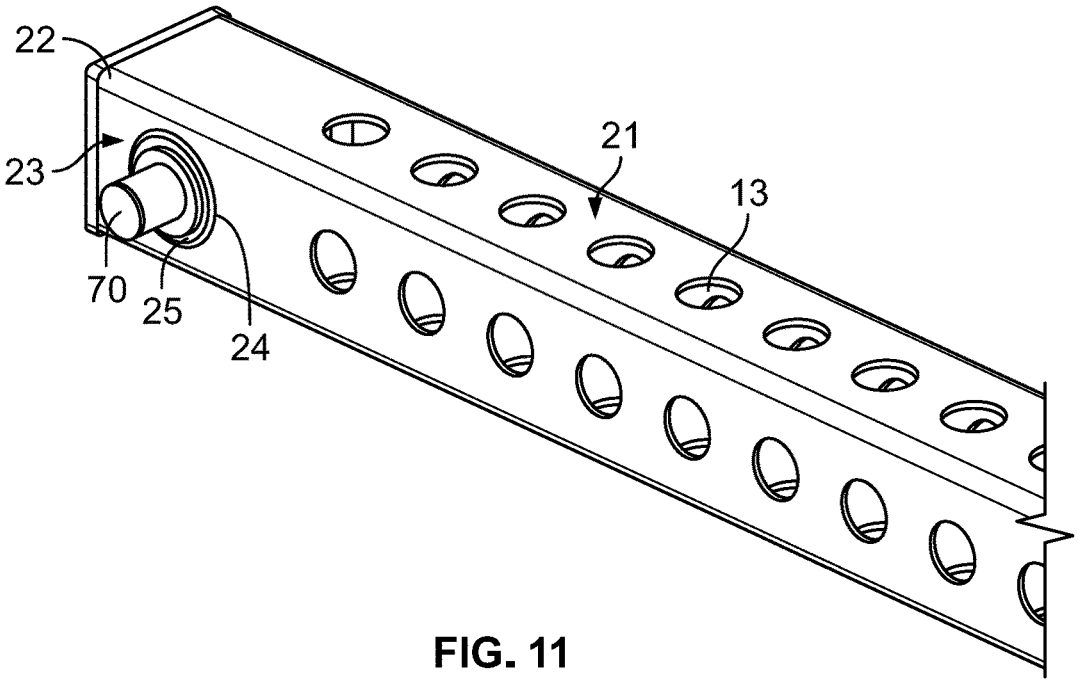
FIG. 11 is a front perspective view of a portion of one of the articulating arms of FIG. 1.
Figure 12:
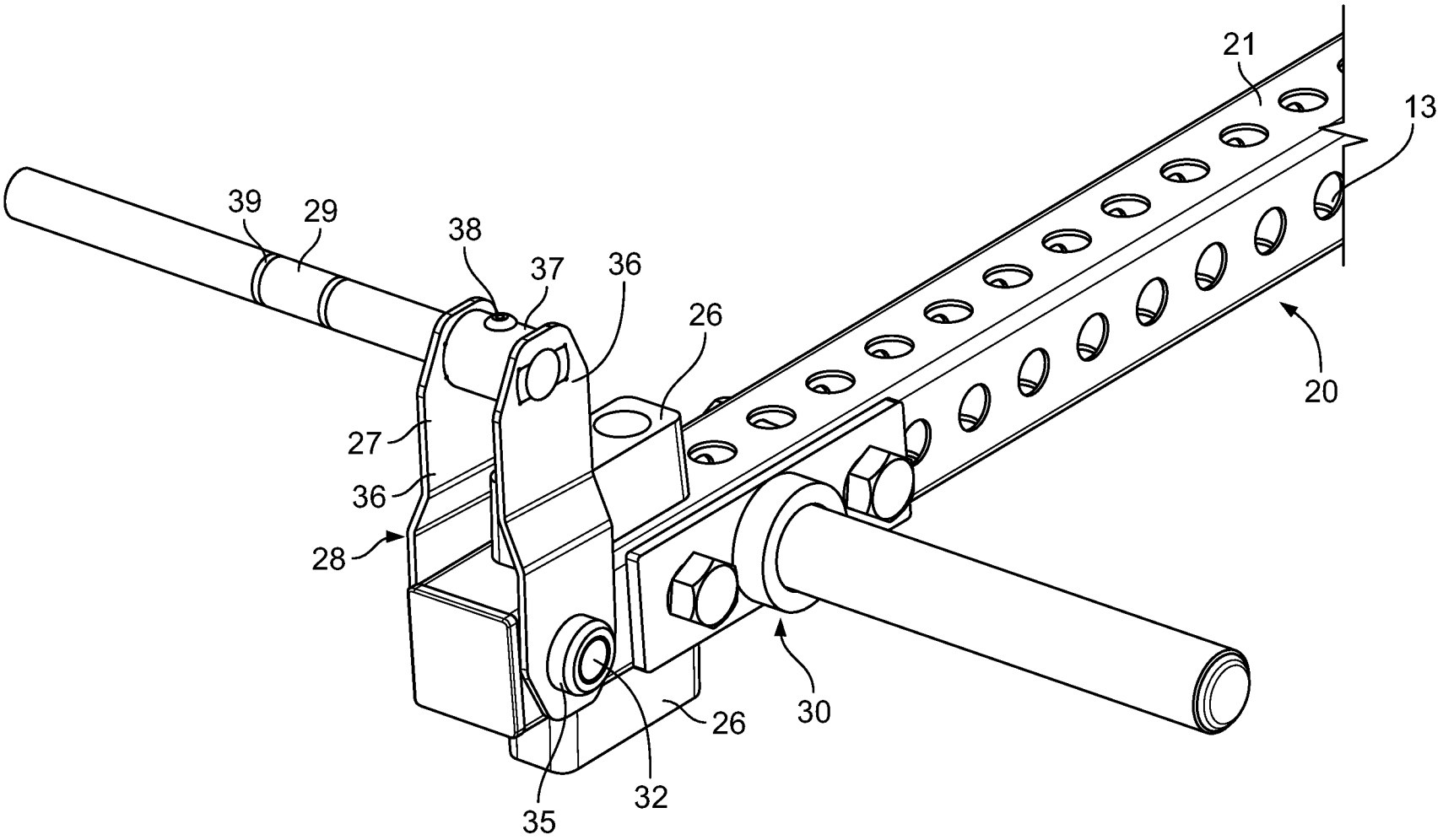
FIG. 12 is a front perspective view of a portion of one of the articulating arms of FIG. 1 and the handle assembly and the weight holder connected to the articulating arm.
Figure 13:
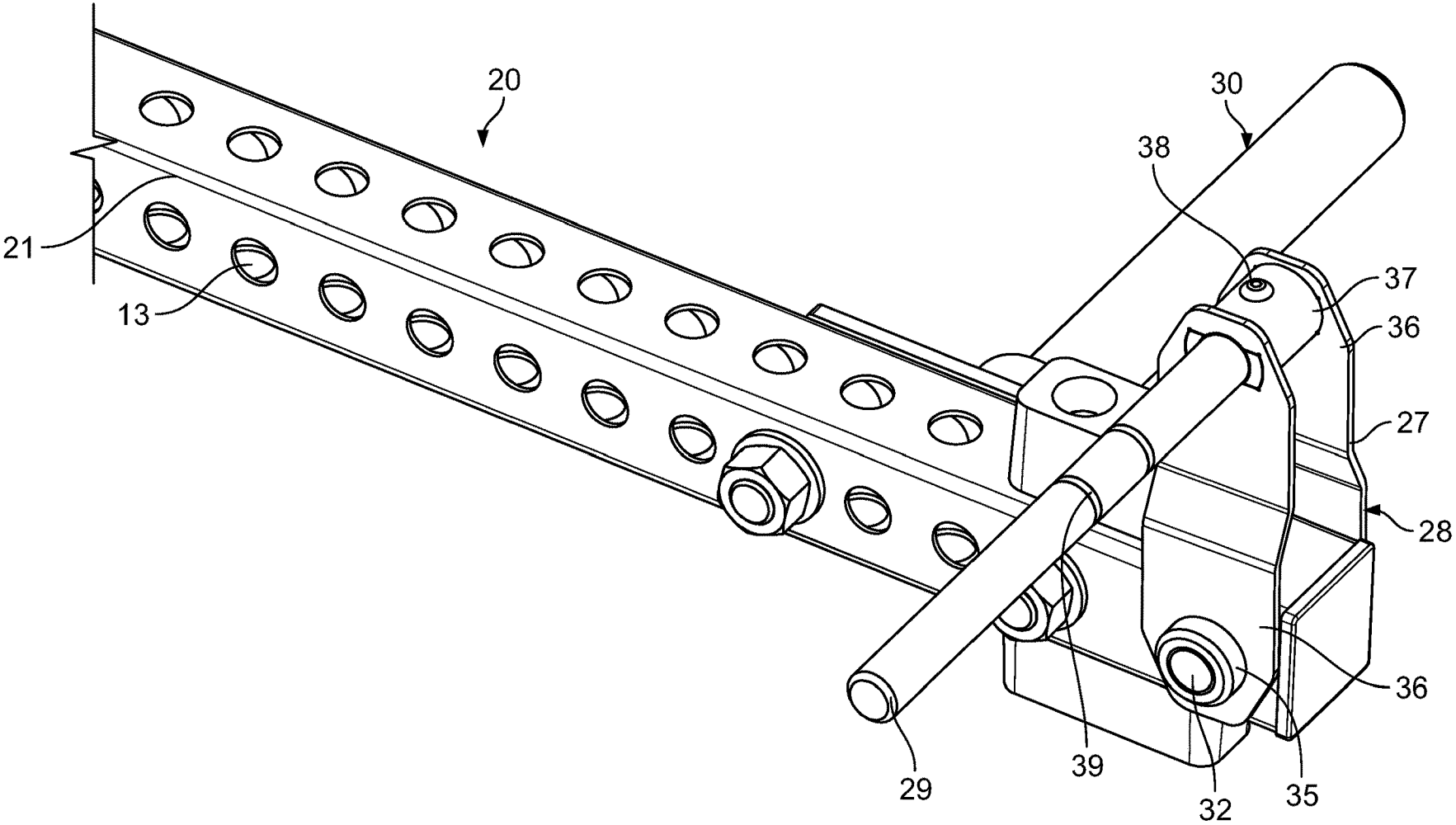
FIG. 13 is a front perspective view of the portion of the articulating arm, the handle assembly, the weight holder of FIG. 12.

The locking structure 80 in FIGS. 1-10 includes a collar 82 connected to the rear plate 74 and housing a spring 89 or other biasing member or mechanism (see FIG. 10) configured to engage the pin 81 and bias the pin 81 toward the locked position, i.e., toward the front 48 of the carriage assembly 50 in the embodiment of FIGS. 1-10. In this configuration, the carriage assembly 50 is locked in position with respect to the frame member 11 unless the locking structure 80 is manipulated to be released, e.g., by pulling the pin 81 to the free position. The spring 89 is illustrated as a coil spring in FIG. 10 and may abut engagement surfaces 82A, 82B of the collar 82 and the pin 81, respectively, to compress the spring 89 upon retraction of the pin 81. The pin 81 as illustrated in FIG. 10 has a narrower first portion 81A that connects to the end piece 86 and grips 83 and extends through the collar 82, with the spring 89 wrapped around the first portion 81A, and a wider second portion or end portion 81B that extends through the rear plate 74 and engages the frame member 11 in the locked position. The locking structure 80 in one embodiment may also include a removable pin 31 that extends through both of the plates 57 transversely and extends through the holes 13 in the frame member 11 transverse to the pin 81 to further secure the carriage assembly 50 in position. The removable pin 31 may have a locking structure, such as a cotter key, an end cap, or other mechanism.

The carriage assembly 50 in FIGS. 1-10 has the pin 81 located between the handles 77 of the handle assembly 75 and located at the midpoint between the handles 77. The pin 81 may also include one or more actuation structures, which may be in the form of grips 83 configured to facilitate manipulation of the pin 81 while simultaneously gripping the handles 77. The pin 81 in the embodiment of FIGS. 1-10 has two grips 83 extending outward from left and right lateral sides at the rearward-most end of the pin 81. The grips 83 in this embodiment are in the form of vertical flanges that extend laterally outward and curve forwardly at the distal ends 84 to form recesses 85 on the front sides of the grips 83. In this configuration, the grips 83 are configured to be engaged by the user's fingers, such that the user's fingers engage the distal ends 84 and/or are received in the recesses 85 to pull the pin 81 rearwardly to the free position when the user's hands are on the handles 77. Additionally, the grips 83 in FIGS. 1-10 are formed as part of a substantially T-shaped end cap 86 that is connected to the rear end of the pin 81 and has the grips 83 extending outwardly from both sides, with curved rear surfaces 87 extending to the distal ends 84. This configuration creates an ergonomic and aesthetically pleasing form for the actuation structure of the pin 81. The user is able to grip the handles 77 and actuate the pin 81 to the free position by pulling on the grips 83 with one or more fingers, and the structure and positioning of the grips 83 permits the user to easily maintain his/her grip on the handles 77 and the grips 83 to lift or lower the carriage assembly 50.

Movement of the carriage assembly 50 in the embodiment of FIGS. 1-10 can be accomplished by pulling the user the grips 83 while gripping the handles 77 to retract the pin 81, then raising or lowering the carriage assembly 50 to the desired position, and then releasing the pin 81, which will be pushed back to the locked position by the spring 89 when the end of the pin 81 is aligned with one of the holes 13 in the frame member 11. As seen in FIG. 5, the length of the pin 81 is sufficient to extend into one of the holes 13 on the frame member 11 but not sufficient to extend completely through the frame member 11. In another embodiment, the pin 81 may have increased length, with the understanding that this configuration may require greater travel distance for retraction of the pin 81. By allowing the user to retract the pin 81 while gripping the handles 77, this configuration facilitates moving the carriage assembly 50, which may have significant weight, particularly if connected to an implement 20. Additionally, the configuration of the locking structure 80 in this embodiment increases the safety of the carriage assembly 50, because the user will naturally be gripping the handles 77 when retracting the pin 81 and will therefore be less likely to drop the carriage 50, and even if the user releases his/her grip on the handles 77 and the grips 83, the biasing mechanism 89 will cause the pin 81 to automatically engage the frame member 11 to lock the carriage assembly 50 in place again.

Figure 30:
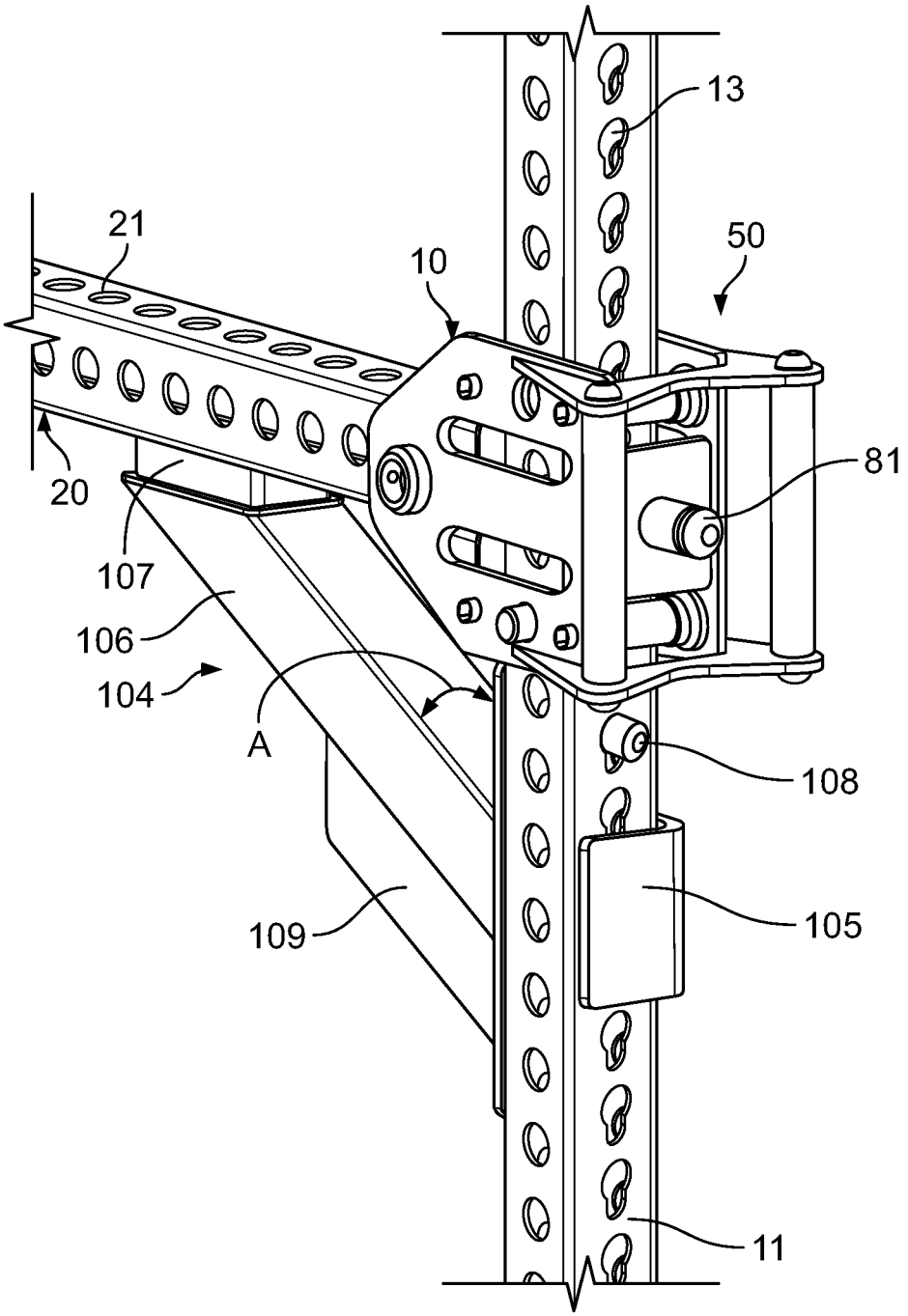
FIG. 30 is a rear perspective view of a portion of the frame member, the support, and a portion of the weightlifting assembly of FIG. 29.

In other embodiments, the locking structure 80 may have another configuration, including pins having other configurations or other types of mechanical locking structures, which may be configured to engage the holes 13 in the frame member 11 and/or other structures of the frame member 11. For example, the pin 81 may include a retaining structure to retain the pin 81 in the hole 13 and in connection with the frame member 11, including a detent, a tab, a cotter key, or other structure. As another example, the pin 81 may not be spring-biased, and may be in the form of a sliding pin with a retaining structure to lock the pin 81 in the locked position. FIG. 30 illustrates an embodiment where the carriage assembly 50 has a pin 81 configured as a detent pin with a round head, positioned in the same location as the pin 81 of FIGS. 1-10. In a further embodiment, the locking structure 80 may be configured to engage a frame member 11 without holes 13, and may include structures such as clamps, brakes, etc.

Figure 15:
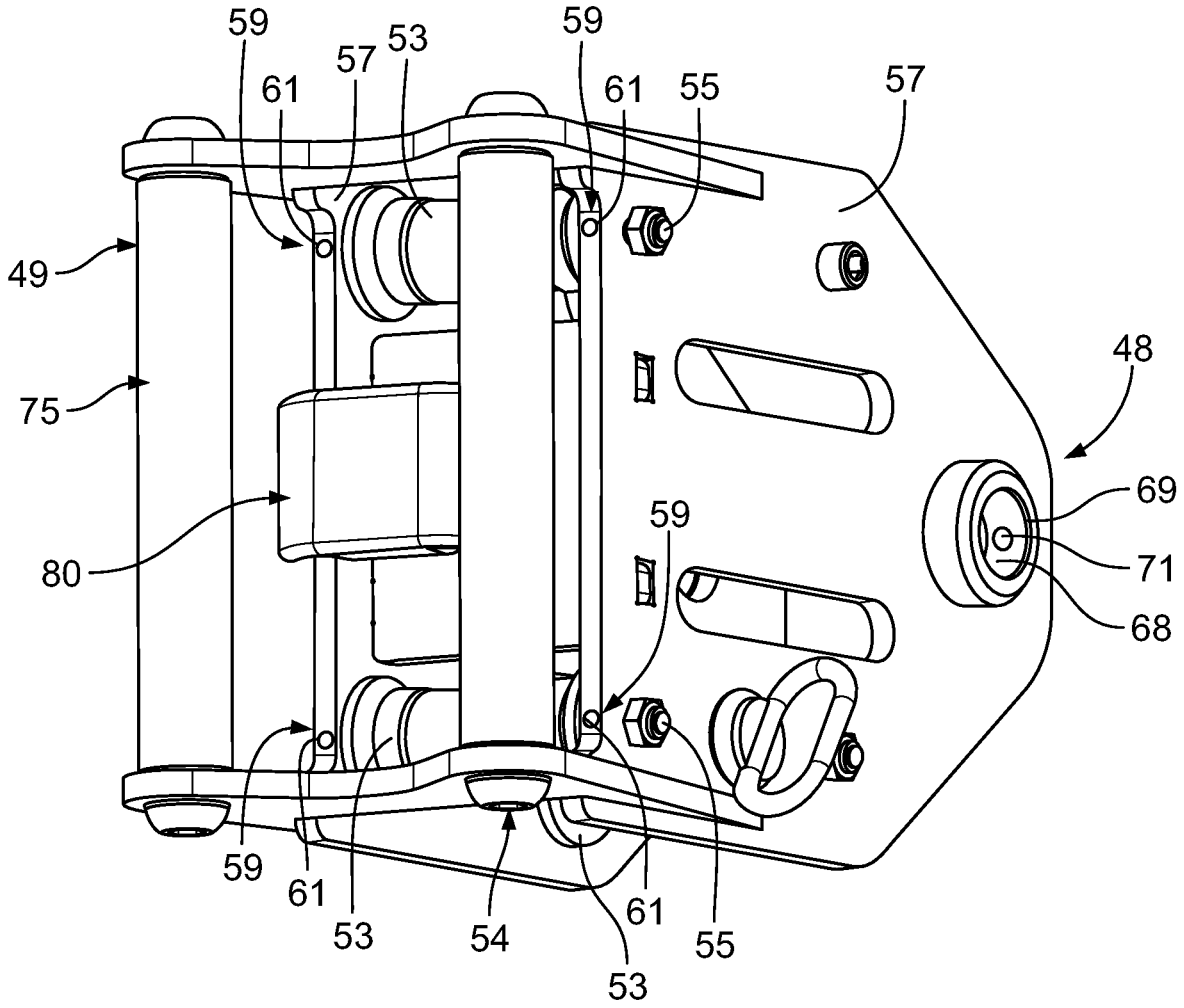
FIG. 15 is a bottom rear perspective view of another embodiment of a carriage assembly according to aspects of the disclosure.
Figure 16:
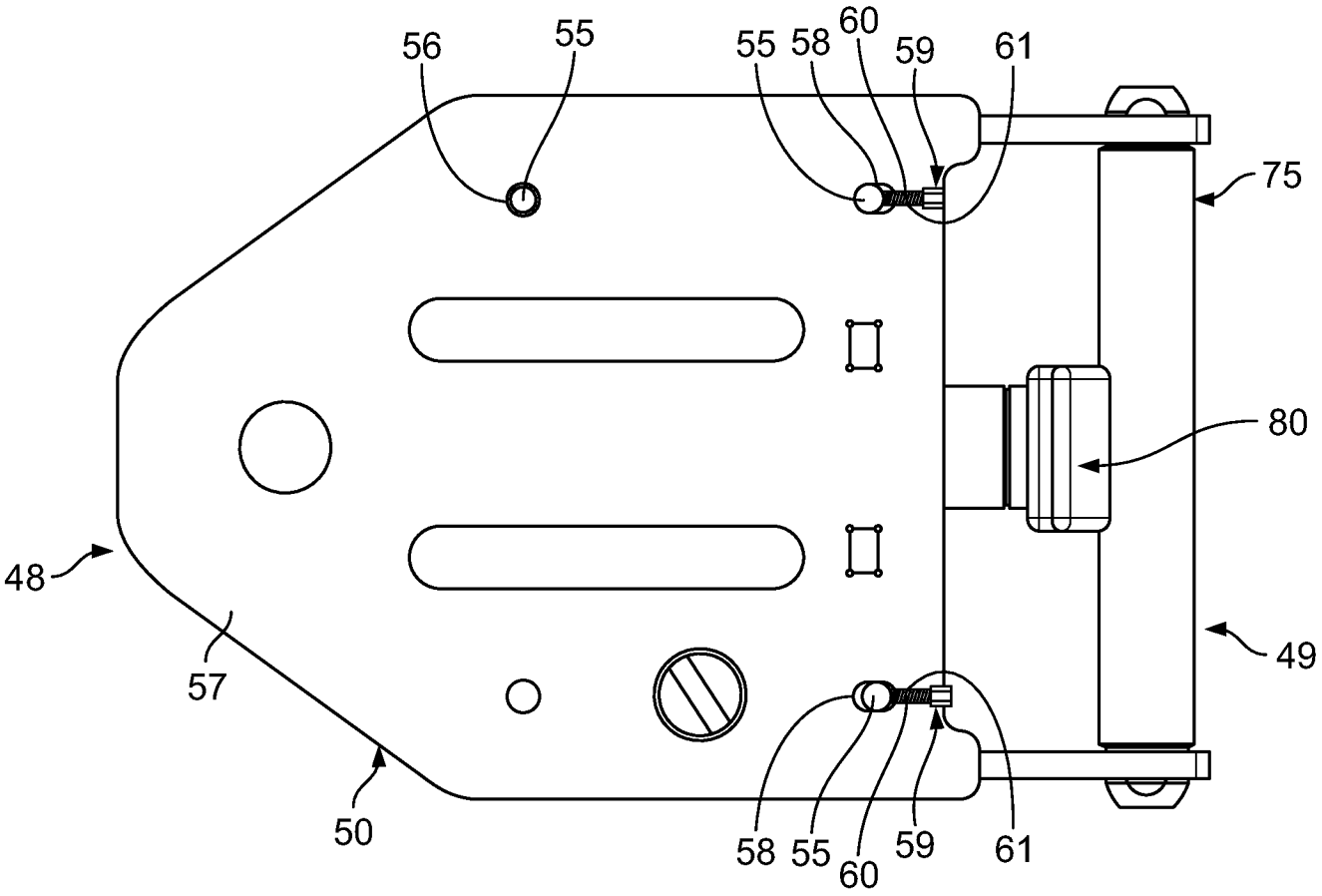
FIG. 16 is a cross-section view of the carriage assembly of FIG. 15.

In another embodiment, shown in FIGS. 15-16, the carriage assembly 50 has an adjustment mechanism to adjust the spacing between the axles 55 of the front rollers 53 and the rear rollers 53. In this embodiment, the axles 55 of the front rollers 53 are laterally/horizontally fixed, and the axles 55 of the rear rollers 53 are adjustable closer or farther from the front rollers 53 to increase or decrease the spacing. In the embodiment of FIGS. 15-16, the adjustment mechanism for adjusting the spacing includes slots 58 that receive the ends of the axles 55 of the rear rollers 53 and have a length that is elongated in the front-to-rear direction. The axles 55 can be moved forward and rearward within the slots 58 to adjust the spacing between the axles 55 of the front and rear rollers 53. The carriage assembly 50 further includes fixing members 59 in this embodiment for fixing and/or adjusting the positions of the axles 55 within the slots 58. In the embodiment of FIGS. 15-16, the fixing members 59 are formed by set screws 60 that are received in threaded apertures 61 that are open on the rear sides of the plates 57 and transversely intersect the slots 58. The positions of the axles 55 within the slots 58 in this embodiment can be incrementally adjusted forward or rearward by advancing or retreating the set screws 60 within the apertures 61, such that the ends of the screws 60 push the rear axles 55 forwardly or provide space for the axles 55 to move rearwardly, respectively. Each of the four slots 58 has a separate fixing member 59 for moving and fixing the corresponding axle 55 within the slot 58. Generally, the set screws 60 are advanced within the apertures 61 to push the axles 55 until the rear rollers 53 engage the frame member 11 tightly, allowing the carriage assembly 50 to accommodate different frame members 11 having different front-to-rear dimensions. In other embodiments, the front rollers 53 may additionally or alternately be configured with an adjustment mechanism to adjust the spacing, or a different adjustment mechanism may be used. The embodiment of FIGS. 15-16 does not include the spacers 72 as shown in FIGS. 1-10, although it is understood that such spacers 72 may be included in this embodiment.

Figure 17:
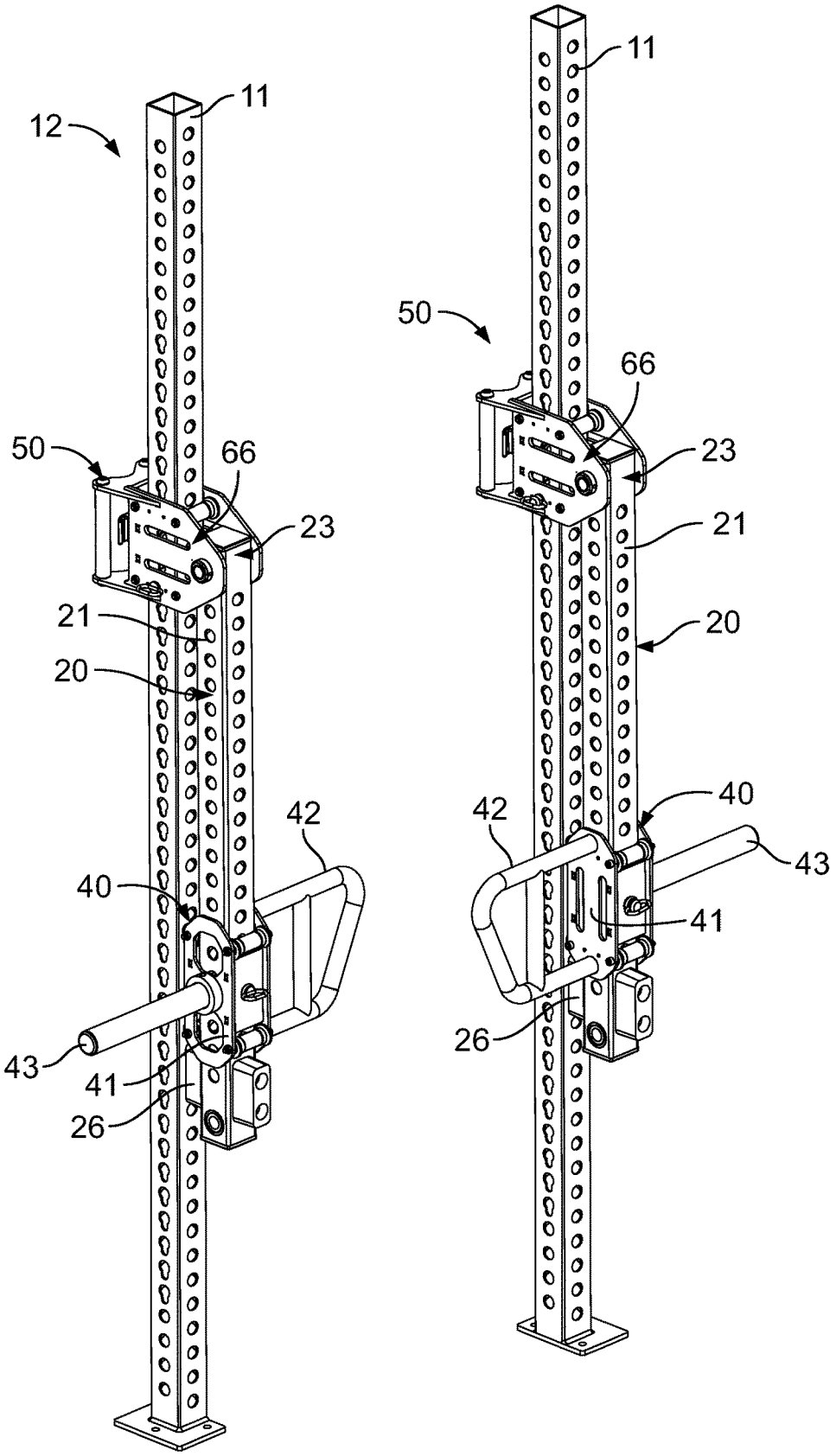
FIG. 17 is a front perspective view of the weight rack and two weightlifting assemblies of FIG. 1 with another embodiment of an accessory connected to each articulating arm in the form of an adjustable handle assembly, with the carriage assembly of each weightlifting assembly in an elevated position, according to aspects of the disclosure.
Figure 18:
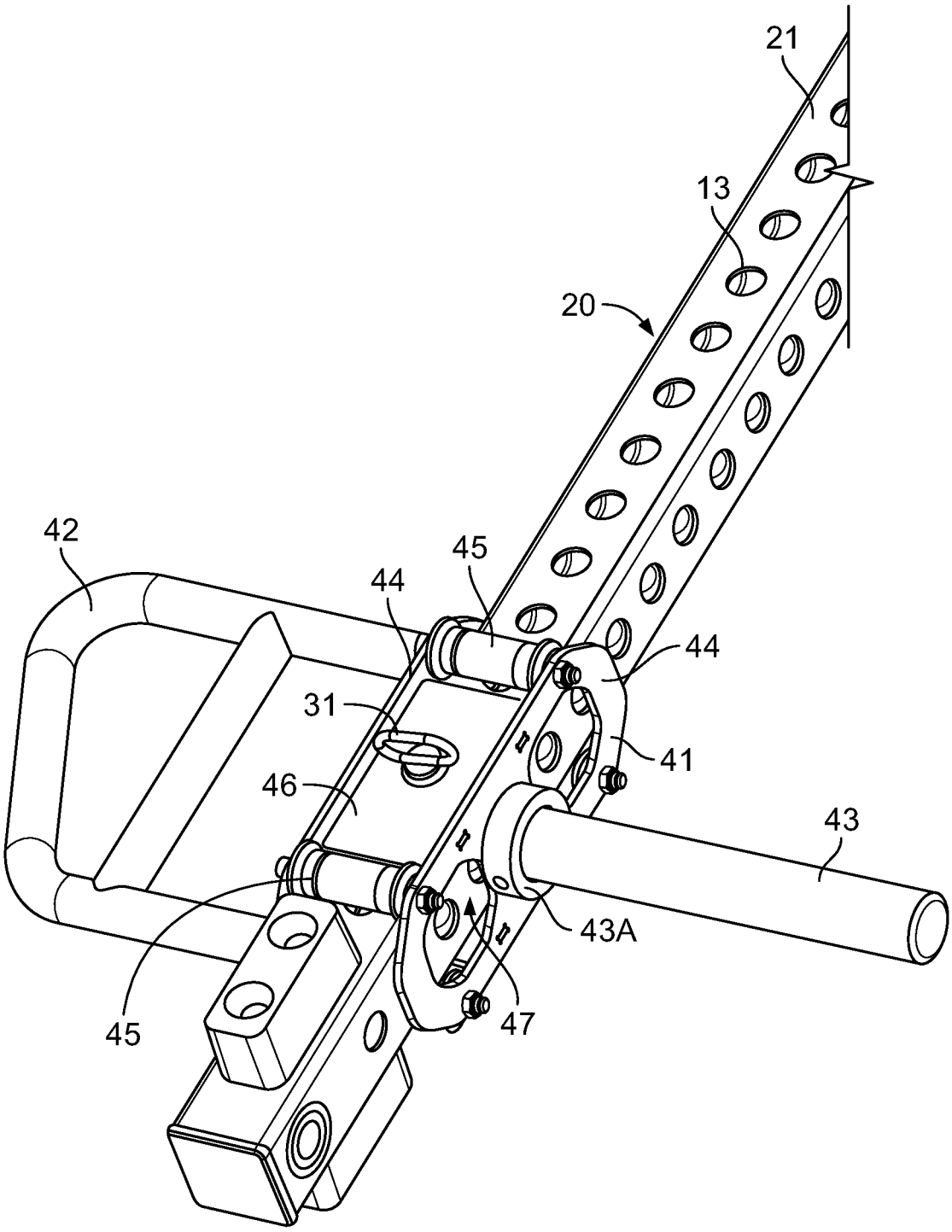
FIG. 18 is a front perspective view of a portion of one of the arms of FIG. 17 and the adjustable handle assembly connected to the arm.

The carriage assembly 50 in FIGS. 1-10 is configured for connection to an implement 20 in a pivoting or articulating configuration, such that the implement 20 or a portion thereof can pivot or articulate with respect to the carriage assembly 50. Various embodiments of implements 20 can be used in connection with the carriage assembly 50, including non-articulating implements. In one embodiment, the implement 20 may be a weightlifting arm 21 as shown in FIGS. 1-2 and 11-14. The weightlifting arm 21 has a proximal end 22 that has connection structure 23 for connection to the connection structure 66 of the carriage assembly 50 to form a pivoting or articulating configuration. The connection structure 23 of the arm 21 in FIGS. 2 and 11-14 includes a passage 24 having an internal bushing 25. In this configuration, the proximal end 22 of the arm 21 is received between the plates 57 at the front 48 of the carriage assembly 50, and the pin 70 extends through the openings 68 in the plates 57 and through the passage 24 to connect the arm 21 to the carriage assembly 50. The bushing 25 permits the arm 21 to pivot about the pin 70 to pivot with respect to the carriage assembly 50. The arm 21 in FIGS. 11-14 has pads or bumpers 26 on the top and bottom surfaces, to protect the arm 21 against impacts, e.g., with the ground or with part of the weight rack 12. Additionally, the arm 21 in FIGS. 11-14 is configured somewhat similarly to the frame members 11, as an elongated square or rectangular tubular structure with a plurality of holes 13 extending along the length of the arm 21 on all outer surfaces of the arm 21. The arm 21 may further be configured for connection of accessories for specific functionality, and the holes 13 may be used for connection of such accessories. Examples of accessories are shown in FIGS. 12-14, 17-29, 32-34, 35-43, and 59-64 and described herein. In one embodiment, a weight rack 12 may be provided with two or more frame members 11, each having an articulating arm 21 with one or more accessories connected thereto, such as shown in FIGS. 1 and 17. For example, arms 21 having accessories for gripping (e.g., as in FIGS. 12-14, 17-21, 29, 32-34, and 35-43) may be provided as a pair of parallel frame members 11 and arms 21 so that each arm 21 is configured for engagement by one arm or leg of a user. As another example, arms 21 having accessories for supporting a free weight (e.g., as in FIGS. 22-28) may be provided as a pair of parallel frame members 11 and arms 21 so that a user can stand between the arms 21 to lift the free weight. It is understood that a weight rack 12 with multiple arms 21 may have different accessories connected to each arm 21.

Figure 14:
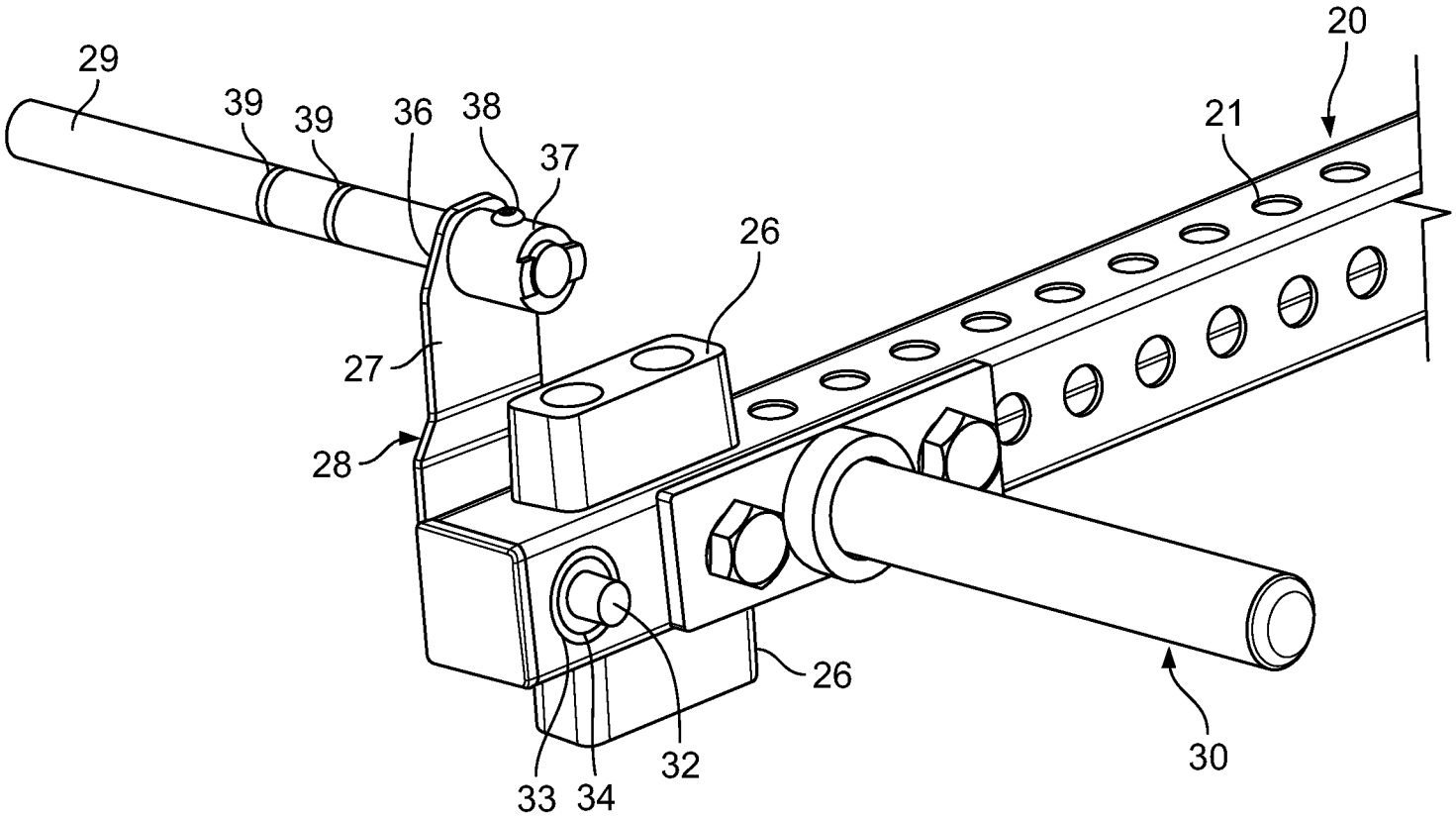
FIG. 14 is a front perspective view of the portion of the articulating arm, the handle assembly, and the weight holder of FIG. 12, with a portion of one of the accessories removed to show a connection between the accessory and the arm.

The arm 21 in FIGS. 11-14 has accessories in the form of a handle assembly 28 for gripping by a user and a weight holder 30 for holding one or more weights, e.g., in the form of weight plates, both of which are connected to the arm 21 for use in a weightlifting exercise. The handle assembly 28 in the embodiment of FIGS. 11-14 is an articulating handle assembly, and includes an articulating bracket 27 connected to the arm 21 at a pivoting or articulating connection, and a gripping handle 29 connected to the articulating bracket 27. The bracket 27 in FIGS. 11-14 includes two side members 36 that are pivotably connected to the arm 21 on opposite sides of the arm 21 and a tube member 37 extending between the side members 36 to fixedly connect the side members 36 together and to receive the end of the gripping handle 29. The handle 29 may be held in place by a set screw 38 received in a hole (not shown) in the handle 29 in this embodiment, as shown in FIG. 14. The articulating connection is formed by a pin 32 that is fixedly connected to the articulating bracket 27 and extends through a passage 33 having an internal bushing 34 to permit the pin 32 and the articulating bracket 27 to pivot with respect to the arm 21, as shown in FIG. 14. The bracket 27 includes collars 35 on each side member 36 with set screws for fixing the pin 32 with respect to the bracket 27. The weight holder 30 is mounted to the arm 21 by fixing structures in the form of threaded bolts in FIGS. 11-14 but may alternately be in the form of one or more removable pins, detent pins, spring pins, or other connections. The position of the weight holder 30 may be adjusted by removing the bolts and relocating the weight holder 30 along the length of the arm 21 to a desired position, and then re-inserting the bolts. The handle 29 and the weight holder 30 extend outward from opposite sides of the arm 21 in the configuration of FIGS. 11-14. In this configuration, the handle 29 (or at least a portion thereof) and the weight holder 30 extend outward in directions that is parallel to the axis of articulation of the arm 21. In one embodiment, the handle 29 may include indicia 39 to communicate information to the user, such as a reference point for hand positioning for certain exercises (e.g., a bench press). The use of the articulating handle assembly 28 in FIGS. 11-14 provides the ability for a linear weightlifting motion to be performed using an articulating arm 21. A fixed handle connected to an articulating arm 21 travels in an arc motion, and the secondary articulation provided by the articulating handle assembly 28 achieves linear motion, which enables proper form on lifts such as a bench press, overhead lift, dead lift, snatch, clean and jerk, and other weightlifting exercises with linear form.

Figure 32:
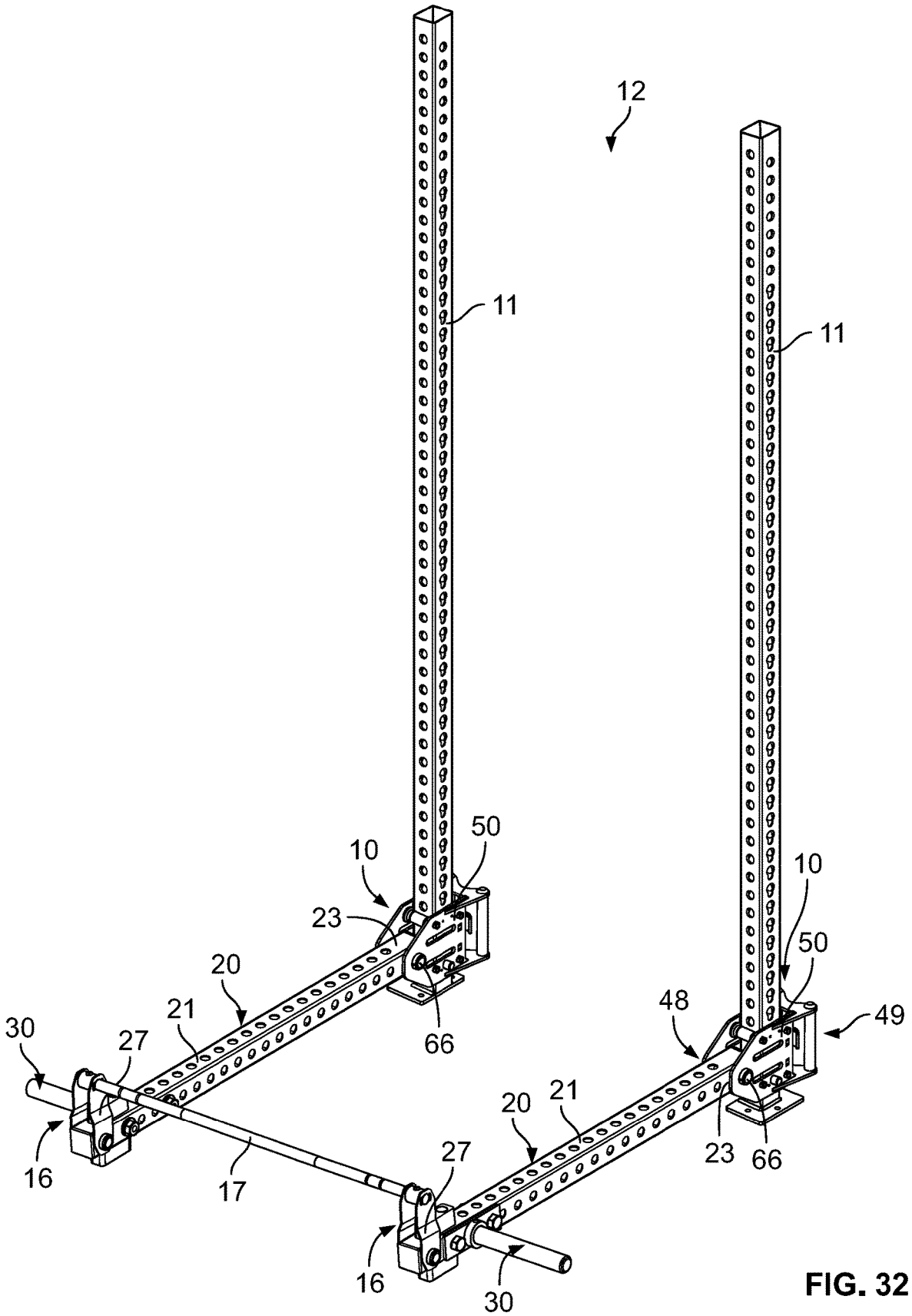
FIG. 32 is a front perspective view of the weight rack and two weightlifting assemblies of FIG. 1 with an accessory connected to each articulating arm in the form of the weight holder of FIG. 1 and another embodiment of a handle assembly, according to aspects of the disclosure.
Figure 33:
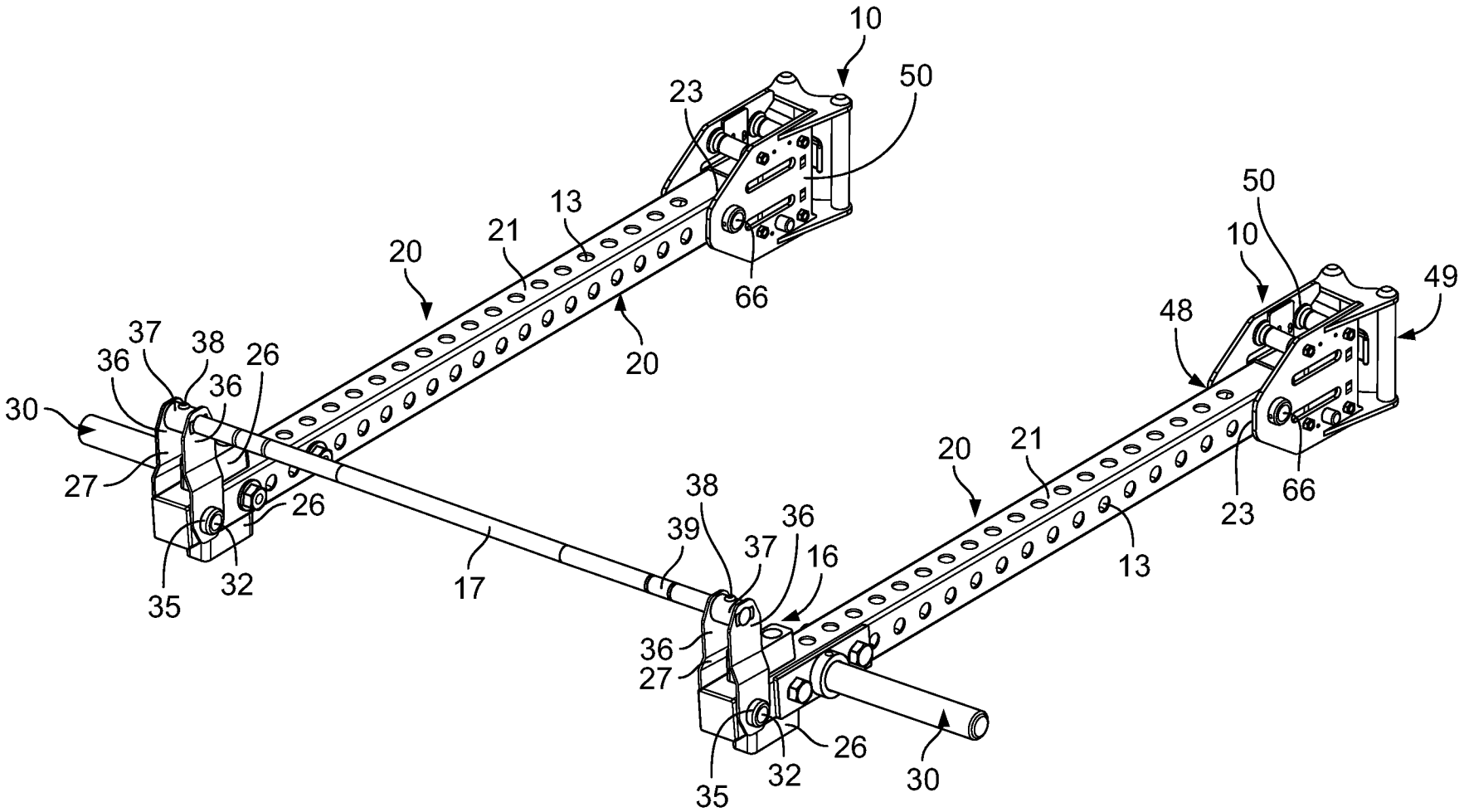
FIG. 33 is a front perspective view of the two weightlifting assemblies of FIG. 32.
Figure 34:
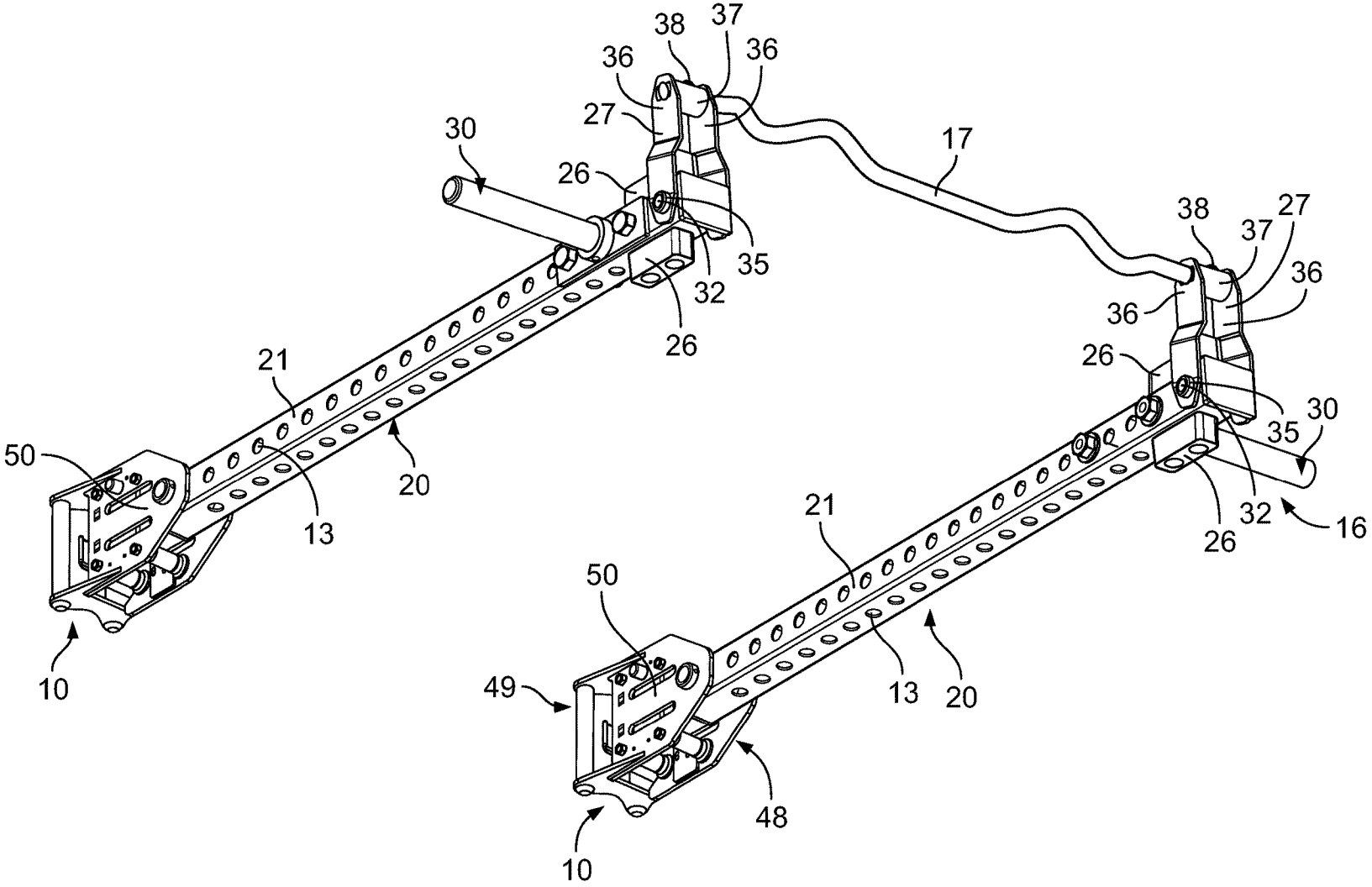
FIG. 34 is a bottom front perspective view of the two weightlifting assemblies of FIG. 32, with a different gripping handle than shown in FIGS. 32-33.

The arm 21 in FIGS. 32-34 has accessories in the form of a handle assembly 16 for gripping by a user and a weight holder 30 for holding one or more weights, e.g., in the form of weight plates, both of which are connected to the arm 21 for use in a weightlifting exercise. The weight holder 30 in FIGS. 32-34 is similar or identical to the weight holder 30 in FIGS. 11-14, and therefore will not be re-described in detail for the sake of brevity. The handle assembly 16 in the embodiment of FIGS. 32-34 is an articulating handle assembly that includes many components and features that are similar or identical to certain components and features of the handle assembly 28 of FIGS. 11-14, and such similar or identical components and features may not be re-described in full detail for the sake of brevity. It is understood that the same reference numbers are used herein to refer to such similar or identical components and features in the embodiments of FIGS. 11-14 and 32-34. The handle assembly 16 in FIGS. 32-34 includes first and second articulating brackets 27 each connected to one of the pair of arms 21 at a pivoting or articulating connection, and a gripping handle 17 connected to both articulating brackets 27 and extending between the brackets 27. Each bracket 27 in FIGS. 32-34 includes two side members 36 that are pivotably connected to the arm 21 on opposite sides of the arm 21 and a tube member 37 extending between the side members 36 to fixedly connect the side members 36 together and to receive one of the ends of the gripping handle 17. The ends of the handle 17 may be held in place by set screws 38 received in holes (not shown) at or near the ends of the handle 17 in this embodiment, as shown in FIG. 33. The articulating connection between each articulating bracket 27 and the respective arm 21 is formed in the same configuration shown in FIG. 14 and described above, by a pin 32 that is fixedly connected to each articulating bracket 27 and extends through a passage 33 having an internal bushing 34 to permit the pin 32 and the articulating bracket 27 to pivot with respect to the respective arm 21 (see FIG. 14). The bracket 27 includes collars 35 on each side member 36 with set screws for fixing the pin 32 with respect to the bracket 27.

The handle 29 and the weight holder 30 extend outward from opposite sides of the arm 21 in the configuration of FIGS. 32-34. In this configuration, the handle 29 (or at least a portion thereof) and the weight holder 30 extend outward in directions that are parallel to the axis of articulation of the arm 21. The gripping handle 17 in FIGS. 32-33 is in the form of a straight bar that has a circular cross section and extends linearly for the entire distance between the brackets 27. Such a straight bar may be used in exercises such as bench presses and deadlifts, among numerous other lifts. FIG. 34 illustrates a gripping handle 17 in the form of a curl bar that is connected to the brackets 27 in the same way as the straight bar in FIGS. 32-33. The curl bar gripping handle 17 extends the entire distance between the brackets 27 and has upward and downward curves that may be suitable for certain weightlifting exercises, such as bicep curls and triceps extensions, among numerous other lifts. The handle assembly 16 in FIGS. 32-34 provides the ability for a wide variety of weightlifting motions to be performed using an articulating arm 21, which would normally move in a fixed arc. The secondary articulation provided by the articulating handle assembly 16 allows linear motion and a wider variety of arcing motions to be achieved, which enables proper form on numerous lifts.

In other embodiments, the arm 21 in FIGS. 11-14 and 32-34 may have an accessory in the form of a fixed handle, rather than an articulating handle, using any of the embodiments of gripping handles 17, 29 shown in FIGS. 11-14 and 32-34 or other handle configurations. Such a fixed handle may be connected to the arm 21 similarly to the weight holder 30 in FIGS. 11-14 and 32-34. The weight holder 30 may be provided as part of a single, integral accessory with such a fixed handle in one configuration. Further accessory configurations may be used, and it is understood that such accessories may be designed to be compatible with the structure of the arm 21.

The arm 21 in FIGS. 17-21 has an accessory in the form of another embodiment of an adjustable handle assembly 40 configured for various weightlifting exercises. The handle assembly 40 includes a mounting body 41 in the form of a moveable carriage assembly or carriage configured for connection to the arm 21, a gripping handle 42 connected to the mounting body 41 for gripping by a user, and a weight holder 43 connected to the mounting body 41 for holding one or more weights, e.g., in the form of weight plates. The gripping handle 42 and the weight holder 43 are connected to, and extend outward from, opposite sides of the mounting body 41, and these components may be connected by welding or other integral joining technique in one embodiment. In the embodiment of FIGS. 17-21, the weight holder 43 is received within a collar 43A welded to one of the plates 44 of the mounting body 41 and having a set screw for fixing the weight holder 43, similar to the collar 69 described herein.

Figure 19:
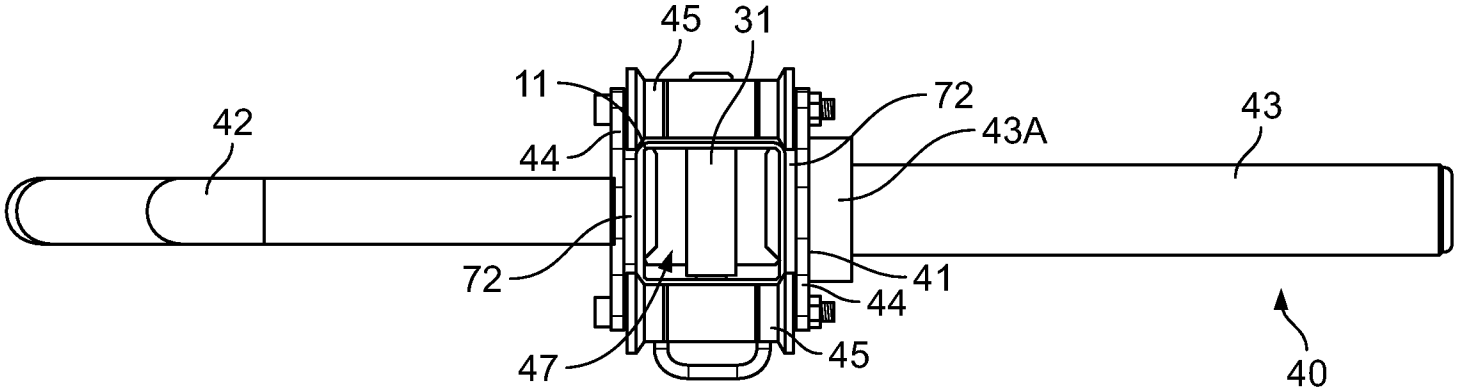
FIG. 19 is a front view of the arm and the adjustable handle assembly of FIG. 18.
Figure 20:
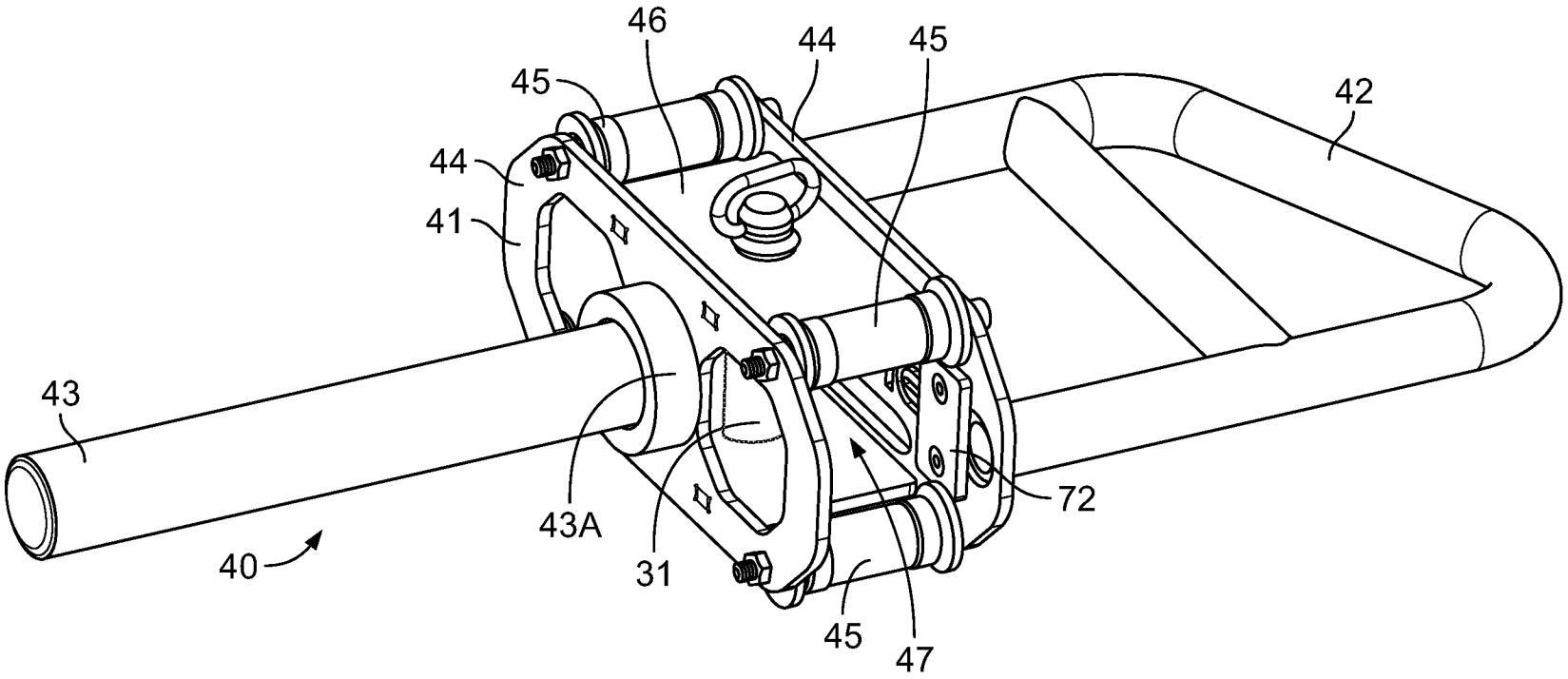
FIG. 20 is a front perspective view of the adjustable handle assembly of FIG. 18.
Figure 21:
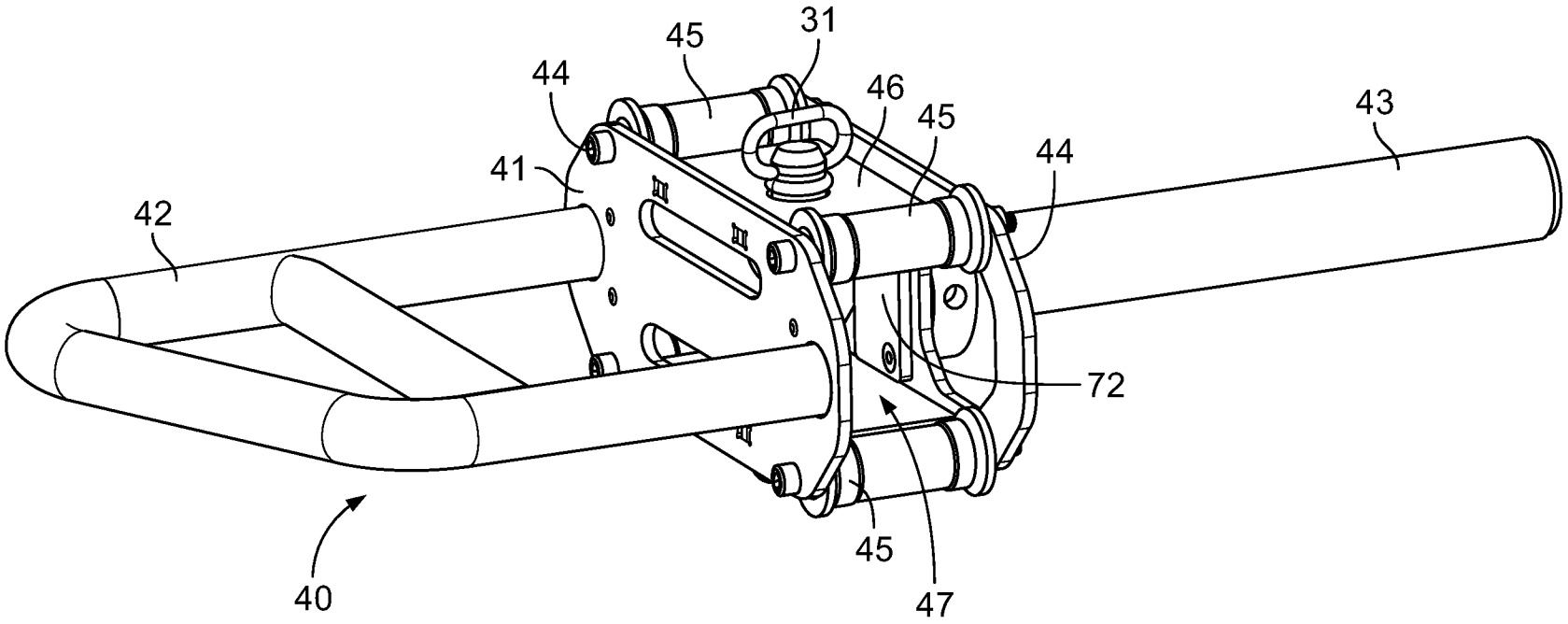
FIG. 21 is a rear perspective view of the adjustable handle assembly of FIG. 18.

The mounting body 41 includes two side plates 44 that are parallel and spaced from each other, and a plurality of rollers 45 are connected to the two side plates 44 and extend between the two side plates 44. The rollers 45 in the handle assembly 40 of FIGS. 17-21 are freely rotatable on parallel axes and are similar in structure and function to the rollers 53 shown and described herein with respect to the carriage assembly 50, e.g., being configured to engage the opposed surfaces and corners of the arm 21 as shown in FIG. 19. Therefore, the structure and function of the rollers 45 of the handle assembly 40 will not be re-described in detail herein, for the sake of brevity. The mounting body 41 may further include one or more transverse plates 46 on the top and/or bottom of the mounting body 41 that are connected to both side plates 44 and extend laterally between the side plates 44 transverse or perpendicular to both side plates 44. The transverse plates 46 in FIGS. 17-21 do not extend the full length of the side plates 44, and do not extend above outwardly of the rollers 45 in one embodiment. The side plates 44 and the transverse plates 46 may be connected together by welding the ends of the transverse plates 46 to the inner surfaces of the side plates 44 in a T-joint configuration in one embodiment, but other connection techniques may be used including integral joining techniques.

The side plates 44 define the lateral sides of a passage 47 through the mounting body 41, with the rollers 45 defining the front and rear sides of the passage 47. The rollers 45 provide the points of moveable engagement between the mounting body 41 and the arm 21 in the embodiment of FIGS. 17-21 similarly to the rollers 53 and the frame member 11 in FIGS. 2-5, and may provide the sole points of constant engagement between the handle assembly 40 and the arm 21 in one embodiment. The mounting body 41 may further have spacers 72 connected to the inner surfaces of both side plates 44, as similarly discussed herein with respect to the carriage assembly 50. The gripping handle 42 is connected to one of the side plates 44, and the weight holder 43 is connected to the opposite side plate 44, such that the gripping handle 42 and the weight holder 43 extend outwardly in opposite directions from the mounting body 41. These connections may be made by welding or other connection techniques described herein, including other integral joining techniques. The gripping handle 42 has multiple gripping portions oriented at multiple orientations in order to provide different grip configurations for different types of weightlifting exercises.

The adjustable handle assembly 40 is fixed in position with respect to the arm by a removable pin 31 or other connecting structure as described herein, e.g., a detent pin, a spring pin, or other connection. The pin 31 extends transversely through both the top and bottom transverse plates 46 and through holes 13 in the arm 21 to fix the handle assembly 40 in place with respect to the arm 21. The position of the handle assembly 40 may be adjusted by removing the pin 31 and sliding the handle assembly 40 along the arm 21 to the desired position, and then re-inserting the pin 31.

The arm 21 in FIGS. 22-28 has a further embodiment of an accessory in the form of a moveable weight supporting assembly 90 configured to hold and support a free weight for lifting by a user at an elevated height, which may be referred to as a "monolift" accessory. The weight supporting assembly 90 includes a weight support 91 connected to the arm 21 and configured for holding and supporting a free weight (not shown) and a counterweight assembly 92 connected to the arm 21 and configured to cause movement of the arm 21 when the weight support 91 is unloaded. The weight support 91 in FIGS. 22-28 includes a mounting bracket 93 fixedly connected to the arm 21 and an engagement part 94 connected to the mounting bracket 93 and configured to support the free weight. The mounting bracket 93 in this embodiment extends around three sides of the arm 21 and is connected to the arm 21 by a fixed peg 88 and a removable pin 31 that extend through holes 13 in the arm 21. The mounting bracket 93 may be considered to have a J-cup configuration in one embodiment. The fixed peg 88 is fixedly connected to the inner surface of the mounting bracket 93, and the removable pin 31 can be inserted through the arm 21 and through the mounting bracket 93 after the fixed peg 88 is inserted and the mounting bracket 93 is in the correct position. In another embodiment, the fixed peg 88 may be replaced by a peg that is not fixedly connected to the mounting bracket 93, such as a removable pin 31 or a pin that is not removable but not fixedly connected to the mounting bracket 93.

In the embodiment of FIGS. 22-28, the engagement part 94 extends outwardly from the mounting bracket 93 and has a notch 95 and a protrusion 96 extending upward at the distal end of the engagement part 94 to define the end of the notch 95. The engagement part 94 in this configuration may be considered to have a hook shape. When the engagement part 94 engages the free weight, a portion of the free weight is received in the notch 95 and engages the protrusion 96 to support the free weight. One embodiment of such a free weight may have a round bar portion for gripping (e.g., a barbell), and such a round bar portion may be received within the notch 95, where the protrusion 96 obstructs the round bar portion from rolling or slipping out of the notch 95.

Figure 22:
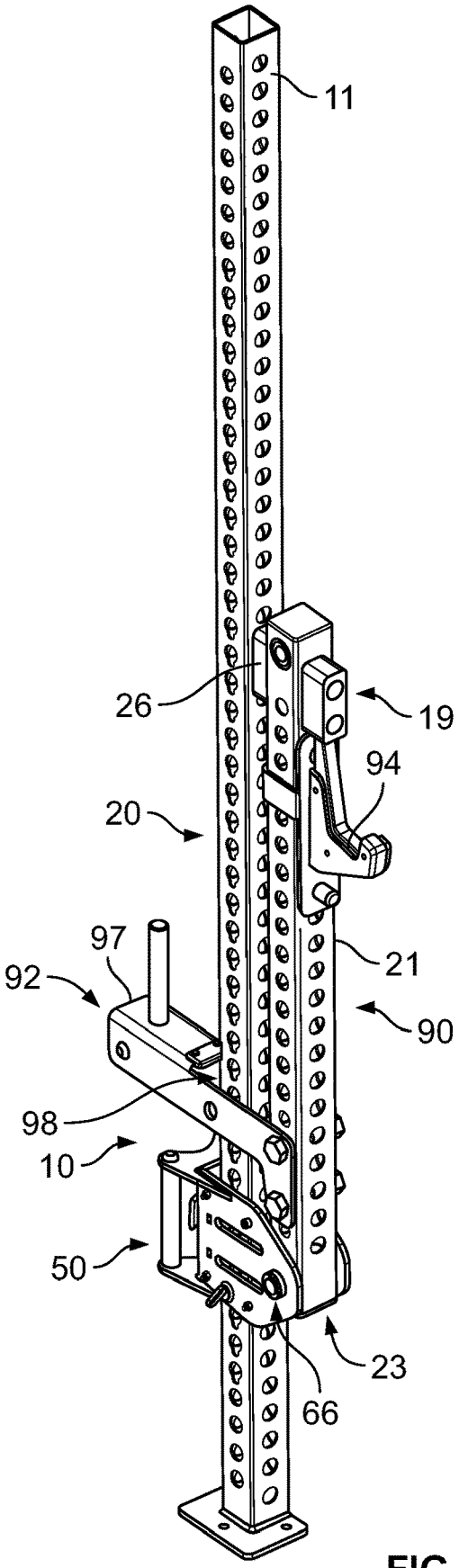
FIG. 22 is a front perspective view of one of the frame members and one of the weightlifting assemblies FIG. 1 with another embodiment of an accessory connected to the articulating arm in the form of a moveable weight holder assembly, and with the articulating arm in a rearward position, according to aspects of the disclosure.
Figure 23:
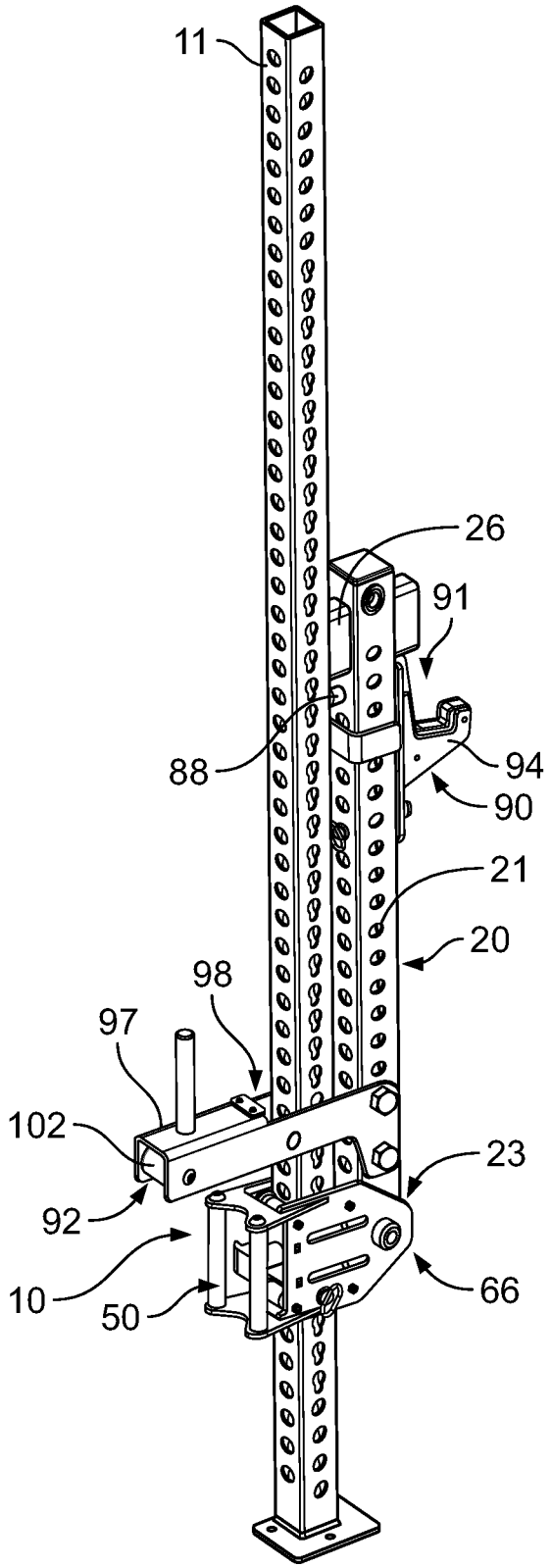
FIG. 23 is a rear perspective view of the frame member and the weightlifting assembly of FIG. 22.
Figure 24:
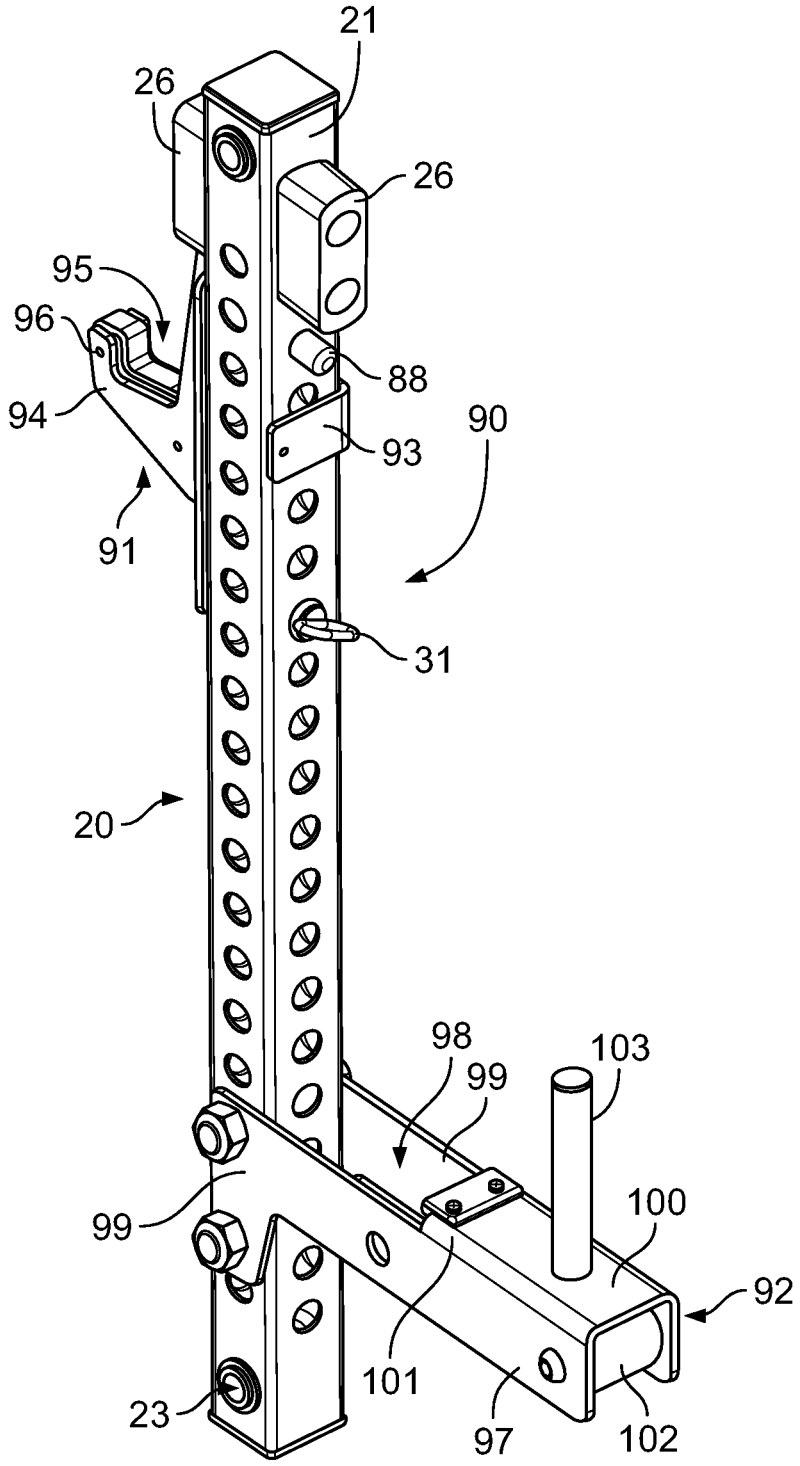
FIG. 24 is a rear perspective view of the articulating arm and the moveable weight holder assembly of FIG. 22.
Figure 25:
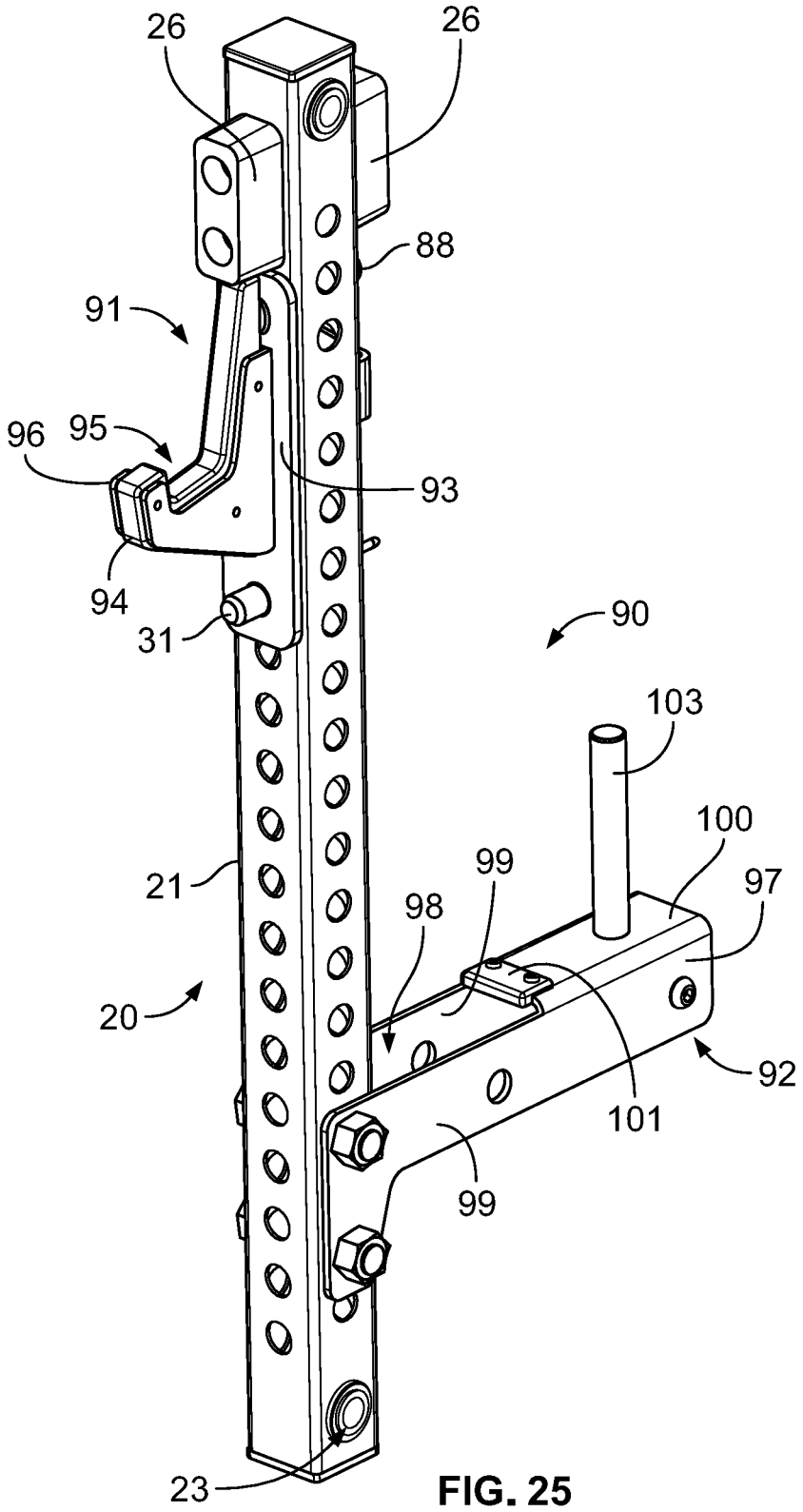
FIG. 25 is a front perspective view of the articulating arm and the moveable weight holder assembly of FIG. 22.
Figure 26:
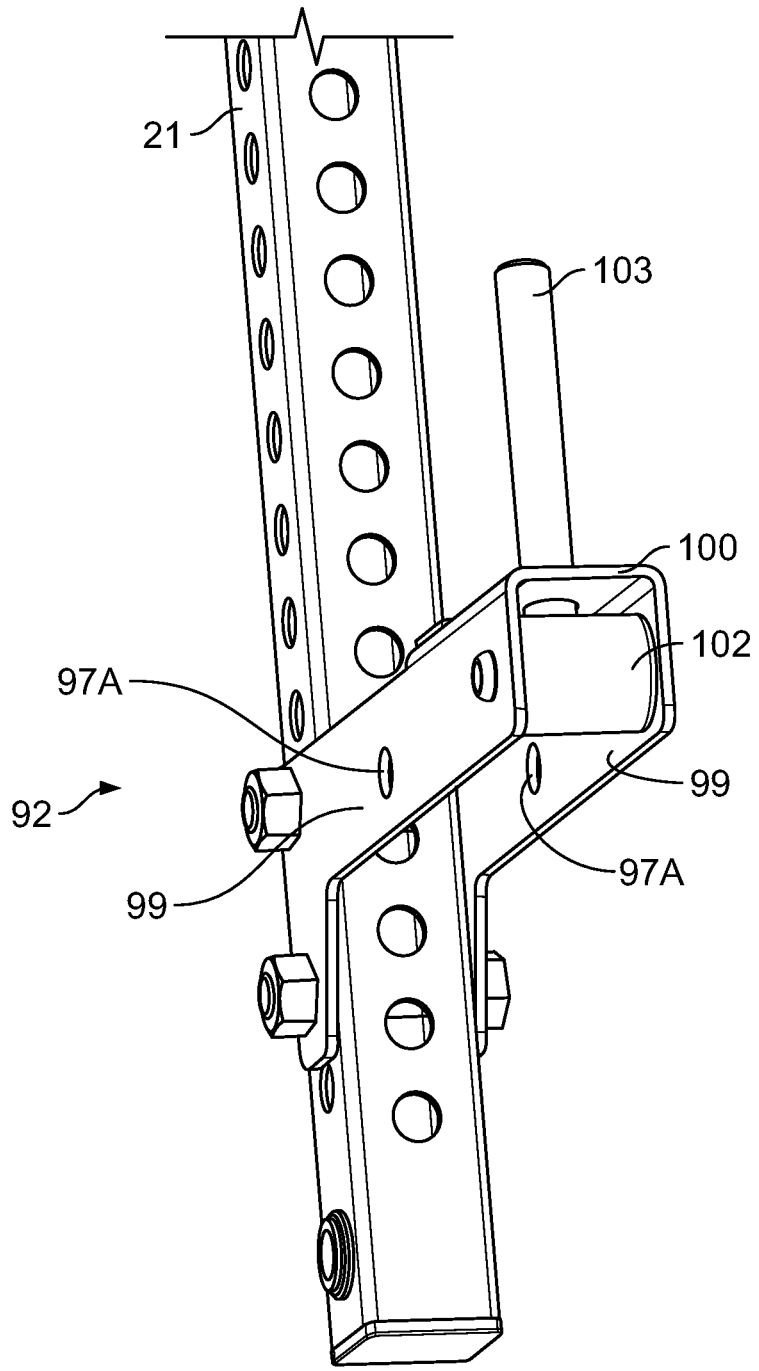
FIG. 26 is a bottom rear perspective view of a portion of the articulating arm and a portion of the moveable weight holder of FIG. 22.
Figure 27:
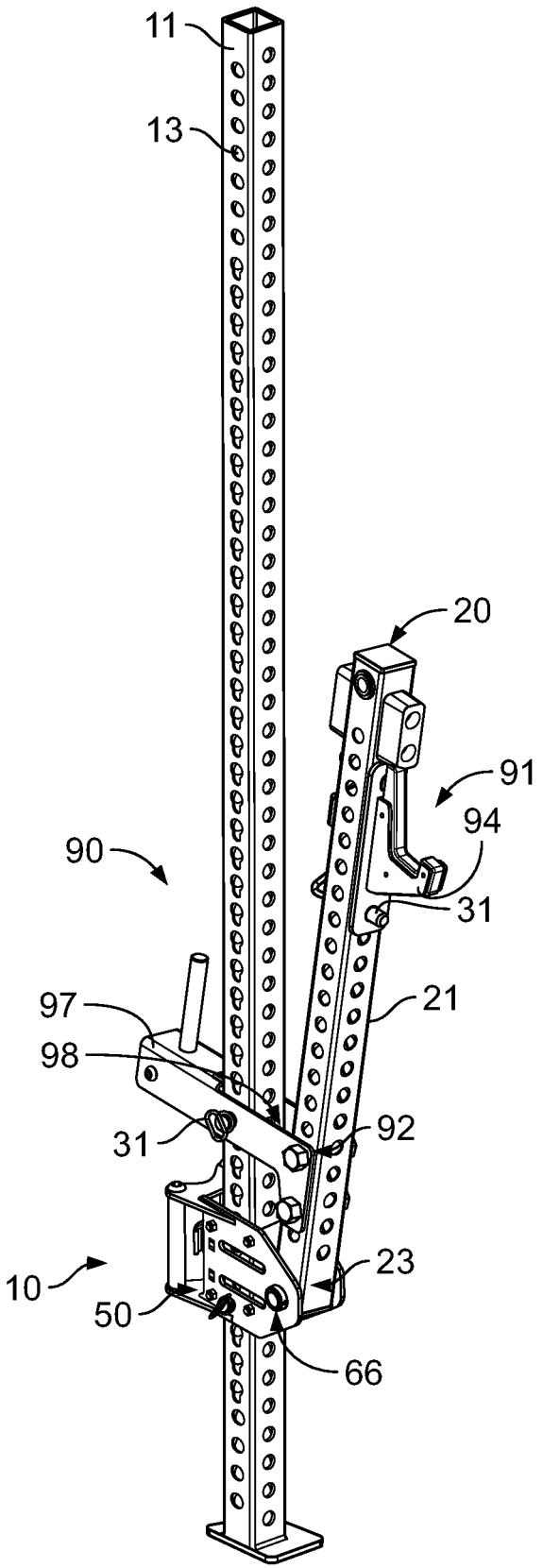
FIG. 27 is a front perspective view of the frame member and weightlifting assembly of FIG. 22, with the articulating arm in a forward position.
Figure 28:
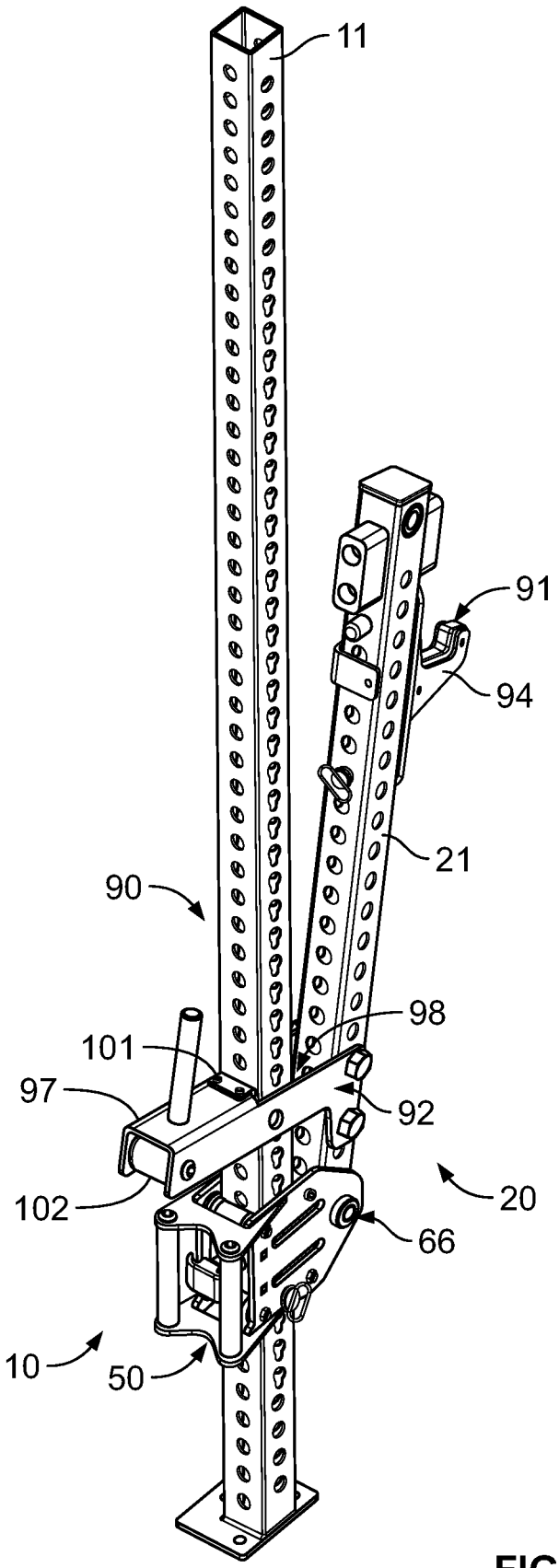
FIG. 28 is a rear perspective view of the frame member and weightlifting assembly of FIG. 27.

The counterweight assembly 92 includes a retaining bracket 97 that is fixedly connected to the arm 21 (e.g., by bolts, pins, or other connecting structures) and has a slot 98 that receives the frame member 11 to which the arm 21 is mounted (e.g., by the carriage assembly 50). The retaining bracket 97 includes two side plates 99 connected to opposite sides of the arm 21 and defining an elongated passage between them to define the slot 98, with a top plate 100 connected to both side plates 99 at one end of the slot 98. The slot 98 is longer than the width of the frame member 11 such that the arm 21 can pivot with a range of motion defined by the length or range of travel of the frame member 11 within the slot 98. A pad or bumper 101 may be located at one or both ends of the slot 98, and the counterweight assembly 92 in FIGS. 22-28 has a pad 101 located at the rear end of the slot 98. In the embodiment of FIGS. 22-28, the range of motion of the arm 21 is defined in the forward/downward direction by the engagement of the frame member 11 with the rear end of the slot 98 (i.e., the pad 101), as shown in FIGS. 27-28, and in the rearward/upward direction by engagement of the arm 21 with the frame member 11 (with the bumper 26 engaging the frame member 11 in this configuration), as shown in FIGS. 22-23.

The counterweight assembly 92 further includes a counterweight 102 that is located on the opposite side of the frame member 11 as the arm 21. The counterweight 102 is configured to bias the arm 21 to pivot rearwardly, i.e., toward the frame member 11, and the retaining bracket 97 may extend a distance rearwardly of the frame member 11 in order to increase the length of the moment arm created by the counterweight 102. It is understood that the counterweight 102 may be positioned at or near the rear end of the retaining bracket 97 for this purpose. The counterweight 102 in FIGS. 22-28 is positioned beneath the top plate 100 and fixedly connected to both side plates 99 at the rear end of the retaining bracket. The retaining bracket 97 may further include a post 103 to serve as a handle for manual pivoting of the arm 21, including to push the arm 21 back forward for assisting a lifter in resting the free weight on the engagement part after exercising. The post 103 may additionally or alternately be configured for exertion of additional counterweighting force, such as stacking of additional weights, connection of resistance bands, etc. The post 103 is connected to the top plate 100 and extends upward from the top plate 100 in FIGS. 22-28. The retaining bracket 97 also includes holes 97A configured to receive a removable pin 31 (see FIGS. 26-27) or other connecting member extending through the holes 13 in the frame member 11 to fix the weight supporting assembly 90 in position with respect to the frame member 11, thereby creating a fixed weight supporting assembly 90.

In another embodiment, the counterweight assembly 92 may be fixedly connected to the frame member 11 and the arm 21 may travel within the slot 98 during pivoting. In this embodiment, the counterweight assembly 92 would still be configured to locate the counterweight 102 on the opposite side of the frame member 11 as the arm 21. Thus, in a broader sense, the counterweight assembly 92 in one embodiment includes a retaining bracket 97 that is fixedly connected to one of the arm 21 and the frame member 11 and has a slot 98 receiving the other of the arm 21 and the frame member 11 such that the other of the arm 21 and the frame member 11 travels within the slot 98 during pivoting of the arm 21 with respect to the frame member 11, and having a counterweight 102 connected to the retaining bracket 97 on the opposite side of the frame member 11 as the arm 21.

The weight support 91 in FIGS. 22-28 functions to hold a free weight at a stationary, elevated position above the ground for use in a weightlifting exercise, and to pivot rearwardly away from the user when the user lifts the free weight from the weight support 91. In this embodiment, the mass of the free weight resting on the engagement part 94 exerts a moment arm on the arm 21 to cause the arm 21 to pivot to the forward position, i.e., away from the frame member 11. When the free weight is lifted from the engagement part 94, the moment arm exerted by the counterweight 102 causes the arm 21 to pivot rearwardly, i.e., toward the frame member 11, to move the arm 21 and the weight support 91 away from the user to avoid interference in a weightlifting exercise. During this pivoting, the frame member 11 travels within the slot 98 in the embodiment of FIGS. 22-28. The free weight can then be replaced on the engagement part 94 to support the free weight in the elevated position again, which will result in the arm 21 pivoting forwardly again. An assisting user may push the arm 21 to the forward position prior to resting the free weight on the engagement part 94, e.g., by exerting force on the post 103. It is understood that a free weight such as a barbell may use two weight supporting assemblies 90 positioned on two arms 21 spaced from each other and connected to carriage assemblies 50 on two frame members 11 spaced from each other, such that the user may stand between the arms 21, e.g., for a squat lift.

Figure 29:
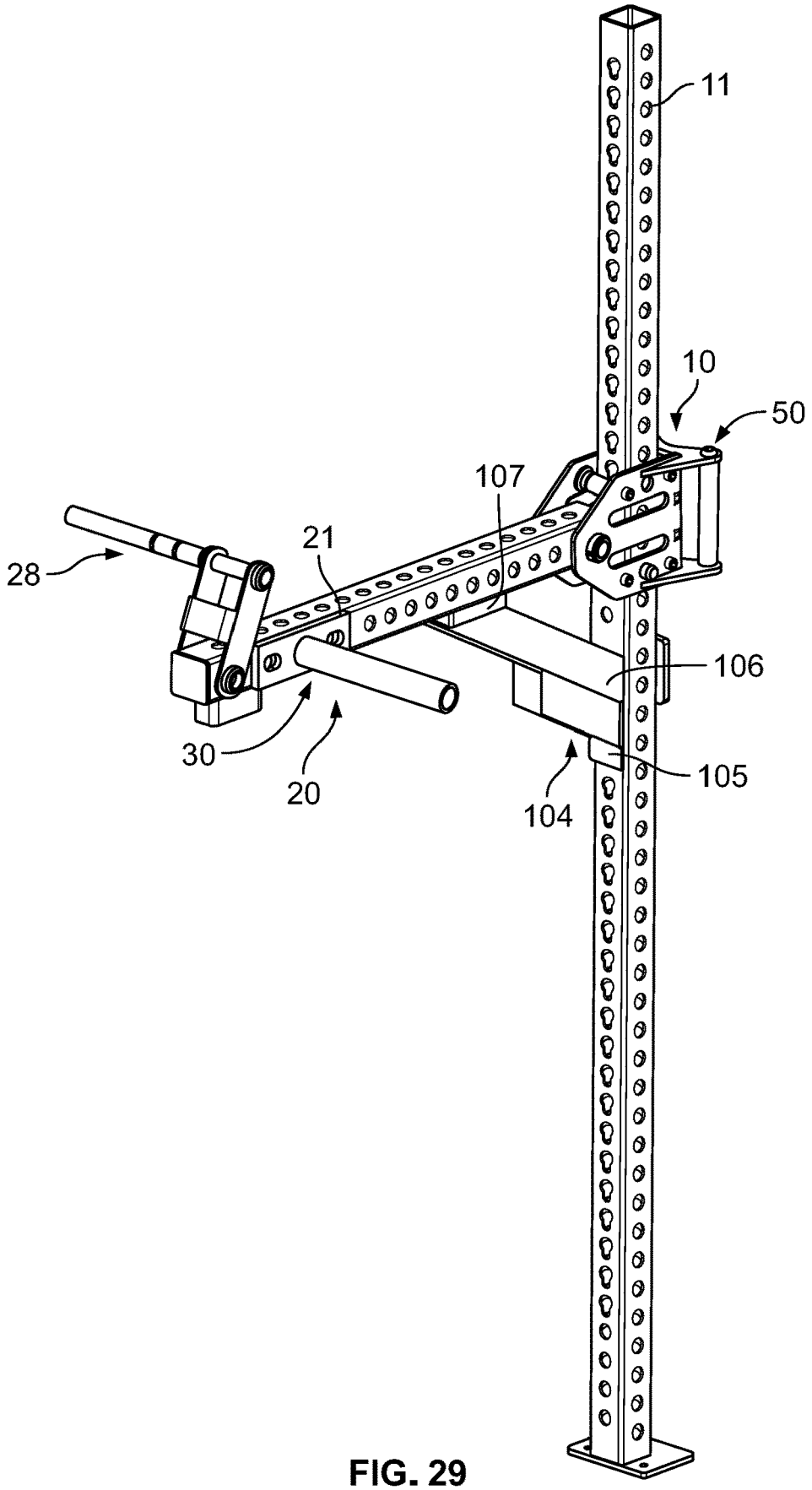
FIG. 29 is a front perspective view of one of the frame members and one of the weightlifting assemblies FIG. 1, with the weightlifting assembly having another embodiment of a carriage assembly, and with one embodiment of a support connected to the frame member, according to aspects of the disclosure.
Figure 31:
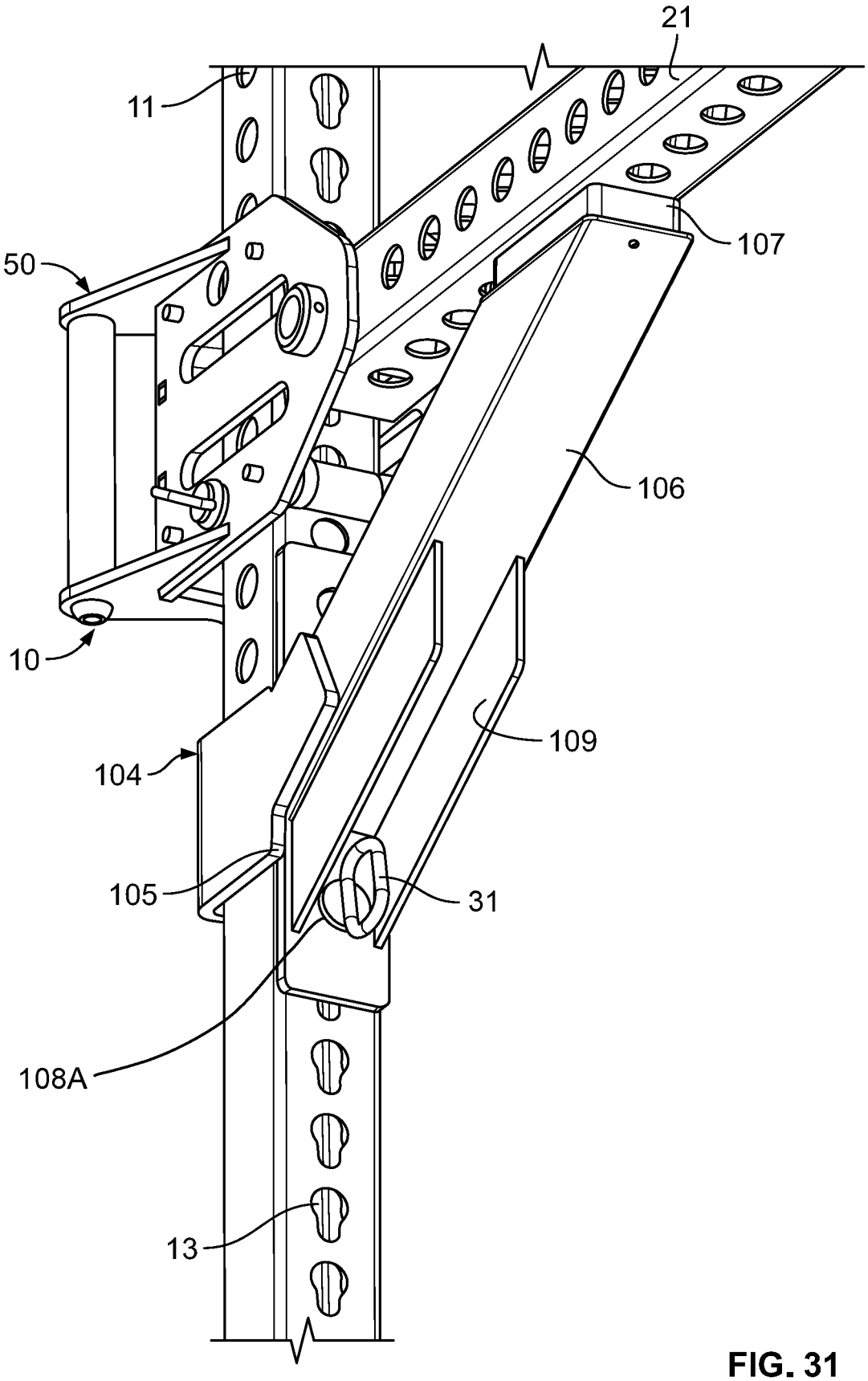
FIG. 31 is a bottom front perspective view of the portion of the frame member, the support, and the portion of the weightlifting assembly of FIG. 30.

FIGS. 29-31 depict one embodiment of a support 104 for connection to a frame member 11 as shown and described herein, which may be advantageously used in connection with a pivoting or articulating arm 21 as shown and described herein. The support 104 is depicted for use with an arm 21 connected to a carriage assembly 50 according to aspects shown and described herein, although it is understood that the support 104 may be used in connection with an articulating arm 21 that is connected and supported by a different structure, such as a differently-configured carriage assembly or a fixed articulating support. Additionally, the arm 21 in FIGS. 29-31 is outfitted with a handle assembly 28 and a weight holder 30 as shown in FIGS. 14-16, but it is understood that the arm 21 may be outfitted with one or more different accessories, such as the adjustable handle assembly 40 of FIGS. 17-21. The support 104 is configured to support the arm 21 in an extended position, e.g., at approximately 90° to the frame member 11 and/or parallel to the ground as in FIGS. 29-31, at an elevated position above the ground. This configuration may be particularly advantageous for exercises with vertical lifting motions, such as a bench press, overhead lift, squat, rack pull, etc. The elevations of the support 104 and the carriage assembly 50 may be adjusted for various desired exercises.

The support 104 in the embodiment of FIGS. 29-31 includes a mounting bracket 105 connected to the frame member 11, a support beam 106 connected to the mounting bracket 105 and extending outward from the mounting bracket 105, and a support surface 107 supported by the support beam 106 and configured for supporting the arm 21. The mounting bracket 105 may be fixedly connected to the frame member 11 by one or more pegs or pins, or another connecting structure such as bolts, in one embodiment. The mounting bracket 105 in FIGS. 29-31 extends around three surfaces 15 of the frame member 11, and is fixed to the frame member 11 by at least a fixed peg 108 connected to the inner surface of the mounting bracket 105. In this configuration, the mounting bracket 105 may be considered to have a J-cup configuration. The mounting bracket 105 further includes a hole 108A that may be used for a removable pin 31 or other connecting structure, such as a bolt, which may be inserted after the fixed peg 108 is in the proper position. In another embodiment, the fixed peg 108 may be replaced by a peg that is not fixedly connected to the mounting bracket 105, such as a removable pin or a pin that is not removable but not fixedly connected to the mounting structure.

The support beam 106 is fixedly connected to the mounting bracket 105 at a proximal end and has the support surface 107 at a distal end. The support beam 106 of FIGS. 29-31 is connected to the mounting bracket 105 and extends outward from the mounting bracket 105 in order to space the support surface 107 from the frame member 11, and further angles upward to avoid excessive cantilever bending force on the support beam 106, forming an oblique angle A of the support beam 106 with the vertical frame member 11. The angle A in FIGS. 29-31 is 60° or about 60° (+/−5°), and in one embodiment, the angle A may be between 30° and 75°, or between 45° and 70°. The support 104 may also have one or more additional support structures to add further strength and rigidity to the support beam 106. In the embodiment of FIGS. 29-31, the support 104 has two support flanges 109 connected to the underside of the support beam 106 and the mounting bracket 105 and extending along a portion of the length of the support beam 106 for this purpose. The support surface 107 in FIGS. 29-31 is in the form of a pad or bumper at the distal end of the support beam 106 that engages the bottom surface of the arm 21, but may be provided by other structures in other embodiments. For example, in one embodiment, the end of the support beam 106 itself may provide the support surface 107. The support 104 in FIGS. 29-31 provides a stable and reliable structure for using the weightlifting assembly 10 with articulating arms 21 in an elevated position, as shown in FIG. 29, which is easy to mount on a frame member 11 of a weight rack 12. In this configuration, the arms 21 with the support 104 may be particularly useful for performing rack pull lifts while maintaining proper form without damaging the components of the weight rack 12 or weightlifting assembly 10.

Figure 35:
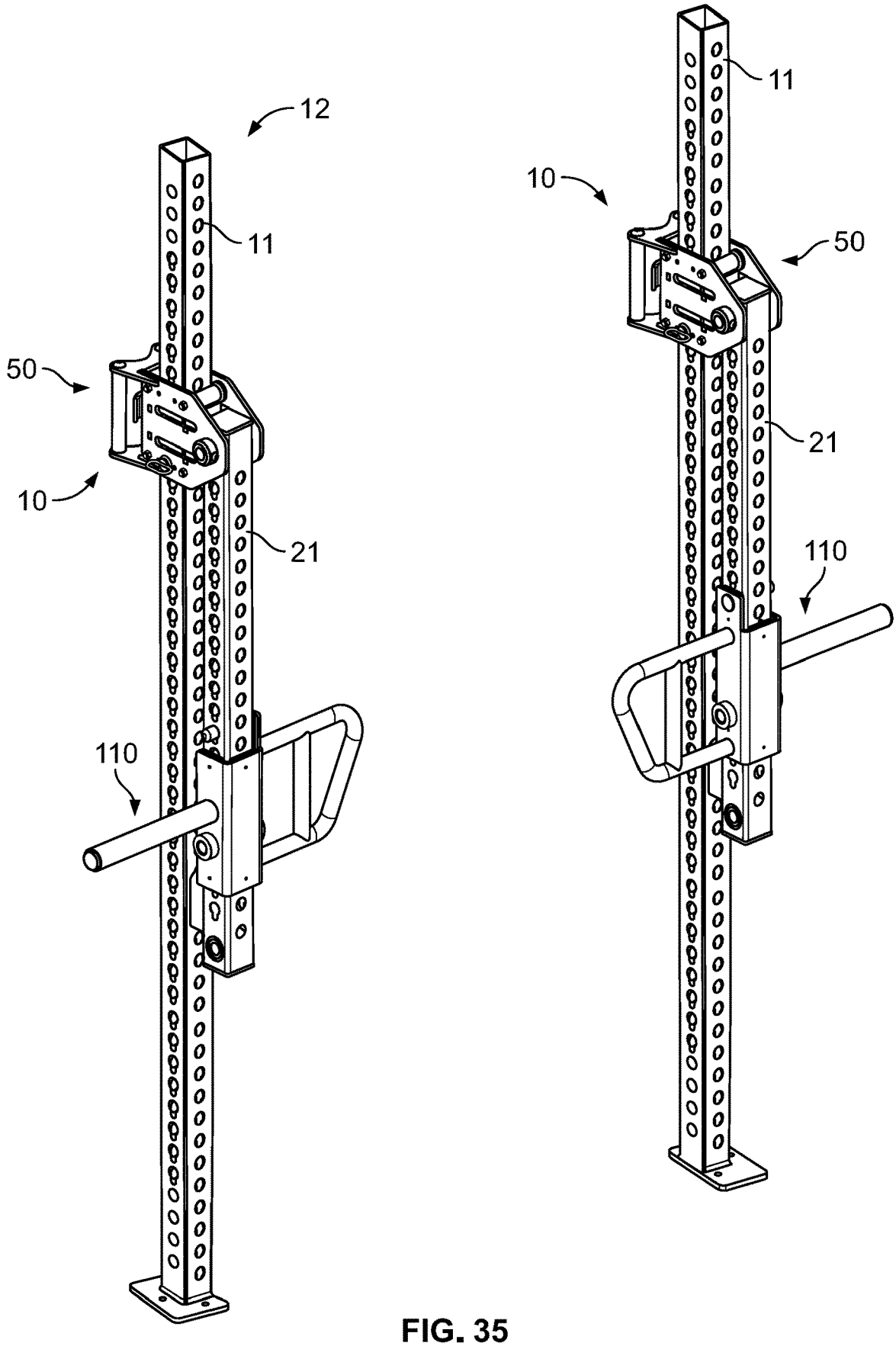
FIG. 35 is a front perspective view of a weight rack and two weightlifting assemblies of FIG. 1 with another embodiment of an accessory connected to each articulating arm in the form of an adjustable handle assembly, with the carriage assembly of each weightlifting assembly in an elevated position, according to aspects of the disclosure.
Figure 36:
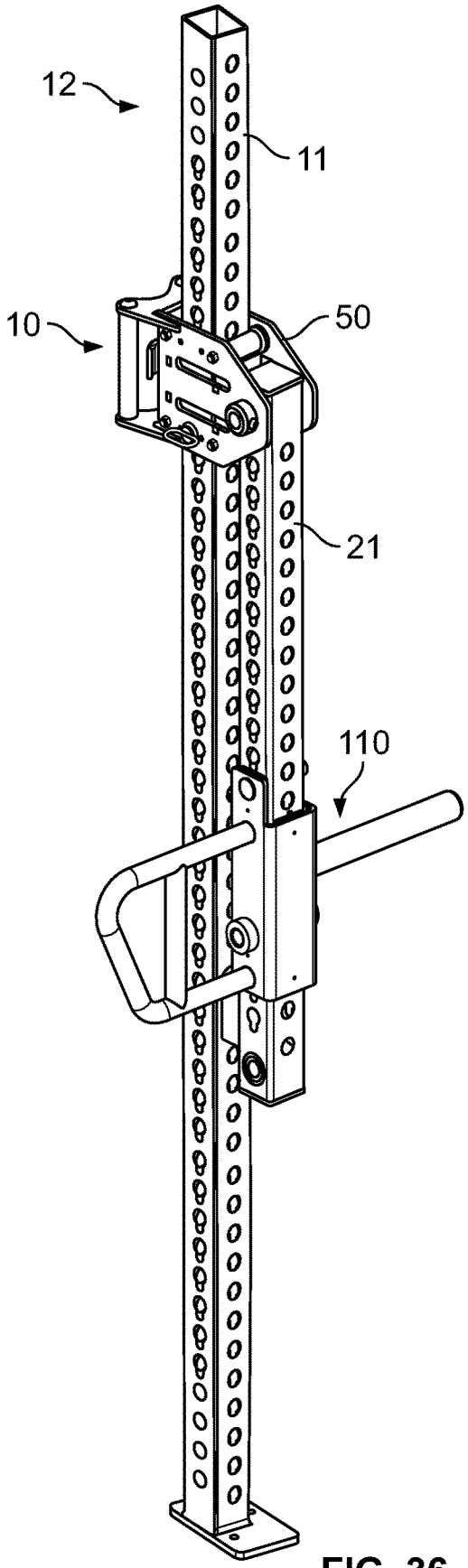
FIG. 36 is a front perspective view of a portion of the weight rack of FIG. 1, with one of the weightlifting assemblies and the corresponding articulating arm and adjustable handle assembly connected thereto.
Figure 37:
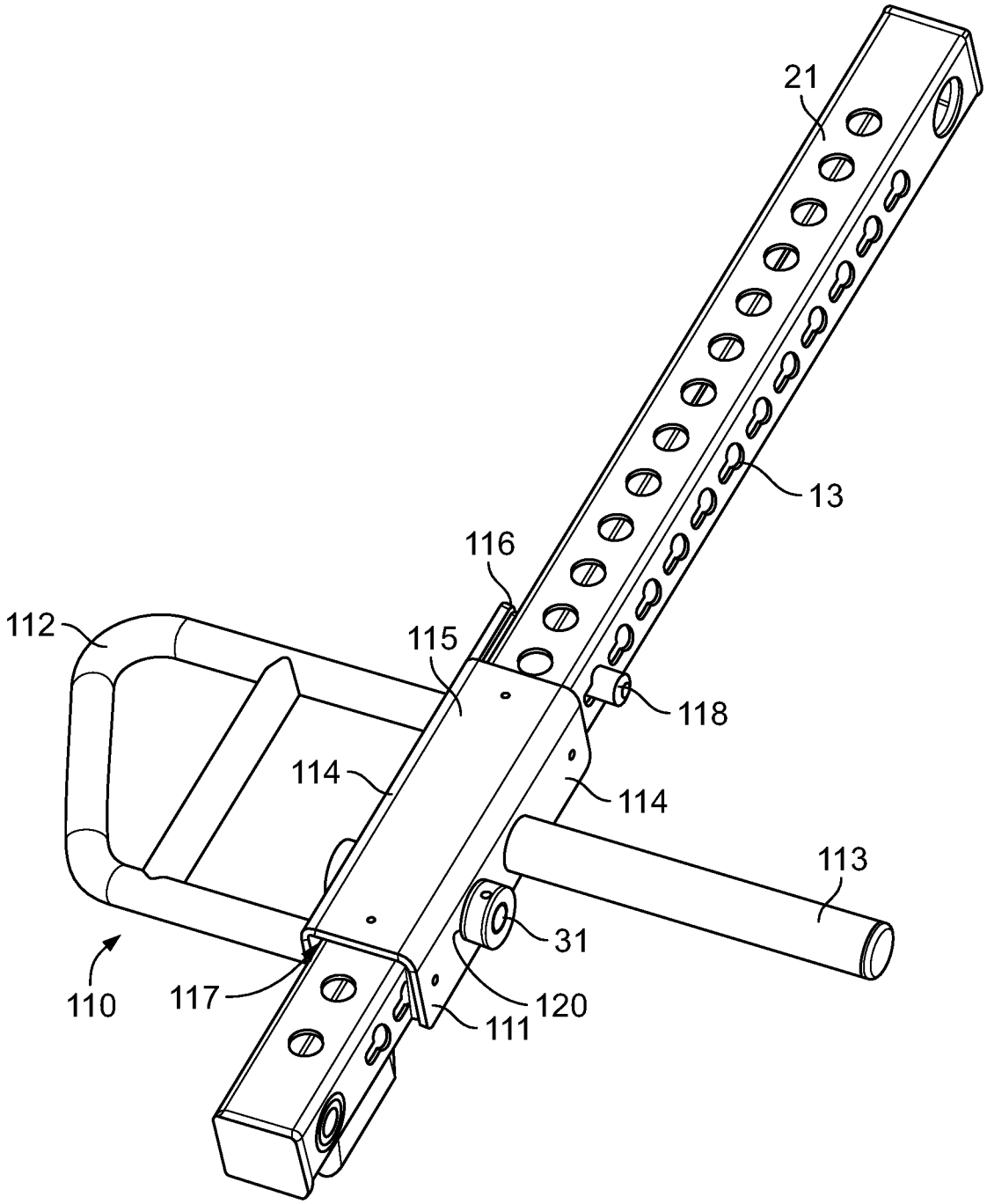
FIG. 37 is a front perspective view of one of the arms of FIG. 1 and the adjustable handle assembly connected to the arm.
Figure 38:
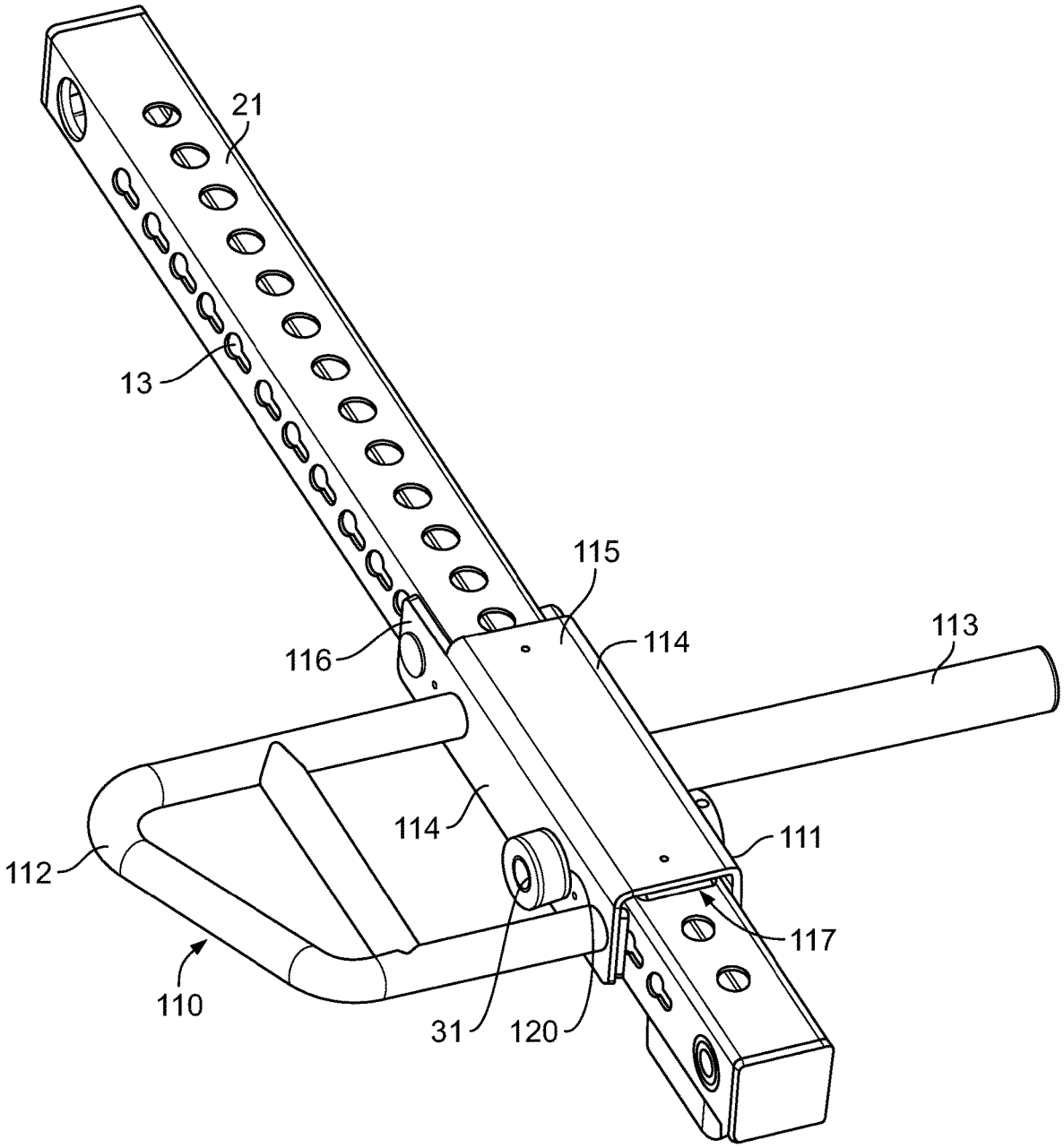
FIG. 38 is a front perspective view of the arm and the adjustable handle assembly of FIG. 37.
Figure 39:
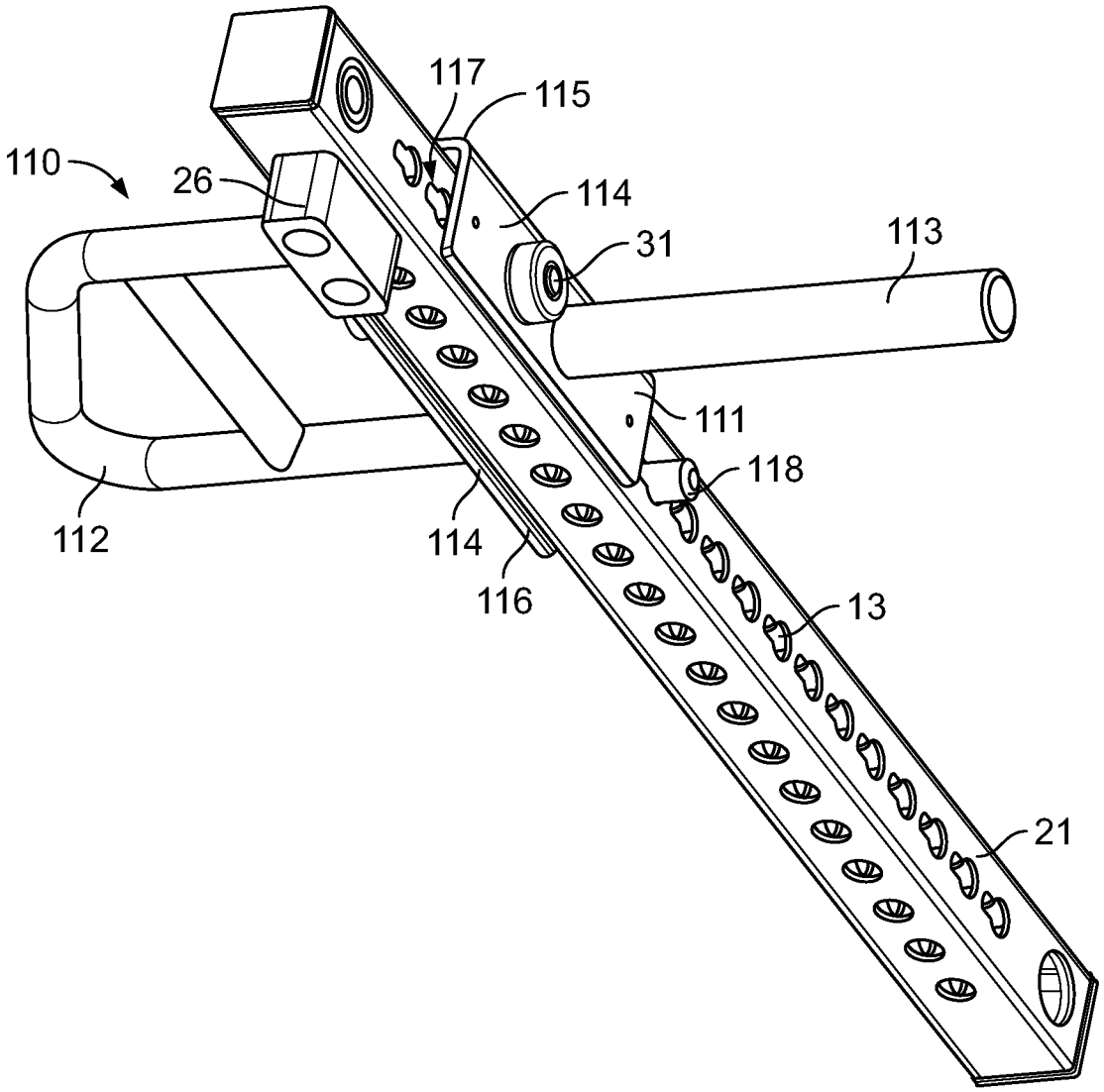
FIG. 39 is a bottom front perspective view of the arm and the adjustable handle assembly of FIG. 37.
Figure 40:
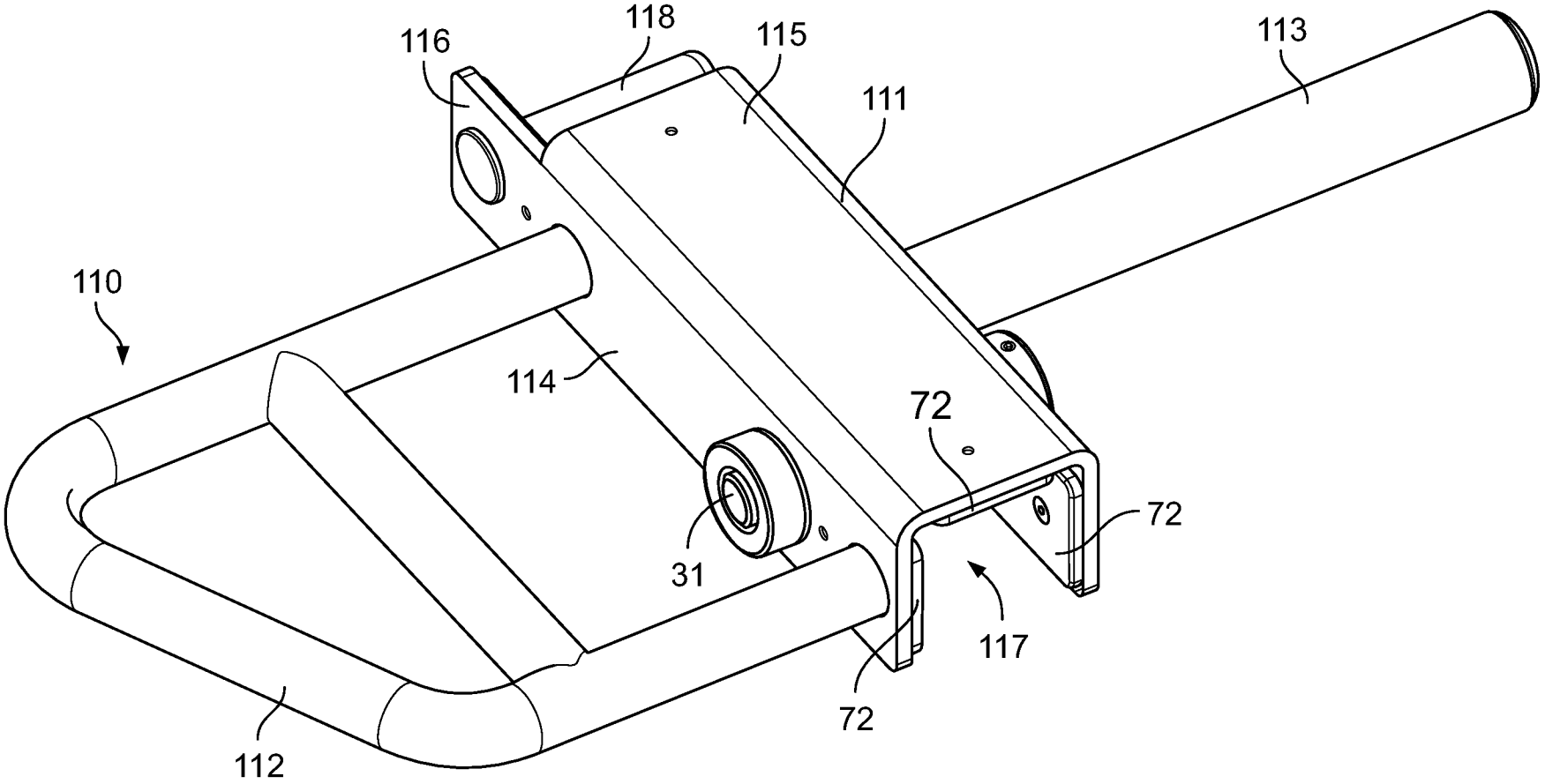
FIG. 40 is a front perspective view of the adjustable handle assembly of FIG. 37.
Figure 41:
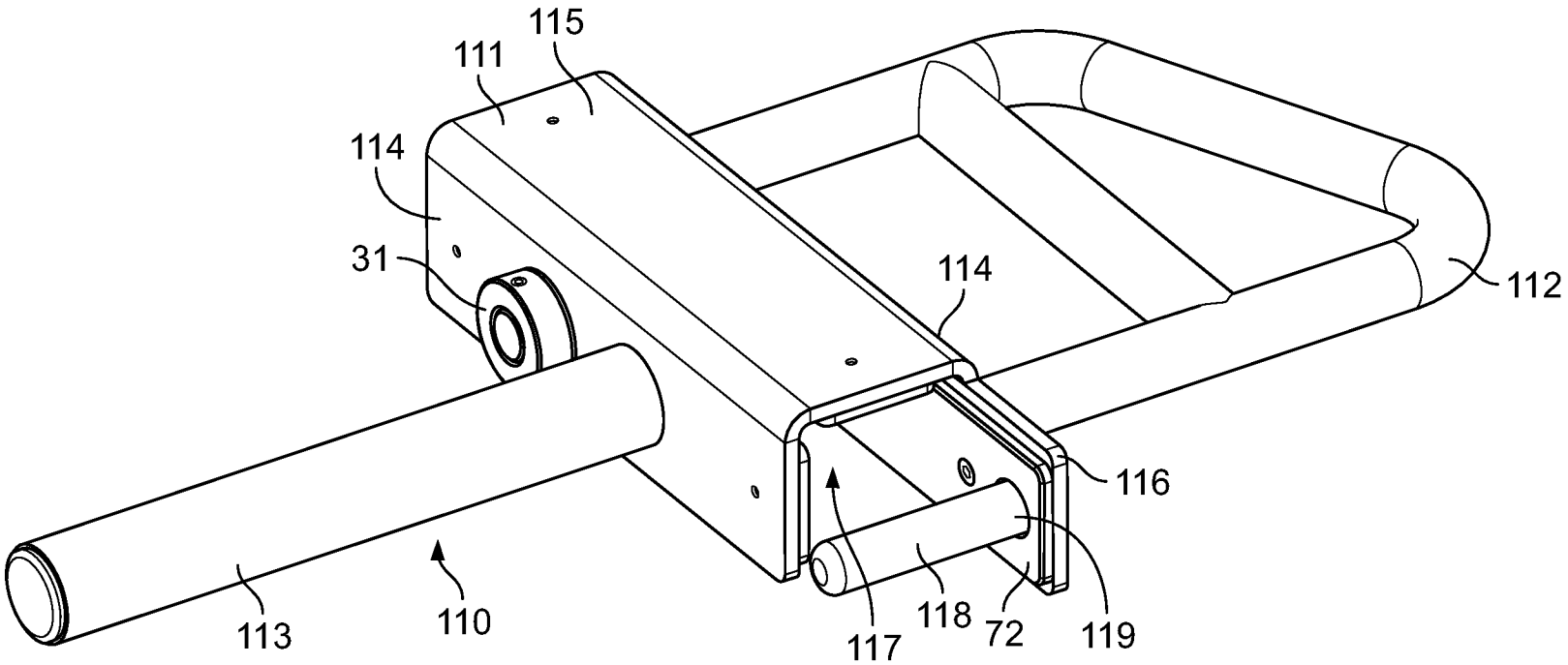
FIG. 41 is a rear perspective view of the adjustable handle assembly of FIG. 37.
Figure 42:
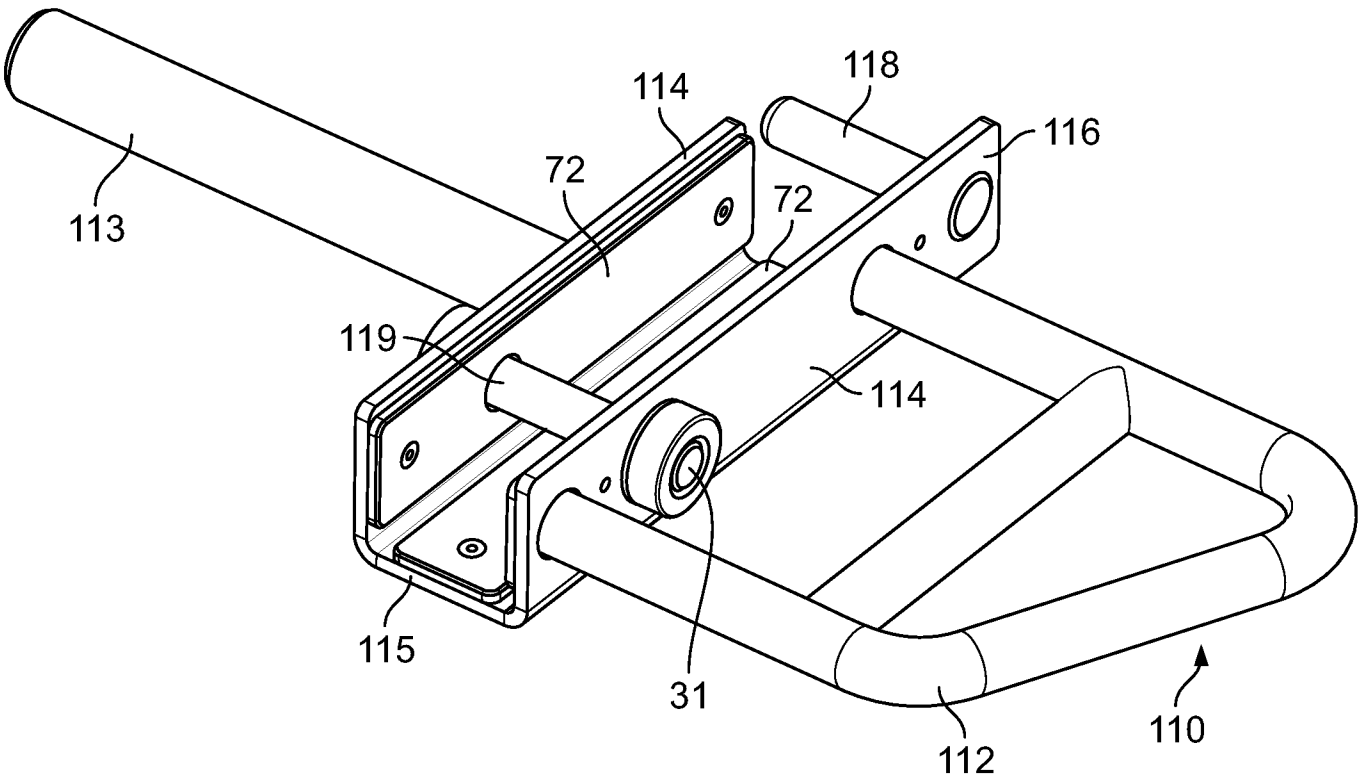
FIG. 42 is a bottom front perspective view of the adjustable handle assembly of FIG. 37.
Figure 43:
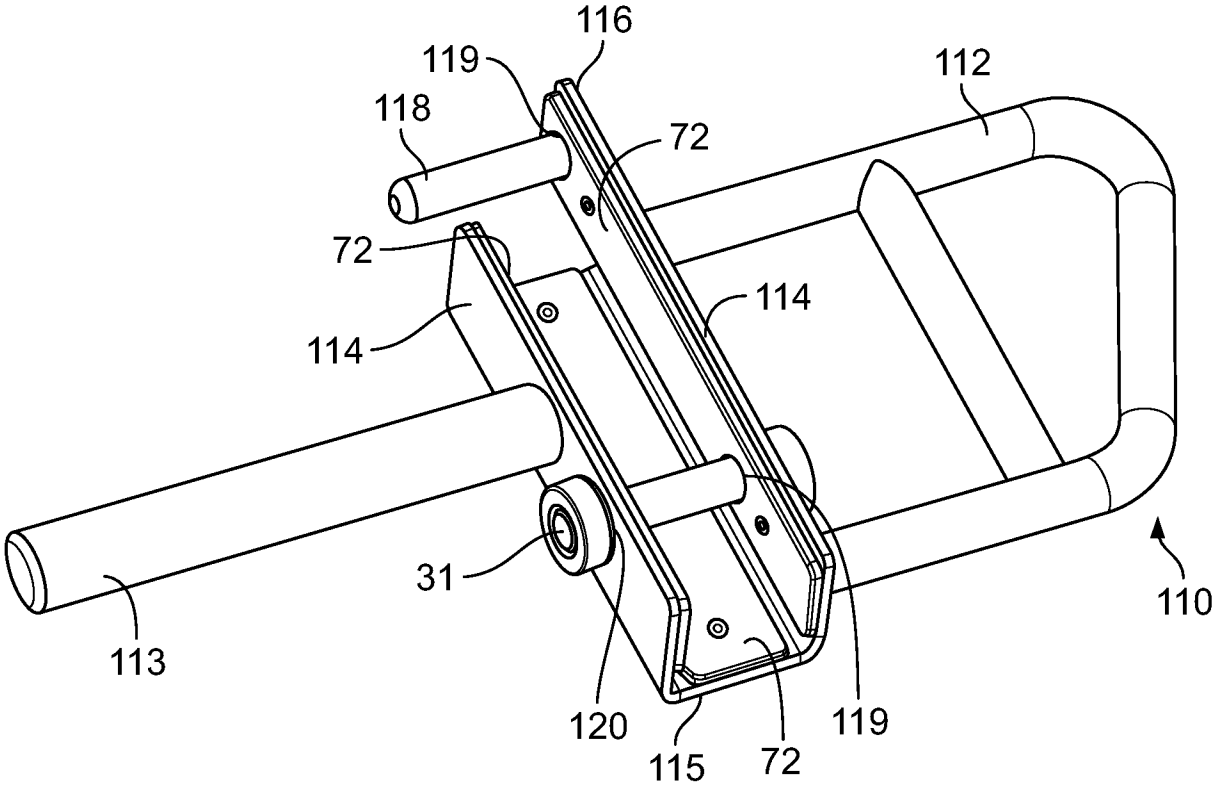
FIG. 43 is a bottom front perspective view of the adjustable handle assembly of FIG. 37.

The arm 21 in FIGS. 35-43 has an accessory in the form of another embodiment of an adjustable handle assembly 110 configured for various weightlifting exercises. The handle assembly 110 includes a mounting body 111 in the form of a moveable carriage assembly or carriage configured for connection to the arm 21, a gripping handle 112 connected to the mounting body 111 for gripping by a user, and a weight holder 113 connected to the mounting body 111 for holding one or more weights, e.g., in the form of weight plates. The gripping handle 112 and the weight holder 113 are connected to, and extend outward from, opposite sides of the mounting body 111, and these components may be connected by welding or other integral joining technique in one embodiment. In the embodiment of FIGS. 35-43, the gripping handle 112 and the weight holder 113 are connected to the mounting body 111 by welding, and may have end portions received in receivers on the mounting body 111. The gripping handle 112 in this embodiment is similar to the gripping handle 42 of FIGS. 17-21 and has multiple gripping portions oriented at multiple orientations in order to provide different grip configurations for different types of weightlifting exercises. As shown in FIG. 35, the assembly 110 may be provided in left-hand or right-hand configurations that are mirror images of each other.

The mounting body 111 has a C-shaped or U-shaped configuration including two side walls 114 that are parallel and spaced from each other and a transverse wall 115 connected to the two side walls 114 and extending between the two side walls 114. The mounting body 111 in FIGS. 35-43 does not include any rollers as in the embodiment of FIGS. 17-21, but the mounting body 111 may be modified to include a roller assembly in another embodiment. The side walls 114 define the lateral sides of a passage 117 through the mounting body 111, with the transverse wall 115 defining a third side of the passage 117, with the fourth side of the passage 117 being open. The mounting body 111 may further include an extension or projection 116 extending from the front or rear along the length of the passage 117, with a fixed peg 118 or other connector positioned on the extension 116 for connection to the arm 21. In the embodiment of FIGS. 35-43, the extension 116 is contiguous with one of the side walls 114 and is formed as an extended portion of the side wall 114 that extends axially (along the length of the passage 117) past the ends of the other side wall 114 and the transverse wall 115. The mounting body 111 further is configured to receive a removable pin 31 therethrough and may have one or more openings 120 to receive the pin 31. The mounting body 111 in FIGS. 35-43 has openings 120 in both side walls 114 to receive the pin 31 therethrough, and the pin 31 may be configured to extend through the holes 13 in the frame member 11 to further secure the handle assembly 21 in position. The pin 31 may be configured according to any embodiment described herein, and the pin 31 may have a locking structure, such as a cotter key, an end cap, or other mechanism for retaining the pin 31 within the openings 120 and the holes 13. In one embodiment, the pin 31 may be configured according to one of the embodiments of a connection pin assembly described in U.S. Provisional Application No. 62/747,953, filed Oct. 19, 2018, which is incorporated by reference herein. In other embodiments, a different releasable locking or connecting structure may be used, including other structures described herein, e.g., a detent pin, a spring pin, or other connecting structure.

The mounting body 111 may further have spacers 72 connected to the inner surfaces of one or more of the side walls 114 and the transverse wall 115, as similarly discussed herein with respect to the carriage assembly 50. The mounting body 111 in FIGS. 35-43 include spacers 72 connected to the inner surfaces of both of the side walls 114 and the transverse wall 115 to border the passage 117 on three sides. The spacers 72 in this embodiment cover substantially the entire inner surfaces of the side walls 114 and the transverse wall 115 and have rectangular shapes to correspond to the rectangular shapes of the side walls 114 and the transverse wall 115. The spacer 72 connected to the side wall 114 having the extension 116 has a greater length than the spacers 72 connected to the other side wall 114 and the transverse wall 115, such that the extension 116 is also at least partially, or substantially entirely, covered by the spacer 72. This spacer continuously is connected to and/or covers the extension 116 and the corresponding side wall 114, but in other embodiments, the extension 116 may have a separate spacer 72 connected thereto. The spacers 72 in this configuration have openings 119 that are aligned with the openings 120 of the mounting body 111 for receiving the pin 31 therethrough, as well as an opening 119 to receive the fixed peg 118 therethrough.

The side walls 114 and the transverse wall 115 may be formed of a single piece of material (e.g., metal plate) that is formed or bent to form the mounting body 111 in one embodiment, or the side walls 114 and the transverse wall 115 may be formed of two or more separate pieces connected together in another embodiment. Such pieces may be connected by welding or other integral joining techniques, e.g., welding the edges of the transverse wall 115 to one or both of the side walls 114, in one embodiment, but other connection techniques may be used.

The adjustable handle assembly 110 in FIGS. 35-43 is mounted on the arm 21 (or another structure) by inserting the fixed peg 118 into the holes 13 and through the arm 21 at a desired position, and then pivoting the mounting body 111 about the fixed peg 118 until the arm 21 is received within the passage 117. The pin 31 is then inserted through the openings 119, 120 of the spacers 72 and the mounting body 111 and through other holes 13 of the arm 21 to fix the adjustable handle assembly 110 in position relative to the arm 21. If the user desires to move the adjustable handle assembly 110, the pin 31 is removed, the mounting body 111 is pivoted to permit removal of the fixed peg 118 from the holes 13, and the assembly 110 is relocated and re-mounted.

Figure 44:
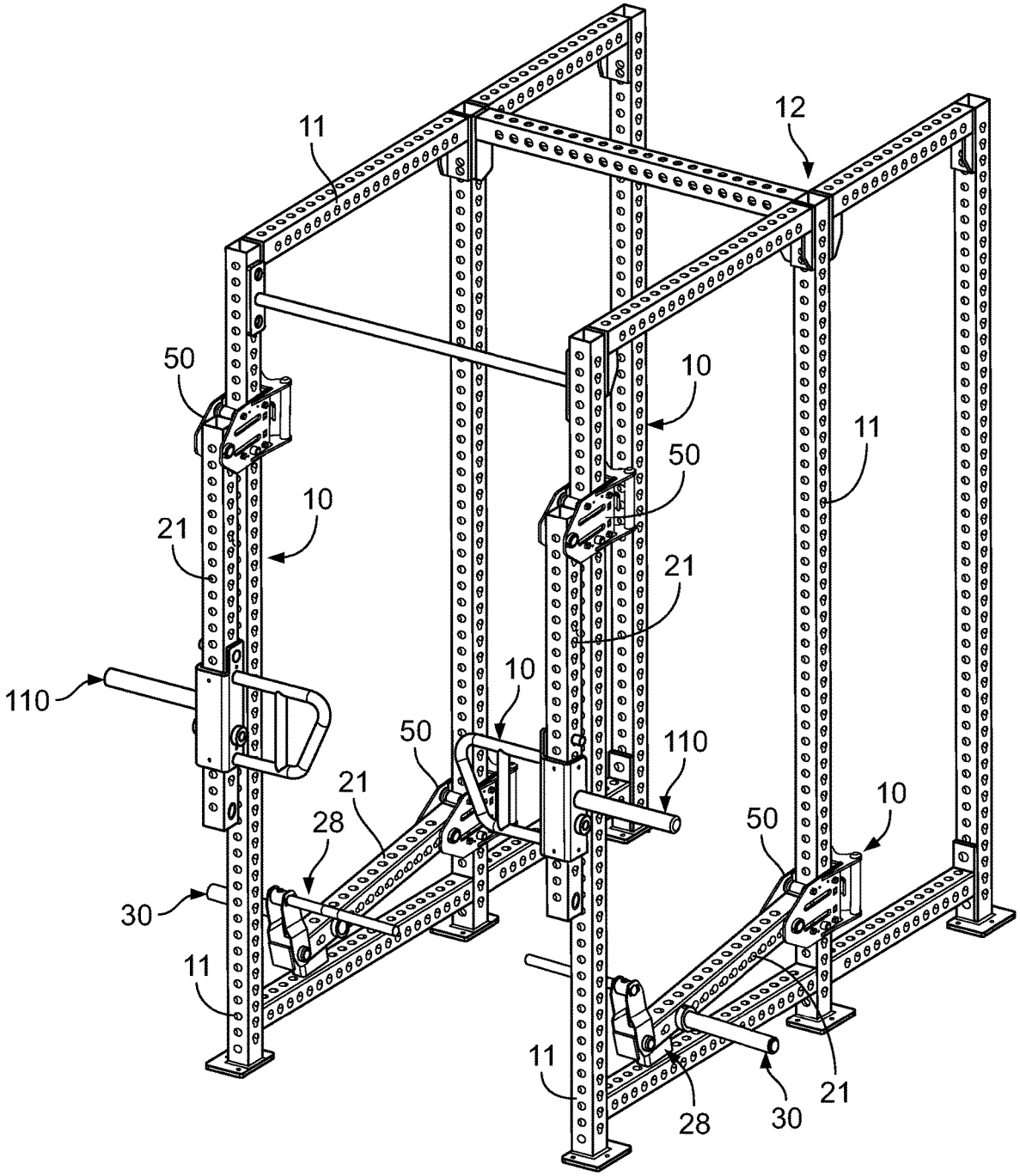
FIG. 44 is a rear perspective view of a weight rack and four weightlifting assemblies of FIG. 1 with the accessories of FIGS. 12-14 connected to two of the articulating arms and the accessories of FIGS. 35-43 connected to the other two articulating arms, according to aspects of the disclosure.
Figure 45:
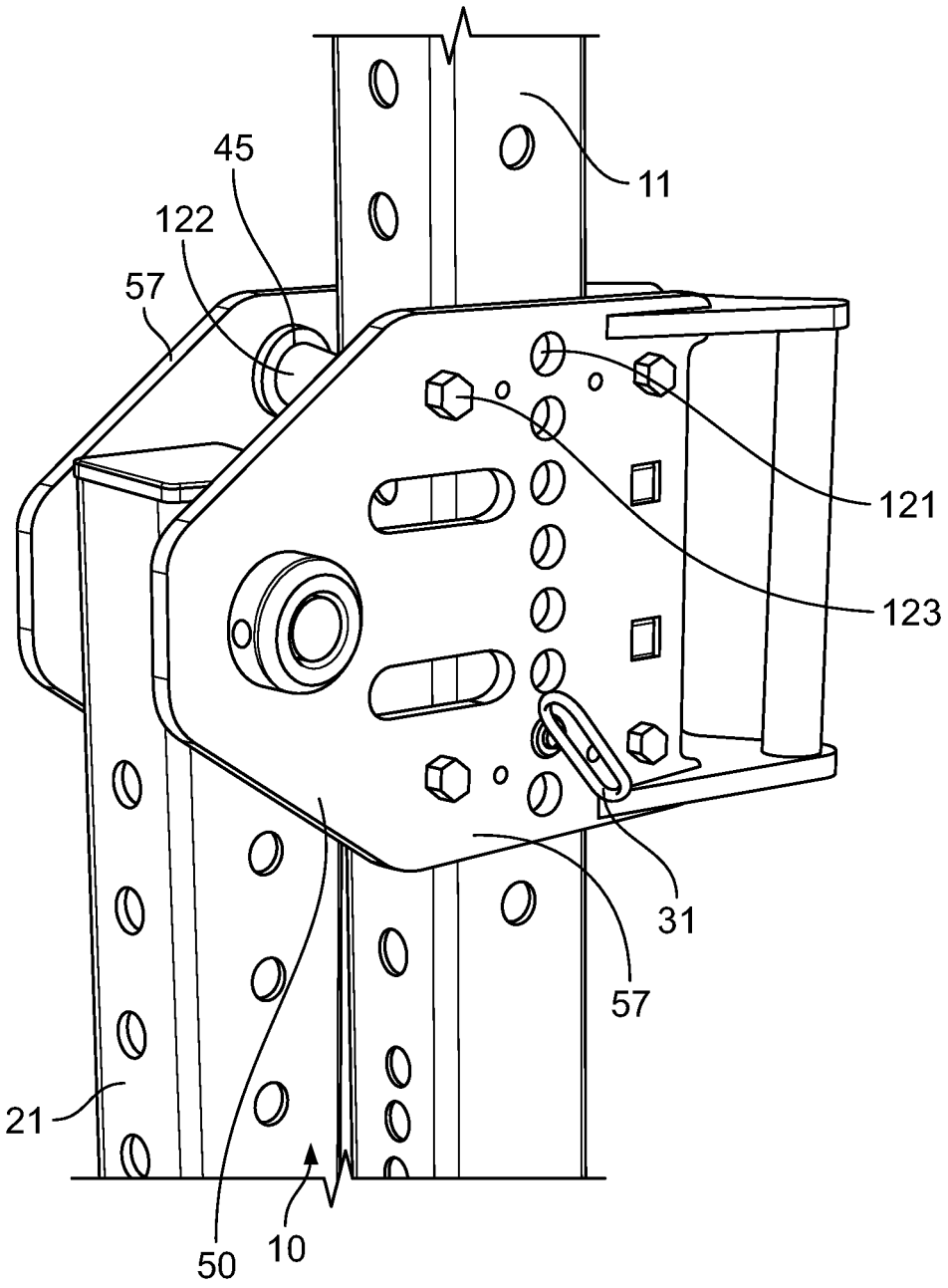
FIG. 45 is a front perspective view of another embodiment of a weightlifting assembly connected to a portion of a frame member of a weight rack according to aspects of the disclosure.
Figure 46:
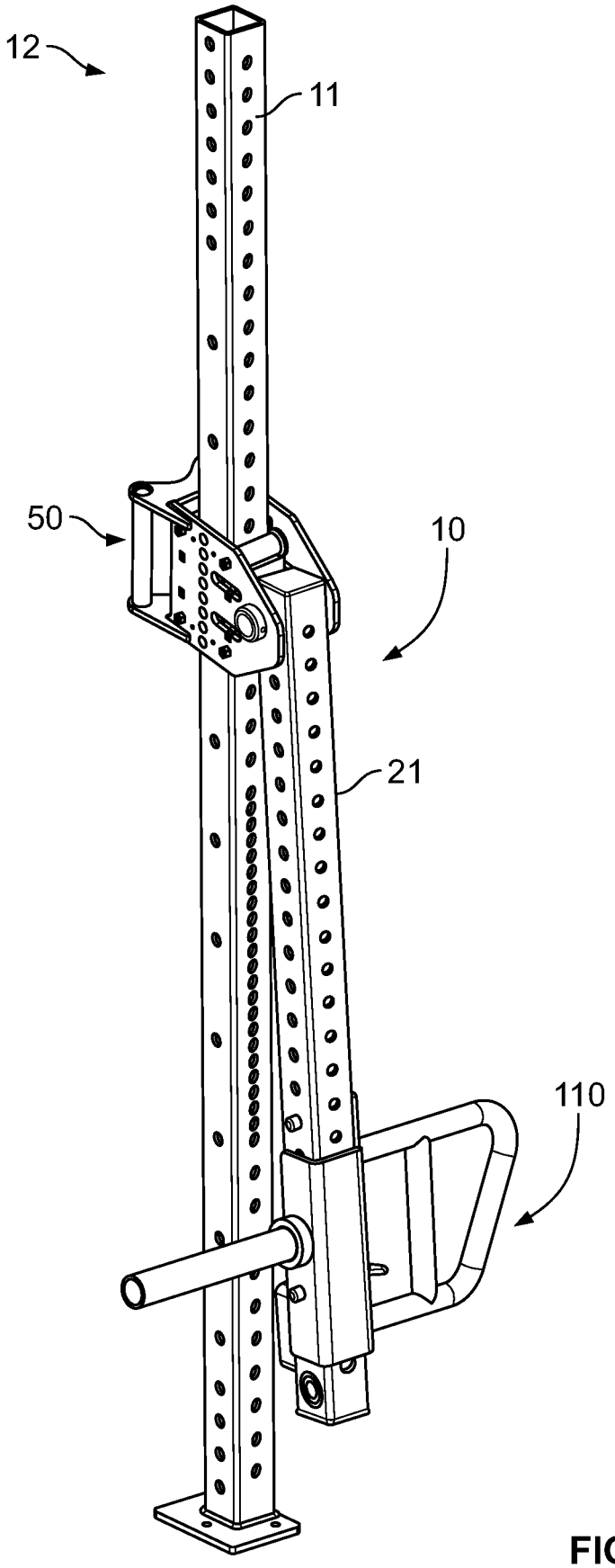
FIG. 46 is a front perspective view of the weightlifting assembly and the frame member of FIG. 45.
Figure 47:
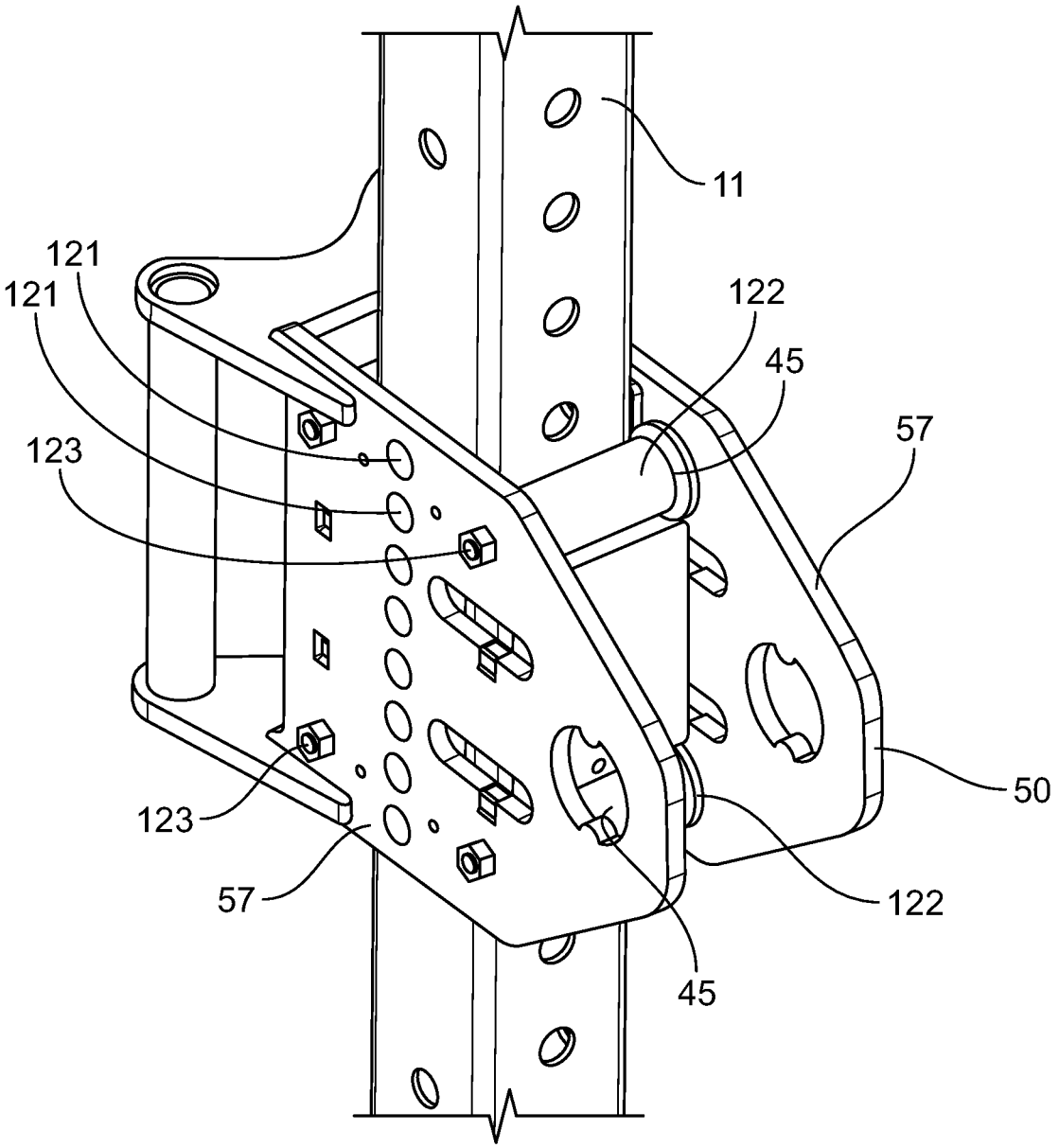
FIG. 47 is a front perspective view of a carriage assembly of the weightlifting assembly and a portion of the frame member of FIG. 45.
Figure 48:
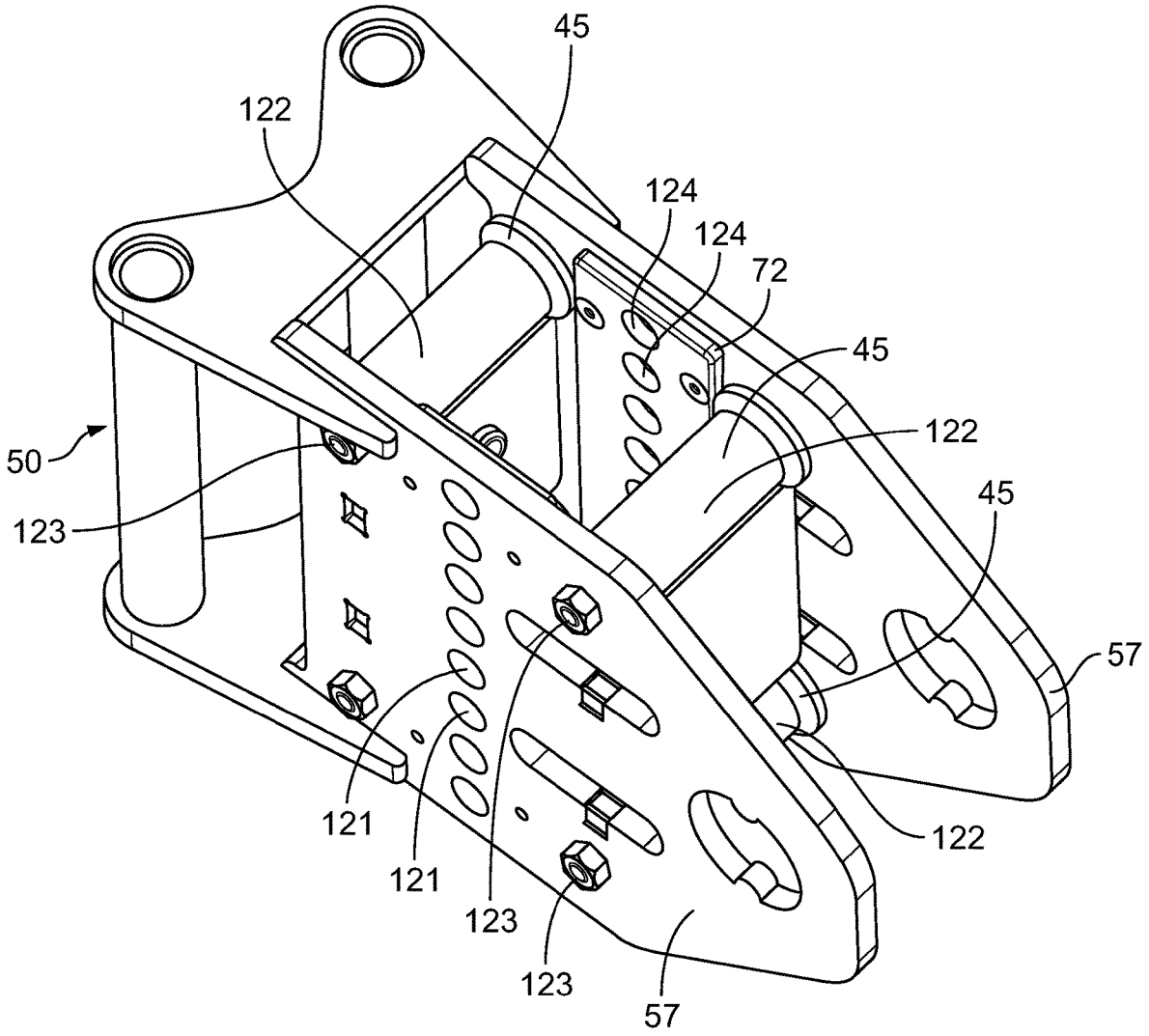
FIG. 48 is a front perspective view of the carriage assembly of FIG. 47.
Figure 49:
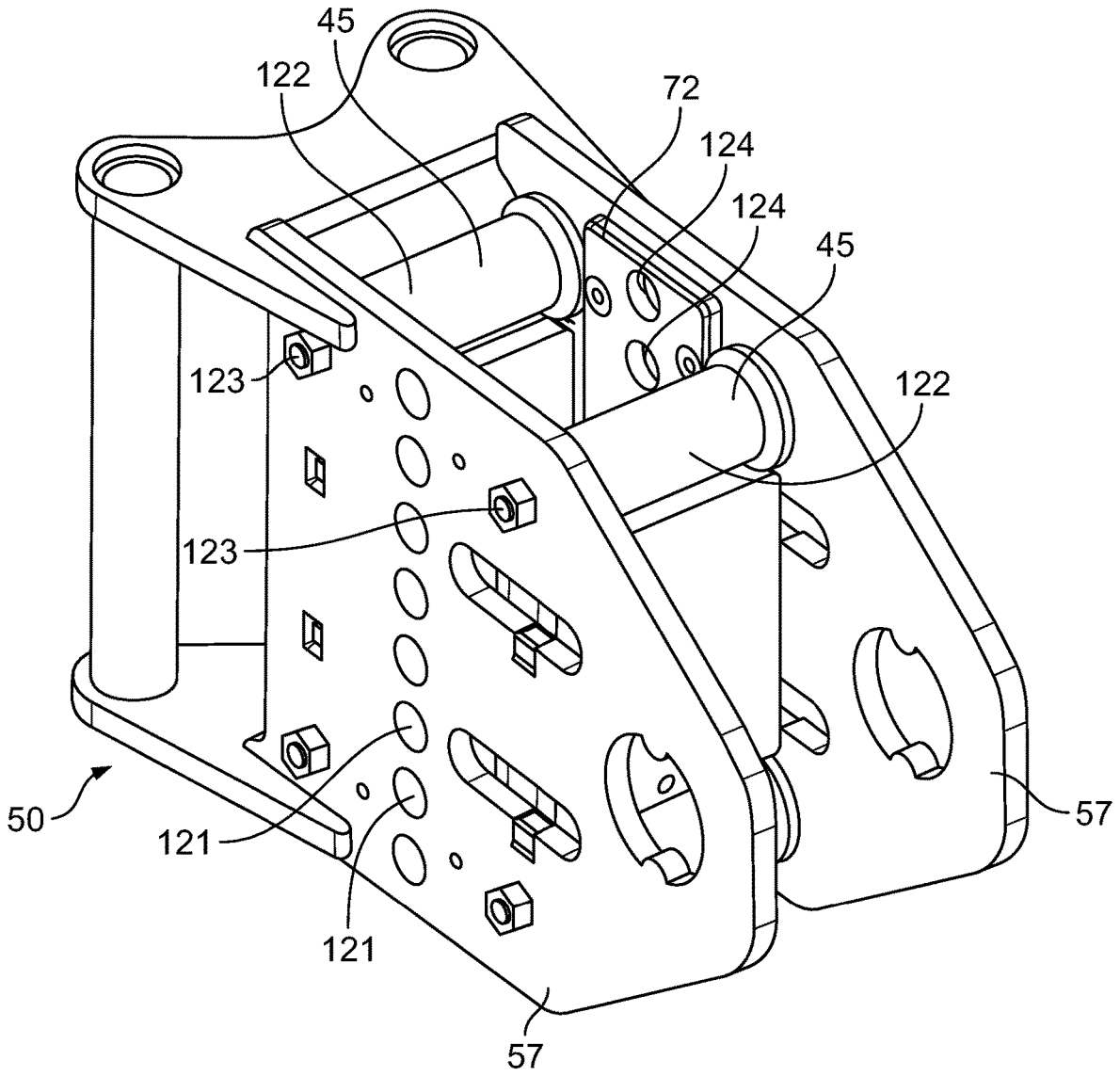
FIG. 49 is a front perspective view of the carriage assembly of FIG. 47.

As described herein, a weight rack 12 may be provided with multiple weightlifting assemblies 10 having multiple different implements or accessories, in various embodiments. For example, FIG. 44 illustrates a weight rack 12 and four weightlifting assemblies 10 with the handle assemblies 28 and weight holders 30 of FIGS. 12-14 connected to two of the articulating arms 21 and the adjustable handle assemblies 110 of FIGS. 35-43 connected to the other two articulating arms 21. Any number of other figures and combinations is possible.

FIGS. 45-49 illustrate another embodiment of a weightlifting assembly 10 and a carriage assembly 50 that includes many structures in common with the weightlifting assembly 10 and carriage assembly 50 shown in FIGS. 1-10 and described herein. In this configuration, the carriage assembly 50 and the side plates 57 thereof include multiple openings 121 aligned vertically along the sides of the passage 54 to permit insertion of the pin 31 at various vertical positions, in order to provide for more precision in mounting height. The spacers 72 include corresponding openings 124. Additionally, the carriage assembly 50 in FIGS. 45-49 has rollers 45 that have no internal ball bearing structure and are formed by an outer shell 122 freely rotating on a pin or shaft 123. In contrast, the rollers 45 in the embodiment of FIGS. 1-10 have an internal ball bearing structure to facilitate free rotation under great loads. Other rotational structures may be used in other embodiments.

Figure 2:
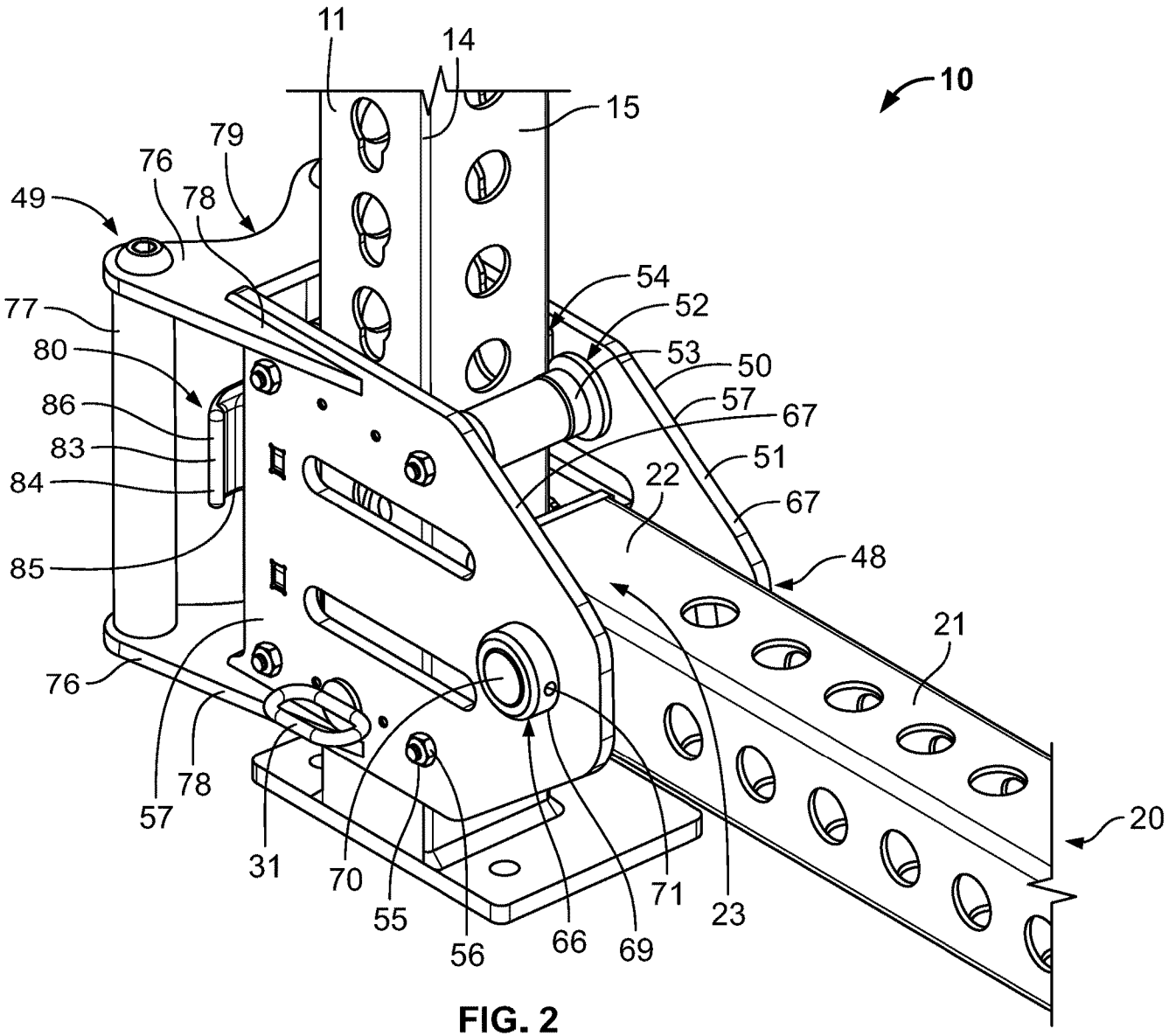
FIG. 2 is a front perspective view of a portion of a frame member of the weight rack of FIG. 1 with a portion of one of the weightlifting assemblies.
Figure 3:
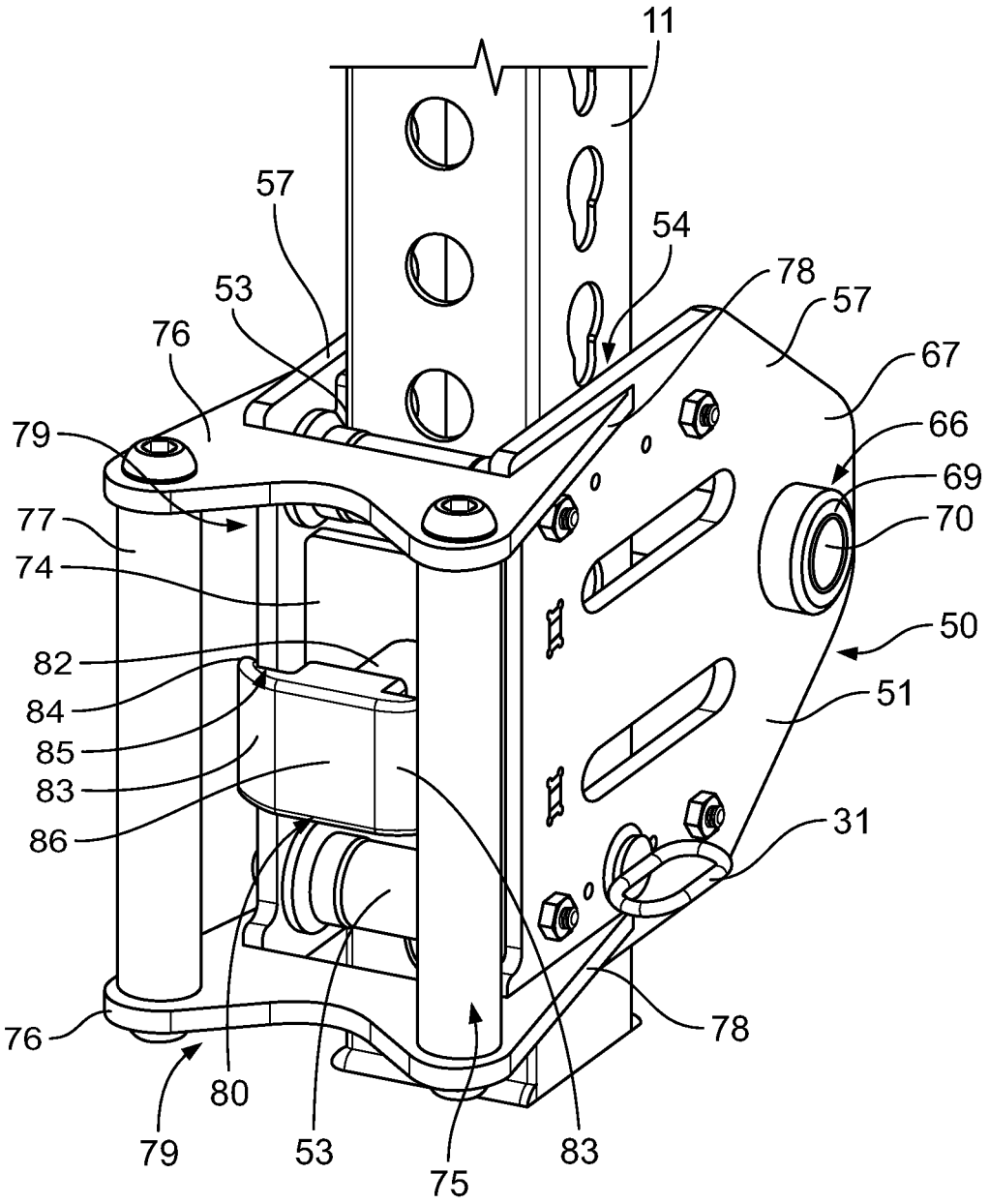
FIG. 3 is a rear perspective view of the portion of the frame member and the weightlifting assembly of FIG. 2.
Figure 4:
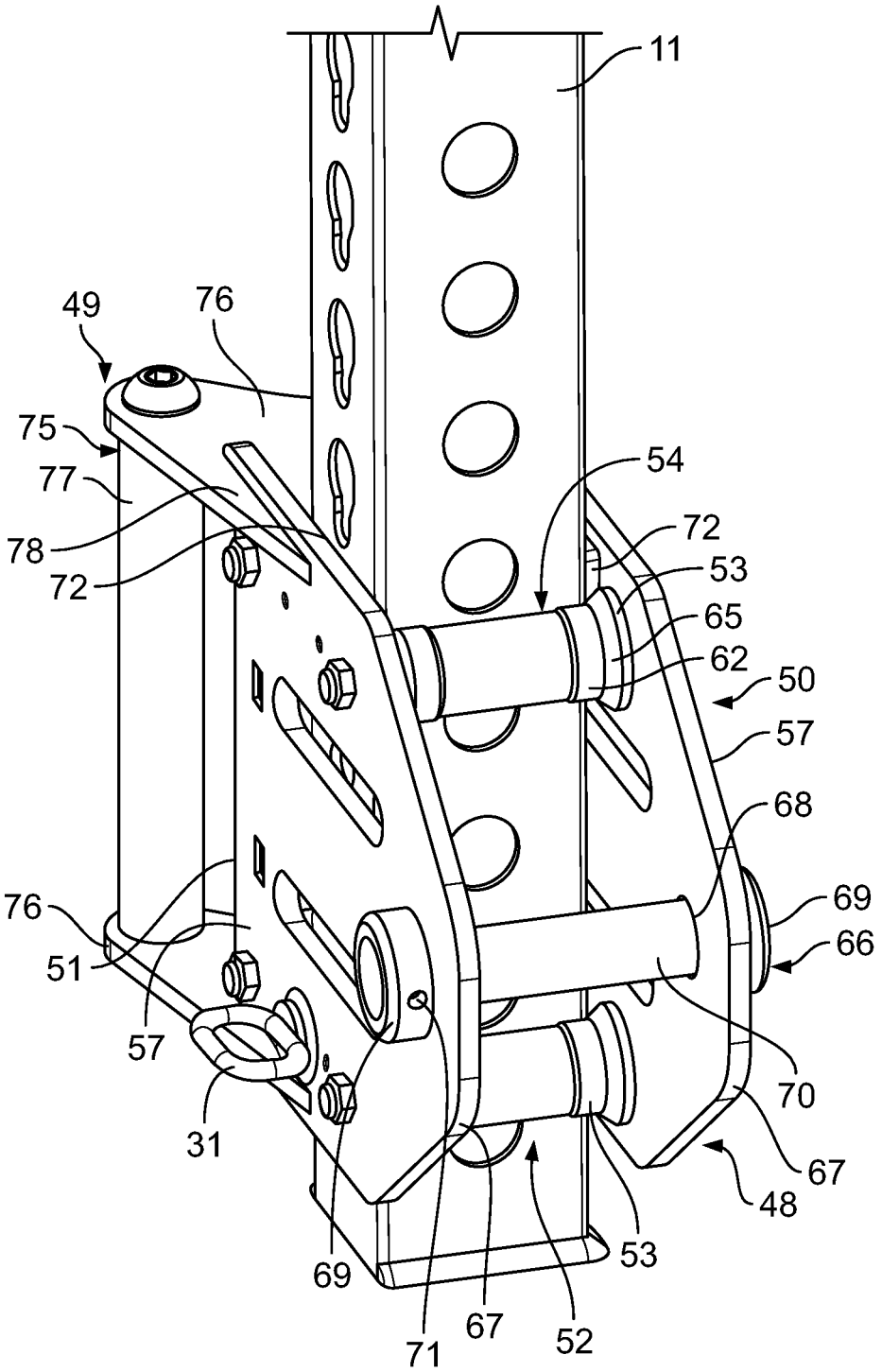
FIG. 4 is a front perspective view of the portion of the frame member and a carriage assembly of the weightlifting assembly of FIG. 2.
Figure 65:
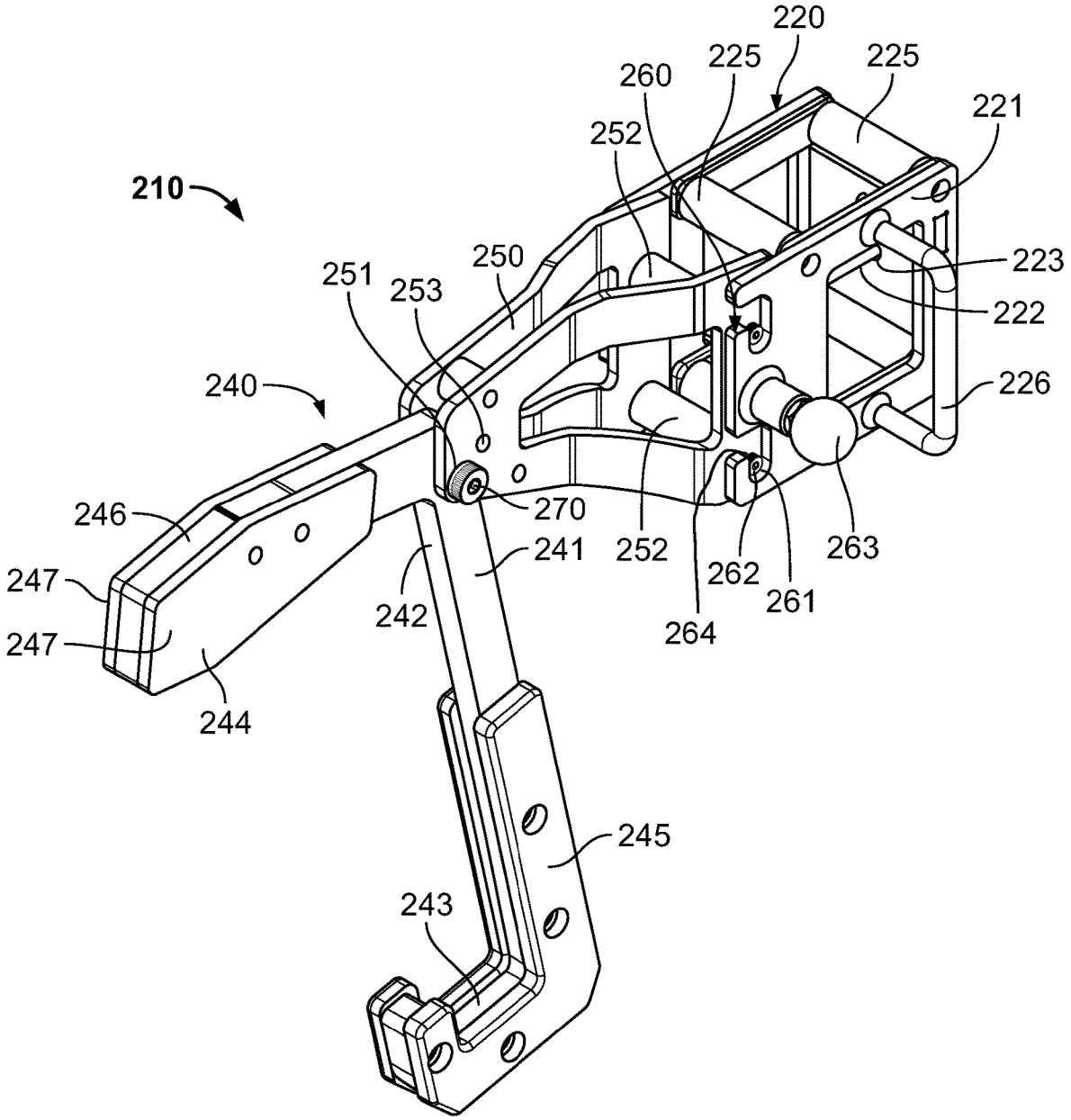
FIG. 65 is a perspective view of another embodiment of a carriage assembly according to aspects of the disclosure.
Figure 66:
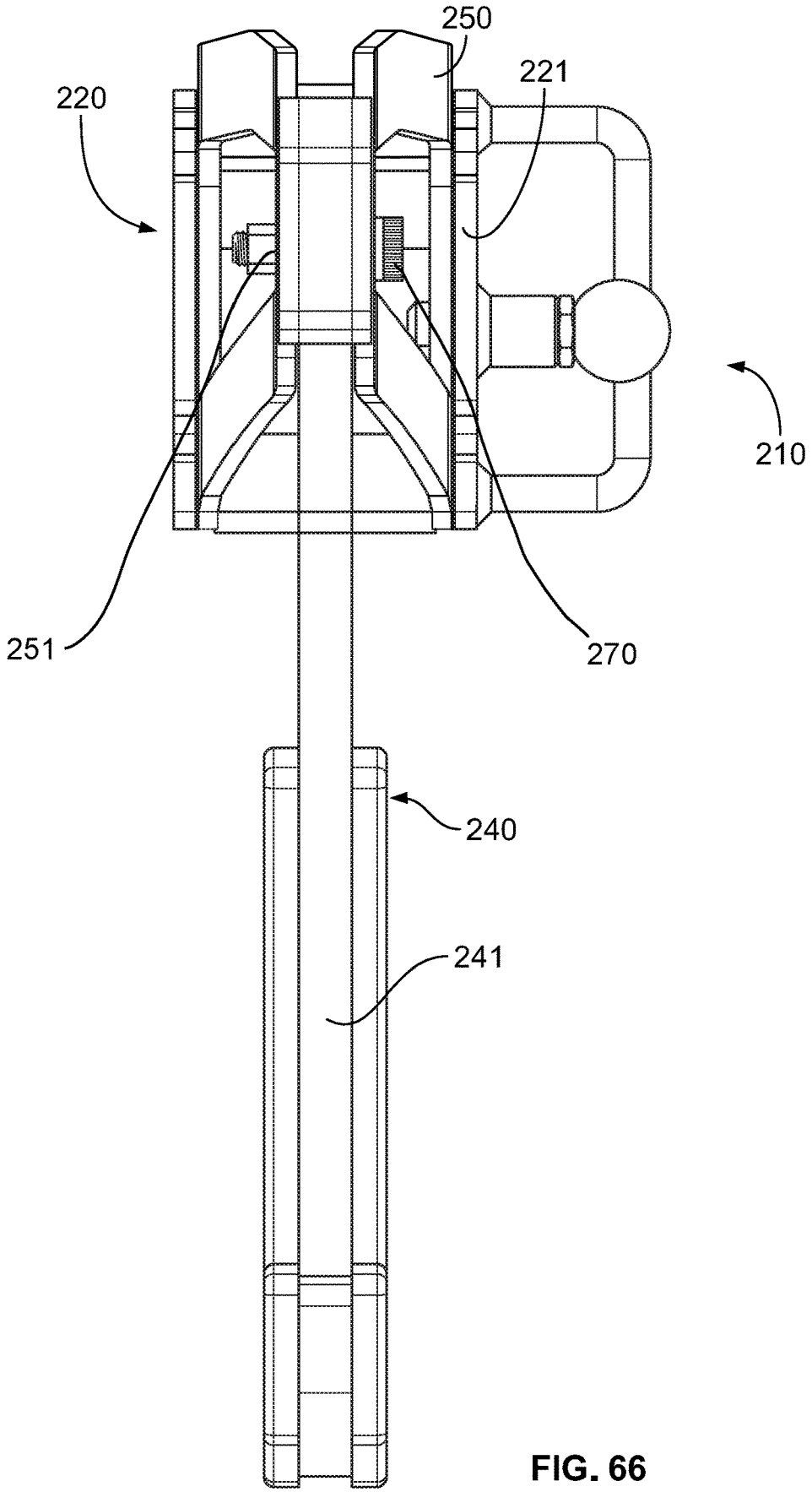
FIG. 66 is a front view of the carriage assembly of FIG. 65.
Figure 67:
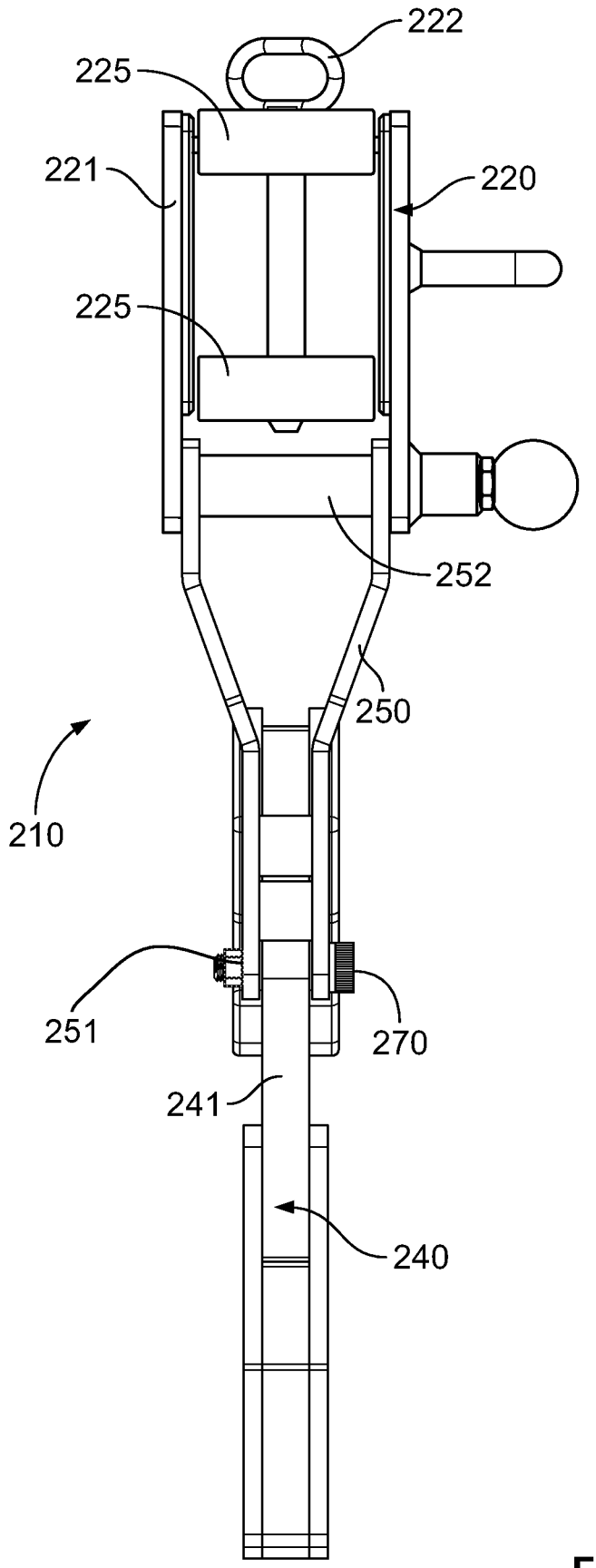
FIG. 67 is a top view of the carriage assembly of FIG. 65.
Figure 77:
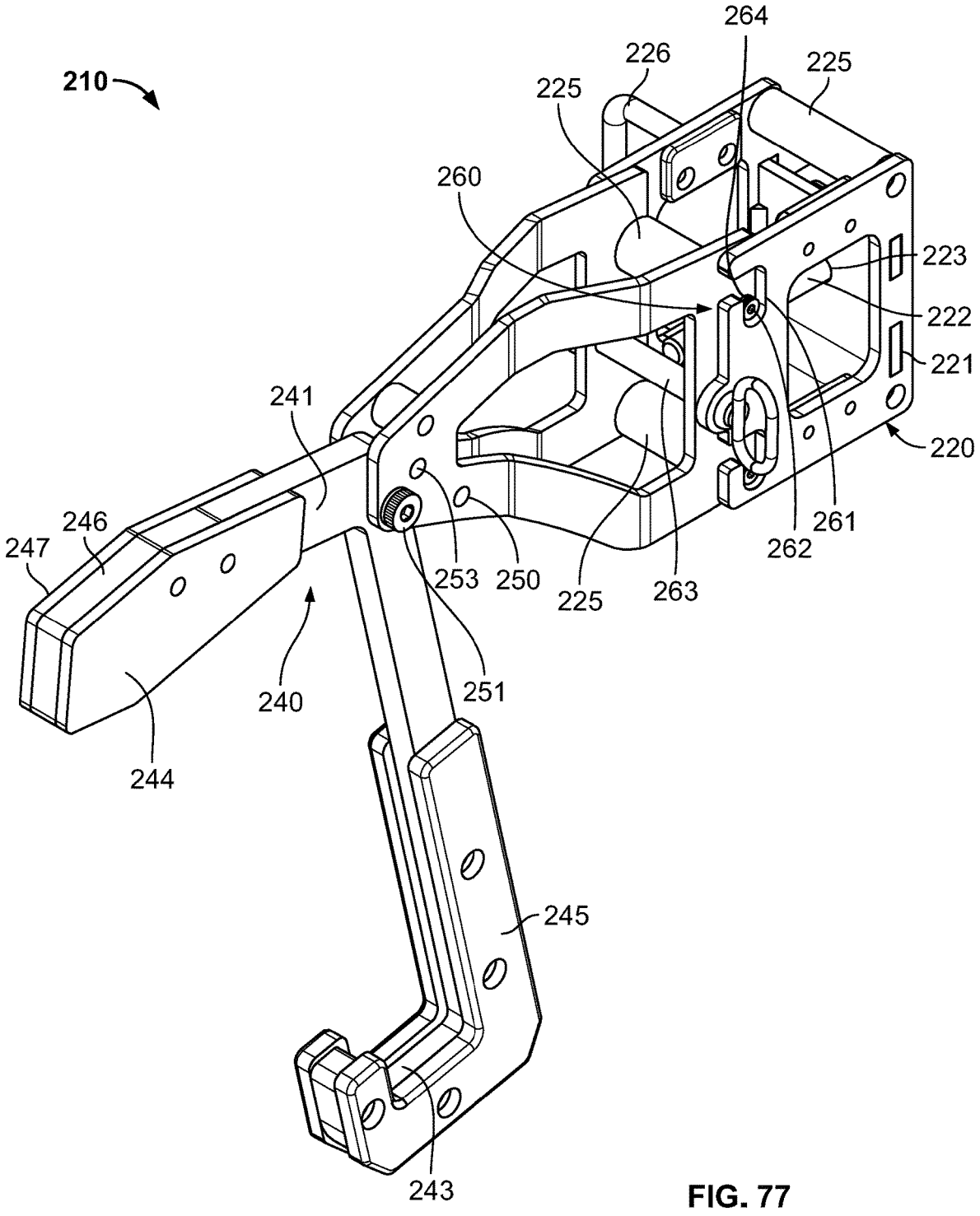
FIG. 77 is a perspective view of another embodiment of a carriage assembly according to aspects of the disclosure.
Figure 78:
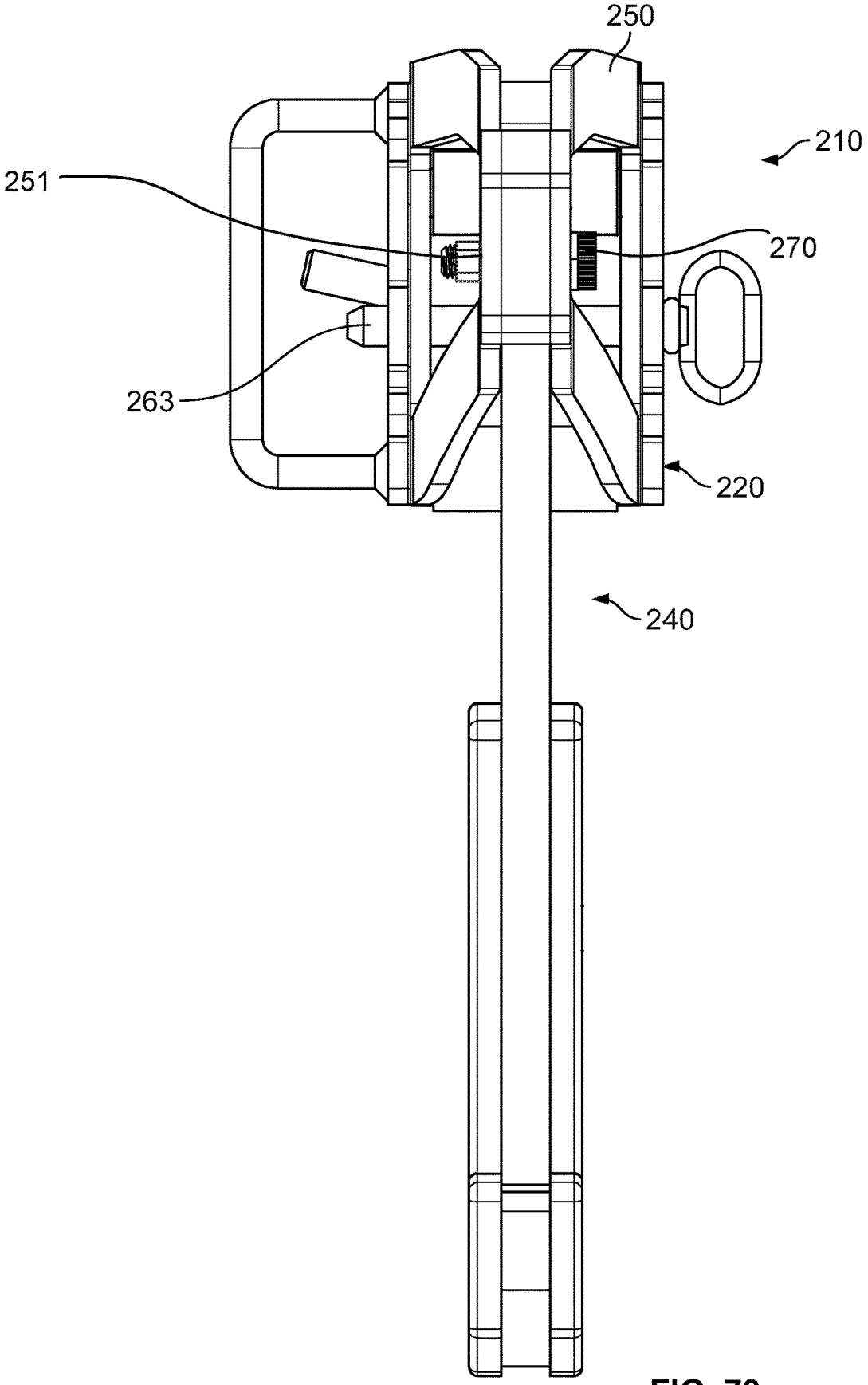
FIG. 78 is a front view of the carriage assembly of FIG. 77.
Figure 79:
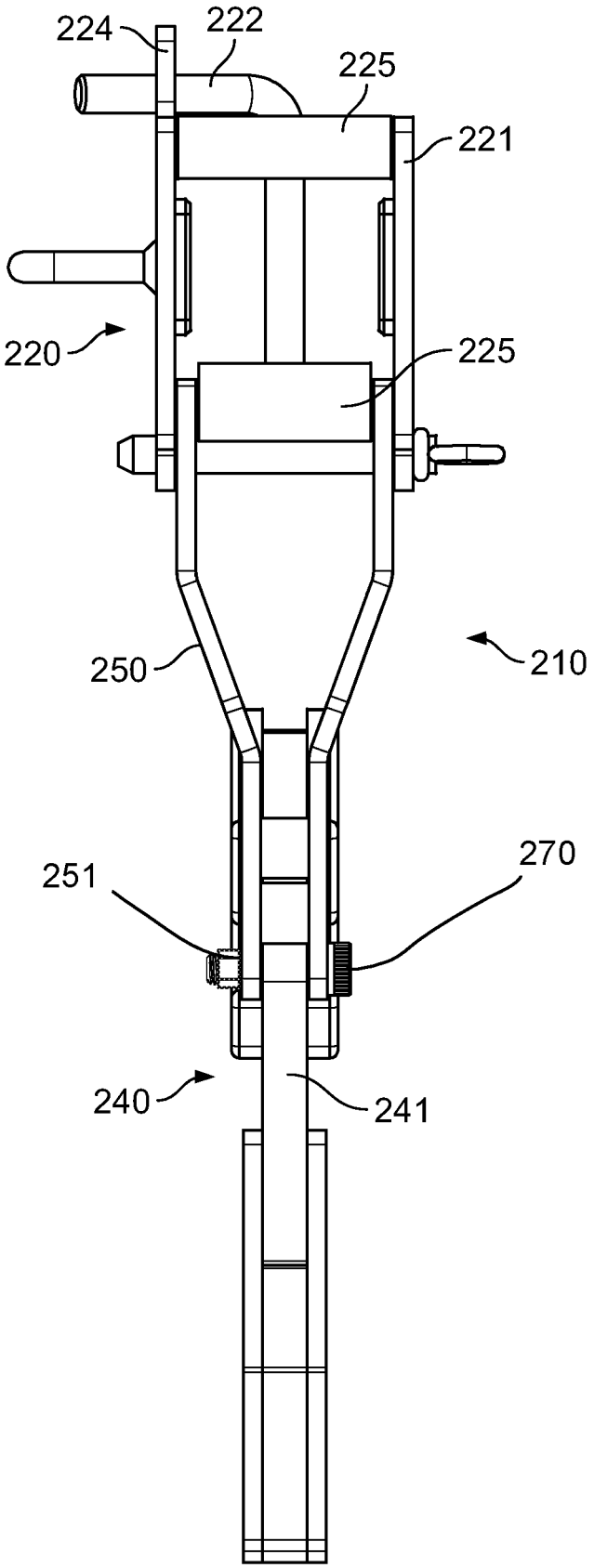
FIG. 79 is a top view of the carriage assembly of FIG. 77.
Figure 80:
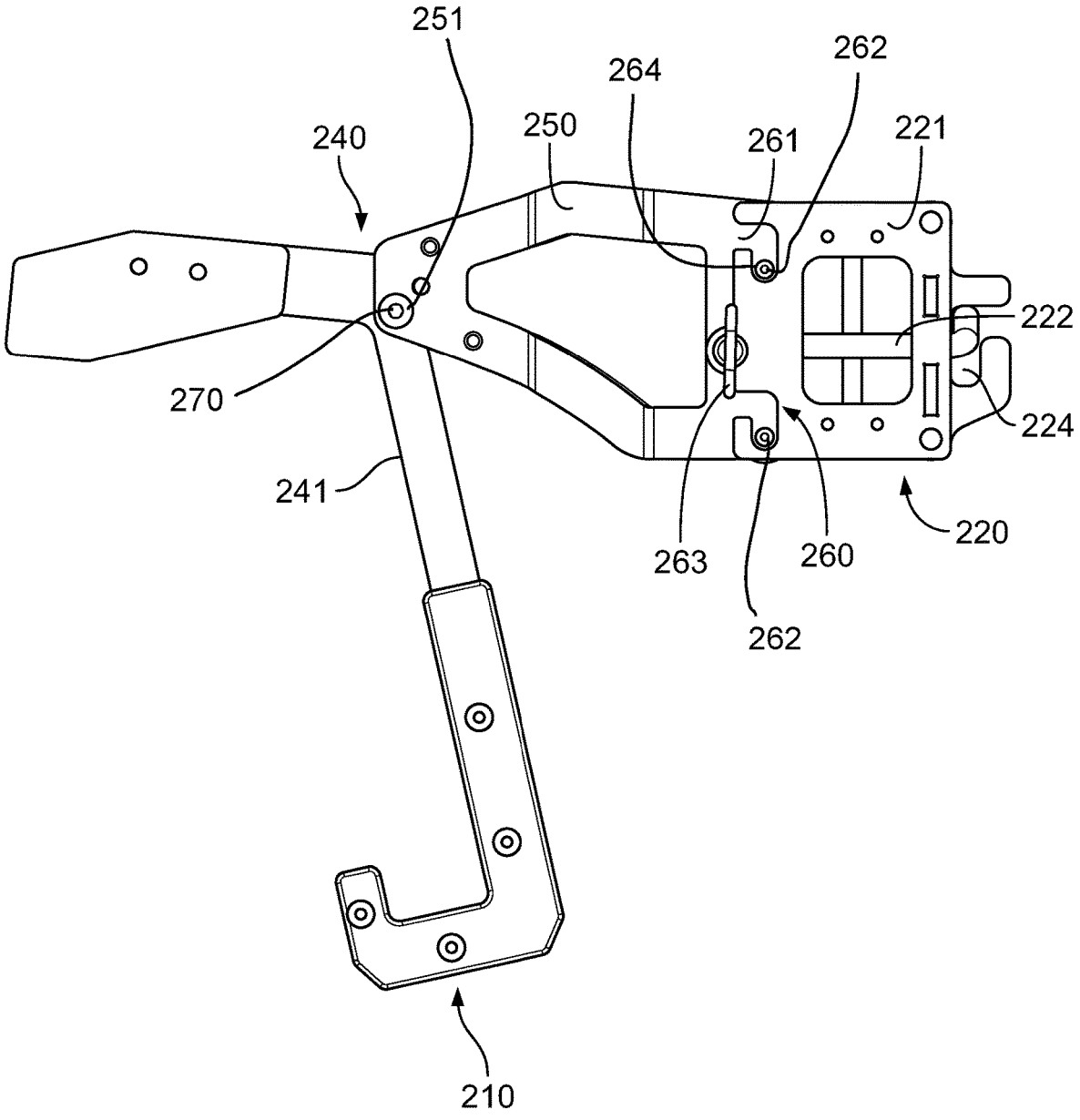
FIG. 80 is a side view of the carriage assembly of FIG. 77.
Figure 81:
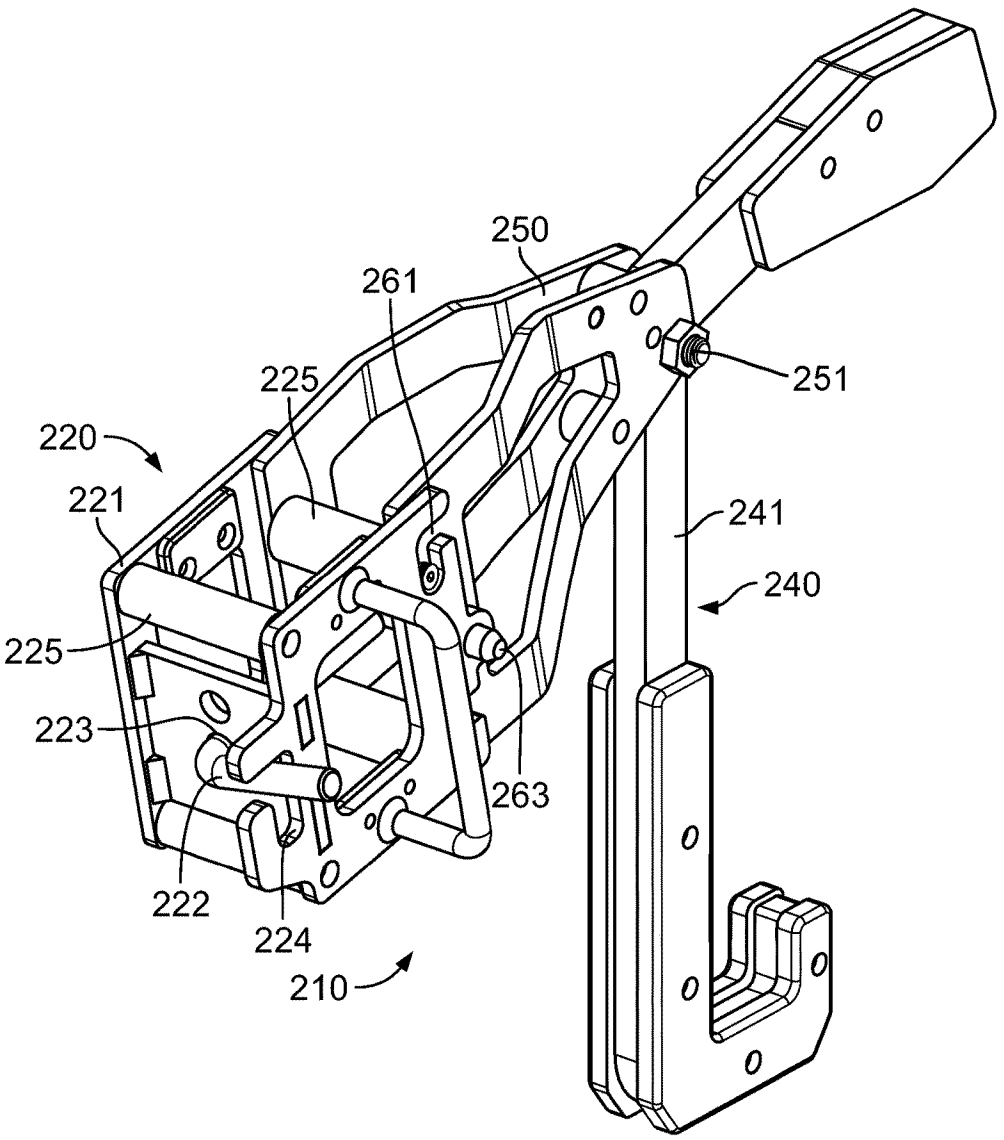
FIG. 81 is a top rear perspective view of the carriage assembly of FIG. 77.
Figure 82:
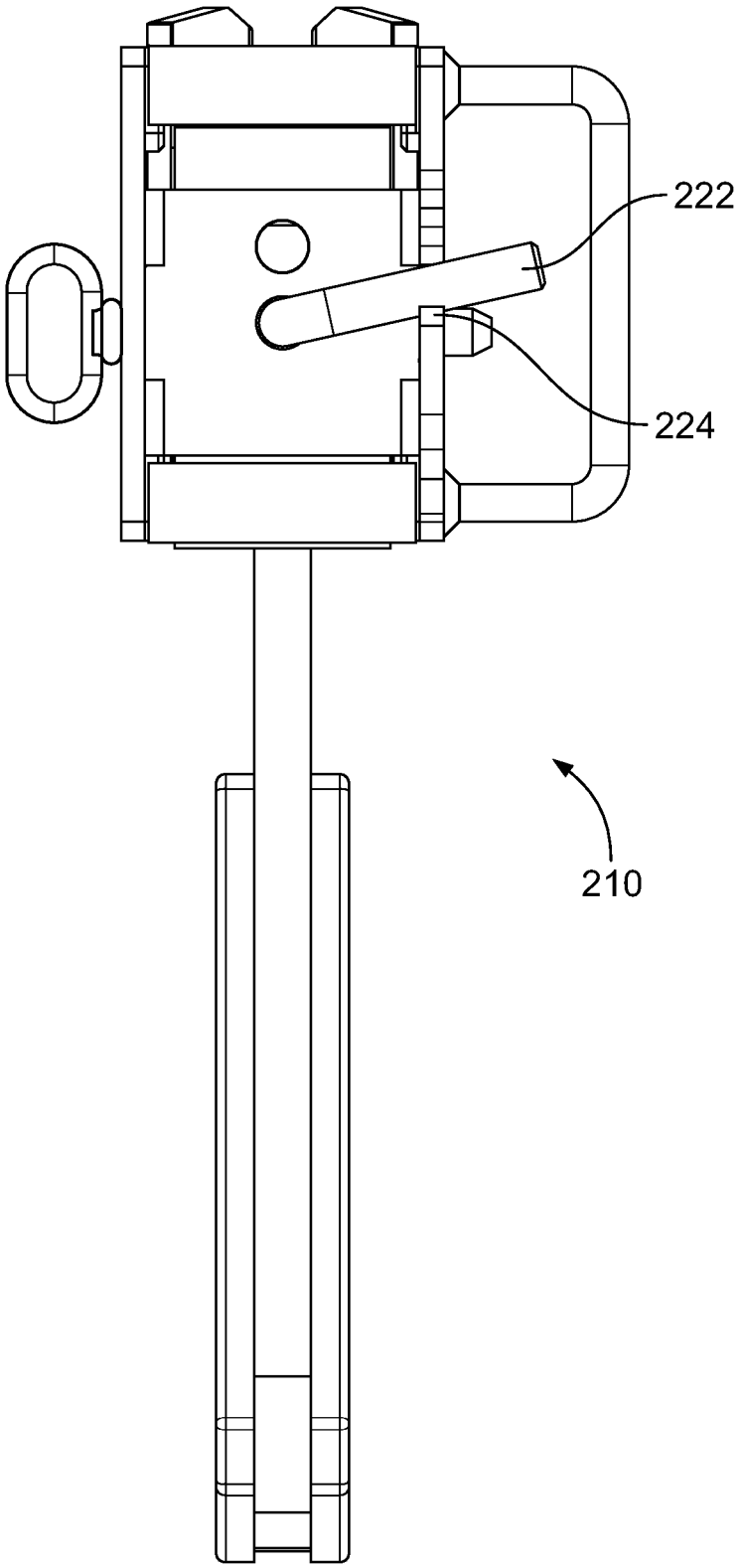
FIG. 82 is a rear view of the carriage assembly of FIG. 77.
Figure 83:
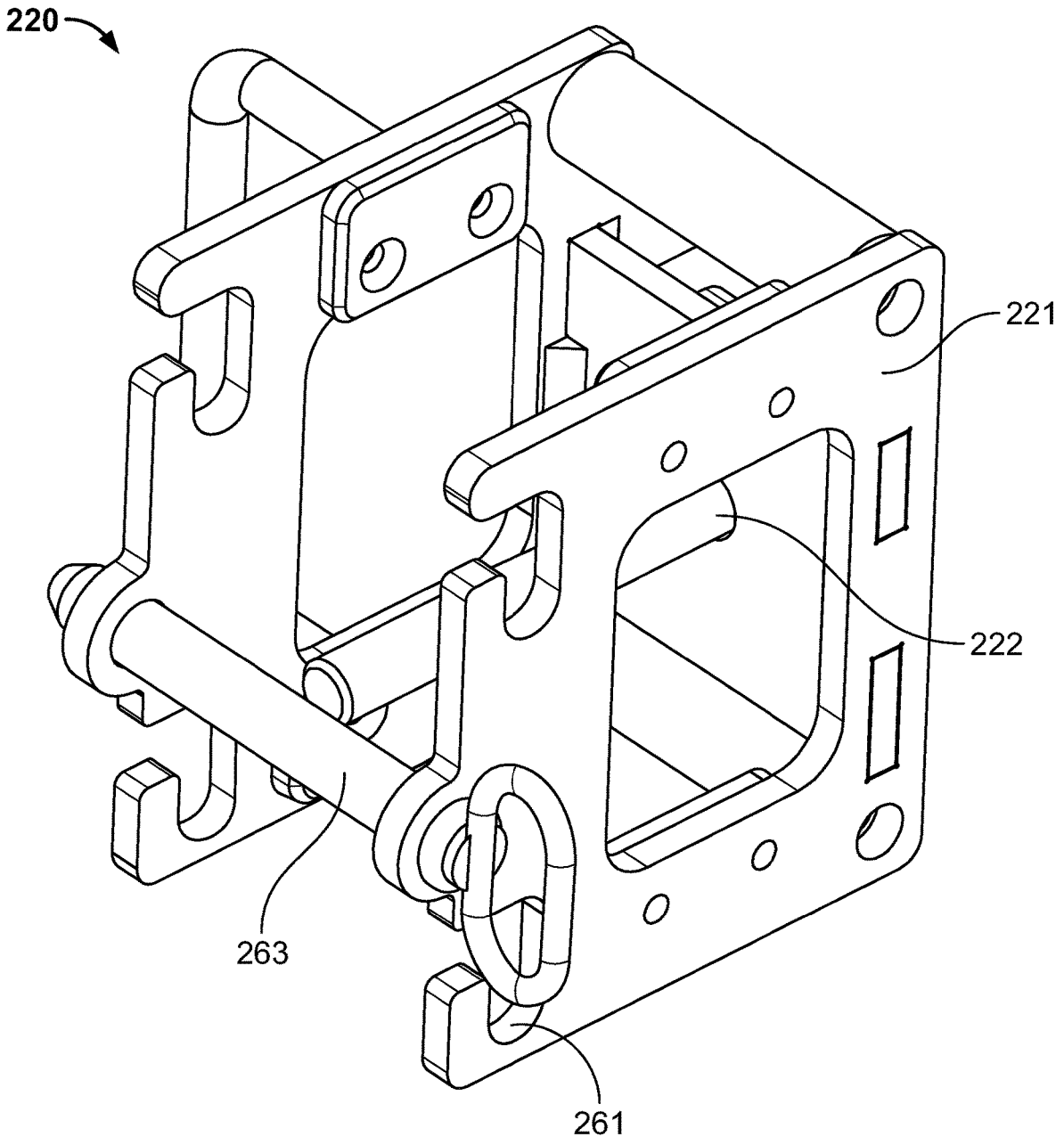
FIG. 83 is a perspective view of an adjustable bracket of the carriage assembly of FIG. 77.
Figure 84:
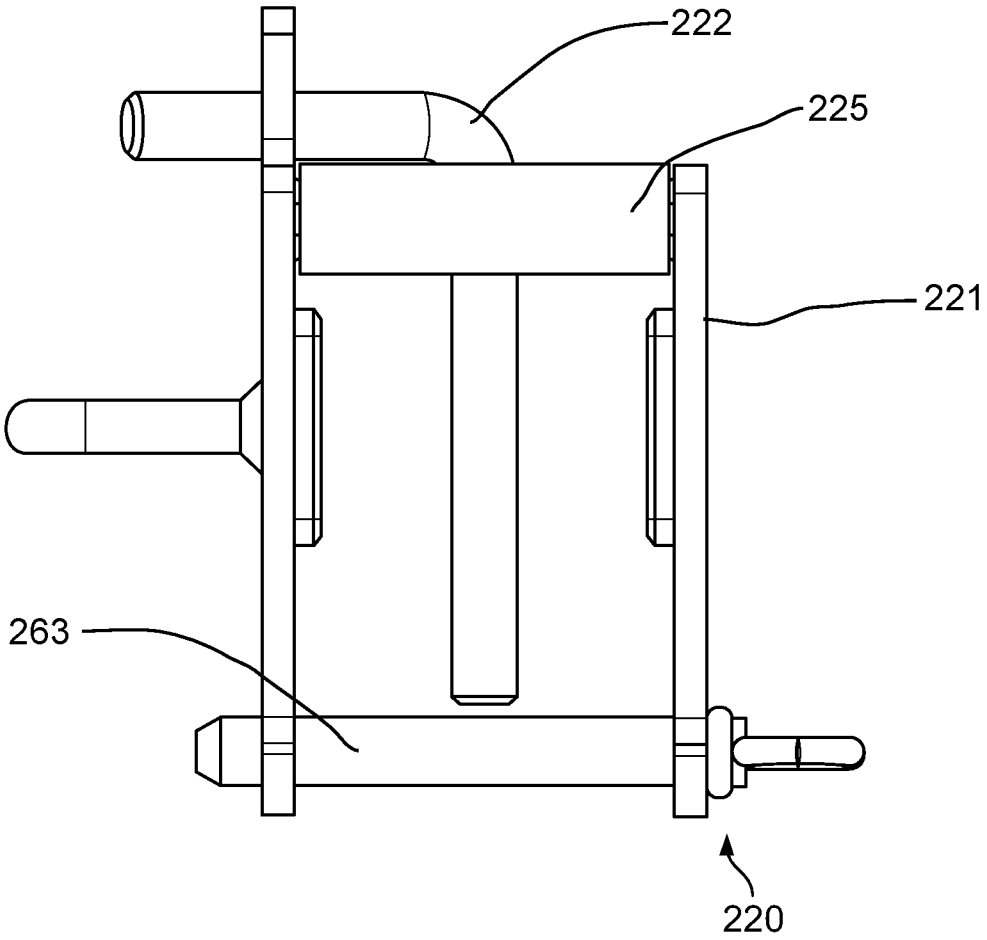
FIG. 84 is a top view of the adjustable bracket of the carriage assembly of FIG. 77.
Figure 85:
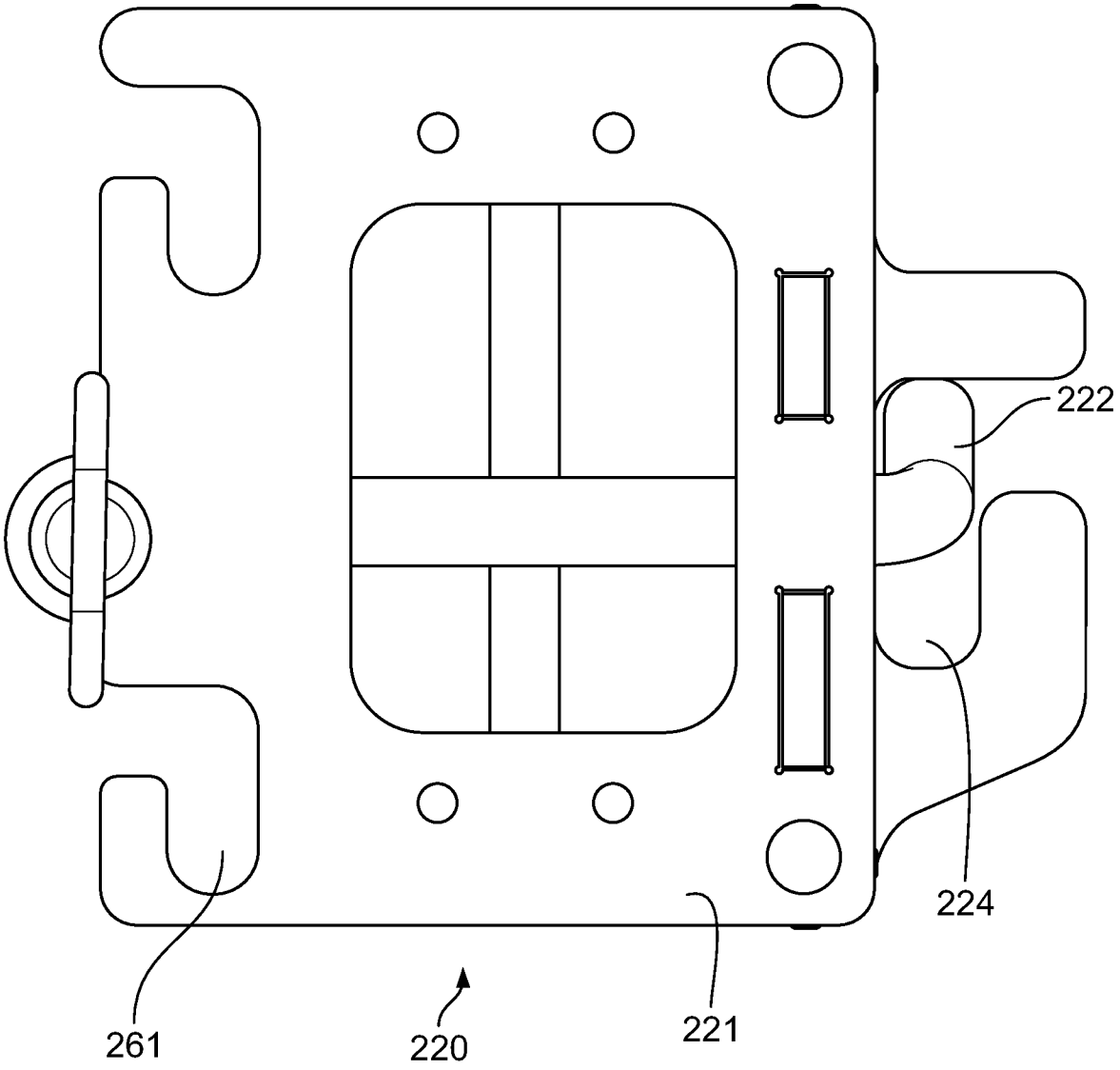
FIG. 85 is a side view of the adjustable bracket of the carriage assembly of FIG. 77.
Figure 86:
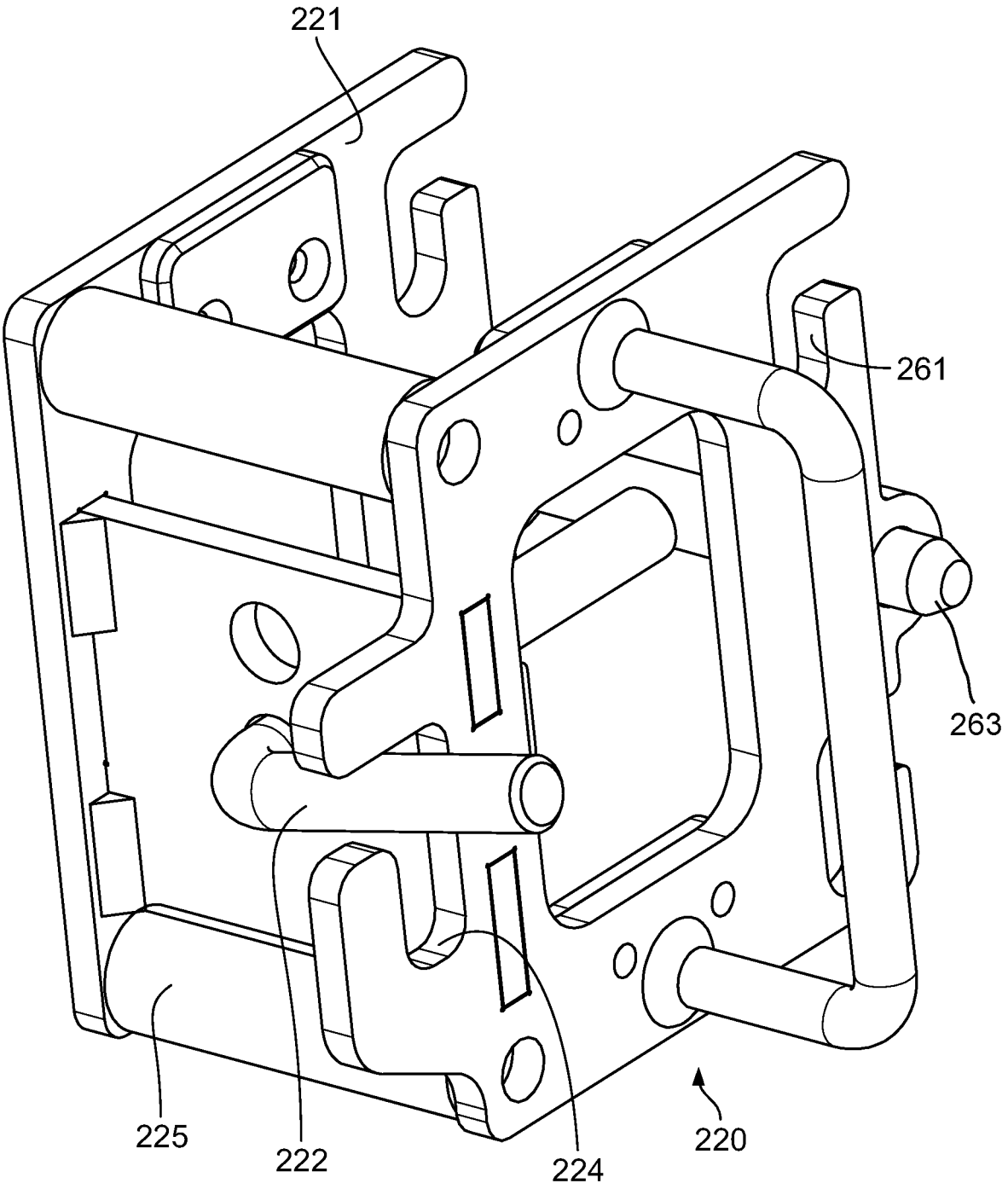
FIG. 86 is a top rear perspective view of the adjustable bracket of the carriage assembly of FIG. 77.
Figure 87:
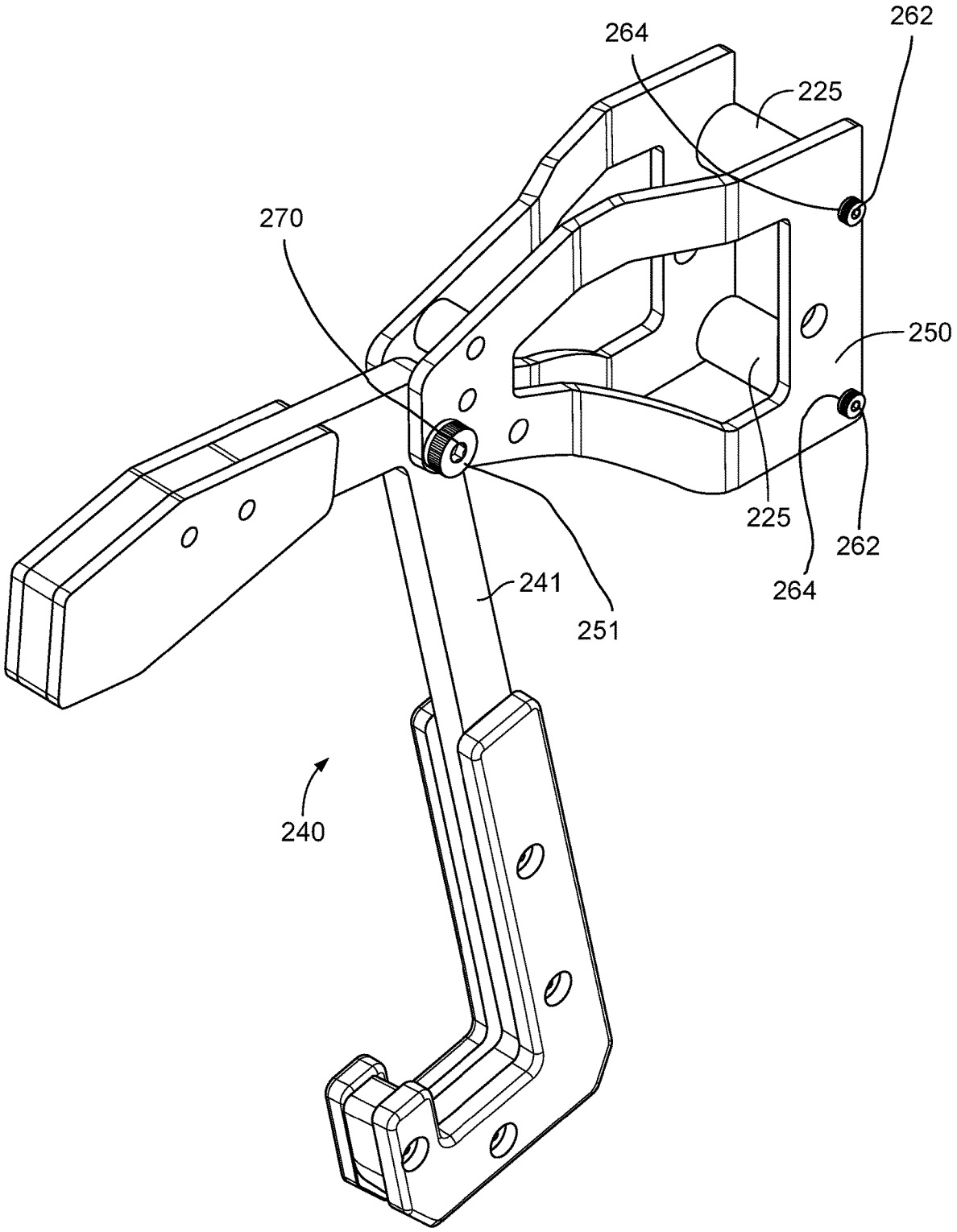
FIG. 87 is a perspective view of a mounting bracket and an exercise implement of the carriage assembly of FIG. 77.

FIGS. 50-58 illustrate additional embodiments of accessories and implements configured for use in connection with one or more weightlifting assemblies 10 as described herein. It is understood that these implements and accessories may be used in connection with any embodiment of the weightlifting assembly 10 as described herein, as well as weight racks 12 incorporating such assembly or assemblies 10. It is understood that the accessories in FIGS. 50-58 may be used in connection with a carriage assembly 50 that includes an articulating arm 21 mounted on a carriage 51 as described herein, e.g., as shown in FIGS. 1-2 or a carriage assembly 220 as shown, e.g., in FIG. 65 or FIG. 77.

Figure 50A:
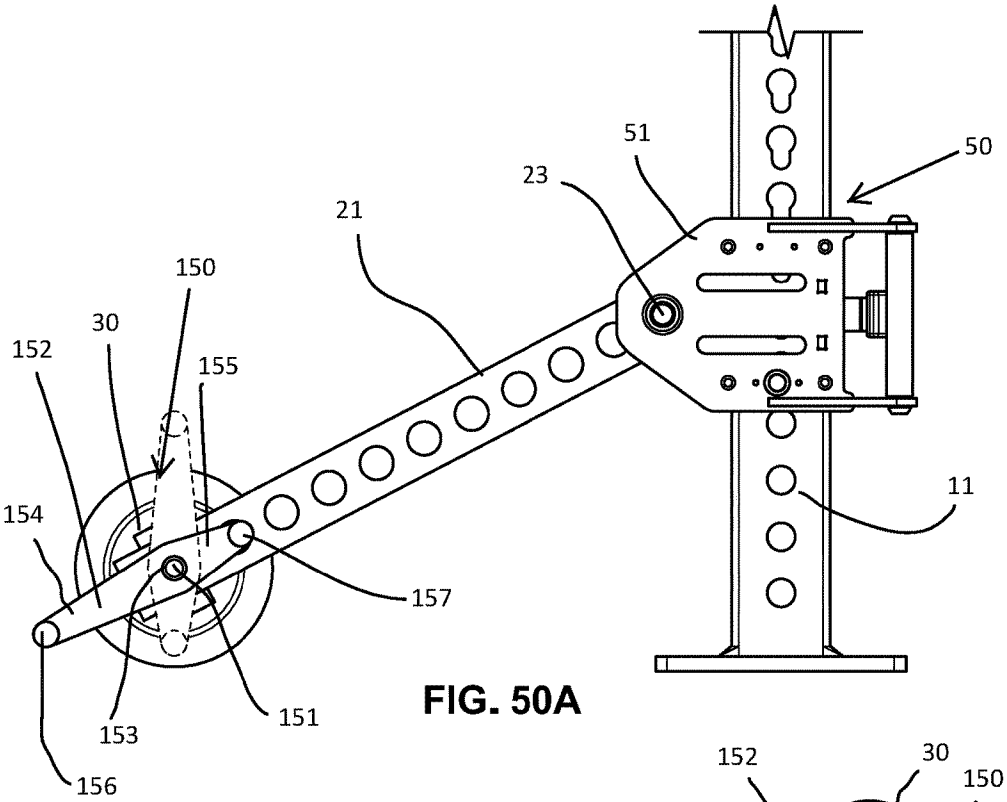
FIG. 50A is a side view of another embodiment of a weightlifting assembly connected to a frame member of a weight rack according to aspects of the disclosure.
Figure 50B:
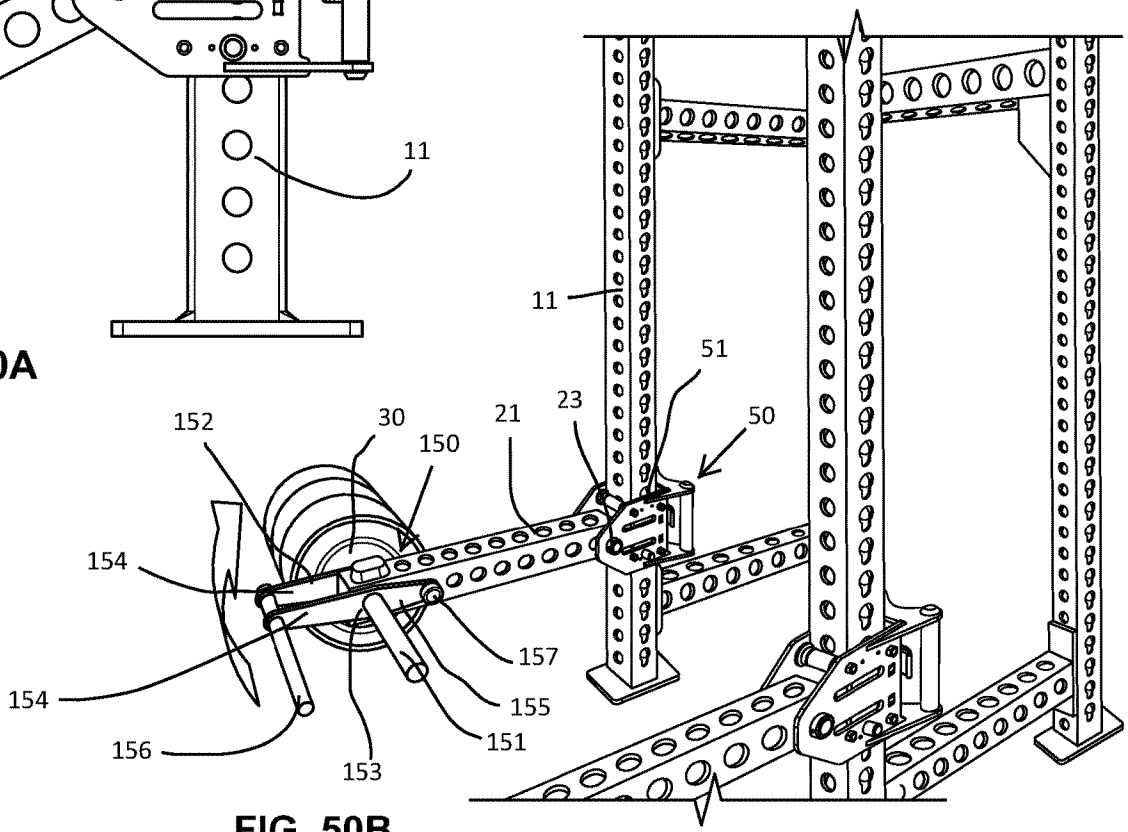
FIG. 50B is a perspective view of portions of the weightlifting assembly and the weight rack of FIG. 50A.

FIGS. 50A-B illustrate an arm 21 with an accessory in the form of a locking handle assembly 150 for gripping by a user and a weight holder 30 for holding one or more weights, e.g., in the form of weight plates, both of which are connected to the arm 21 for use in a weightlifting exercise. The weight holder 30 may be structured according to other embodiments herein, and the handle assembly 150 may include an additional weight holder 151 on the opposite side of the arm 21 as the weight holder 30. The handle assembly 150 in this embodiment includes an articulating bracket 152 having a pivotable connection structure 153 configured to be pivotably connected to the arm 21 and having a first leg 154 and a second leg 155 extending outwardly from the pivotable connection structure 153. The handle assembly 150 in FIGS. 50A-B also includes a gripping handle 156 connected to the first leg 154 of the articulating bracket 152 and extending from the articulating bracket 152, for gripping by a user during a weightlifting exercise. The handle assembly 150 in FIGS. 50A-B has two first legs 154 positioned in spaced relation that engage opposite sides of the arm 21, as similarly shown in FIGS. 12-14. The second leg 155 has a releasable locking structure 157 configured to fixedly connect the second leg 155 to the arm 21 to prevent rotation of the articulating bracket 152 relative to the arm 21. The releasable locking structure 157 is depicted as a manually actuated retractable pin in FIGS. 50A-B, but may be a spring-loaded retractable pin or a removable pin, among other locking structures described herein. The locking structure 157 permits the handle assembly 150 to be used in a locked configuration, where the handle assembly 150 is fixed with respect to the arm 21, or a swivel configuration, where the handle assembly 150 is freely pivotable with respect to the arm 21. In the configuration of FIGS. 50A-B, the first and second legs 154, 155 extend in opposite directions from the pivotable connection 153, but the legs 154, 155 may extend in oblique or transverse directions in other embodiments. The second weight holder 151 is optional in one embodiment. In one embodiment, the second weight holder 151 is connected to the articulating bracket 152 at or proximate the pivotable connection 153 and extends outward in the same direction as the handle 156, and in another embodiment, the second weight holder 151 is part of a single, unitary structure with the weight holder 30 that extends through the arm 21. It is understood that this configuration may be used with two arms 21 and a single handle 156 such as shown in FIGS. 32-34.

Figure 51B:
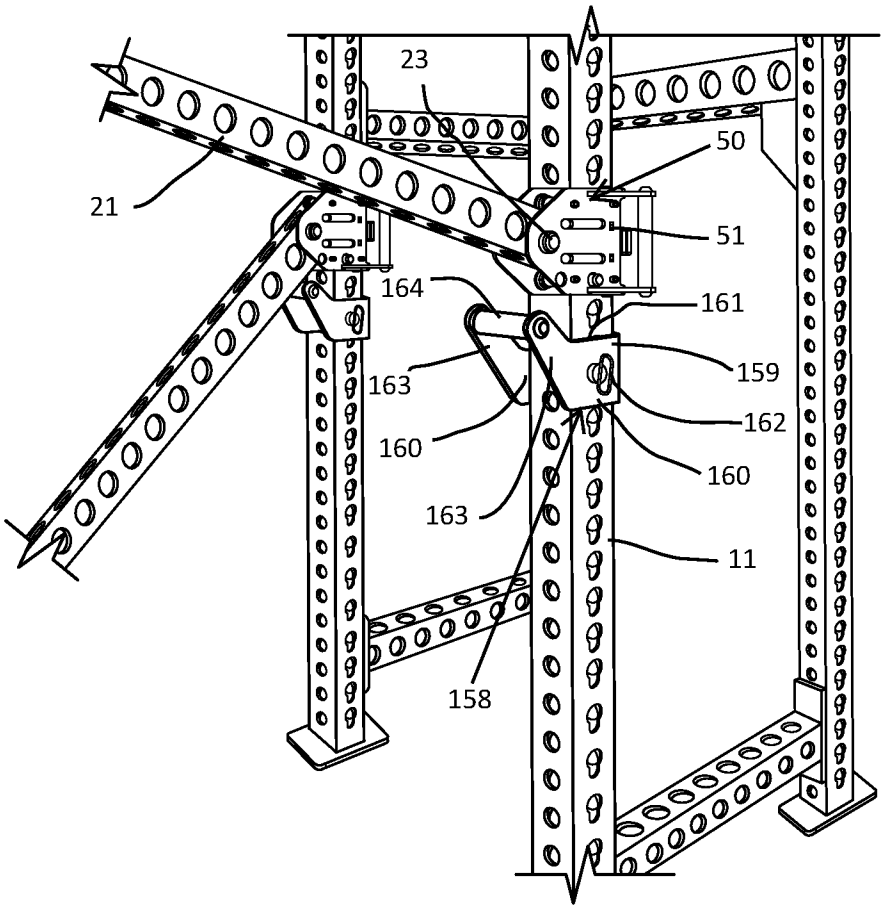
FIG. 51B is a perspective view of the support and portions of the weight rack and weightlifting assemblies of FIG. 51A.
Figure 51A:
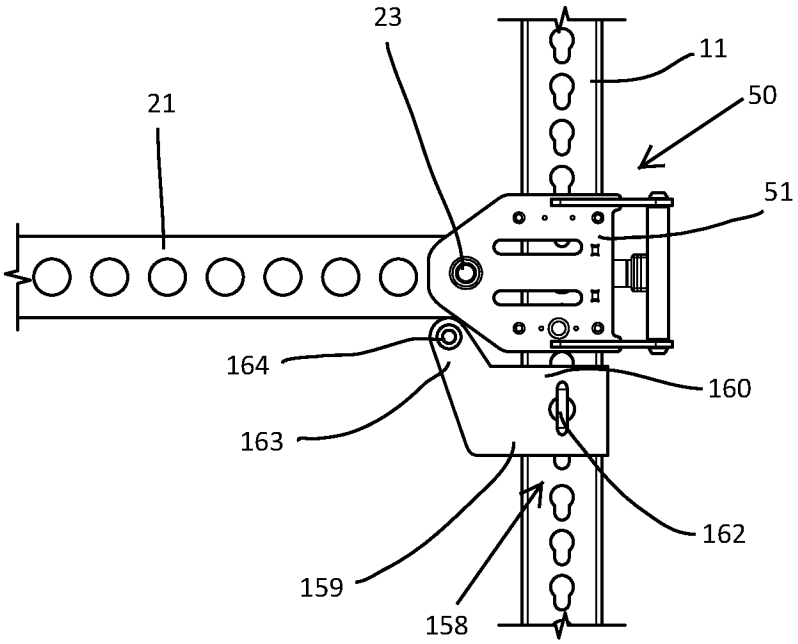
FIG. 51A is a side view of portions of the weight rack and the weightlifting assemblies FIG. 1, with another embodiment of a support connected to the weight rack, according to aspects of the disclosure, with the support used in a first configuration.
Figure 52B:
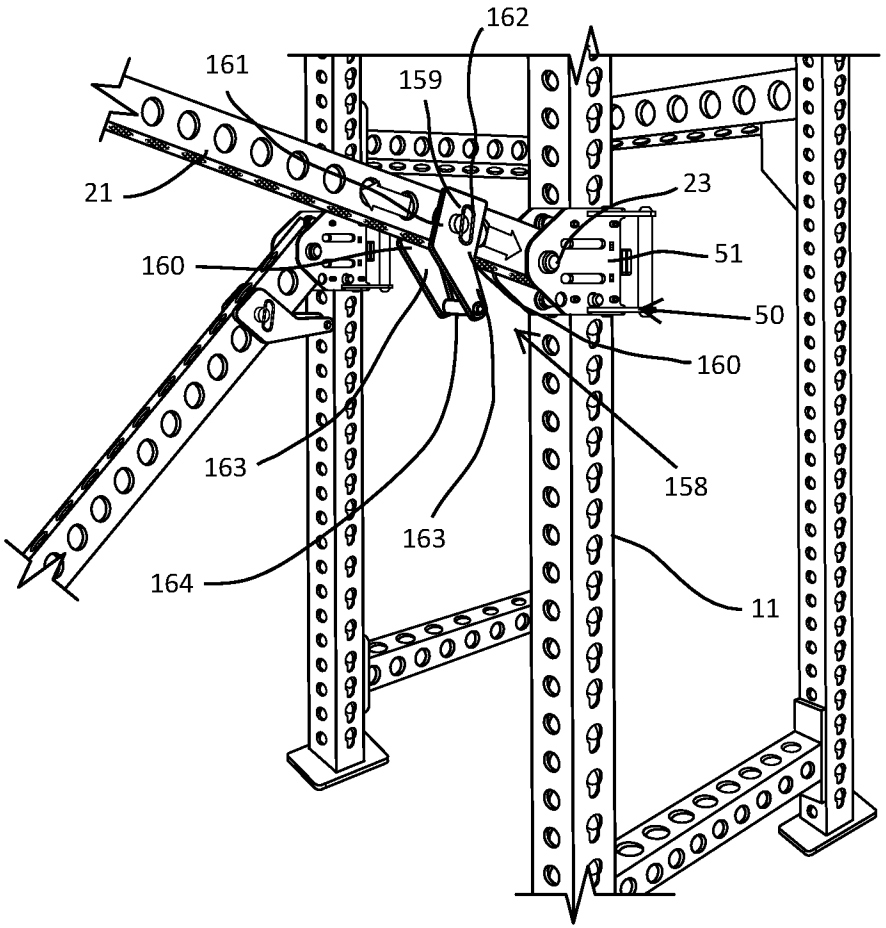
FIG. 52B is a perspective view of the support and portions of the weight rack and weightlifting assemblies of FIG. 52A.
Figure 52A:
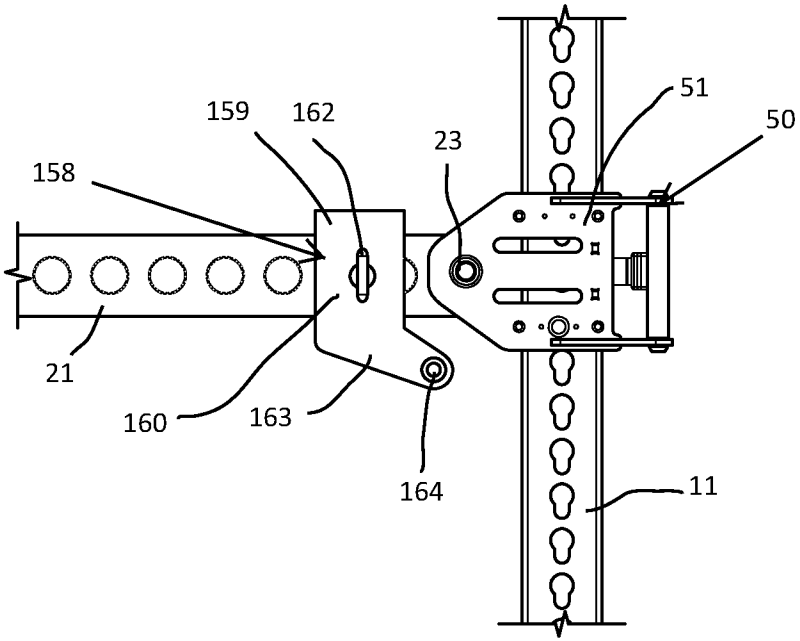
FIG. 52A is a side view of the support and portions of the weight rack and weightlifting assemblies of FIG. 51A, with the support used in a second configuration.

FIGS. 51A-B and 52A-B illustrate an accessory in the form of a fixed support 158 that is adjustably connectable to one of the vertical frame member 11 or the arm 21 and abuttingly engages the other to function as a motion limiter. The support 158 includes a mounting bracket 159 having two side walls 160 that are parallel and spaced from each other to define a passage 161 configured to receive an elongated member (e.g., the frame member 11 or the arm 21) therethrough, and a locking structure 162 configured for engaging the elongated member to releasably lock the mounting bracket 159 in position relative to the elongated member. The support 158 includes legs 163 extending outward and upward from distal ends of the side walls 160, such that the legs 163 extend alongside each other in spaced relation. The legs 163 in FIGS. 51-52 are part of a single, integral piece with the mounting bracket 159, but the legs 163 may be separately connected to the mounting bracket 159 in another embodiment. The support 158 further includes a support member 164 connected to the legs 163 and extending between the legs 163. The support member 164 is configured to abuttingly engage the other elongated member (e.g., the frame member 11 or the arm 21) pivotably connected to the elongated member to which the support 158 is mounted to limit the minimum spacing between the first and second elongated members. The support member 164 in FIGS. 51-52 is a cylinder with a resilient covering, but may have a different configuration in other embodiments. The locking structure 162 is depicted as a removable pin that extends into the passage to engage the elongated member in FIGS. 51-52, but may be a retractable pin or other locking structure as described herein. The support 158 is adjustable along the length of the elongated member by removing/releasing the locking structure 162 and relocating the support 158. FIGS. 51A-B illustrate the support 158 mounted on the vertical member 11 and configured so the support member 164 abuttingly engages the arm 21, and FIGS. 52A-B illustrate the support 158 mounted on the arm 21 and configured so the support member 164 abuttingly engages the vertical member 11. Adjusting the position of the support 158 along the arm 21 or the vertical member 11 changes the range of motion that is permitted by the arm 21 with respect to the vertical member 11.

Figure 53B:
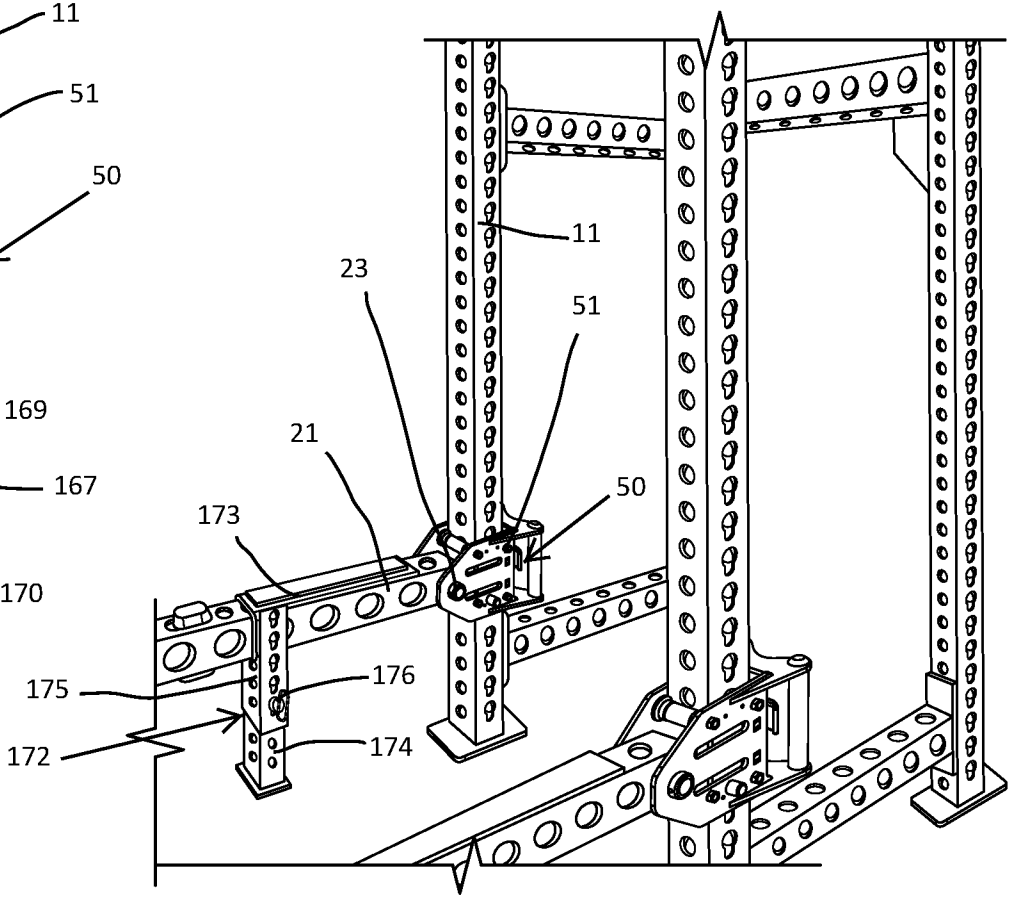
FIG. 53B is a perspective view of portions of the weight rack and the weightlifting assemblies FIG. 1, with another embodiment of a support connected to an articulating arm of the weightlifting assembly, according to aspects of the disclosure.
Figure 53A:
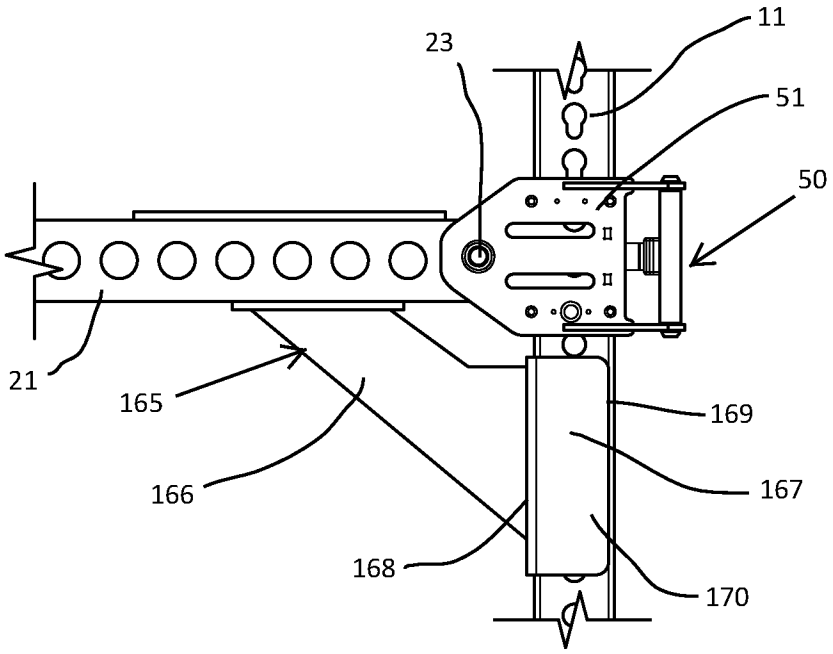
FIG. 53A is a side view of portions of the weight rack and the weightlifting assemblies FIG. 1, with another embodiment of a support connected to an articulating arm of the weightlifting assembly, according to aspects of the disclosure.

FIG. 53A illustrates an arm 21 with an accessory in the form of a support 165 configured to engage the arm 21 and the vertical frame member 11 to function as a motion limiter. The support 165 in this embodiment includes a support member 166 connected to the arm 21 and configured to pivot along with the arm 21, and an engaging member 167 configured to abuttingly and releasably engage the vertical member 11 to resist downward pivoting of the arm 21 and to permit upward pivoting of the arm 21 with respect to the vertical frame member 11. The support member 166 extends downward and rearward from the arm 21, and the engaging member 167 is connected at the distal end of the support member 166. The engaging member 167 has an abutting surface 168 configured to abuttingly engage the vertical frame member, and may also include a channel or receiver 169 defined between two sidewalls 170 extending from the abutting surface 168 and spaced from each other, such that the channel 169 receives the frame member 11 when the abutting surface 168 engages the frame member 11. When the engaging member 167 engages the frame member 11, the support member 166 limits further downward pivoting of the arm 21, and when the arm 21 is pivoted upward, the entire support 165 travels with the arm 21. The support member 166 may be oriented at an angle to the abutting surface 168 of about 45° or about 60°, and in one embodiment, the angle may be between 30° and 75°. Additionally, the support member 166 may be connected to the arm 21 by one or more fixed pins, removable/retractable pins, fasteners, or other connecting structure.

FIG. 53B illustrates an arm 21 with an accessory in the form of a support 172 configured to engage the arm 21 and the ground surface to function as a motion limiter. The support 172 in this embodiment includes a support member 173 connected to the arm 21 and configured to pivot along with the arm 21, and an engaging member 174 configured to abuttingly and releasably engage the ground to resist downward pivoting of the arm 21 and to permit upward pivoting of the arm 21 with respect to the ground and the vertical frame member 11. The support member 173 extends downward and rearward from the arm 21, and the engaging member 174 is connected at the distal end of the support member 173. In one embodiment, the length of the support member 173 is adjustable to accommodate different elevations of the arm 21 and the carriage assembly 50. In the embodiment of FIG. 53B, the support member 173 includes a receiving tube 175 extending downward from the arm 21, the engaging member 174 in the form of a moveable leg received in the receiving tube 175 and extending out of the receiving tube 175 to engage the ground surface, and a locking structure 176 engaging the receiving tube 175 and the moveable leg 174 to fix the moveable leg 174 in position with respect to the receiving tube 175. The locking structure 176 is depicted as a removable pin that extends into the passage to engage the elongated member in FIG. 53B, but may be a retractable pin or other locking structure as described herein. The removable or retractable pin can be disengaged from the moveable leg 174 to permit adjustment of the moveable leg 174 to adjust the support 172 among the plurality of different heights. When the engaging member 174 engages the ground, the support member 173 limits further downward pivoting of the arm 21, and when the arm 21 is pivoted upward, the entire support 172 travels with the arm 21. It is understood that other adjustable-height mechanisms and/or different locking structures 176 may be used for the support member 173 and the engaging member 174 in other embodiments.

Figure 54A:
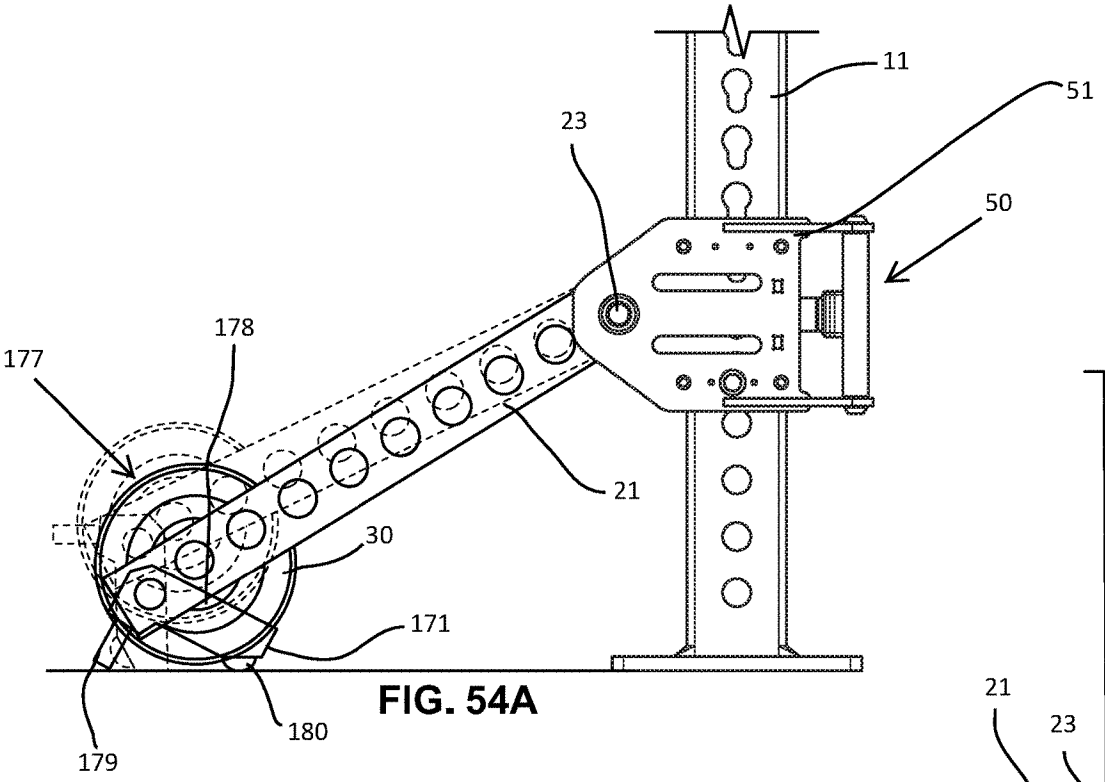
FIG. 54A is a side view of a weightlifting assembly connected to a frame member of a weight rack with another embodiment of a support connected to an articulating arm of the weightlifting assembly according to aspects of the disclosure.
Figure 54B:
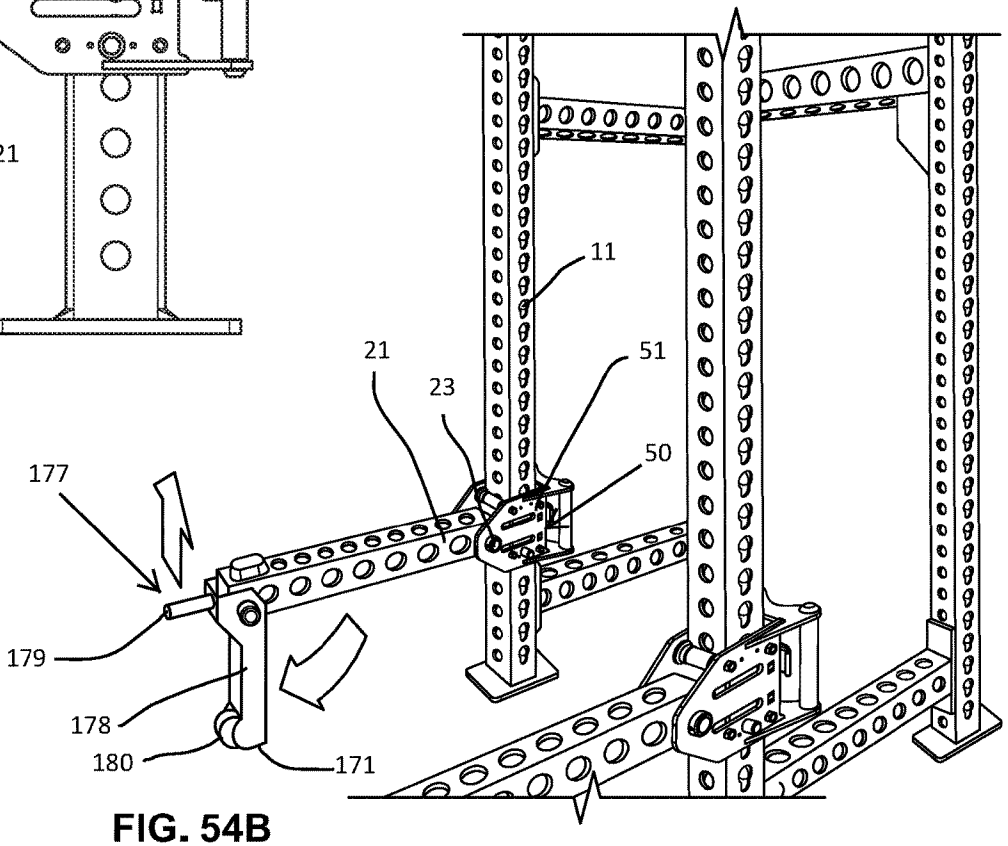
FIG. 54B is a perspective view of the support and portions of the weight rack and the weightlifting assembly of FIG. 54A.

FIGS. 54A-B illustrate an arm 21 with an accessory in the form of a moveable support or jack 177 configured to engage the arm 21 and the ground surface to raise the arm 21 to an elevated position. The moveable support 177 includes an articulating bracket 178 pivotably connected to the arm 21 and moveable between a folded position, where the articulating bracket 178 is configured to engage the ground to support the arm 21 at a first elevated position above the ground, and an extended position, where a distal end 171 of the articulating bracket 178 is configured to be extended away from the arm 21 to support the arm 21 at a second elevated position that is farther above the ground surface than the first elevated position. The support 177 may further include a gripping handle 179 as shown in FIGS. 54A-B, which can be gripped by the user to manipulate the articulating bracket 178 between the extended and folded positions. As shown in FIGS. 54A-B, the handle 179 is elongated and extends approximately perpendicularly (90°) outward from the direction of elongation of the articulating bracket 178, such that pulling upward on the handle 179 causes rotation of the articulating bracket 178 away from the arm 21 to the extended position. The support 177 may further include a rotatable wheel 180 connected to the distal end 171 of the articulating bracket 178 and configured to engage the ground to facilitate movement of the articulating bracket 178 between the folded and extended positions. The handle 179 may further function as a ground-engaging structure in the folded position, as shown in FIG. 54A, where the handle 179 and the wheel 180 engage the ground simultaneously in the folded position.

Figure 55B:
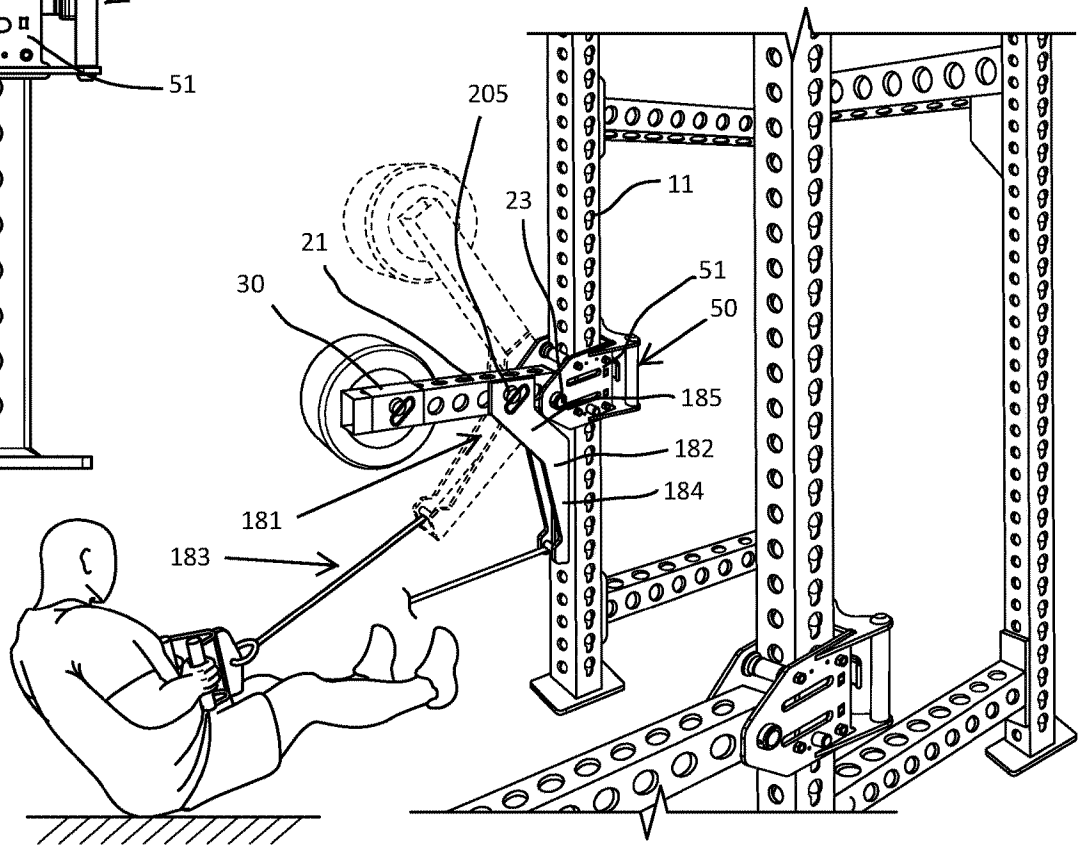
FIG. 55B is a perspective view of portions of the weightlifting assembly and the weight rack of FIG. 55A.
Figure 55A:
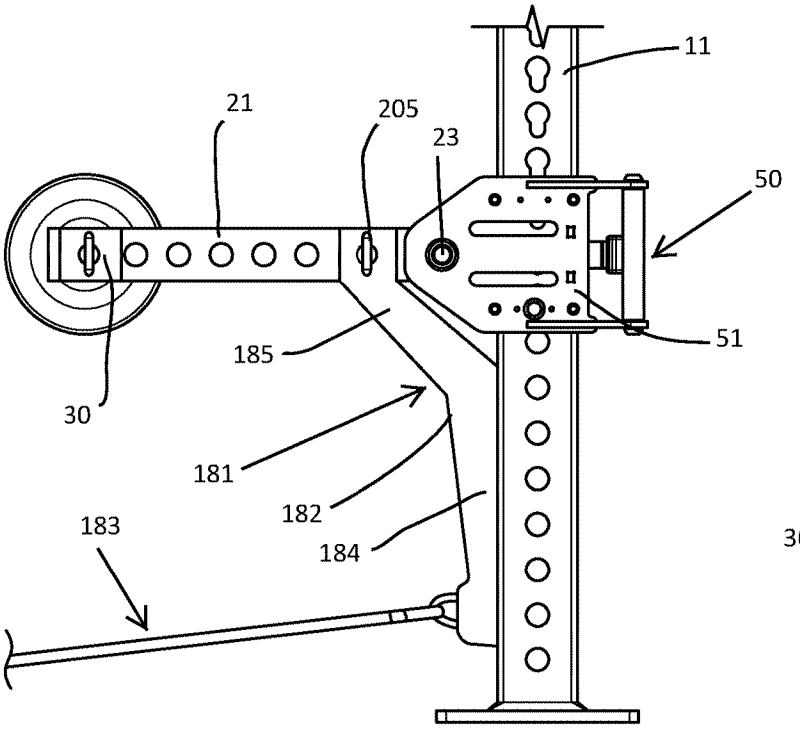
FIG. 55A is a side view of another embodiment of a weightlifting assembly connected to a frame member of a weight rack according to aspects of the disclosure.

FIGS. 55A-B illustrate an arm 21 with an accessory in the form of a weightlifting assembly configured as a rowing attachment 181. The arm 21 may include a weight holder 30 in this configuration, such as any of the various weight holders described herein. The rowing attachment 181 includes a support member 182 connected to the arm 21 and configured to pivot along with the arm 21, and a handle assembly 183 connected to the support member 182 and configured for gripping by a user. The support member 182 in this configuration is fixedly connected to the arm, such as by use of pins, pegs, and/or fasteners, and extends downward and rearward from the arm 21 to engage the vertical frame member 11 to resist downward pivoting of the arm 21 and to permit upward pivoting of the arm with respect to the frame member 11. The support member 182 in FIGS. 55A-B has an angled portion 185 and a straight or abutting portion 184, where the angled portion 185 extends downwardly and rearwardly from the arm 21 toward the frame member 11, and the abutting portion 184 abuts the frame member 11 at the lower limit of pivoting movement of the arm 21. As shown in FIG. 55A-B, the angled portion 185 has an angle and configuration to create an angle of approximately 90° between the abutting portion 184 (or the frame member 11) and the arm 21. In other embodiments, the angled portion 185 may have different angles and configurations, to provide different resting positions for the arm 21. For example, the angled portion 185 may be angled to provide a lower resting angle for the arm 21 as compared to the support member 182 in FIGS. 55A-B, e.g., so that the arm 21 rests at an angle of between 30° and 70° with the abutting portion 184 or the frame member 11, and this lower resting position may increase range of motion for the rowing attachment 181 and increase the consistency of the "felt weight" for the user. The handle assembly 183 is connected to the support member 182 at a location below the pivot connection structure 23 of the arm 21 (e.g., on the abutting portion 184) and extends away from the support member 182. The user can grip the handle assembly 183 and pull the handle assembly 183 away from the vertical frame member 11 to pivot the arm 21, the weight holder 30, and the support member 182 upward during the weightlifting exercise, as shown in FIG. 55B. The handle assembly 183 in FIG. 55B is configured for a rowing exercise, with two gripping members connected to the support member 182 by a cable. The support member 182 may further include a locking structure 205 for locking the support member 182 in position on the arm 21. The locking structure 205 is depicted in FIGS. 55A-B as a removable pin that engages the support member 182 and the arm 21, the locking structure 205 may additionally or alternately include a retractable pin, a fixed peg, and/or other locking structure as described herein, or combinations thereof.

Figures 56A, 56B:
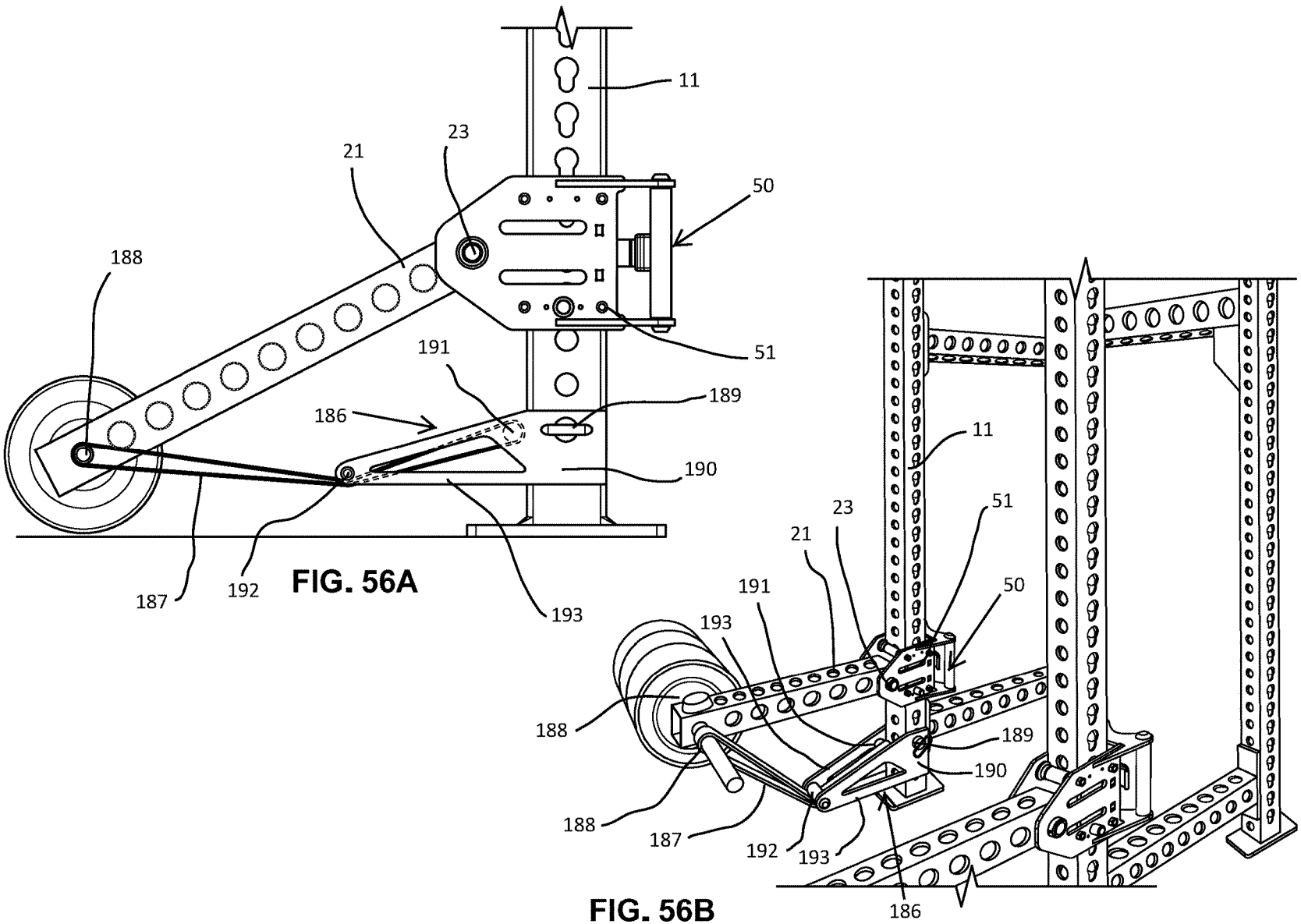
FIG. 56A is a side view of another embodiment of a weightlifting assembly connected to a frame member of a weight rack according to aspects of the disclosure.
FIG. 56B is a perspective view of portions of the weightlifting assembly and the weight rack of FIG. 56A.
Figure 57:
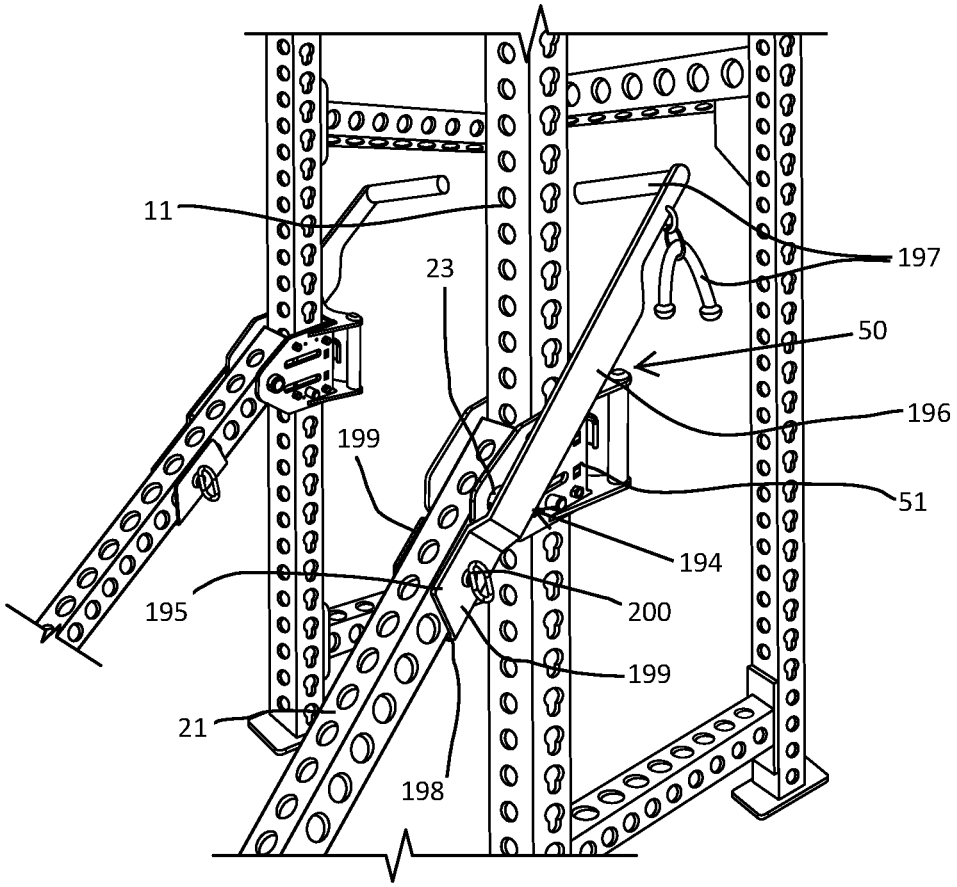
FIG. 57 is a side view of another embodiment of a weightlifting assembly connected to frame members of a weight rack according to aspects of the disclosure.

FIGS. 56A-B illustrate an arm 21 with an accessory in the form of a weightlifting assembly configured as a resistance band assembly 186 for deadlifting or other exercises with a generally vertical weight movement from a lowered weight position, using one or more resistance bands 187 as a weight load. The resistance band assembly 186 includes one or more weight holders 188 connected to the arm 21 and configured to pivot along with the arm 21, and at least one of the weight holders 188 is configured to be loaded with one or more resistance bands 187 for use in a weightlifting exercise. The embodiment of FIGS. 56A-B includes two weight holders 188 that may be configured in the same manner as the weight holders 30, 151 in FIGS. 50A-B, and these weight holders 188 can be used to hold the resistance band(s) 187 or weight plates alternately or simultaneously. The weight holders 188 in FIGS. 56A-B may also be used as gripping handles for moving the arm 21 during the weightlifting exercise, such as during a deadlift exercise. In other embodiments, the resistance band assembly 186 may include a separate articulating or fixed handle assembly, such as any embodiments thereof described herein. The resistance band assembly 186 also includes structures connected to the vertical member 11 to form a fixing point for the resistance band 187. The resistance band assembly 186 in FIGS. 56A-B includes a mounting bracket 190 connected to the vertical frame member 11 on which the arm 21 is mounted, a band holder 191, and a guide 192 for directing the path of the resistance band 187 during the exercise. The guide 192 is positioned more proximate to the distal end of the mounting bracket 190 relative to the band holder 191, such that the band 187 is connected at one end to the band holder 191 and at the other end to the weight holder 188, and the band 187 engages the guide 192 between the band holder 191 and the weight holder 188 to redirect the band 187. The guide 192 in FIGS. 56A-B is in the form of a freely rotatable roller located at the distal end of the mounting bracket 190, and the resistance band 187 extends from the band holder 191, below the roller 192, and to the weight holder 188. The roller 192 is rotatable to accommodate stretching and contraction of the band 187 without excessive friction. The mounting bracket 190 in FIGS. 56A-B includes two spaced legs 193 extending outward from the frame member 11, and the roller 192 is connected to the legs 193 and extends between the legs 193. The roller 192 may have a groove or a concave contour in the outer surface in one embodiment. The support member 182 may further include a locking structure 189 for locking the mounting bracket 190 in position on the vertical member 11, which may be configured according to any embodiments described herein. The locking structure 189 is depicted as a removable pin, but may additionally or alternately include a retractable pin, a fixed peg, and/or other locking structure as described herein, or combinations thereof.

FIGS. 57A-B illustrate an arm 21 with an accessory in the form of a handle assembly 194 connected to the articulating arm 21 and configured to use a lever arm configuration to achieve upward rotation of the arm 21 with downward effort applied to the handle assembly 194. The articulating arm 21 in this embodiment is mounted on the vertical frame member 11, such as by a carriage 51, and extends in a first direction from the frame member 11. The handle assembly 194 includes a mounting bracket 195 connected to the arm 21 and a lever arm 196 that extends from the mounting bracket 195 in a second direction that is opposite the first direction in which the arm 21 extends from the frame member 11. In this configuration, the lever arm extends beyond the pivot connection structure 23 of the arm 21 and extends beyond the frame 11 member in the second direction. A handle 197 may be connected to the lever arm 196 at a location beyond the pivot connection 23 from the mounting bracket 195, such that the mounting bracket 195 and the handle 197 are positioned on opposite sides of the fulcrum, i.e., the pivot connection 23. In this configuration, a downward force exerted on the handle 197 causes the arm to pivot upward toward the vertical frame member 11. Various types of handles 197 may be used in connection with the handle assembly 194, including handles 197 configured for exercises that involve downward pulling, such as lat pull handles and tricep extension handles, both of which are shown in FIGS. 57A-B. The mounting bracket 195 in FIGS. 57A-B generally includes a transverse wall 198 extending along an underside of the arm 21 and a pair of sidewalls 199 extending upward from the transverse wall 198 along lateral sides of the arm 21. The mounting bracket 195 may further include a locking structure 200 for locking the mounting bracket 195 in position on the arm 21. The locking structure 200 is depicted in FIGS. 57A-B as a removable pin that engages the mounting bracket 195 and the arm 21, the locking structure 200 may additionally or alternately include a retractable pin, a fixed peg, and/or other locking structure as described herein, or combinations thereof.

Figure 58B:
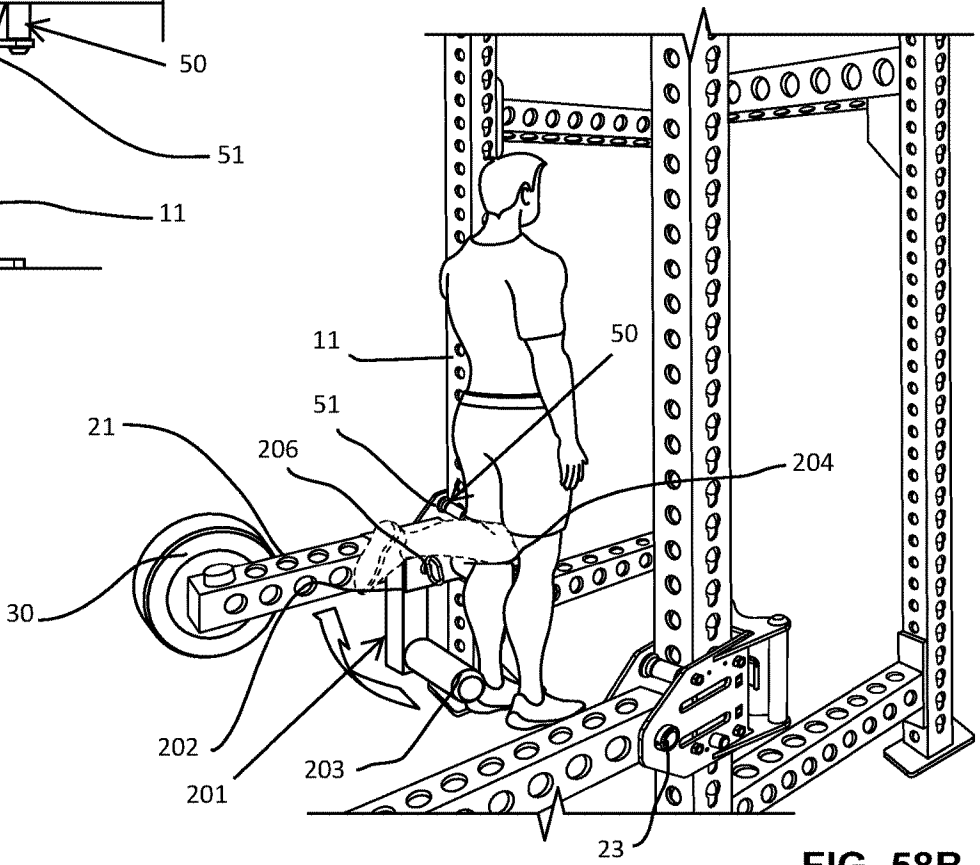
FIG. 58B is a perspective view of portions of the weightlifting assembly and the weight rack of FIG. 58A.
Figure 58A:
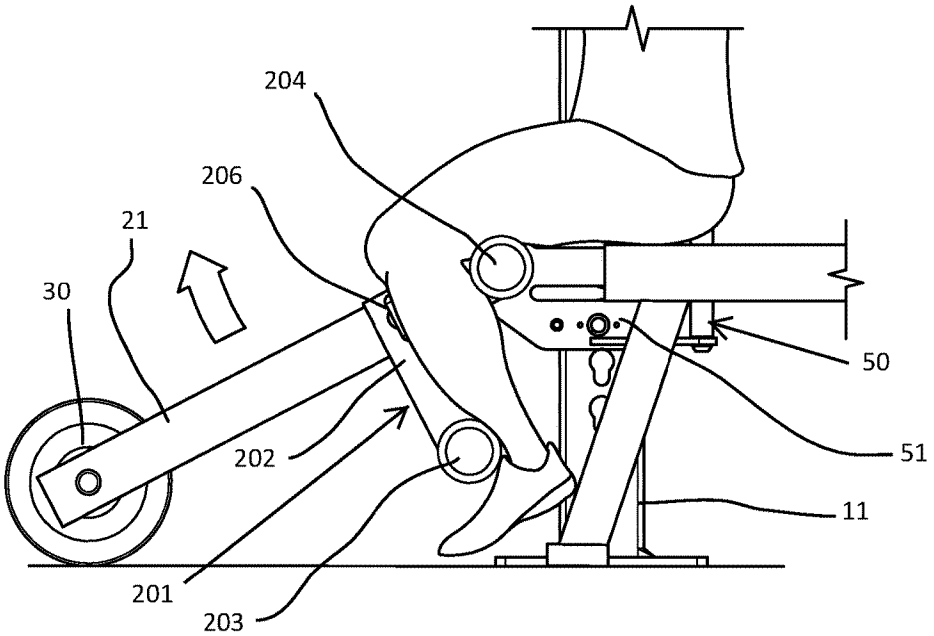
FIG. 58A is a side view of another embodiment of a weightlifting assembly connected to a frame member of a weight rack according to aspects of the disclosure.
Figure 59:
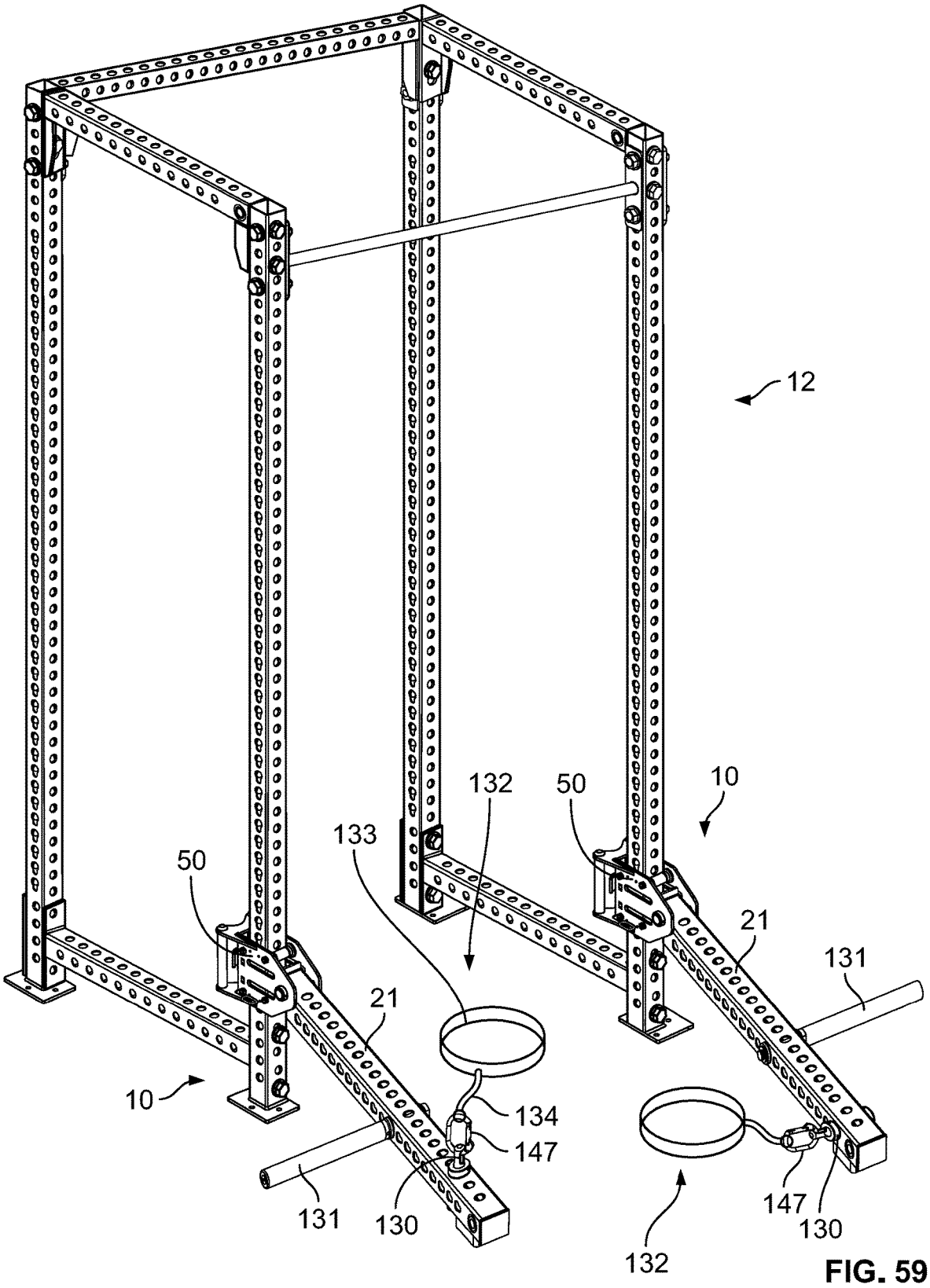
FIG. 59 is a front perspective view of a weight rack having two weightlifting assemblies as shown in FIG. 1 with another embodiment of an accessory connected to each articulating arm in the form of a releasable accessory connection and a weight holder, according to aspects of the disclosure.
Figure 60:
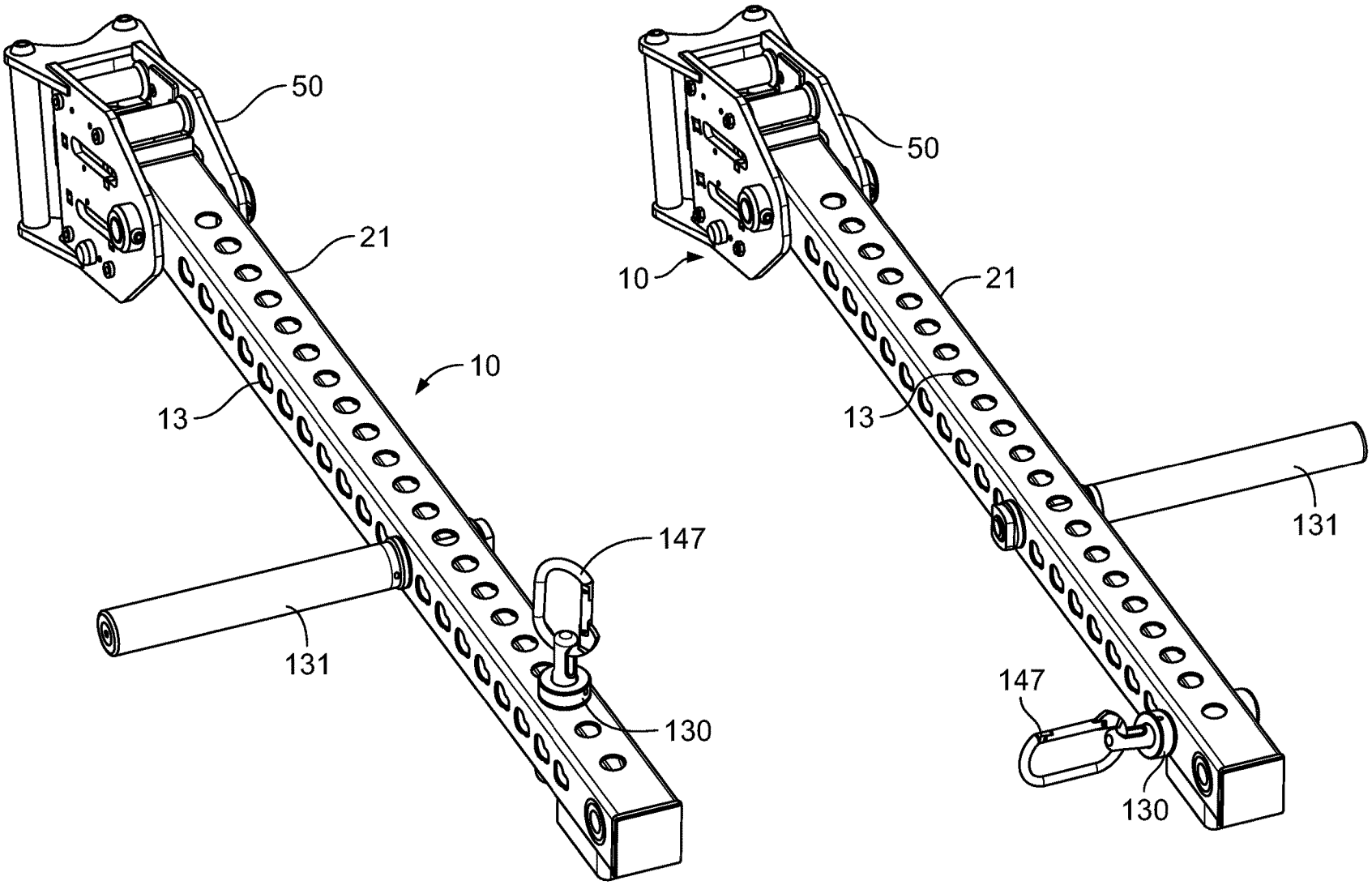
FIG. 60 is a front perspective view of the two weightlifting assemblies of FIG. 59.
Figure 61:
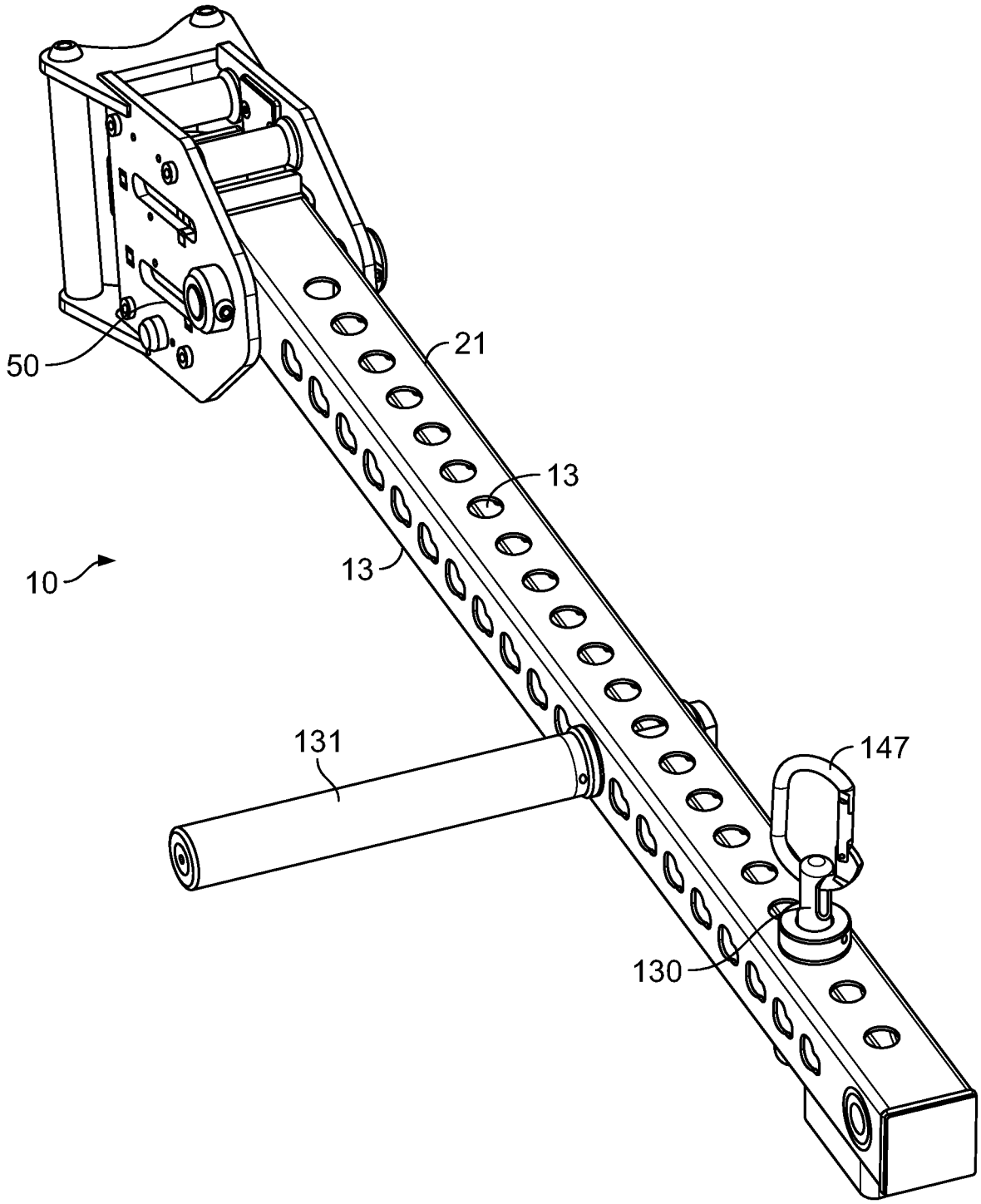
FIG. 61 is a front perspective view of one of the weightlifting assemblies of FIG. 59, with the releasable accessory connection arranged in a first configuration.
Figure 62:
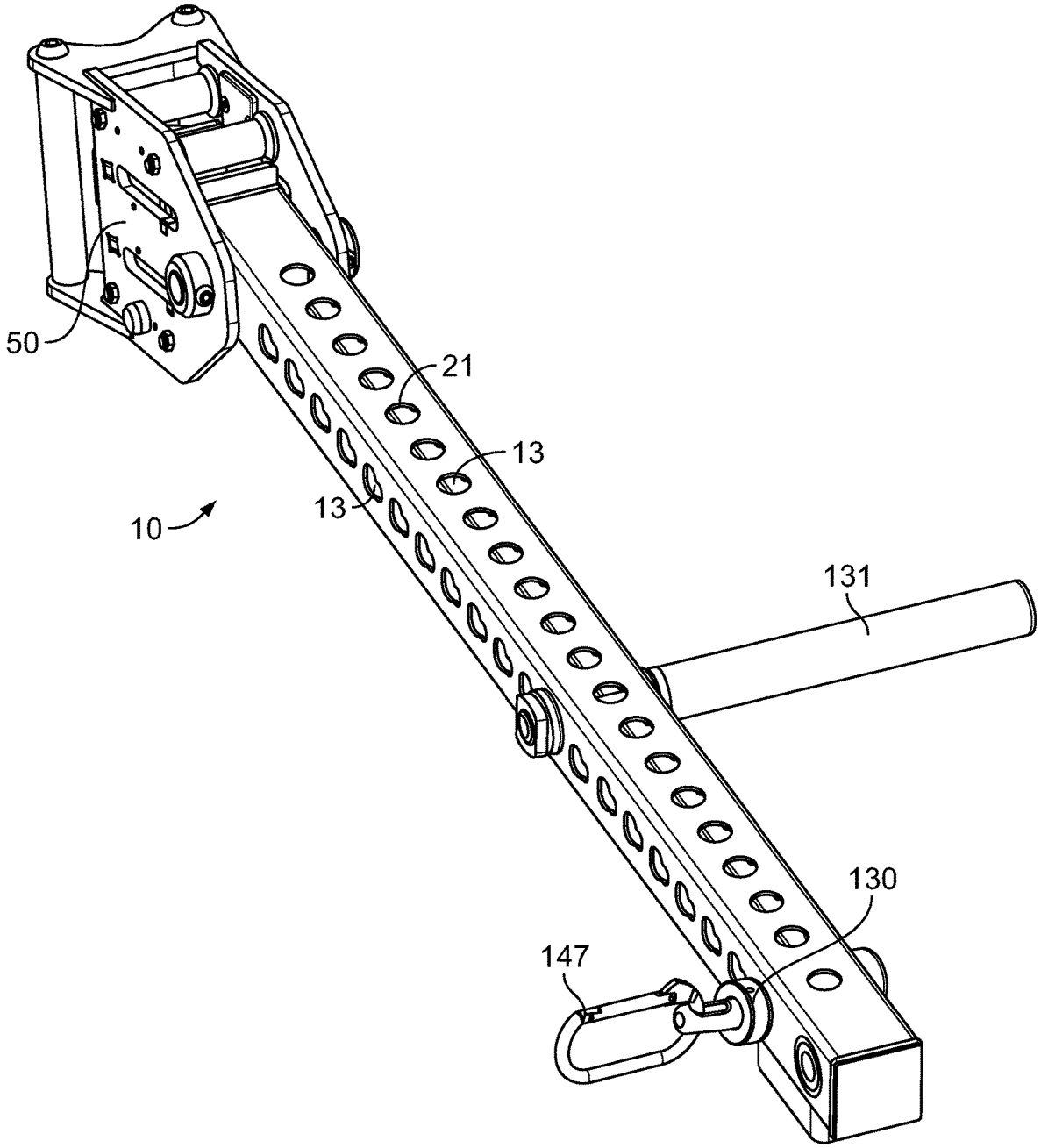
FIG. 62 is a front perspective view of another of the weightlifting assemblies of FIG. 59, with the releasable accessory connection arranged in a second configuration.

FIGS. 58A-B illustrate an arm 21 with an accessory in the form of a weightlifting assembly including a leg-engaging assembly 201 configured to be engaged by a user's leg for exertion of force to pivot the arm 21 during a weightlifting exercise (e.g., leg curls and/or extensions). The arm 21 in this embodiment may have a weight holder 30 connected thereto, which may be any weight holder shown and described herein. The leg-engaging assembly 201 generally includes a mounting bracket 202 connected to the arm 21 to pivot with the arm 21, an engagement member 203 engaged by a lower portion of the user's leg (e.g., the heel, shin, upper foot, etc.) for exertion of force to pivot the arm 21 during the weightlifting exercise, and a stabilizing member 204. The stabilizing member 204 is located above the engagement member 203 and is configured to engage an opposite side of the user's leg from the engagement member 203, at a higher location than the engagement member 203, e.g., the front or rear area around the user's knee. It is understood that the leg-engaging assembly 201 may include length adjustment mechanisms for adjusting the position of the engagement member 203 and/or the stabilizing member 204 to fit the assembly 201 to the user. The stabilizing member 204 and the engagement member 203 may both be padded cylinders, as commonly used in devices for leg exercises such as leg curls and extensions. The mounting bracket 202 may further include a locking structure 206 for locking the mounting bracket 202 in position on the arm 21. The locking structure 206 is depicted in FIGS. 58A-B as a removable pin that engages the mounting bracket 202 and the arm 21, the locking structure 206 may additionally or alternately include a retractable pin, a fixed peg, and/or other locking structure as described herein, or combinations thereof.

The arm 21 in FIGS. 59-64 has accessories in the form of a releasable accessory connection 130 for connection to an additional accessory and a weight holder 131 for holding one or more weights, e.g., in the form of weight plates, both of which are connected to the arm 21 for use in a weight-lifting exercise. The releasable accessory connection 130 in the embodiment of FIGS. 59-64 is connected to the arm 21 and configured for releasable connection to an additional accessory 132 that may not be configured for direct connection to the arm 21. In the configuration shown in FIG. 59, the additional accessory 132 includes a squat belt accessory that includes a belt 133 and a tether 134 having one end connected to the belt 133 and the other end configured for connection to the releasable accessory connection 130. It is understood that numerous other accessories may be connected to the releasable accessory connection 130, including other accessories designed for squat exercises or other types of exercises, and that the carriage assembly 50 and/or the arm 21 may be located in different positions for use with such other accessories.

Figure 64:
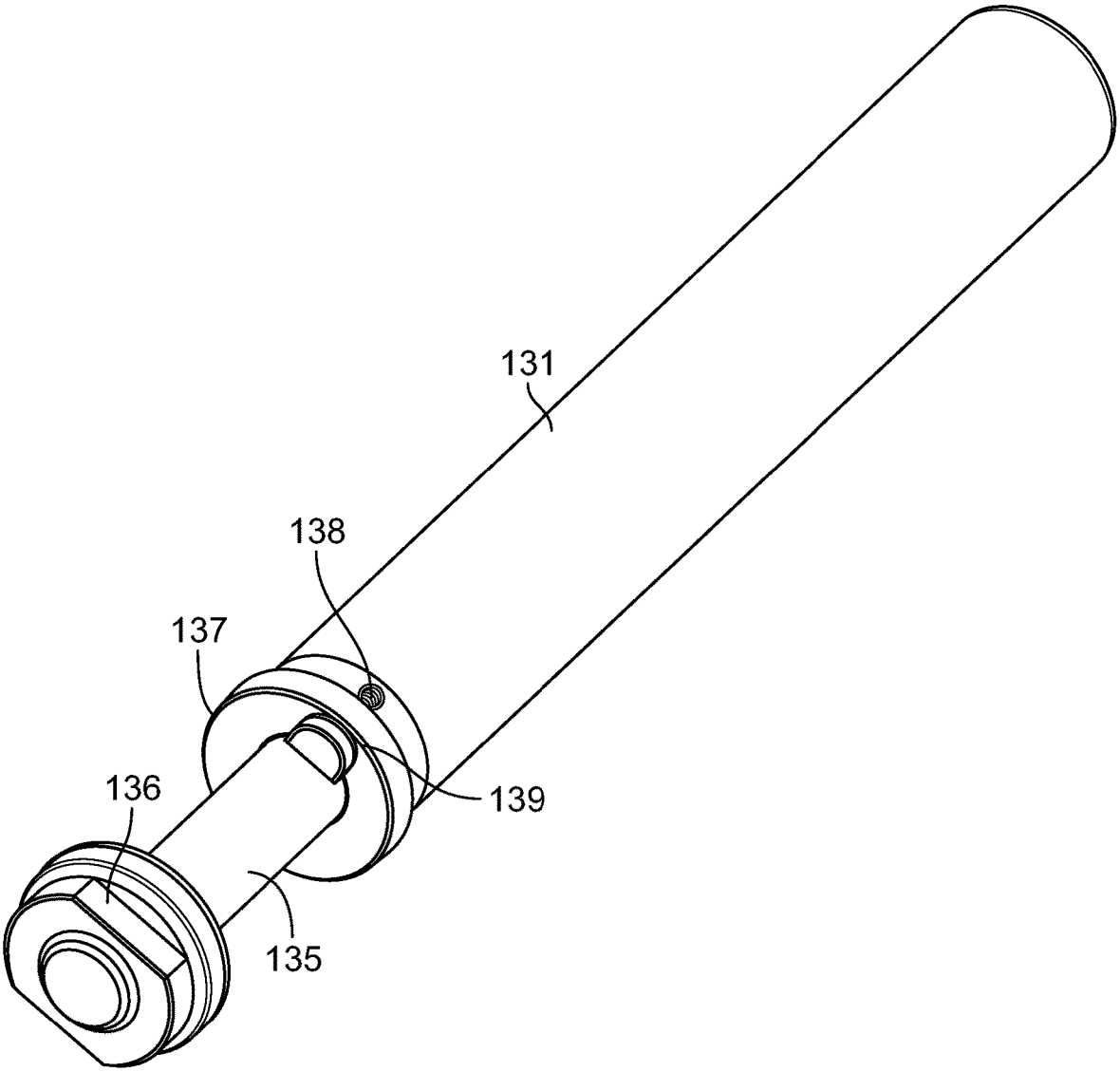
FIG. 64 is a perspective view of one of the weight holders of FIG. 59.

The weight holder 131 is mounted to the arm 21 by a fixing structures in the form of a bolt or pin 135 that extends through the arm 21 (i.e., through the holes 13) and is fastened by an end cap 136, but may alternately be in the form of one or more removable pins, detent pins, spring pins, or other connections. The fixing structure for the weight holder 131 is shown in greater detail in FIG. 64 and includes a first contact piece 137 positioned adjacent the proximal end of the weight holder 131, which engages one side of the arm 21. The first contact piece 137 in FIG. 64 is collar formed as a separate piece from the weight holder 131, which is fixed in position on the pin 135 by a set screw 138, but may be part of the weight holder 131 in another embodiment. The first contact piece 137 has a projection 139 that is configured to be received in a portion of the hole 13 on the arm 21 to rotationally fix the pin 135 in place. The end cap 136 is removably connected to the pin 135, such as by threading (not shown) or other connection structure and forms a second contact piece, such that the end cap 136 and the first contact piece 137 engage opposite sides of the arm 21. This configuration permits the weight holder 131 to be positioned at a desired position along the length of the arm 21. The position of the weight holder 131 may be adjusted by removing the end cap 136 and relocating the weight holder 131 along the length of the arm 21 to a desired position, and then re-inserting the pin 135 in the desired hole 13 and reconnecting the end cap 136. It is understood that the weight holder 131 may be used in any other embodiments described herein, such as to form the weight holder 30 as described in various embodiments.

Figure 63:
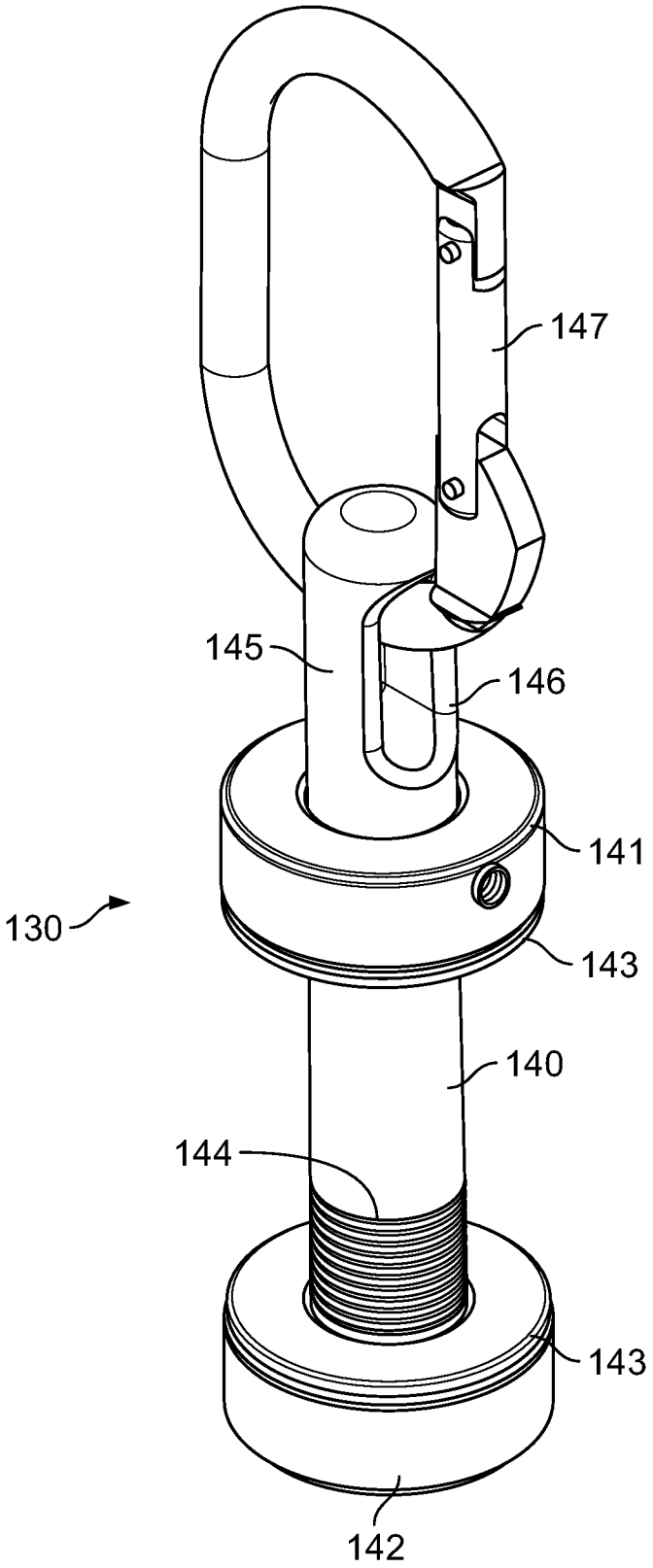
FIG. 63 is a perspective view of one of the releasable accessory connections of FIG. 59.

The releasable accessory connection 130 in FIGS. 59-63 is shown in greater detail in FIG. 63 and may be configured as shown and described in U.S. Provisional Application No. 62/747,953, filed Oct. 19, 2018, which is incorporated by reference herein, e.g., in the embodiment in FIGS. 15-19 in the '953 application. In this configuration, the releasable accessory connection 130 may include a pin or shaft 140 that is received through the arm 21 (i.e., through holes 13), having a pair of engagement members 141, 142 connected to the shaft 140 at locations spaced from each other along the length of the shaft 140, along with spacers 143 engaged with the engagement members 141, 142 to contact the outer surfaces of the arm 21. The engagement members 141, 142 include a first, fixed engagement member 141 connected to the shaft 140 and a second, removable and/or adjustable engagement member 142 connected to the shaft 140 in a removable and/or adjustable engagement, such as by threading 144 on the shaft 140. This permits the releasable accessory connection 130 to be connected and/or relocated at a desired location and for the releasable accessory connection 130 to be tightly engaged with the arm 21. The shaft 140 in this embodiment has a connector 145 formed by an elongated aperture 146 extending through the body of the shaft 140 proximate the first engagement member 141, which is configured to receive a karabiner 147 or various other components that can connect to the connector 145 by extending through the aperture 146. The karabiner 147 is also releasably connectable to the additional accessory 132. The releasable accessory connection 130 can be mounted in a vertical orientation (see FIG. 61) or a horizontal orientation (see FIG. 62).

Figure 68:
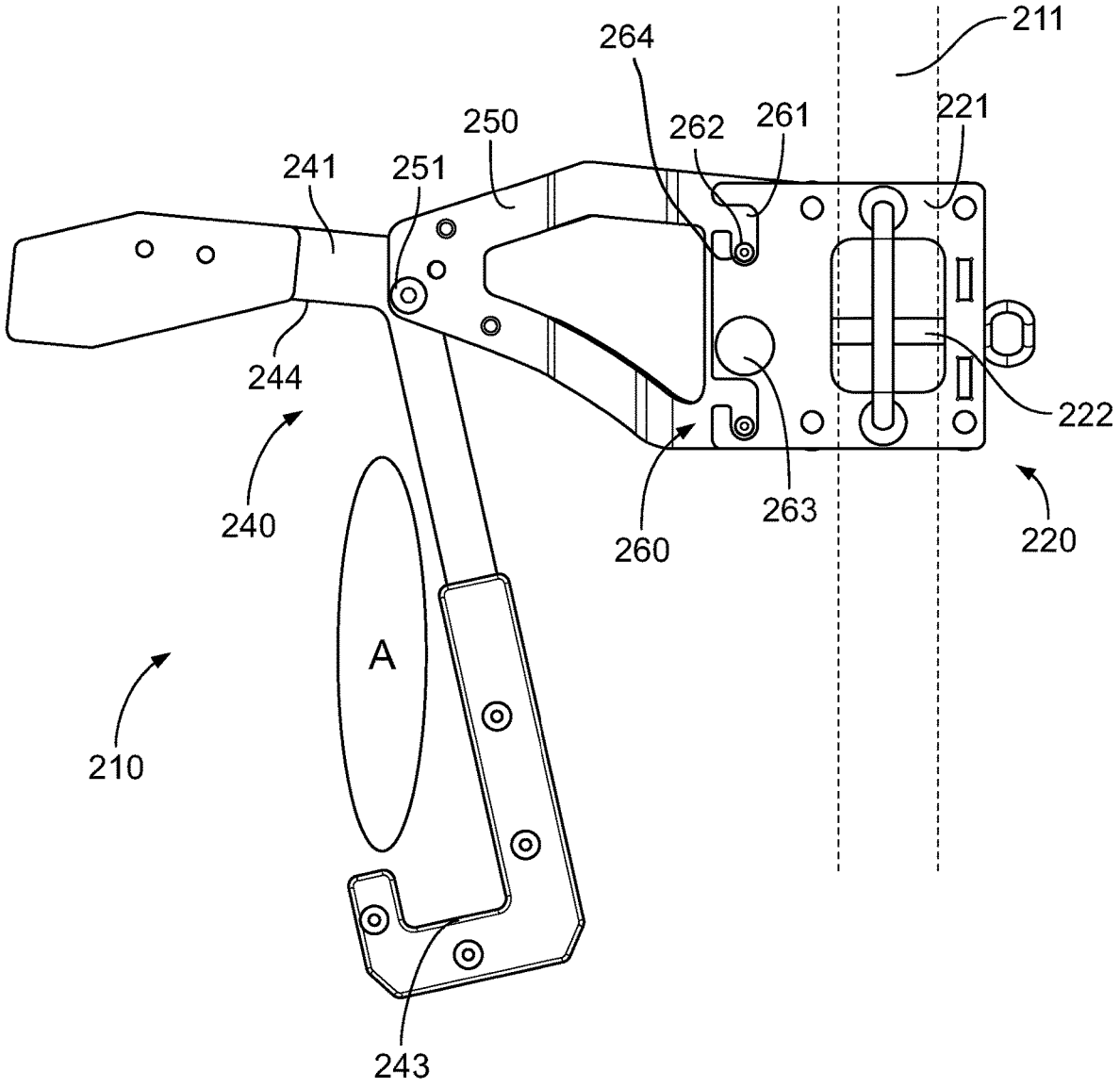
FIG. 68 is a side view of the carriage assembly of FIG. 65 mounted on a frame member of a weight rack assembly.
Figure 69:
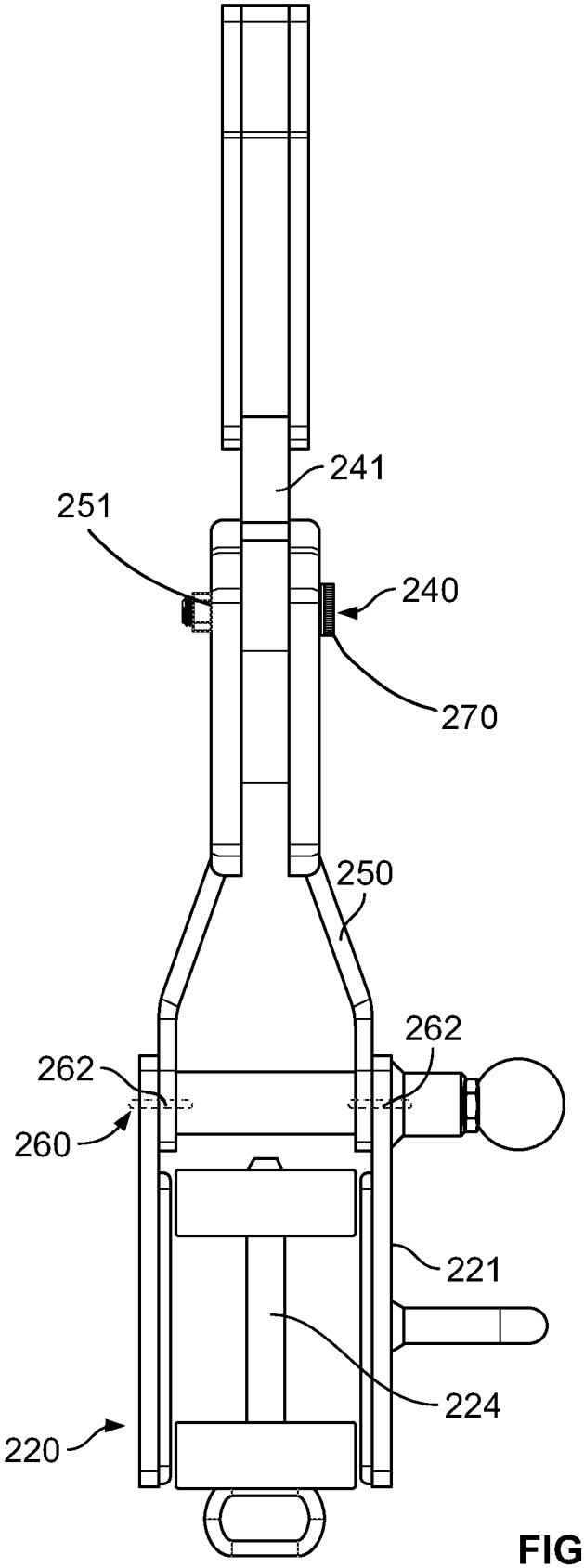
FIG. 69 is a bottom view of the carriage assembly of FIG. 65.
Figure 70:
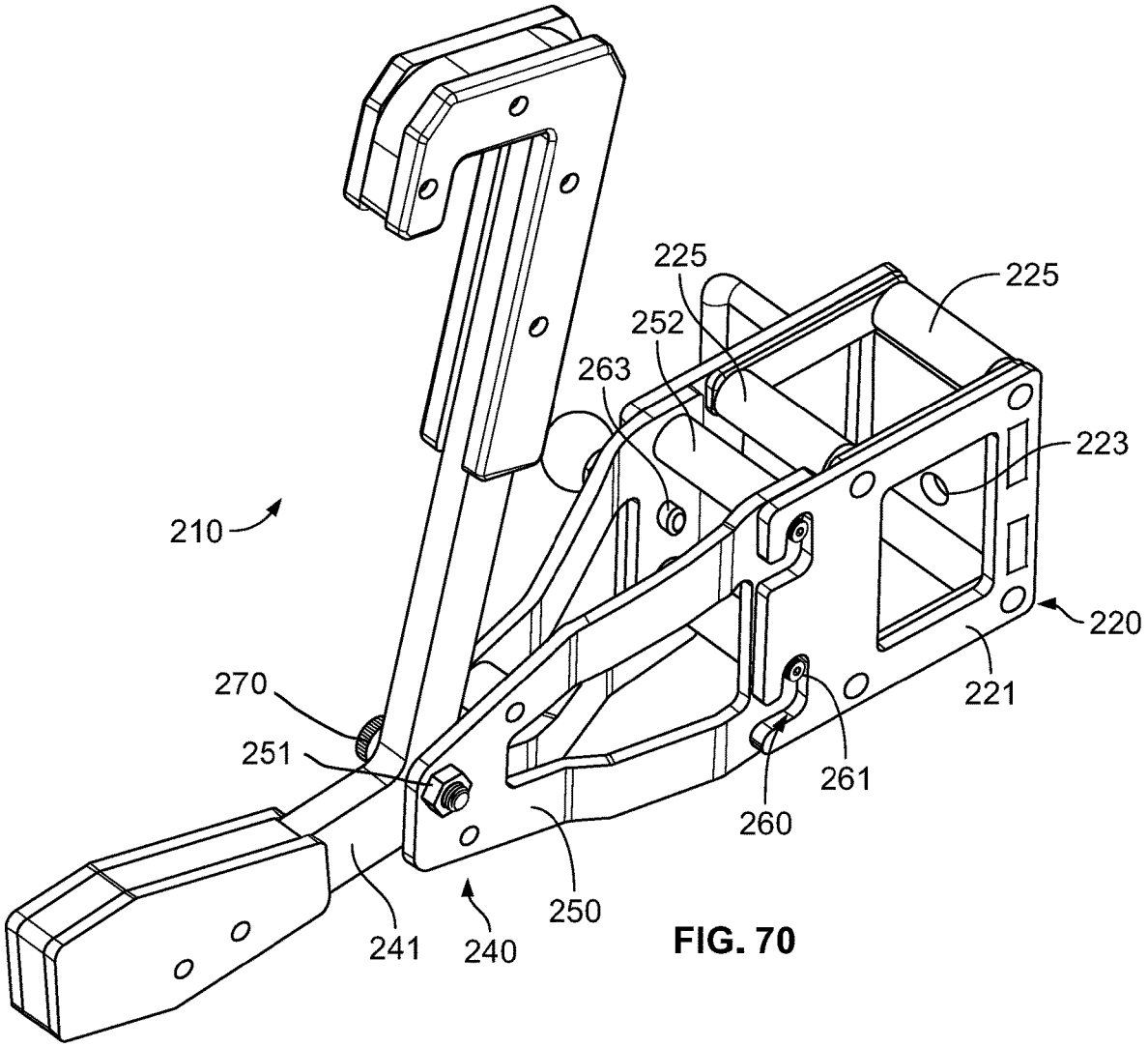
FIG. 70 is a bottom perspective view of the carriage assembly of FIG. 65.
Figure 71:
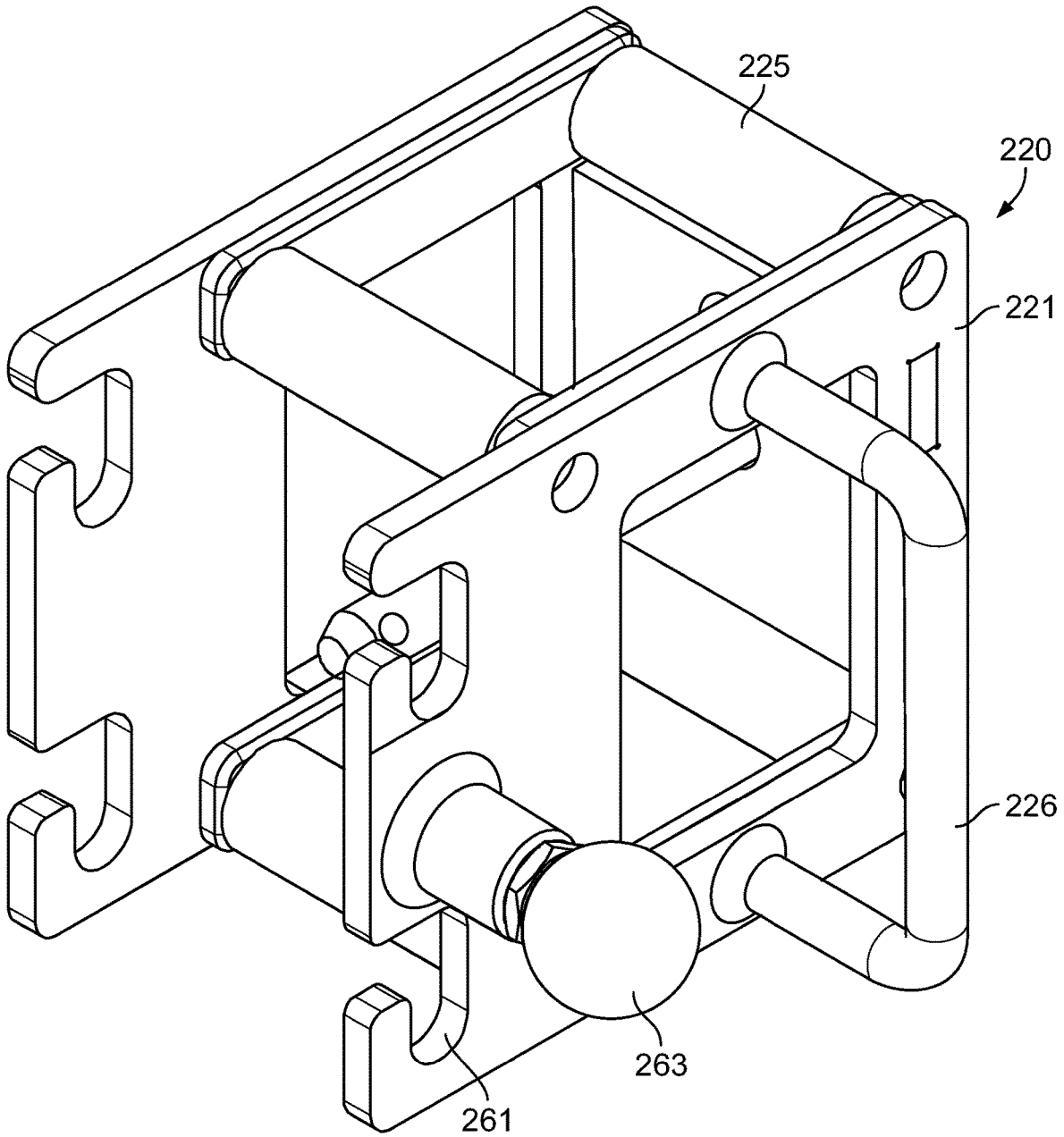
FIG. 71 is a perspective view of an adjustable bracket of the carriage assembly of FIG. 65.
Figure 72:
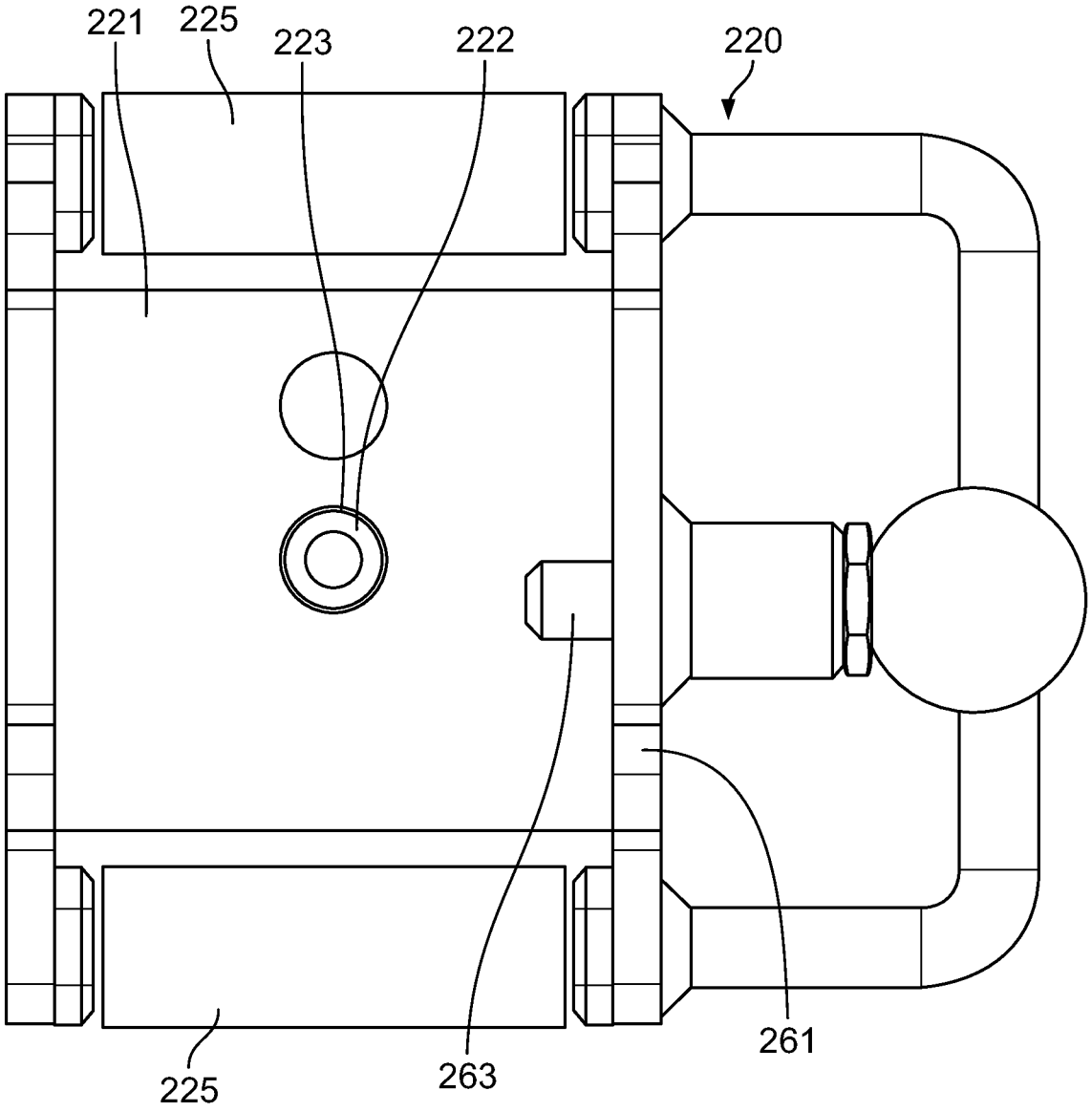
FIG. 72 is a front view of the adjustable bracket of FIG. 71.
Figure 73:
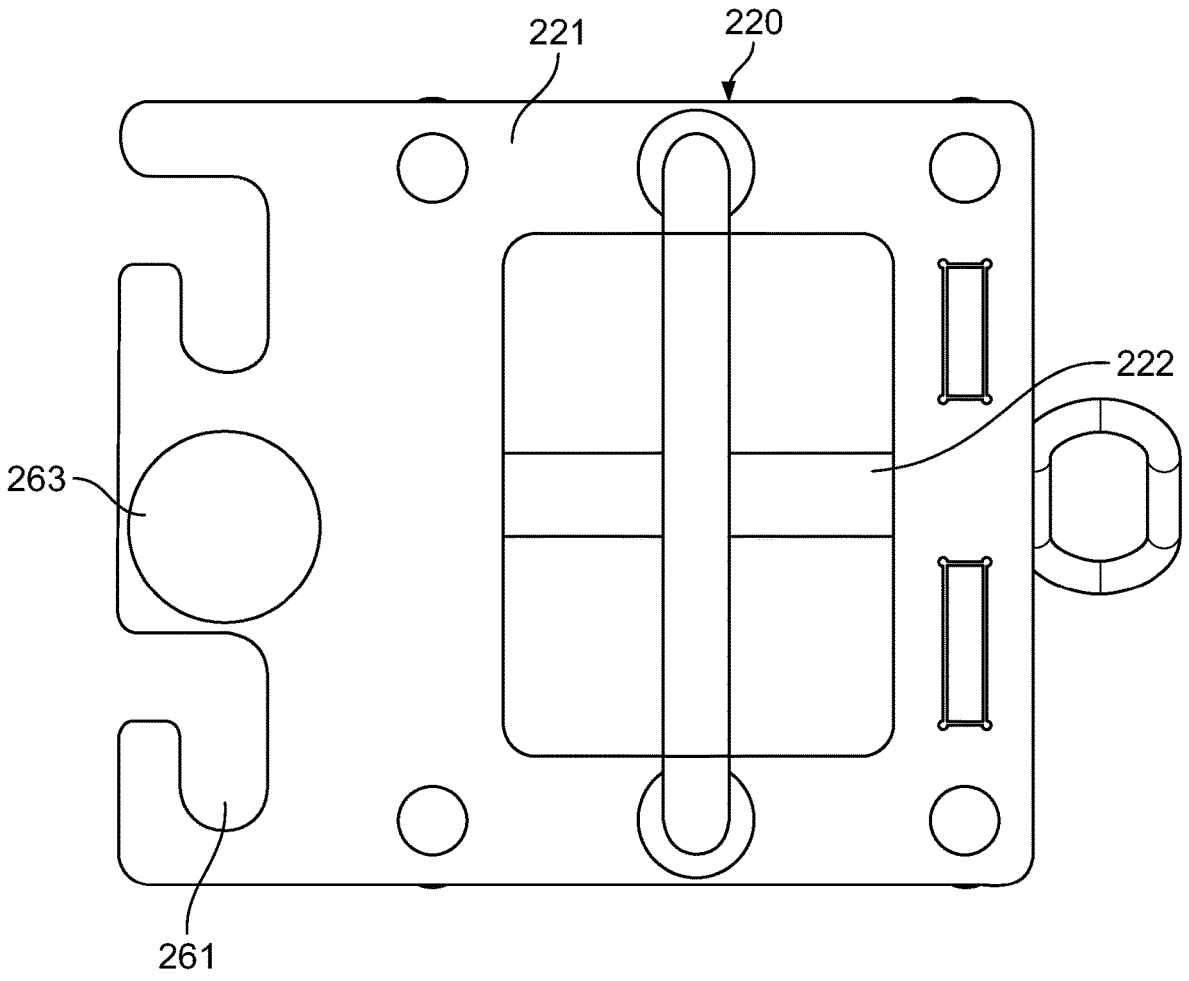
FIG. 73 is a side view of the adjustable bracket of FIG. 71.
Figure 74:
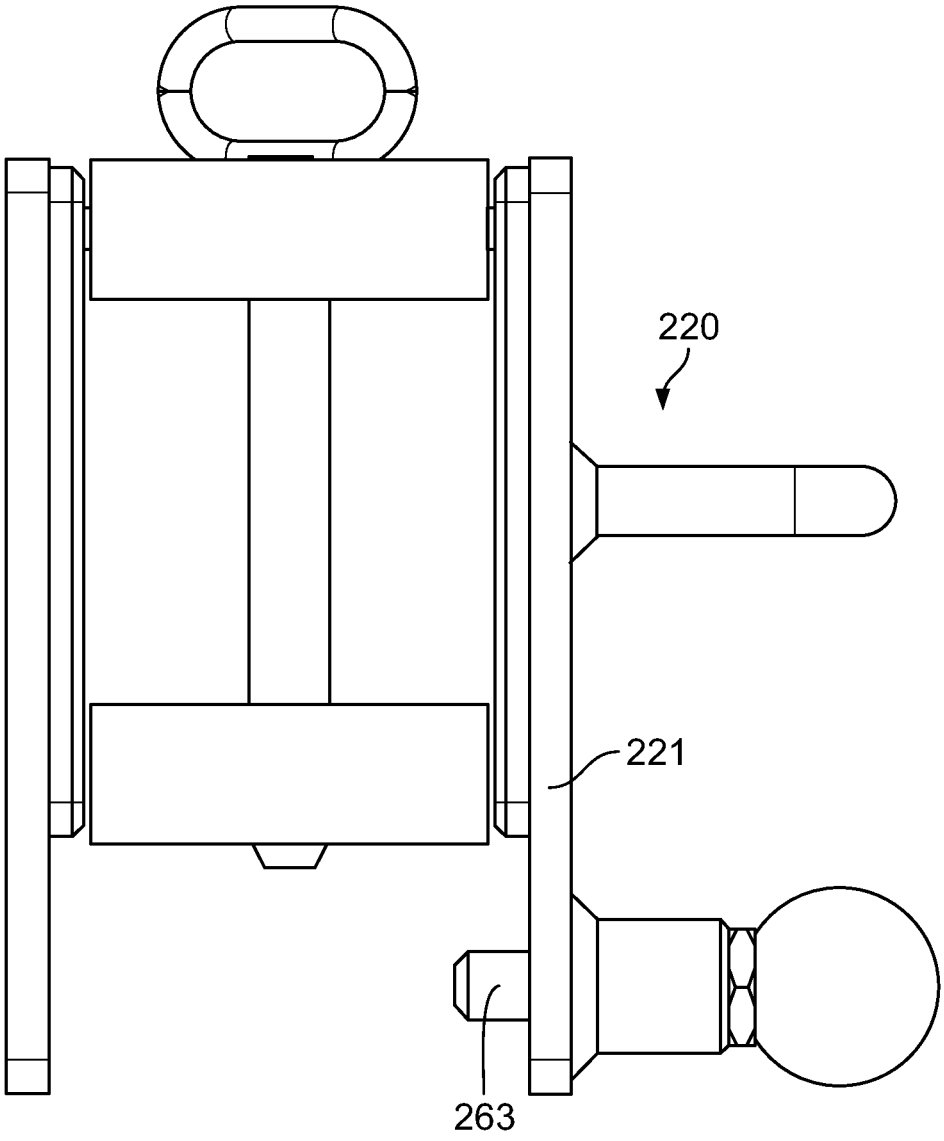
FIG. 74 is a top view of the adjustable bracket of FIG. 71.
Figure 75:
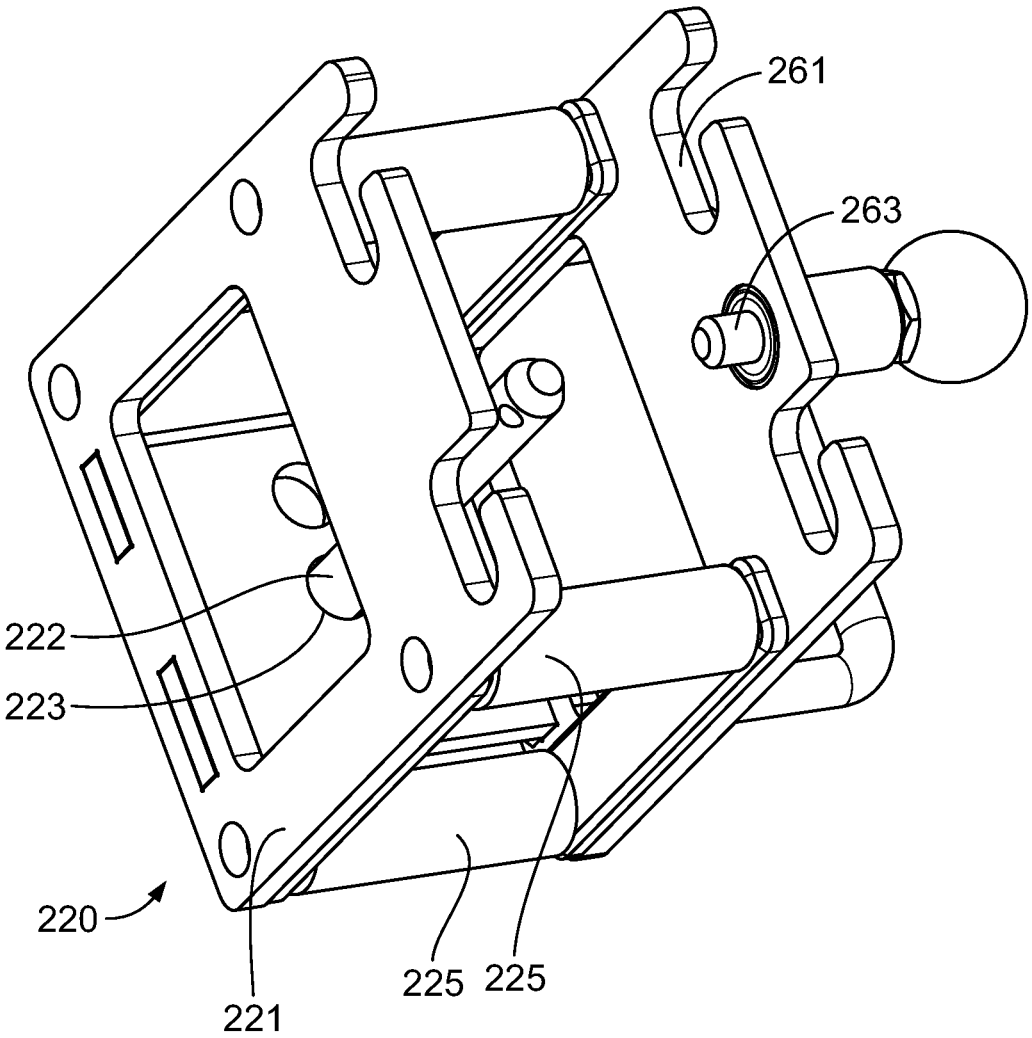
FIG. 75 is a bottom perspective view of the adjustable bracket of FIG. 71.
Figure 76:
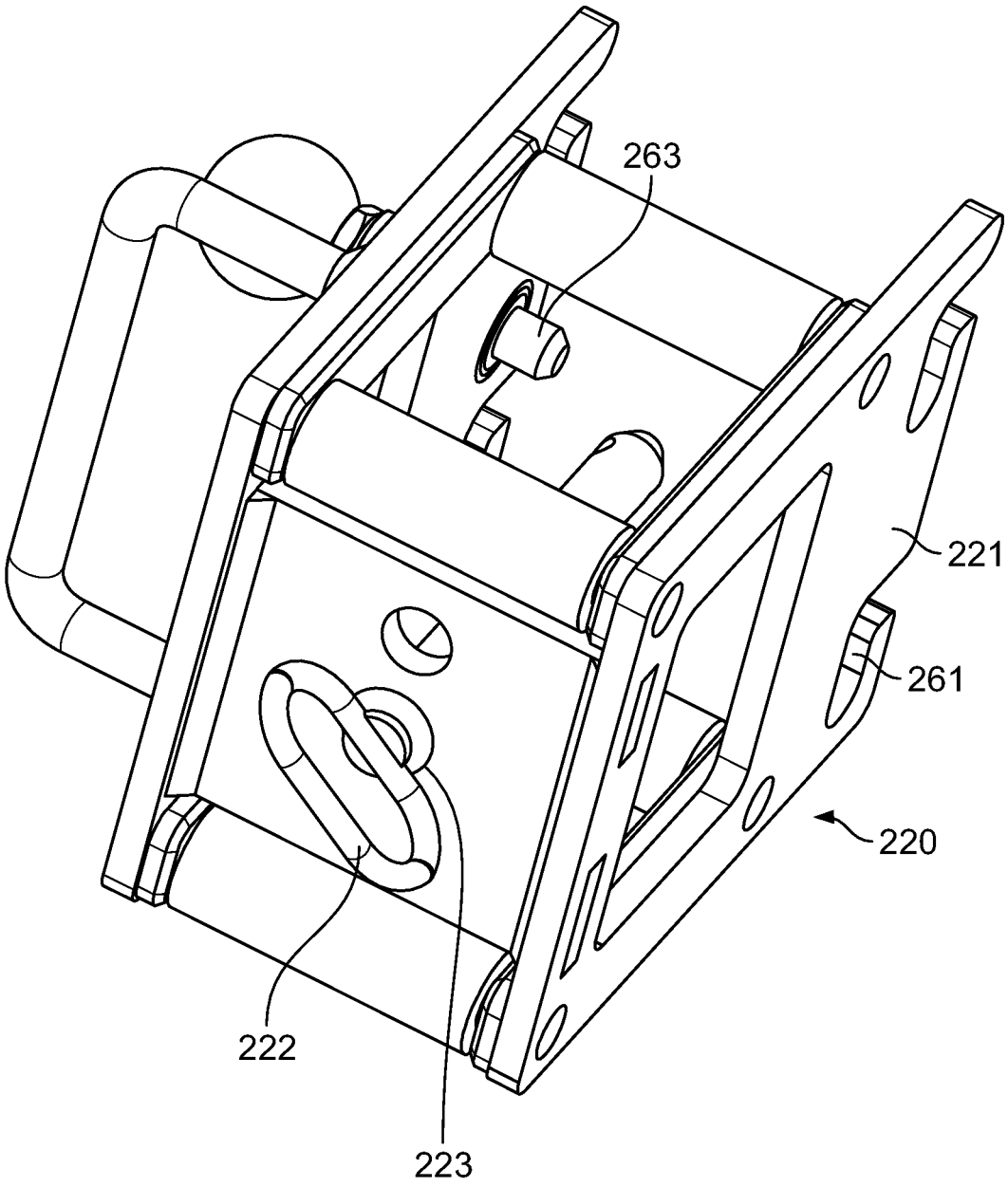
FIG. 76 is a top rear perspective view of the adjustable bracket of FIG. 71.

FIGS. 65-76 illustrate another embodiment of a weight-lifting assembly 210 for connection to a frame member of a weight rack, such as the vertical member 211 shown in broken lines in FIG. 68. Such a frame member may have a plurality of holes extending through the sides of the frame member for connection to a variety of different components, as described herein. The weightlifting assembly 210 includes a carriage assembly 220 and an implement 240 connected to the carriage assembly 220. The carriage assembly 220 is configured to be adjustably mounted on the frame member 211 to permit sliding of carriage assembly 220 axially along the frame member 211 and fixing of the carriage assembly 220 at a plurality of different axial positions (vertical positions in FIG. 68). The carriage assembly 220 includes an adjustable bracket 221 and a mounting bracket 250 that is removably connected to the adjustable bracket 221, and the implement 240 is connected to the mounting bracket 250 to permit disconnection of the implement 240 and reconnection of a different implement (not shown). FIGS. 77-87 illustrate a second embodiment of a weightlifting assembly 210 that includes many components in common with the assembly 210 in FIGS. 65-76. The following description will be described primarily with respect to the embodiment of FIGS. 65-76, with the understanding that the embodiment of FIGS. 77-87 may utilize similar components, features, and functionality, and that the embodiment of FIGS. 77-87 may in some circumstances only be described with respect to the differences from FIGS. 65-76 for the sake of brevity. The implement 240 illustrated in FIGS. 65-87 is a counterweighted Monolift attachment.

The carriage assembly 220 in FIGS. 65-76 includes an adjustable bracket 221 that is configured to define a passage for receiving the frame member 211 and a mounting bracket 250 connected to the adjustable bracket 221, as well as a locking structure configured for engaging the frame member 211 to lock the carriage assembly 220 in position relative to the frame member 211. The locking structure in FIGS. 65-76 is in the form of a fixing pin 222 that is configured to extend through a hole or holes in the frame member 211 to fix the carriage assembly 220 in position on the frame member 211. The fixing pin 222 in FIGS. 65-76 is in the form of a detent pin that extends through a hole 223 in a rear plate of the adjustable bracket 221. The fixing pin 222 may include a retaining structure to retain the pin 222 in the hole 223 and in connection with the frame member 211, including a detent, a tab, a cotter key, or other structure. The fixing pin 222 in FIGS. 77-87 is in the form of a sliding pin with an angled end that rotates to fit within a slot 224 on the rear of the adjustable bracket 221, in order to resist removal of the pin 222, as shown in FIGS. 80-82 and 85-86. The carriage assembly 220 in FIGS. 65-76 includes four rollers 225 mounted on the adjustable bracket 221 that engage the front and rear surfaces of the frame member 211 and ease movement of the carriage assembly 220 along the frame member 211 when desired. The carriage assembly 220 in FIGS. 77-87 includes only two rollers 225 on the rear side of the adjustable bracket 221, and the other two rollers 225 are provided on the mounting bracket 250, such that all four rollers 225 engage the frame member 211 only when the mounting bracket 250 is connected to the carriage assembly 220. The rollers 225 may be made from a hard plastic (e.g., UHMW) or other polymer material in one embodiment, but may be made from other materials (e.g., aluminum or other metals) in another embodiment. The carriage assembly 220 also has a handle 226 on the adjustable bracket 221 for gripping by the user to adjust the position of the carriage assembly 220.

Figure 88:
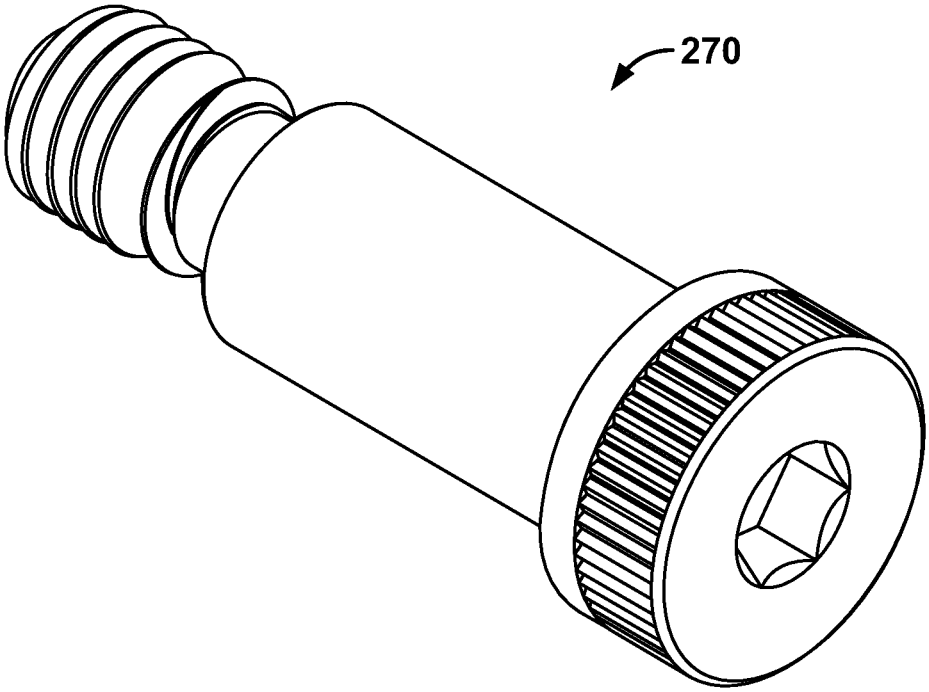
FIG. 88 is a perspective view of one embodiment of a socket cap bolt of the carriage assembly of FIG. 77.

The mounting bracket 250 is connected to the implement 240, which may include an exercise implement 241 connected to the mounting bracket 250 for use in a physical exercise such as weight lifting. The mounting bracket 250 includes a pivot connection 251 that permits connection of an exercise implement 241 in a pivoting or rotating connection. The pivot connection 251 is formed by a socket cap bolt 270 in one embodiment, and such a bolt is shown in FIG. 88. The Monolift attachment 241 includes a pivoting piece 242 with a hook 243 and a counterweight 244. Support pieces 245 may be connected to the hook 243, and additional counterweight pieces 246, 247 may be connected to the counterweight 244. In one embodiment of a manufacturing method, the pivoting piece 242 may be cut from a piece of steel (or other metal) plate and one or more of the counterweight pieces 246, 247 may be cut from the same piece of metal plate in the area (A) between the counterweight and the hook 244 (See FIG. 68), in order to reduce overall material waste. In one embodiment, the additional counterweight pieces 246, 247 can be cut from the excess portions (e.g., within the area (A) of a rectangular piece of minimum size necessary to cut the pivoting piece 242, no additional portion of the rectangular piece of the metal plate is necessary to be used for cutting the additional counterweight pieces 246, 247. The mounting bracket 250 may further include a hole 253 to permit insertion of a stop pin to operate as a rotational stop for the pivoting piece 242.

The adjustable bracket 221 and the mounting bracket 250 include engaging structures 260 to removably connect the mounting bracket 250 to the adjustable bracket 221. In FIGS. 65-76, the adjustable bracket 221 includes four slots 261 (which are L-shaped in this embodiment) to receive four projections 262 on the mounting bracket 250 (shown schematically in broken lines in FIG. 67). In one embodiment, the projections 262 are formed by four socket cap bolts 270 as shown in FIG. 88, screwed into holes 264 in the sides of the mounting bracket 250. In FIGS. 65-76, the mounting bracket 250 has spacers 252 at the points of insertion of the bolts 270, and in FIGS. 77-87, the rollers 225 are located at the points of insertion, which may provide structural reinforcement. The projections 262 can be slid rearwardly into the slots 261 and then slid downward to resist removal. The engaging structures 260 also include an engaging pin 263 that releasably connects the adjustable bracket 221 to the mounting bracket 250. The engaging pin 263 in FIGS. 65-76 is a sliding retractable pin (which may be spring loaded) mounted on the adjustable bracket 221, and the engaging pin 263 in FIGS. 77-87 is a removable detent pin as described above. The engaging pin 263 in this embodiment is moveable between an extended position, where the pin 263 engages the mounting bracket 250 to retain the mounting bracket 250 in connection with the adjustable bracket 221, and a retracted position, where the pin 263 permits the mounting bracket 250 to be removed from the adjustable bracket 221. The engaging pin 263 may take different forms in other embodiments, and different removable engaging structures 260 may also be used. It is understood that the engaging structures 260 of the adjustable bracket 221 and the mounting bracket 250 may be complementary with each other.

The removable connection of the mounting bracket 250 to the adjustable bracket 221 permits different implements 240 to be connected to a single carriage assembly 220 without removal of the adjustable bracket 221, provided that such implements 240 include engaging structure 260 that is configured to engage the engaging structure 260 of the adjustable bracket 221. Examples of other implements 240 that may be connected to the carriage assembly 220 include pivotable lever arms, a rack pull attachment, or various other movable or fixed structures for various exercises, including mounts for various weights, functional weightlifting attachments, supports, pulley wheels, etc. It is understood that some alternate implements 240 may use a similar mounting bracket 250 as shown and described herein, while other implements 240 may include a mounting bracket 250 specially configured for the specific implement.

Mounting of the weightlifting assembly 210 in FIGS. 65-76 can be accomplished by inserting the end of the frame member 211 through the passage within the adjustable bracket 221, between the rollers 225, which may require removal of other components connected to the frame member 211. Alternately, mounting of the weightlifting assembly 210 in FIGS. 65-76 can be accomplished by removing the front rollers 225 with the mounting bracket 250 and the implement 240 disconnected and sliding the adjustable bracket 221 forward onto the frame member 211, then reconnecting the rollers 225. In either case, the fixing pin 222 is inserted to engage the frame member 211 and fix the carriage assembly 220 in place, and removal of the carriage assembly 220 or the weightlifting assembly 210 can be accomplished by reversing these steps. Mounting of the weightlifting assembly 210 of FIGS. 77-87 can be accomplished by separating the adjustable bracket 221 and the mounting bracket 250, which removes the front rollers 225 that are connected to the mounting bracket 250, then sliding the adjustable bracket 221 forward onto the frame member 211 and reconnecting the mounting bracket 250 to engage the frame member 211 with all four rollers 225. Thus, the weightlifting assembly 210 in FIGS. 77-87 may in some circumstances be quicker and easier, because the only component that must be removed is the mounting bracket 250 (potentially also the implement 240), which is designed to be quickly and easily removable and reconnectable.

The various embodiments of a carriage assembly 50, 220 and weightlifting assembly 10, 210 described herein provide significant advantages over prior such structures for use with a weight rack. These embodiments provide an adjustable structure that can be positioned and fixed at a variety of different locations along a frame member, while permitting interchangeable connection of multiple different implements, and thereby greatly increasing the potential variety of configurations available for different exercises. The configurations of the handles and locking structures of the carriage assembly described herein facilitate adjusting the carriage assembly between different heights and provide secure locking in position, despite the significant weight that the carriage assembly may have, particularly with an implement connected thereto. The configurations of the rollers described herein also facilitate adjustment of the carriage assembly, as well as any accessories or other structures incorporating such rollers. A wide variety of different implements and accessories may be used with the carriage assembly, including numerous examples described herein. The various implements and accessories provide great versatility of use, ease of adjustability, and structural stability. Those skilled in the art will recognize additional advantages from the structures and concepts disclosed herein.

Various embodiments of weightlifting assemblies 10, 210 and weight racks 12 incorporating such assemblies 10, 210 have been described herein, which include several embodiments of implements and accessories. In other embodiments, the weightlifting assembly 10, 210 and/or the weight rack 12 may be provided with a combination of such implements and accessories, or with other implements and/or accessories not specifically disclosed herein, without departing from the scope of the disclosure. It is also understood that in other embodiments, the various devices, components, and features described herein, including without limitation the weightlifting assembly 10, 210, the carriage assembly 50, 220, any implements connected to the carriage assembly 50, 220, such as the arm 21, and any accessories connected to the arm 21, and/or a weight rack 12 incorporating any of the above, may be constructed with similar structural and functional elements having different configurations, including different ornamental appearances.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. Terms such as "top," "bottom," "front," "side," "rear," "proximal," "distal," "forward," "rearward," and the like, as used herein, are relative terms intended for illustrative purposes only and do not limit the embodiments in any way. Nothing in this specification should be construed as requiring a specific three dimensional orientation of structures in order to fall within the scope of this invention, unless explicitly specified by the claims. "Integral joining technique," as used herein, means a technique for joining two pieces so that the two pieces effectively become a single, integral piece, including, but not limited to, irreversible joining techniques such as welding, brazing, soldering, or the like, where separation of the joined pieces cannot be accomplished without structural damage thereto. Additionally, the term "plurality," as used herein, indicates any number greater than one, either disjunctively or conjunctively, as necessary, up to an infinite number. Accordingly, while the specific embodiments have been illustrated and described, numerous modifications come to mind without significantly departing from the spirit of the invention and the scope of protection is only limited by the scope of the accompanying claims.

What is claimed is:

1. An adjustable carriage assembly comprising:

a carriage defining a passage configured to receive a frame member therethrough such that the carriage is moveable along the frame member;

at least one handle mount connected to the carriage and extending outward from the carriage;

a first handle and a second handle connected to and supported by the at least one handle mount and extending from the at least one handle mount, such that a space is defined between the first and second handles, and wherein the at least one handle mount comprises at least a first handle mount portion connected to the first handle and extending between the first handle and the carriage to mount the first handle on the carriage at a first location spaced from the carriage such that a first space is defined between the first handle and the carriage to receive a portion of a first hand of a user, and a second handle mount portion connected to the second handle and extending between the second handle and the carriage to mount the second handle on the carriage at a second location spaced from the carriage such that a second space is defined between the second handle and the carriage to receive a portion of a second hand of the user; and a locking structure configured for engaging the frame member to lock the carriage in position relative to the frame member, wherein the locking structure comprises a pin connected to the carriage that is moveable by axial translation between a locked position, where the pin extends into the passage and is configured to engage the frame member to lock the carriage in position, and an unlocked position, where the pin is retracted from the passage and is configured to disengage from the frame member to allow movement of the carriage with respect to the frame member, wherein the pin is positioned between the first and second handles, and the pin comprises an end piece having a first grip extending outward from the end piece toward the first handle and a second grip extending outward from the end piece toward the second handle.

2. The adjustable carriage assembly of claim 1, wherein the carriage comprises a first side plate, a second side plate spaced from the first side plate, and a rear plate connected to the first and second side plates and extending between the first and second side plates, wherein the passage is defined between the first and second side plates.

3. The adjustable carriage assembly of claim 2, further comprising a plurality of rollers rotatably connected to the first and second side plates and extending between the first and second side plates, wherein a pivotable connection structure is connected to the first and second side plates of the carriage at a front of the carriage.

4. The adjustable carriage assembly of claim 1, wherein the pin is connected to a rear side of the carriage, and wherein the first handle and the second handle are connected to the carriage proximate the rear side of the carriage, such that the first and second handles are located on opposite lateral sides of the pin.

5. The adjustable carriage assembly of claim 4, wherein the at least one handle mount comprises a first handle mount and a second handle mount connected to the carriage proximate the rear side of the carriage and spaced vertically from each other, wherein the first handle is connected to the first and second handle mounts and extends vertically between the first and second handle mounts, and the second handle is connected to the first and second handle mounts and extends vertically between the first and second handle mounts.

6. The adjustable carriage assembly of claim 5, wherein the carriage has first and second opposed sides spaced laterally from each other, such that the rear side extends between the first and second opposed sides, wherein the first handle mount is connected to the first side and the second side proximate a top of the carriage and extends across the rear side of the carriage between the first and second sides, and the second handle mount is connected to the first side and the second side proximate a bottom of the carriage and extends across the rear side of the carriage between the first and second sides.

7. The adjustable carriage assembly of claim 1, wherein the locking structure further comprises a biasing member operably engaging the pin and biasing the pin toward the locked position and a collar connected to a rear side of the carriage, wherein the pin extends through the collar, and the biasing member is positioned within the collar.

8. The adjustable carriage assembly of claim 7, wherein the pin has a first portion that connects to the end piece and extends through the collar and a second portion that is wider than the first portion and forms a distal end of the pin, wherein the second portion extends through the rear side of the carriage and into the passage when the pin is in the locked position, and wherein the biasing member comprises a coil spring wrapped around the first portion, such that the pin compresses the coil spring in the unlocked position.

9. The adjustable carriage assembly of claim 1, further comprising:

a plurality of rollers rotatably connected to the carriage within the passage and including a front roller and a rear roller spaced rearwardly from the front roller, such that the front roller is configured to engage a front surface of the frame member and the rear roller is configured to engage a rear surface of the frame member; and a pivotable connection structure connected to the carriage and configured for connection to an articulating implement.

10. A weightlifting assembly comprising the adjustable carriage assembly of claim 1, and further comprising an articulating arm pivotably connected to the carriage and an accessory connected to the articulating arm and configured for use in a weightlifting exercise.

11. An adjustable carriage assembly comprising:

a carriage defining a passage configured to receive a frame member therethrough such that the carriage is moveable along the frame member;

at least one handle mount connected to the carriage and extending outward from the carriage;

a first handle and a second handle connected to and supported by the at least one handle mount, wherein the at least one handle mount comprises at least a first handle mount portion connected to the first handle and extending rearwardly between the carriage and the first handle to mount the first handle on the carriage and a second handle mount portion connected to the second handle and extending rearwardly between the carriage and the second handle to mount the second handle on the carriage, wherein the first handle comprises a first elongated vertical beam and extending vertically from the first handle mount portion, and the second handle comprises a second elongated vertical beam extending vertically from the second handle mount portion, such that the first and second handles are spaced from each other, such that the first and second handles are parallel to each other; and a locking structure configured for engaging the frame member to lock the carriage in position relative to the frame member, wherein the locking structure comprises a pin connected to the carriage at a location between the first and second handles such that the pin is configured to be actuated by a user's hands while the user's hands are gripping the first and second handles, wherein the pin is moveable by axial translation between a locked position, where the pin extends into the passage and is configured to engage the frame member to lock the carriage in position, and an unlocked position, where the pin is retracted from the passage and is configured to disengage from the frame member to allow movement of the carriage with respect to the frame member.

12. The adjustable carriage assembly of claim 11, wherein the first and second handle mount portions comprise a first upper mounting portions on a first side of the carriage and a second upper mounting portion on a second side of the carriage opposite the first side, and the at least one handle mount further comprises a first lower mounting portion extending outward on the first side of the carriage and a second lower mounting portion extending outward on the second side of the carriage, wherein the first handle is connected to the first upper mounting portion and the first lower mounting portion and extends vertically between the first upper mounting portion and the first lower mounting portion, and the second handle is connected to the second upper mounting portion and the second lower mounting portion and extends vertically between the second upper mounting portion and the second lower mounting portion, such that the first upper mounting portion and the first lower mounting portion extend between the first handle and the carriage to mount the first handle on the carriage, and the second upper mounting portion and the second lower mounting portion extend between the second handle and the carriage to mount the second handle on the carriage.

13. The adjustable carriage assembly of claim 11, wherein the first handle mount portion extends outward on a first side of the carriage and the second handle mount portion extends outward on a second side of the carriage opposite the first side.

14. The adjustable carriage assembly of claim 11, wherein the locking structure further comprises a biasing member operably engaging the pin and biasing the pin toward the locked position and a collar connected to a rear side of the carriage, wherein the pin extends through the collar, and the biasing member is positioned within the collar.

15. The adjustable carriage assembly of claim 14, wherein the pin has a first portion that connects to an end piece and extends through the collar and a second portion that is wider than the first portion and forms a distal end of the pin, wherein the second portion extends into the passage when the pin is in the locked position, and wherein the biasing member comprises a coil spring wrapped around the first portion, such that the pin compresses the coil spring in the unlocked position.

16. The adjustable carriage assembly of claim 11, wherein the at least one handle mount comprises a first handle mount and a second handle mount connected to the carriage proximate a rear side of the carriage and spaced vertically from each other, wherein the first handle is connected to the first and second handle mounts and extends vertically between the first and second handle mounts, and the second handle is connected to the first and second handle mounts and extends vertically between the first and second handle mounts.

17. The adjustable carriage assembly of claim 16, wherein the first handle mount is connected to first and second opposed sides of the carriage proximate a top of the carriage and extends across the rear side of the carriage between the first and second sides, and the second handle mount is connected to the first side and the second side of the carriage proximate a bottom of the carriage and extends across the rear side of the carriage between the first and second sides.

18. The adjustable carriage assembly of claim 17, the first handle mount has first arms extending forward along the first side and the second side for connection to the first and second sides, and the second handle mount has second arms extending forward along the first side and the second side for connection to the first and second sides.

19. The adjustable carriage assembly of claim 16, wherein the first handle mount has a first cutout extending forward with respect to the carriage and located between the first and second handles, and the second handle mount has a second cutout extending forward with respect to the carriage and located between the first and second handles.

20. The adjustable carriage assembly of claim 11, wherein the pin comprises an end piece having a first grip extending outward from the end piece toward the first handle and a second grip extending outward from the end piece toward the second handle.

21. The adjustable carriage assembly of claim 11, further comprising a second pin configured to removably engage the carriage, wherein the second pin is configured to extend into the passage to engage the frame member to lock the carriage in position when the second pin is engaged with the carriage, and wherein the pin is configured to extend into the passage in a first direction, and the second pin is configured to extend into the passage in a second direction that is perpendicular to the first direction.

22. A weightlifting assembly comprising the adjustable carriage assembly of claim 11, and further comprising an articulating arm pivotably connected to a front of the carriage and an accessory connected to the articulating arm and configured for use in a weightlifting exercise.

23. The adjustable carriage assembly of claim 11, wherein the first elongated vertical beam and the second elongated vertical beam each have a circular cross section.

* * * * *